US006164224A

United States Patent [19]

Tachikawa et al.

[11] Patent Number: 6,164,224

[45] Date of Patent: Dec. 26, 2000

[54] BUTTONHOLE DARNING SEWING MACHINE

[75] Inventors: Mitsuhiro Tachikawa; Kazuaki Ishii; Yasuaki Hirano; Takashi Tsukioka; Toshiaki Kasuga; Tsuguo Kubota, all of Tokyo, Japan

[73] Assignee: Juki Corporation, Tokyo, Japan

[21] Appl. No.: 09/105,475

[22] Filed: Jun. 26, 1998

[30] Foreign Application Priority Data

Jun. 27, 1997 [JP] Japan ..... 9-172648

[51] Int. Cl.[7] ..... D05B 3/06; D05B 19/12; D05B 37/02; D05B 69/10

[52] U.S. Cl. ..... 112/68; 112/73; 112/470.05; 112/300

[58] Field of Search ..... 112/68, 70, 73, 112/76, 65, 300, 447, 475.25, 470.06, 470.05

[56] References Cited

U.S. PATENT DOCUMENTS

| | | | |
|---|---|---|---|
| 1,497,220 | 6/1924 | Mattingly . | |
| 3,440,982 | 4/1969 | Seaman | 112/68 |
| 4,509,441 | 4/1985 | Tamiya et al. | 112/447 |
| 4,517,908 | 5/1985 | Park | 112/129 |
| 4,665,843 | 5/1987 | Goldbeck et al. | 112/68 |
| 5,222,449 | 6/1993 | Koie et al. | 112/68 |
| 5,361,713 | 11/1994 | Suzuki | 112/68 |
| 5,873,314 | 2/1999 | Gamano et al. | 112/68 |

FOREIGN PATENT DOCUMENTS

| | | | |
|---|---|---|---|
| 141227 | of 1903 | Germany . | |
| 2156801 | 11/1971 | Germany . | |
| 3-85196 | 4/1991 | Japan . | |
| 3-85196 | 10/1991 | Japan | D05B 37/02 |
| 6-190164 | 12/1994 | Japan | D05B 3/06 |
| 7-313756 | 5/1995 | Japan | D05B 3/06 |

OTHER PUBLICATIONS

European Search Report Application No. 98111680.9–2314, Jul. 8, 1999.

Database WPI, Section Ch, Week 8841, Derwent Publications Ltd., London, GB; Class 505, AN 88–288449, XP002106344 and JP 63 209692 (Tokyo Juki Ind Co Ltd), Aug. 31, 1988, Abstract, and JP 07 014438B.

Patent Abstracts of Japan, Publication No. 6–190164, Dec. 7, 1994, "Hole Overlock Sewing Machine".

*Primary Examiner*—Peter Nerbun
*Attorney, Agent, or Firm*—Morgan & Finnegan LLP

[57] ABSTRACT

A cloth cutting knife 16 is structured such that the length of the cutting edge thereof is set shorter than the length of the side sewing portions of a buttonhole to be formed, and a buttonhole having a length corresponding to the length of the right and left side sewing portions can be formed by moving up and down the cloth cutting knife 16 two or more times. The cloth cutting knife 16 is moved up and down at least once during formation of the stitches of the right and left side sewing portions. Also, the cloth cutting knife 16 is moved up and down once each time a given number of stitches of the right and left side sewing portions are formed. The given number of stitches is set in accordance with both of the length of the cutting edge of the cloth cutting knife 16 and the length of the buttonhole to be formed.

18 Claims, 99 Drawing Sheets

FIG.9

| MOVEMENT AMOUNT | OUTPUT PULSE MOTOR | |
|---|---|---|
| | BASE LINE | SWING WIDTH |
| 1 | $k_1$ | $h_1$ |
| 2 | $k_2$ | $h_2$ |
| ⋮ | ⋮ | ⋮ |
| n - 1 | $k_{n-1}$ | $h_{n-1}$ |
| n | $k_n$ | $h_n$ |

FIG.39

| No. | SETTING ITEM | RANGE | UNIT | PATTERN No. 1 | 2 | 3 | 4 | 5 | 6 | |
|---|---|---|---|---|---|---|---|---|---|---|
| 1 | CLOTH CUTTING LENGTH | 5.0 ~ 40.0 | mm | | | | | | | a |
| 2 | KNIFE WIDTH | 0 ~ 2.0 | mm | | | | | | | b |
| 3 | LOCK STITCH LENGTH | 1.0 ~ 5.0 | mm | | | | | | | c |
| 4 | LOCK STITCH WIDTH | 1.0 ~ 5.0 | mm | | | | | | | d |
| 5 | PARALLEL PORTION PITCH | 0.20 ~ 1.00 | mm | | | | | | | e |
| 6 | LOCK STITCH PORTION PITCH | 0.20 ~ 1.00 | mm | | | | | | | f |
| 7 | CLOTH KNIFE - FIRST LOCK STITCH GAP | 0 ~ 5.0 | mm | | | | | | | g |
| 8 | CLOTH KNIFE - SECOND LOCK STITCH GAP | 0 ~ 5.0 | mm | | | | | | | h |
| 9 | KNIFE DROP R/L POSITION | -2.0 ~ 2.0 | mm | | | | | | | |
| 10 | PARALLEL PORTION TENSION | 0 ~ 100 | step | | | | | | | |
| 11 | LOCK STITCH PORTION TENSION | 0 ~ 100 | step | | | | | | | |
| 12 | SEWING START TENSION | 0 ~ 100 | step | | | | | | | |
| 13 | SEWING END TENSION | 0 ~ 100 | step | | | | | | | |
| 14 | CLOTH CUTTING KNIFE SIZE | 5.0 ~ 40.0 | mm | | | | | | | $L_1$ |
| 15 | PRESSER SIZE | 30.0 ~ 60.0 | mm | | | | | | | $L_0$ |
| 16 | ENLARGEMENT/REDUCTION RATIO | 10 ~ 500 | % | | | | | | | |
| 17 | CONSTANT STITCH NUMBER IN ENLARGEMENT/REDUCTION | 0/1 | — | | | | | | | |
| 18 | KNIFE DROP TIMING CORRECT NEEDLE NUMBER | 0 ~ 10 | stitch | | | | | | | |
| 19 | SEWING MACHINE SPEED IN KNIFE DRIVING TIME | 0 ~ 4000 | spm | | | | | | | |

FIG.55

SEWING DATA OPERATION RESULTS

| REPETITION NUMBER | Y | BASE LINE | SWING WIDTH | THREAD TENSION | |
|---|---|---|---|---|---|
| $N_1$ | $Y_1$ | $K_1$ | $H_1$ | $T_1$ | 1 |
| $N_2$ | $Y_2$ | $K_2$ | $H_2$ | $T_2$ | 2 |
| $N_3$ | $Y_3$ | $K_3$ | $H_3$ | $T_3$ | 3 |
| $N_4$ | $Y_4$ | $K_4$ | $H_4$ | $T_4$ | 4 |
| $N_5$ | $Y_5$ | $K_5$ | $H_5$ | $T_5$ | 5 |
| $N_6$ | $Y_6$ | $K_6$ | $H_6$ | $T_6$ | 6 |
| $N_7$ | $Y_7$ | $K_7$ | $H_7$ | $T_7$ | 7 |
| $N_8$ | $Y_8$ | $K_8$ | $H_8$ | $T_8$ | 8 |
| $N_9$ | $Y_9$ | $K_9$ | $H_9$ | $T_9$ | 9 |

| KNIFE DRIVE NUMBER OF TIMES | KNIFE DRIVE NEEDLE NUMBER |
|---|---|
| 1 | $M_1$ |
| 2 | $M_2$ |
| ⋮ | ⋮ |
| n - 1 | $M_{n-1}$ |
| n | $M_n$ |

FIG.91

SEWING DATA OPERATION RESULTS

| REPETITION NUMBER | Y | BASE LINE | SWING WIDTH | THREAD TENSION | |
|---|---|---|---|---|---|
| $N_1$ | $Y_1$ | $-K_1$ | $-H_1$ | $T_1$ | 1 |
| $N_2$ | $Y_2$ | $-K_2$ | $-H_2$ | $T_2$ | 2 |
| $N_3$ | $Y_3$ | $-K_3$ | $-H_3$ | $T_3$ | 3 |
| $N_4$ | $Y_4$ | $-K_4$ | $-H_4$ | $T_4$ | 4 |
| $N_5$ | $Y_5$ | $-K_5$ | $-H_5$ | $T_5$ | 5 |
| $N_6$ | $Y_6$ | $-K_6$ | $-H_6$ | $T_6$ | 6 |
| $N_7$ | $Y_7$ | $-K_7$ | $-H_7$ | $T_7$ | 7 |
| $N_8$ | $Y_8$ | $-K_8$ | $-H_8$ | $T_8$ | 8 |
| $N_9$ | $Y_9$ | $-K_9$ | $-H_9$ | $T_9$ | 9 |

FIG.95

| No. | SETTING ITEM | RANGE | UNIT | PATTERN No. | | | | | |
|---|---|---|---|---|---|---|---|---|---|
| | | | | 1 | 2 | 3 | 4 | 5 | 6 |
| 1 | CLOTH CUTTING LENGTH | 5.0 ~ 40.0 | mm | | | | | | |
| 2 | LEFT KNIFE WIDTH $b_1$ | 0 ~ 1.0 | mm | | | | | | |
| 3 | RIGHT KNIFE WIDTH $b_2$ | 0 ~ 1.0 | mm | | | | | | |
| 4 | LOCK STITCH LENGTH | 1.0 ~ 5.0 | mm | | | | | | |
| 5 | LOCK STITCH WIDTH | 1.0 ~ 5.0 | mm | | | | | | |
| 6 | PARALLEL PORTION PITCH | 0.20 ~ 1.00 | mm | | | | | | |
| 7 | LOCK STITCH PORTION PITCH | 0.20 ~ 1.00 | mm | | | | | | |
| 8 | CLOTH KNIFE - FIRST LOCK STITCH GAP | 0 ~ 5.0 | mm | | | | | | |
| 9 | CLOTH KNIFE - SECOND LOCK STITCH GAP | 0 ~ 5.0 | mm | | | | | | |
| 10 | PARALLEL PORTION TENSION | 0 ~ 100 | step | | | | | | |
| 11 | LOCK STITCH PORTION TENSION | 0 ~ 100 | step | | | | | | |
| 12 | SEWING START TENSION | 0 ~ 100 | step | | | | | | |
| 13 | SEWING END TENSION | 0 ~ 100 | step | | | | | | |
| 14 | CLOTH CUTTING KNIFE SIZE | 5.0 ~ 40.0 | mm | | | | | | |
| 15 | PRESSER SIZE | 30.0 ~ 60.0 | mm | | | | | | |
| 16 | ENLARGEMENT/REDUCTION RATIO | 10 ~ 500 | % | | | | | | |
| 17 | CONSTANT STITCH NUMBER IN ENLARGEMENT/REDUCTION | 0/1 | — | | | | | | |
| 18 | KNIFE DROP TIMING CORRECT NEEDLE NUMBER | 0 ~ 10 | stitch | | | | | | |
| 19 | SEWING MACHINE SPEED IN KNIFE DRIVING TIME | 0 ~ 4000 | spm | | | | | | |

BUTTONHOLE DARNING SEWING MACHINE

BACKGROUND OF INVENTION

The present invention relates to a buttonhole darning sewing machine for forming a buttonhole darning seam in a cloth while swinging a needle in tune with the feeding operation of the cloth, a buttonhole darning sewing machine for forming a buttonhole in a cloth using a cloth cutting knife, and a sewing apparatus including such buttonhole darning sewing machine.

In a buttonhole darning sewing machine for forming a buttonhole darning seam in a cloth while swinging a needle in tune with the feeding operation of the cloth and also for forming a buttonhole in a cloth using a cloth cutting knife, conventionally, as known well from Japanese Utility Model Publication No. 743305 of Heisei and the like, a cloth feed mechanism, a needle swing mechanism, a needle swing width change mechanism, and a base line change mechanism are respectively operated due to the rotation of a main cam which can be rotated in linking with the main shaft of the sewing machine.

And, recently, as known well from Unexamined Japanese Patent Application Publication No. 6-190164 of Heisei, there are provided a cloth feed motor, a needle swing width change motor, and a base line change motor, and, by driving or controlling these three motors, the cloth feed mechanism, needle swing width change mechanism, and base line change mechanism are respectively operated.

Also, referring to the cloth cutting knife, conventionally, as known well from Japanese Patent Publication No. 7-14438 of Heisei and the like, the cloth cutting knife is structured such that it is moved up and down once due to the rotation of the above-mentioned main cam.

And, conventionally, there are prepared cloth cutting knives respectively including cutting edges which correspond in length to buttonholes having different lengths; and, a cloth cutting knife corresponding to a given buttonhole is mounted on a knife mounting plate, and a buttonhole is formed in a cloth by moving up and down the cloth cutting knife once.

In forming a buttonhole using a cloth cutting knife in this manner, there are available a pre-sewing cutting processing or operation which is previously executed prior to formation of a buttonhole darning seam, and a post-sewing cutting processing which is executed after completion of formation of a buttonhole darning seam; and, there is also available a processing which is executed by moving down the cloth cutting knife just before completion of formation of a buttonhole darning seam.

In the case of the above-mentioned cloth cutting knife which is structured such that it is moved up and down once due to the rotation of the main cam, as described above, it is necessary to have prepared the cloth cutting knives which respectively include cutting edges corresponding in length to the different-length buttonholes. This not only raises a problem that the number of parts required is large but also requires a troublesome operation to mount a corresponding cloth cutting knife onto a knife mounting plate each time a buttonhole is changed.

SUMMARY OF INVENTION

Accordingly, it is an object of the invention to be able to form a plurality of buttonholes differing in length from each other by a single cloth cutting knife with no need for replacement of the cloth cutting knife.

Also, it is another object of the invention to provide a sewing apparatus which is capable of mounting only a special part such as a special cloth cutting knife or the like onto a special-purpose sewing machine such as a special buttonhole darning sewing machine or the like.

Further, it is still another object of the invention to provide a buttonhole darning sewing machine on which only a special cloth cutting knife can be mounted.

In solving the above problems, a first aspect of the invention provides a buttonhole darning sewing machine which comprises a cloth hold plate disposed along the upper surface of a sewing machine bed, and a cloth presser for moving the cloth hold plate at least in the longitudinal direction of the sewing machine bed in tune with the upward-and-downward movement of a needle provided in the sewing machine while holding a cloth between the cloth hold plate and itself, in which a buttonhole darning seam comprising right and left side sewing portions to be formed on the right and left side portions of a long and narrow buttonhole and a bar-tack sewing portion to be formed at least in one end portion of each of the right and left side sewing portions is formed, and a buttonhole having a length corresponding to the above side sewing portions is formed within the buttonhole darning seam along the right and left side sewing portions by means of a cloth cutting knife, characterized by the cloth cutting knife which includes a cutting edge having a length set shorter than the length of the side sewing portions, and by control means for moving the cloth cutting knife up and down two or more times to thereby form the buttonhole having a length corresponding to the length of the side sewing portions.

Here, the cloth cutting knife is a knife which can be moved up and down to thereby form a buttonhole in a cloth; and, the cloth cutting knife includes a cutting edge in the lower portion thereof, while the length of the cutting edge is set shorter than the length of the side sewing portions.

In the first aspect, with use of the present buttonhole darning sewing machine, a buttonhole having an arbitrary length can be formed using a single kind of cloth cutting knife, which not only eliminates the need for replacement of the cloth cutting knife even when the length of the buttonhole is changed but also eliminates the need for preparation of cloth cutting knives corresponding in number to buttonholes different in length from each other.

According to a second aspect of the invention, there is provided with the buttonhole darning sewing machine of the first aspect, in which the above-mentioned cloth cutting knife is structured such that, during formation of the stitches of the above-mentioned side sewing portions, it is moved up and down once each time a given length of stitch is formed.

In the second aspect, at first, a given number of stitches of the side sewing portions are formed and, after then, the buttonhole is formed. Therefore, the stitches of the side sewing portions can be obtained stably. Also, since the cloth cutting knife is moved up and down once after a given number of stitches are formed, the buttonhole can be formed sharply.

Or, when the cloth cutting knife is moved up and down two or more times, the last upward-and-downward movement of the cloth cutting knife may also be carried out during formation of the lock stitch sewing portion. For example, when the cloth cutting knife is moved up and down two times, the first upward-and-downward movement of the cloth cutting knife may be carried out during formation of the side sewing portions the lock stitch portion and the second upward-and-downward movement of the cloth cutting knife may be carried out during formation of the bar-tack sewing portion.

According to a third aspect of the invention, there is provided the buttonhole darning sewing machine of the second aspect, in which the above-mentioned cloth cutting knife is structured such that it is moved up and down once each time a given number of stitches are formed in the side sewing portions.

In the third aspect, at first, since a buttonhole is formed after formation of a given number of stitches in the side sewing portions, the stitches of the side sewing portions can be obtained stably; and, because the cloth cutting knife is moved up and down once each time a given number of stitches are formed in the side sewing portions, the material of the cloth is reinforced by the thus formed side sewing portions, so that the buttonhole can be formed sharply.

According to a fourth aspect of the invention, there is provided the buttonhole darning-sewing machine of the third aspect, in which the above-mentioned given number of stitches are set in accordance with both of the length of the cutting edge of the cloth cutting knife and the length of the buttonhole.

As described above, according to the fourth aspect of the invention, since there is provided a buttonhole darning sewing machine, in which the given number of stitches as set forth in the third aspect are set in accordance with both of the length of the cutting edge of the cloth cutting knife and the length of the buttonhole, the given number of stitches can be set properly in accordance with both of the length of the cutting edge of the cloth cutting knife and the length of the buttonhole.

According to a fifth aspect of the invention, there is provided the buttonhole darning sewing machine of the first aspect, in which the control means includes electrical moving means comprising a pulse motor, a connecting mechanism, a cloth hold arm or the like, for moving the cloth presser by a given distance in accordance with a given feed signal, electrical drive means comprising a cylinder unit or the like for moving the cloth cutting knife in accordance with an operation signal, and knife control means included in a CPU or the like for generating the operation signal in synchronization with the feed signal indicating a given amount of feed to thereby move the cloth cutting knife up and down.

For example, as the electrical moving means, as described above, there can be used a structure which consists of a pulse motor, a connecting mechanism, a cloth hold arm or the like; however, this is not limitative but other structures can also be used.

As the electrical drive means, for example, there is available a cylinder unit; but, there can also be used other structures such as a solenoid, and the like.

The knife control means can be included in a CPU or the like.

In the fifth aspect, with use of the present buttonhole darning sewing machine, the cloth presser is moved by a given length by the electrical moving means in accordance with the feed signal indicating a given amount of feed and, in synchronization with the feed signal, an operation signal is generated by the knife control means to thereby move the cloth cutting knife up and down; that is, through this operation, the cloth cutting knife can be moved up and down two or more times in tune with the cloth feeding operation, so that a buttonhole can be formed positively.

According to a sixth aspect of the invention, there is provided the buttonhole darning sewing machine as set forth in the fifth aspect, in which the above-mentioned given amount of feed is set in accordance with both of the length of the cutting edge of the cloth cutting knife and the length of the buttonhole.

In the sixth aspect, a given cloth feed amount can be set properly in accordance with both of the length of the cutting edge of the cloth cutting knife and the length of the buttonhole.

According to a seventh aspect of the invention, there is provided the buttonhole darning sewing machine as set forth in the first aspect, which further includes knife upper and lower position detect means such as a close approach type of switch for detecting the upper or lower position of the cloth cutting knife to thereby generate a detect signal, and sewing machine control means included in a CPU or the like for checking whether the detect signal from the knife upper and lower position detect means is present or not and, if not present, for causing the present sewing machine to stop.

As the knife upper and lower position detect means, as described above, there is available a close approach type of switch but there can also be used a contact type of switch or a non-contact type of sensor.

Also, the sewing machine control means, as described above, can be included in a CPU or the like.

In the seventh aspect, when the detect signal from the knife upper and lower position detect means is not generated, it can be judged that the operation of the cloth cutting knife is out of order, so that the operation of the present sewing machine can be stopped by the sewing machine control means.

According to an eighth aspect of the invention, there is provided the buttonhole darning sewing machine as set forth in the first aspect, in which the cloth cutting knife can be moved up and down prior to or after the formation of the buttonhole darning seam.

The eighth aspect of the invention makes it possible to carry out not only a presewing cutting processing in which a buttonhole can be previously formed by two or more times of upward-and-downward movement of the cloth cutting knife before formation of the buttonhole darning seam, but also a post-sewing cutting processing in which a buttonhole can be formed by two or more times of upward-and-downward movement of the cloth cutting knife after formation of the buttonhole darning seam.

According to a ninth aspect of the invention, there is provided the buttonhole darning sewing machine as set forth in the first aspect, in which the cloth cutting knife, after formation one of the right and left side sewing portions, can be moved up and down while the other of them is being formed.

In the ninth aspect, since the buttonhole is formed by moving up and down the cloth cutting knife after formation of one of the right and left side sewing portions and during formation of the other, not only the stitches of the right and left side sewing portions can be obtained stably but also the buttonhole can be formed sharply.

According to a tenth aspect of the invention, there is provided the buttonhole darning sewing machine as set forth in the first or ninth aspect, in which, during the upward-and-downward movement of the cloth cutting knife, the speed of the present sewing machine set for a knife driving time is reduced down to zero or a speed near zero.

In the tenth aspect, with use of this invention, it is possible to prevent the cloth from shifting out of position in the upward-and-downward movement of the cloth cutting knife.

According to an eleventh aspect of the invention, there is provided a buttonhole darning sewing machine in which a buttonhole darning seam comprising right and left side sewing portions to be formed on the right and left sides of a long and narrow buttonhole and a bar-tack sewing portion to be formed at least in one end portion of the right and left side sewing portions is formed, and a buttonhole having a length corresponding to said side sewing portions is formed within said buttonhole darning seam by moving a cloth cutting knife along said side sewing portions, characterized by control means which is able to control or set the cloth cutting knife selectively into a pre-sewing cutting operation in which the cloth cutting knife is moved up and down before formation of the buttonhole darning seam to thereby form the buttonhole, a inter-sewing cutting operation in which the cloth cutting knife is moved up and down during formation of the buttonhole darning seam to thereby form the buttonhole, and a post-sewing cutting operation in which the cloth cutting knife is moved up and down after formation of the buttonhole darning seam to thereby form the buttonhole.

Here, the cloth cutting knife is a knife which can be moved up and down to thereby form a buttonhole in a cloth, while the cloth cutting knife includes a cutting edge in the lower portion thereof.

The knife control means can be included in a CPU or the like.

In the eleventh aspect, with use of the present invention, it is possible to carry out selectively any one of the three knife cutting operations: that is, the pre-sewing cutting operation in which the cloth cutting knife is moved up and down before formation of the buttonhole darning seam to thereby form the buttonhole, the inter-sewing cutting operation in which the cloth cutting knife is moved up and down during formation of the buttonhole darning seam to thereby form the buttonhole, and the post-sewing cutting operation in which the cloth cutting knife is moved up and down after formation of the buttonhole darning seam to thereby form the buttonhole.

According to a twelfth aspect of the invention, there is provided the buttonhole darning sewing machine in which a buttonhole darning seam comprising right and left side sewing portions to be formed on the right and left sides of a long and narrow buttonhole and a bar-tack sewing portion to be formed at least in one end portion of the right and left side sewing portions is formed, and a buttonhole having a length corresponding to said side sewing portions is formed within said buttonhole darning seam along the side sewing portions thereof by means of a cloth cutting knife, characterized by control means which moves the cloth cutting knife up and down during formation of the side sewing portions of the buttonhole darning seam to thereby form the buttonhole, and by knife downward-movement start timing setting means for setting the downward-movement start timing of the cloth cutting knife during formation of the side sewing portions.

Here, the knife control means can be included in a CPU or the like.

As the knife downward-movement start timing setting means, for example, there can be used a knife drop switch which can be operated in correspondence to the cloth feeding operation. However, this is not limitative but other types of switches can also be used.

In the twelfth aspect, the cloth cutting knife can be moved up and down at the thus properly set downward-movement start timing to thereby be able to form a given buttonhole.

According to a thirteenth aspect of the invention, there is provided the buttonhole darning-sewing machine as set forth in the twelfth aspect, further including buttonhole/knife cutting edge length setting means for setting not only the length of the buttonhole but also the length of the cutting edge of the cloth cutting knife, and operation means included in a CPU or the like for operating the downward-movement timing of the cloth cutting knife in accordance with not only the length of the buttonhole but also the length of the cutting edge of the cloth cutting knife set by the buttonhole/knife cutting edge length setting means.

The buttonhole/knife cutting edge length setting means is means which is used to carry out various settings/operations on an operation panel.

The operation means, as described above, can be included in a CPU or the like.

In the thirteenth aspect, the proper down-movement timing of the cloth cutting knife can be operated by the operation means in accordance with not only the length of the buttonhole but also the length of the cutting edge of the cloth cutting knife set by the buttonhole/knife cutting edge length setting means.

According to a fourteenth aspect of the invention, there is provided the buttonhole darning sewing machine as set forth in the twelfth aspect, in which the knife downward-movement start timing setting means includes electrical moving means, such as a structure comprising a pulse motor, a connecting mechanism, a cloth hold arm and the like, for moving the cloth presser by a given distance along the side sewing portions in response to a given feed signal, and sewing movement position detect means, such as a feed sensor of a close approach type, for detecting the sewing movement position of the side sewing portions, characterized in that the cloth cutting knife can be moved downward in accordance with a detect signal generated by the sewing movement position detect means.

As the electrical moving means, for example, there can be used a structure which consists of a pulse motor, a connecting mechanism, a cloth hold arm and the like. However, it is also possible to employ another structure.

As the sewing movement position detect means, for example, there can used a feed sensor of a close approach type. However, it is also possible to employ a sensor of other type, a switch or the like.

In the fourteenth aspect, due to the downward-movement of the cloth cutting knife in synchronization with the cloth feeding operation, the buttonhole can be formed properly.

According to a fifteenth aspect of the invention, there is provided the buttonhole darning sewing machine as set forth in the twelfth aspect, in which the knife downward-movement start timing setting means includes buttonhole formation position setting means for setting the formation position of the buttonhole in a direction extending along the cloth feed direction of the buttonhole darning seam, such as means for carrying out various settings/operations on an operation panel, and knife downward-movement timing decide means included in a CPU or the like for deciding the downward-movement timing of the cloth cutting knife according to the count of stitches or the count of cloth feed pulses in accordance with the above setting made by the buttonhole formation position setting means.

As the buttonhole formation position setting means, for example, there can be used means for carrying out various settings/operations on an operation panel.

And, the knife downward-movement timing decide means can be included in a CPU or the like.

In the fifteenth aspect, with use of this invention, the whole of the knife drop position can be moved in accordance with the downward-movement timing of the cloth cutting knife.

According to a sixteenth aspect of the invention, there is provided a buttonhole darning sewing machine in which a buttonhole darning seam comprising right and left side sewing portions to be formed on the right and left sides of a long and narrow buttonhole and a bar-tack sewing portion to be formed at least in one end portion of the right and left side sewing portions is formed, and a buttonhole having a length corresponding to the side sewing portions is formed within the buttonhole darning seam along the side sewing portions thereof by means of a cloth cutting knife, characterized by gap setting means for setting a gap between the bar-tack sewing portion and the end portion of the buttonhole, such as means for carrying out various settings/operations on an operation panel, side sewing length change means included in a CPU or the like for changing the length of the side sewing portions without changing the cloth cutting length in accordance with the above setting by the gap setting means, and knife downward-movement timing decide means included in a CPU or the like for deciding the timing of the downward-movement timing of the cloth cutting knife in accordance with the above change made by the side sewing length change means. c—Here, the gap setting means is means for carrying out various settings/operations on an operation panel.

Also, the side sewing length change means and knife downward-movement timing decide means are both included in a CPU.

In the sixteenth aspect, with use of this invention, the gap between the bar-tack sewing portion and the knife drop position can be corrected in accordance with the downward-movement timing of the cloth cutting knife.

According to a seventeenth aspect of the invention, there is provided a buttonhole darning sewing machine for forming a buttonhole of a given length by moving i a cloth cutting knife up and down two or more times during formation of a buttonhole darning seam, characterized by knife upward-and-downward movement timing decide means included in a CPU or the like for deciding the timing of the upward-and-downward movement of the cloth cutting knife in accordance with the length of the buttonhole, knife upward-and-downward movement timing interval judge means included in a CPU or the like for judging an interval between the upward-and-downward movement timings decided by the knife upward-and-downward movement timing decide means, and sewing machine drive speed decide means included in a CPU or the like for deciding the drive speed of the sewing machine in accordance with the gap judged by the knife upward-and-downward movement timing interval judge means.

Here, the knife upward-and-downward movement timing decide means, knife upward-and-downward movement timing interval judge means, and sewing machine drive speed decide means are respectively included in a CPU or the like.

In the sixteenth aspect, with use of this invention, in the two or more times of upward-and-downward movement of the cloth cutting knife, the sewing machine drive speeds can be respectively controlled in a proper manner, which makes it possible to form the buttonhole in a good condition.

BRIEF DESCRIPTION OF THE DRAWINGS

FIG. 9 is a table, showing the number of pulses output by a base line pulse motor and a swing width pulse motor;

FIG. 22 is a perspective view of a drive system which moves the cloth cutting knife upward and downward using a mechanical drive mechanism;

FIG. 23 is a perspective view of a cloth cutting knife drive system;

FIG. 25 is an exploded perspective view of the structure of a judgment portion;

FIGS. 27(*b*) and (*c*) are respectively views of a tenth embodiment according to the invention; in more particular FIG. 27(*b*) is a view of a cloth cutting knife including an escape hole, and FIG. 27(*c*)is a view of a cloth cutting knife including a cut-away portion;

FIG. 31 is a perspective view thereof in which a judgment sensor is provided on the leading end portion side of a cloth hold arm;

FIG. 39 is a table which shows items to be set;

FIG. 55 is a table of sewing data operation results;

FIG. 81 is a general flow chart obtained by modifying the general flow shown in FIG. 37 in part;

FIG. 91 is a table of sewing data operation results;

FIG. 95 is a table to show items to be set;

Now.

DETAILED DESCRIPTION OF PREFERRED EMBODIMENTS

First Embodiment

Figure 1:
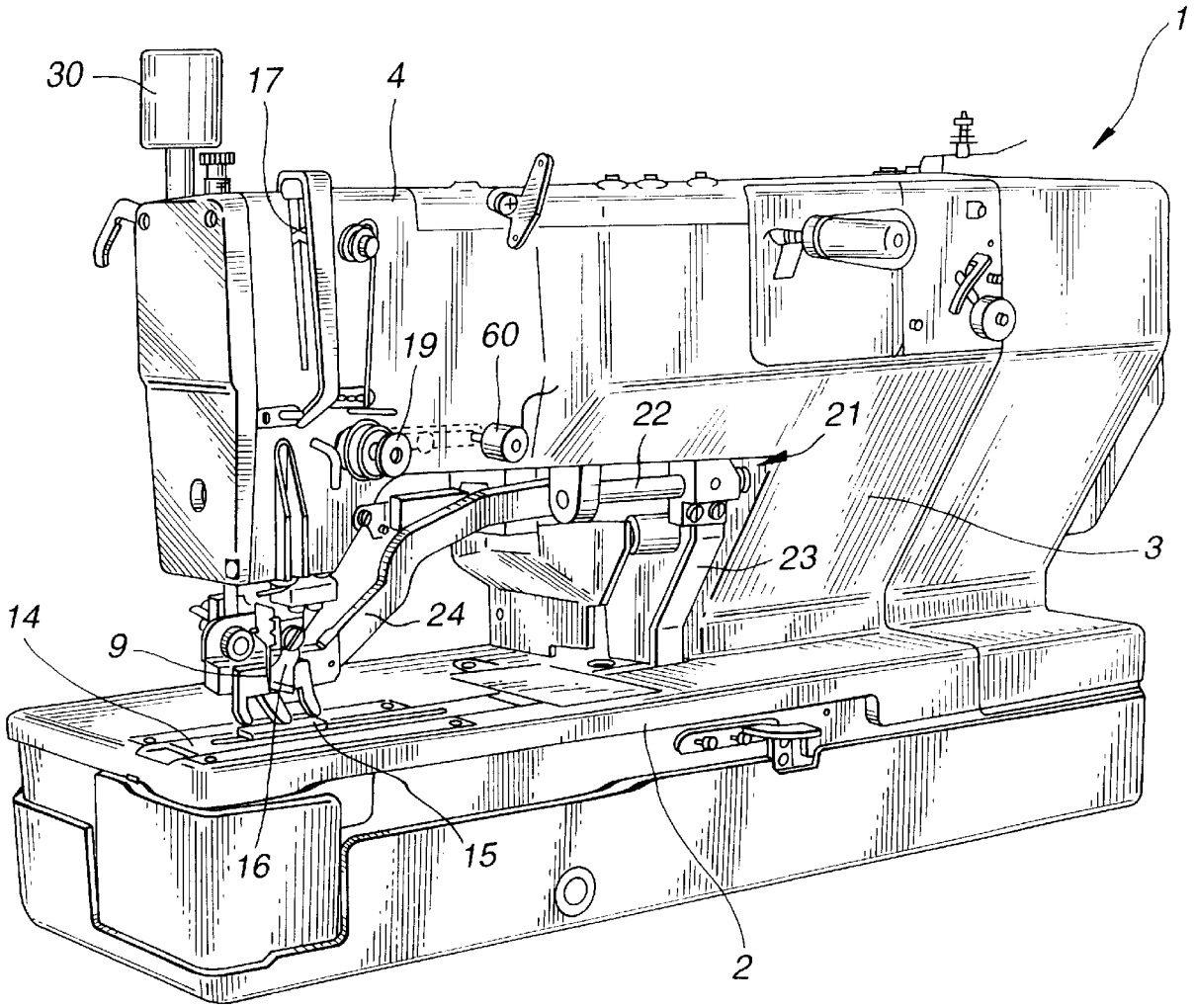
FIG. 1 is a perspective view of the appearance of a buttonhole darning sewing machine to which the present invention is applied.

At first, FIG. 1 is a perspective view of the appearance of a buttonhole darning sewing machine which is a first embodiment according to the invention. Also, FIG. 2 is a perspective view of the outline of the internal mechanism of the first embodiment, and FIG. 3 is a perspective view of the above internal mechanism when it is viewed from the opposite side of FIG. 2.

Figure 2:
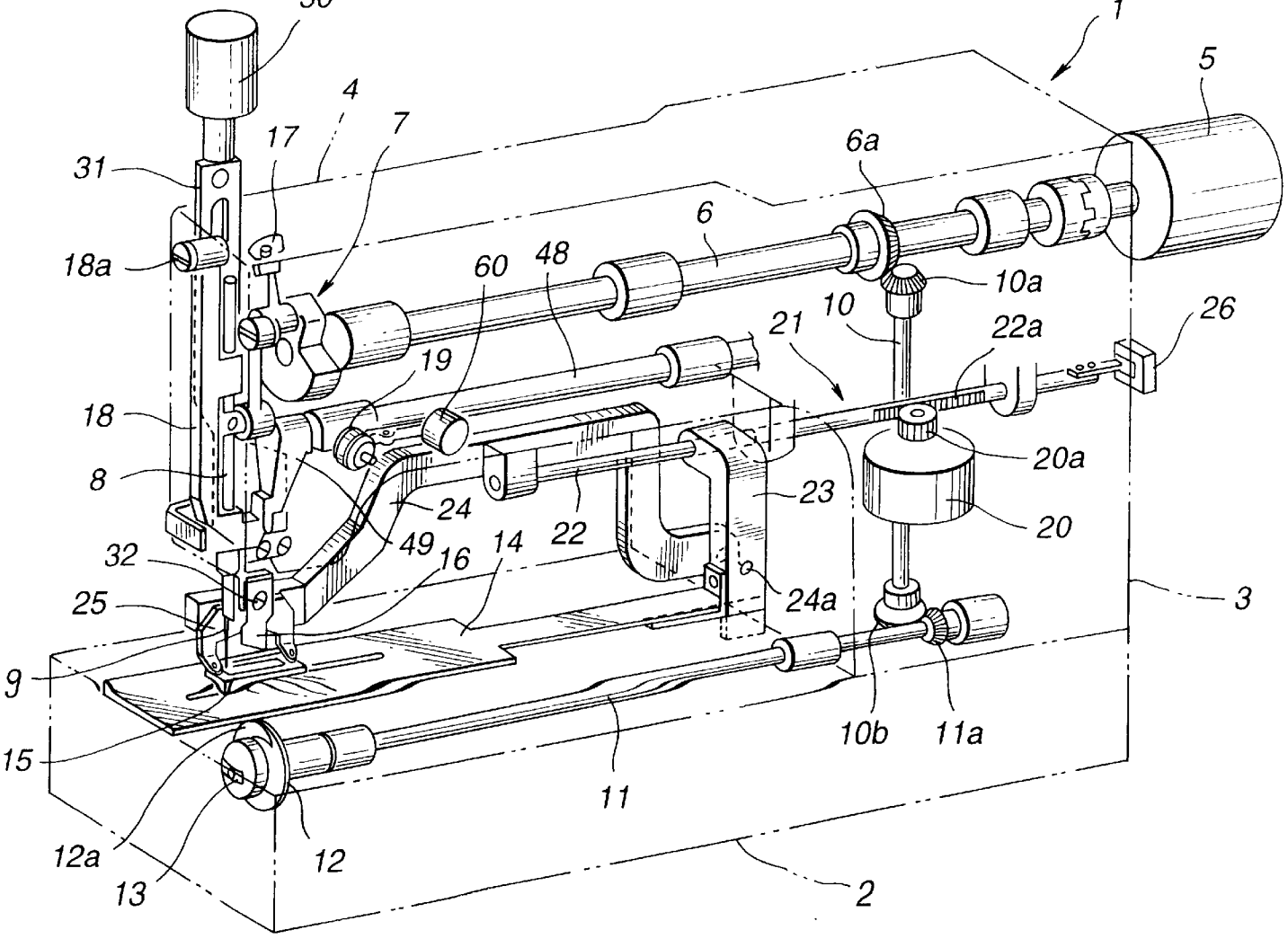
FIG. 2 is a schematic perspective view of a first embodiment of a buttonhole darning sewing machine according to the invention, showing the internal mechanism thereof.
Figure 3:
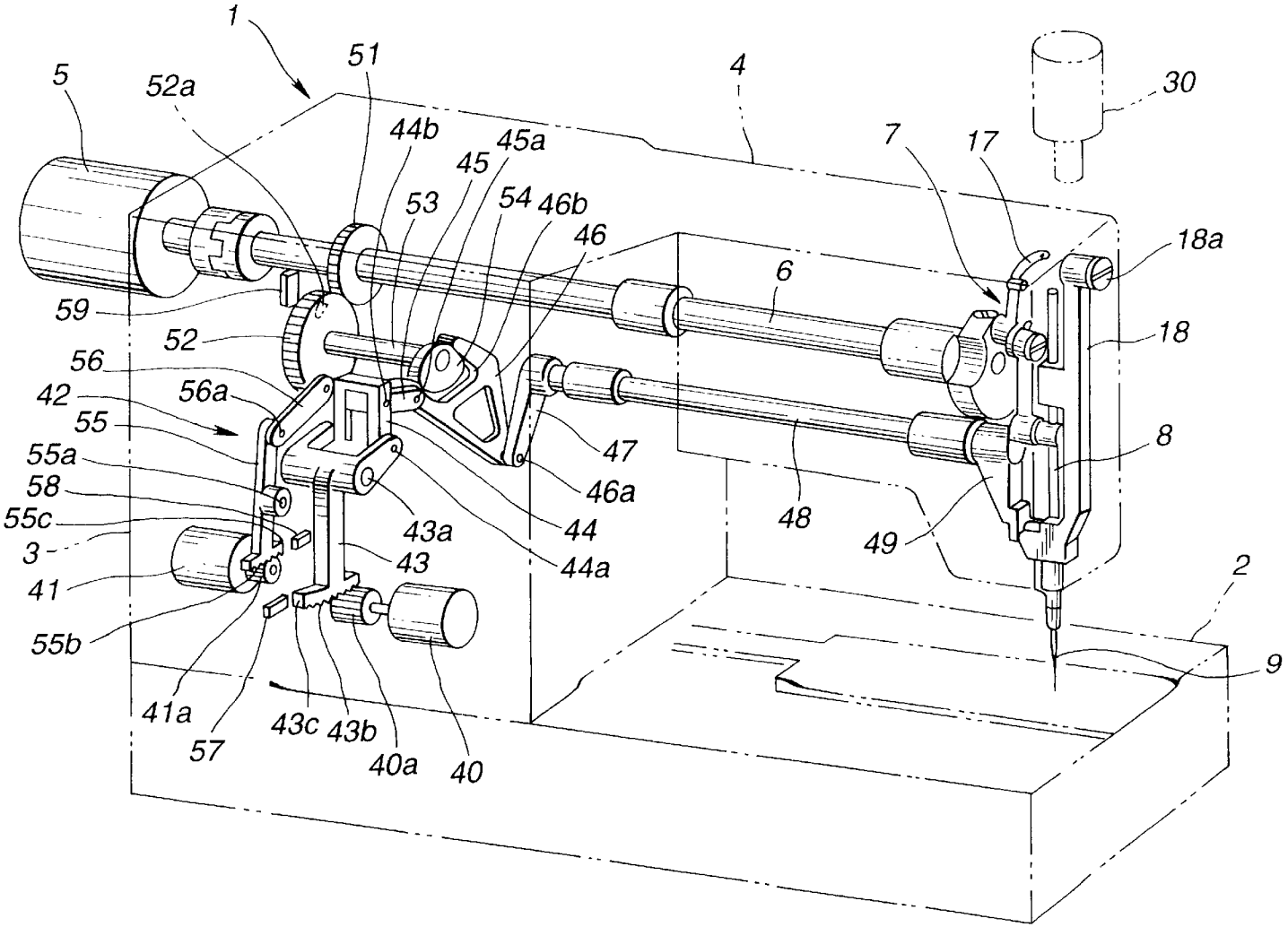
FIG. 3 is also a schematic perspective view, when viewed from the opposite side of FIG. 2, of the first embodiment of a buttonhole darning sewing machine according to the invention, showing the internal mechanism thereof.

In FIGS. 1 to 3, reference character 1 designates a sewing machine frame, 5 a sewing machine motor, 6 an upper shaft, 7 crank mechanism, 8 a needle barm 9 a needle, 10 a vertical shaft, 11 a lower shaft, 12 a hook, 13 a bobbin case, 14 a cloth hold plate, 15 a cloth presser (a frame-shaped clamp body), 16 a cloth cutting knife (a vertically moving knife), 17 a balance, 18 a needle bar swing base, 19 a tension block, 20 a feed motor (electrically driving means: pulse motor), 21 a feed mechanism (connecting means), 30 an air cylinder unit for a cloth cutting knife, 31 a knife mounting plate, 40 a base line motor, 41 a swing width motor, 42 a needle swing mechanism, and 60 a voice coil motor, respectively.

As shown in FIGS. 1 to 3, the sewing machine frame 1 comprises a bed 2 including a flat bed surface on the upper surface thereof, a vertical body portion 3 erected on the one end portion side of the bed 2, and an arm 4 disposed on the vertical body portion 3 and extending substantially in parallel to the bed 2; and, the sewing machine frame 1 has a substantially U-like shape when it is viewed from the flank thereof In the above-mentioned sewing machine frame 1, a sewing machine motor 5 is provided in the end portion thereof on the vertical body portion 3 side, the upper shaft 6 which can be rotated when it is driven by the sewing machine motor 5 is disposed within the arm 4, the needle bar 8 is connected through the crank mechanism 7 to the leading end portion of the upper shaft 6, and the needle 9 is mounted on the lower portion of the needle bar 8.

Also, the vertical shaft 10 is disposed within the vertical body portion 3, the lower shaft 11 is disposed within the bed 2, and the bobbin case 13 is mounted on the tension hook 12 which is disposed in the leading end portion of the lower shaft 11. By the way, the upper end portion of the vertical shaft 10 is connected to the upper shaft 6 through bevel gears 6*a* and 10*a*, whereas the lower end portion of the vertical shaft 10 is connected to the lower shaft 11 through bevel gears 10*b* and 11*a*.

Further, on the bed 2, there is disposed the cloth hold plate 14 which can be moved, and, above the cloth hold plate 14, there are disposed the cloth presser 15 formed of a frame-shaped clamp body and the cloth cutting knife 16 which is a vertically moving knife. By the way, in the crank mechanism 7, there is incorporated the balance 17 which projects externally from the side surface of the leading end portion of the arm 4.

Also, the needle bar 8 is incorporated in the needle bar swing base 18 in such a manner that it can be freely slided in the vertical direction. The needle bar swing base 18 is structured in such a manner that the upper end portion thereof is free to swing with a swing fulcrum shaft 18*a* parallel to the upper shaft 6 as the fulcrum thereof. And, the tension block 19 is arranged in the lower portion of the side surface of the leading end portion of the arm 4, while the tension block 19 is structured such that the tension thereof can be variably controlled by the voice coil motor 60.

In the interior portion of the vertical body portion 3, there is disposed the feed motor 20 which is used as electrically driving means for driving the cloth hold plate 14 and cloth presser 15 electrically; the feed motor 20 is a pulse motor which has an axis extending in the vertical direction; and, there is structured the feed mechanism 21 which extends from the output shaft of the feed motor 20 to the cloth hold plate 14 and cloth presser 15.

Also, on the leading end portion of the arm 4, there is mounted the cloth cutting knife air cylinder unit 30 which serves as electrically driving means for the cutting operation of the cutting knife, while the knife mounting plate 31, which can be moved upward and downward when it is driven by the cloth cutting knife air cylinder unit 30, is so disposed as to extend in the vertical direction within the arm 4. The cloth cutting knife 16 is mounted on the lower end portion of the knife mounting plate 31 by a set screw 32, while the lower end portion of the knife mounting plate 31 is projected downward from the arm 4.

Figure 13:
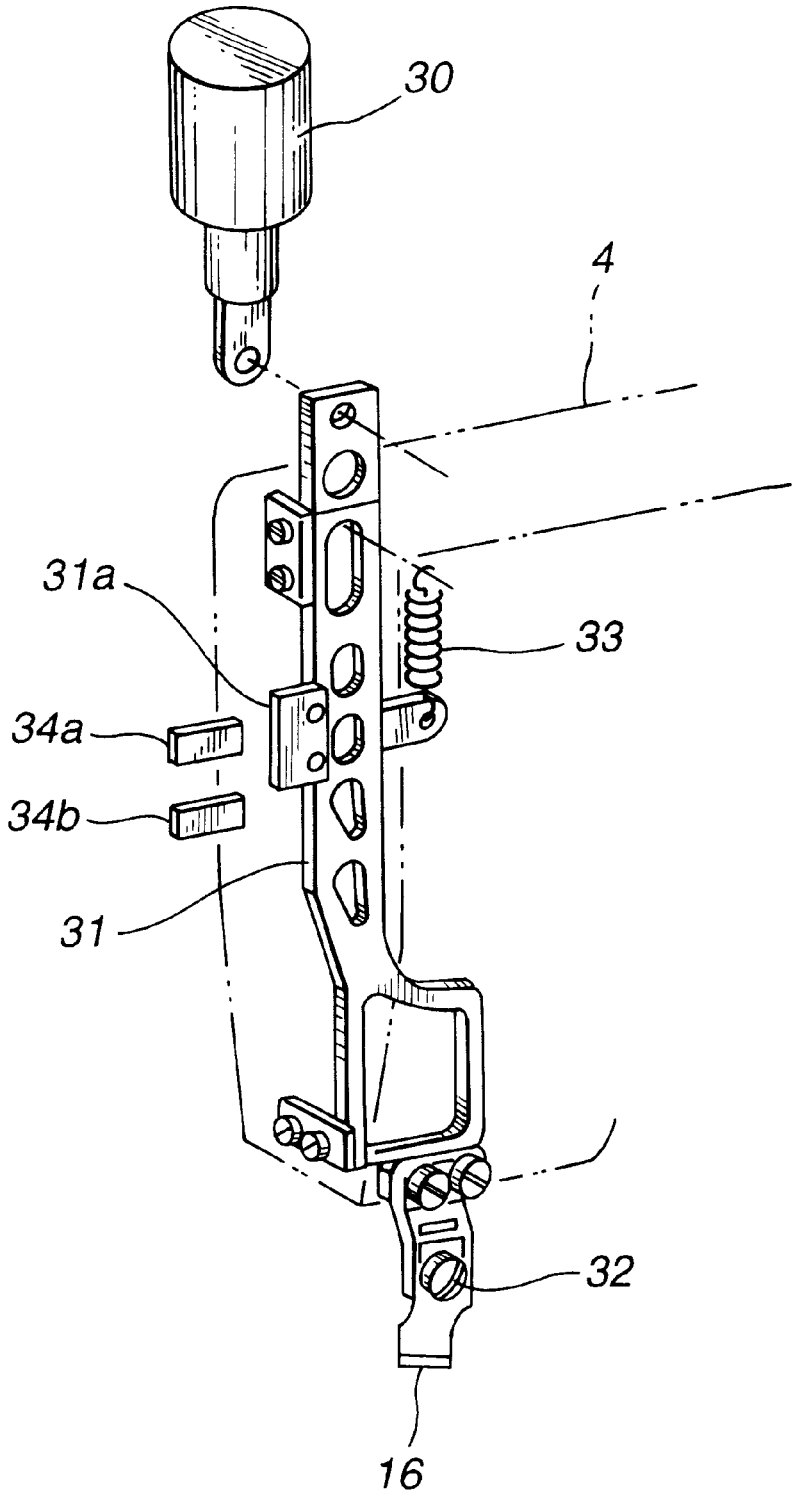
FIG. 13 is a perspective view of a cloth cutting knife drive mechanism.
Figure 14A:
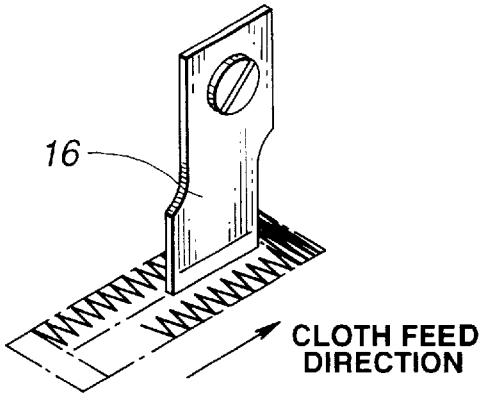
FIG. 14(*a*) shows a state in which a cloth is cut once by the first downward movement of the cloth cutting knife, FIG. 14(*b*) shows the cloth feed direction, and FIG. 14(*c*) shows the second downward movement of the cloth cutting knife.
Figure 14B:
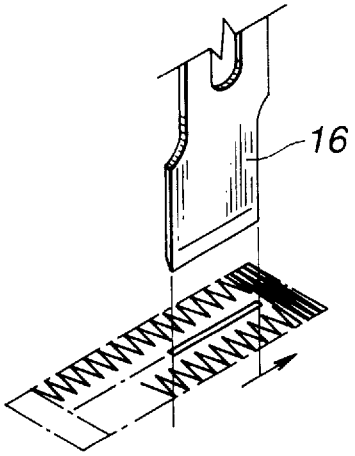
Figure 14C:
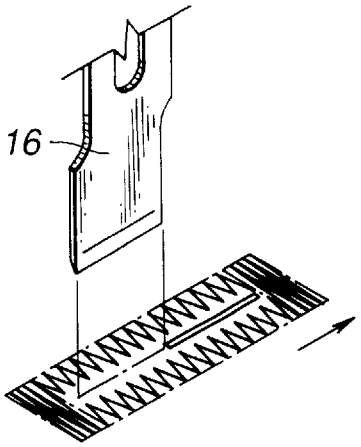

By the way, as shown in FIG. 13, to the knife mounting plate 31, there is connected a return spring 33 for lifting and resuming the knife mounting plate 31 to its original position; and, on the flank side of the knife mounting plate 31, there are arranged cloth cutting upper and lower position detect sensors 34*a* and 34*b* of a close approach type which are respectively used to detect the portion to be detected 31*a* of the knife mounting plate 31.

Further, within the vedical body portion 3, there are disposed the base line motor 40 for deciding the base line position of the needle bar swing base 18 and the swing width motor 41 for deciding the swing width thereof. Both of the base line motor 40 and swing width motor 41 are pulse motors each of which has an axis extending horizontally in parallel to the upper shaft 6, while there is structured the needle swing mechanism 42 which extends from the respective output shafts of the base line motor 40 and swing width motor 41 to the needle bar swing base 18.

Now, the feed mechanism 21, as shown in FIG. 2, comprises a feed shaft 22 with the axis thereof extending in the horizontal direction, a bracket 23 for the cloth hold plate 14, a cloth hold arm 24 for holding the cloth presser 15, —and the like. In this manner, there is structured connecting means which extends from the feed motor 22 to the cloth hold arm 24.

That is, in the vertical body portion 3, there is incorporated the feed shaft 22 including a rack 22*a* in meshing engagement with a pinion 20 a provided on the output shaft of the feed motor 20 and, to the middle portion of the feed shaft 22 that is projected from the vertical body portion 3 and is situated below the arm 4, there is fixed the upper end portion of the bracket 23 which supports the cloth hold plate 14 in the lower end portion thereof. The base end portion of the cloth hold arm 24 including a mounting piece 25, which supports the cloth presser 15 in the leading end portion thereof, is connected to the side surface of the lower portion of the bracket 23 in such a manner that it is free to swing in the vertical direction with a pin 24*a* as the fulcrum thereof.

Although not shown, there are provided an actuator (an air cylinder, a solenoid, or the like) for lifting the cloth hold arm 24, a return spring for lowering the hold arm 24 down to the initial position. However, the vertical movement of the cloth hold arm 24 can also be carried out by means of operation of a pedal.

Also, there is provided an origin position detect sensor 26 of a close approach type which is used to detect an origin position corresponding to the position of the leading end of the knife in accordance with the position of the feed shaft 22.

By means of the above-structured feed mechanism 21, when the feed motor 20 comprising a pulse motor is driven, then the cloth hold plate 14 and cloth presser 15 are moved integrally on the bed 2 through the feed shaft 22, which can be moved back and forth through the meshing engagement between the pinion 20*a* and rack 22*a*, as well as through the bracket 23 and cloth hold arm 24.

The above-mentioned means is means which is employed in the present embodiment for moving the cloth electrically.

That is, in a buttonhole darning sewing machine, since the feed motor 20 comprising a pulse motor for driving the cloth hold arm 24 through the feed mechanism 21 is stored within the vertical body portion 3 of the sewing machine frame 1 in the above-mentioned manner, the space in the vertical body portion 3 can be used effectively and, at the same time, the number of pads to be mounted on the outside of the sewing machine frame 1 can be reduced so that the appearance of the sewing machine frame 1 can be made neat and simple.

Also, since the feed motor 20 for driving the cloth hold arm 24 is stored within the vertical body portion 3, not only there can be provided a sound insulation effect, but also the handling of the cloth can be improved, which in turn can solve a problem that the cloth can be soiled as in the case where a motor is mounted on the outside of a sewing machine frame.

Further, since the pinion 20*a* of the output shaft of the pulse motor (feed motor) 20 with the axis thereof extending in the vertical direction is meshingly engaged with the rack 22*a* of the feed shaft 22 with the axis thereof extending in the horizontal direction and also since the cloth hold arm 24 is fixed to the feed shaft 22, the feed shaft 22 can be driven or moved linearly in the horizontal direction by the vertically extending pulse motor (feed motor) 20 through the rack 20*a* and pinion 22*a*, thereby being able to move the cloth hold arm 24 i-e—a direction in which the cloth hold arm 24 approaches and parts apart from the vertical body portion 3.

Because the base line motor 40 and swing width motor 41 respectively comprising pulse motors are both stored within the vertical body portion 3 in such a manner that their axes are so arranged as to extend in parallel to the upper surface of the bed 2, similarly to the feed motor 20, the space of the interior portion of the vertical body portion 3 can be used effectively and, at the same time, the number of parts to be mounted on the outside of the sewing machine frame 1 can be reduced so that the appearance of the sewing machine frame 1 can be made neat and simple.

Figure 4:
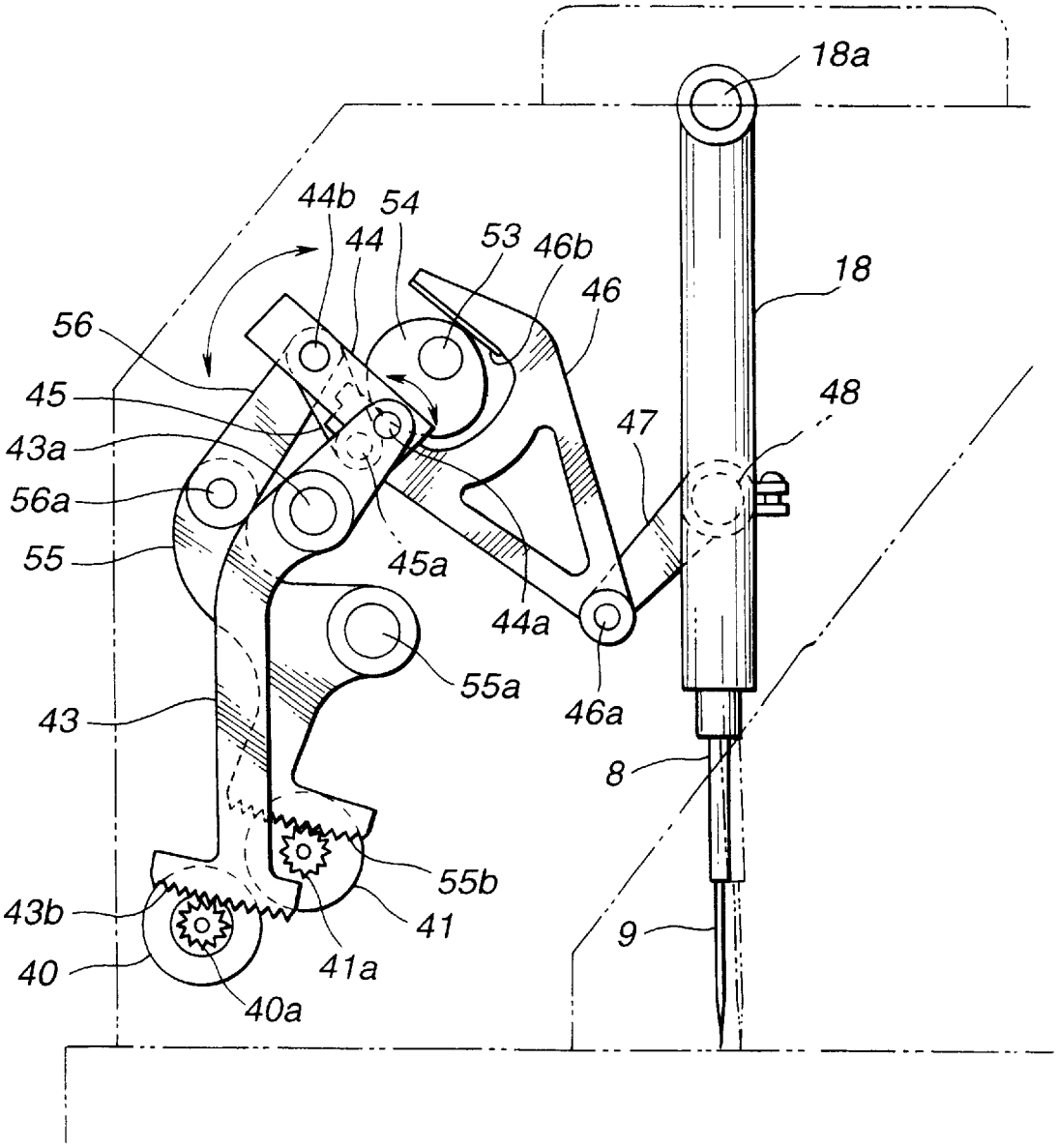
FIG. 4 is a front view of a needle swing mechanism shown in FIG. 3, when viewed from the needle side.
Figure 5:
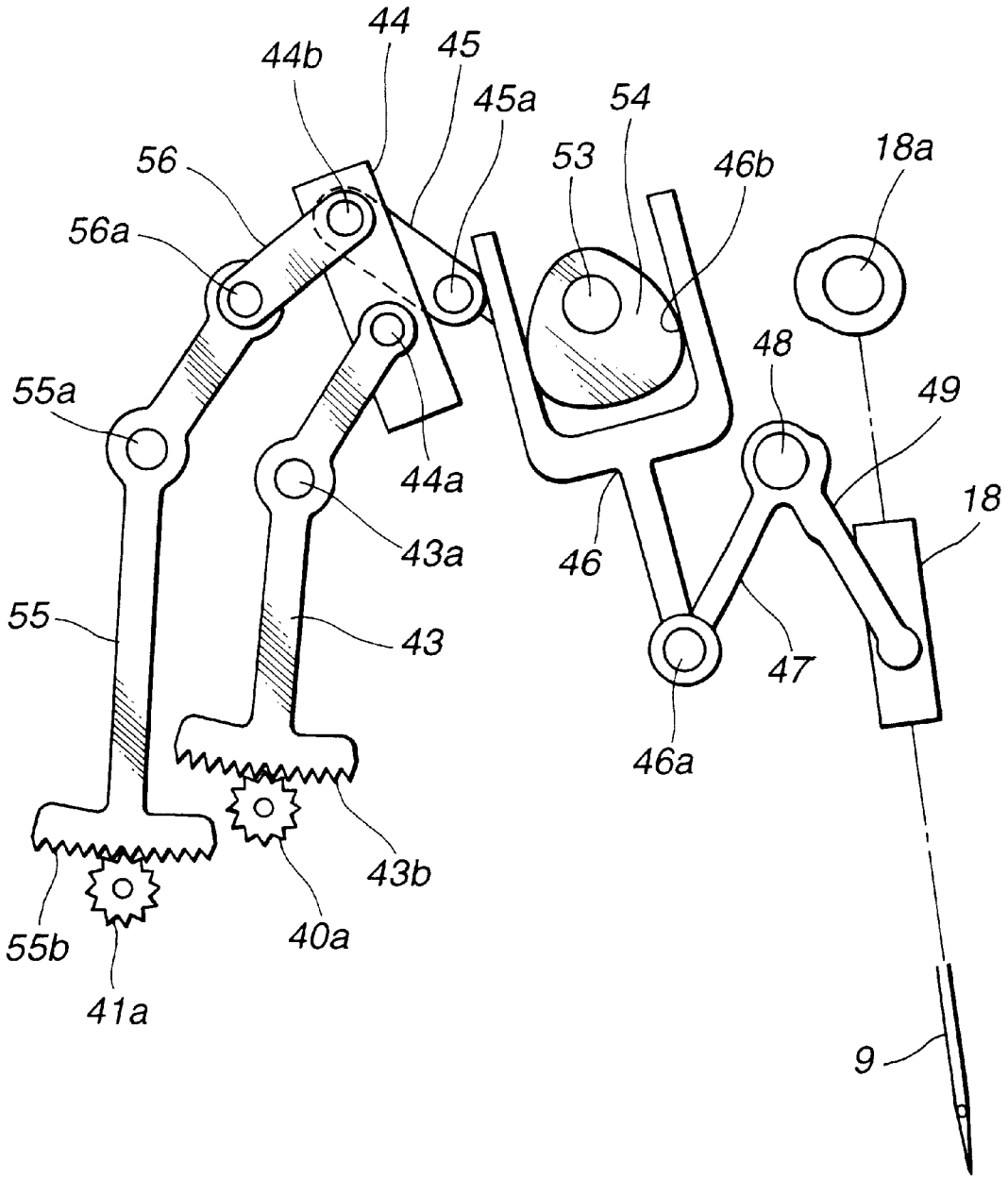
FIG. 5 is a typical view of the needle swing mechanism shown in FIG. 4, explaining the operation thereof.

Next, the needle swing mechanism 42, as shown in FIGS. 3 to 5, comprises a base line arm 43, a base line lever 44, a connecting link 45, a needle swing cam lever 46, a needle swing lever 47, a connecting shaft 48, a needle swing arm 49, a needle swing cam 54, a swing width arm 55, a swing width lever 56, and the like.

That is, within the vertical body portion 3, a sector gear 43*b*, which is provided in the lower end portion of the base line arm 43 with a support shaft 43*a* supported horizontally in the sewing machine frame as the fulcrum of the middle portion thereof, is engaged in mesh with a pinion 40*a* provided on the output shaft of the base line motor 40, and the end portion of the forked base line lever 44 is swingably connected to the forked portion of the upper portion of the base line arm 43 by a horizontal pin 44*a*. Also, one end portion of the connecting link 45 is swingably connected into the forked portion of the base line lever 44 by a horizontal pin 44*b*, while the needle swing cam lever 46 is swingably connected to the other end portion of the connecting link 45 by a horizontal pin 45*a*.

Further, the leading end portion of the needle swing lever 47 is swingably connected to the lower end portion of the needle swing cam lever 46 by a horizontal pin 46*a*, while the base end portion of needle swing lever 47 is fixed to the base end portion of the connecting shaft 48 which is disposed in parallel to the upper shaft 6 within the arm 4. And, the base end portion of the needle swing arm 49 is fixed to the leading end portion of the connecting shaft 48, while the needle bar swing base 18 is swingably connected to the leading end portion of the needle swing arm 49 through a square piece (not shown) or the like.

Here, the needle swing cam lever 46 is so formed as to have an upwardly opened U-shaped engaging recessed portion 46*b*, while the needle swing cam 54 comprising an eccentric cam is in engagement with the engaging recessed portion 46*b*. That is, the needle swing cam 54 is mounted on a counter shaft 53 to which the rotation of the upper shaft 6 can be transmitted at a reduction ratio of 1/2 through reduction gears 51 and 52.

Further, within the vedical body portion 3, a sector gear 55*b*, which is provided in the lower end portion of the swing arm 55 with a support shaft 55*a* supported horizontally in the sewing machine frame as the fulcrum of the middle portion thereof, is engaged in mesh with a pinion 41 a provided on the output shaft of the swing width motor 41, and the end portion of the swing width lever 56 is swingably connected to the forked portion of the upper portion of the swing width arm 55 by a horizontal pin 56*a*. The other end portion of the swing width lever 56 is swingably connected to the connecting link 45 through the horizontal pin 44*b*.

On the flank portion of the sector gear 43*b* of the base line arm 43, there is disposed a base line origin detect sensor 57 which is formed of a magnetic sensor serving as base line position detect means and, on the one end portion side of the sector gear 43*b*, there is disposed a magnet 43*c* for detection of the base line. Similarly, in the neighborhood of the sector gear 55*b* of the swing width arm 55, there is disposed a swing width origin detect sensor 58 which is formed of a magnetic sensor serving as needle swing width detect means and, on one end portion side of the sector gear 55*b*, there is arranged a magnet 55*c* which is used to detect the needle swing width.

Also, on one side surface of the reduction gear 52 located on the counter shaft 53 side, there is disposed a needle swing right and left position detect sensor 59 (base line side/needle swing side detect means) which is formed of a magnetic sensor, while the reduction gear 52 includes a magnet 52*a* which is used to detect the right and left position.

The reduction gear 52 makes one rotation while the reduction gear 51 on the upper shaft 6 makes two rotations, that is, the reduction gear 52 rotates once while the needle 9 makes its up-and-down motion twice. The needle swing right and left position detect sensor 59, in a rotation phase where the needle 9 is situated at the upper stop position and is swung toward the base line side, is disposed opposed to the magnet 52*a*.

With use of the above-structured needle swing mechanism 42, swing movements are transmitted to the needle bar swing base 18 by means of the driving operations of the base line motor 40 and swing width motor 41, which are both formed of pulse motors serving as drive means, through the base line arm 43 to the base line lever 44, or through the swing width arm 55 to the swing width lever 56, and, after then, through the connecting link 45, needle swing cam lever 46, needle swing lever 47, needle swing arm 49 and needle swing cam 54, so that the base line and swing width can be changed with the swing fulcrum shaft 18*a* provided in the upper portion of the needle bar swing base 18 as the fulcrum thereof.

That is, as shown in FIG. 4 and as shown typically in FIG. 5, with regard to the base line, due to the driving operation of the base line motor 40 comprising a pulse motor, the swing movement is transmitted to the needle bar swing base 18 through the base line arm 43, base line lever 44, connecting link 45, needle swing cam lever 46, needle swing lever 47, needle swing arm 49 and needle swing cam 54, thereby causing the needle bar swing base 18 to swing with the swing fulcrum shaft 18*a* provided in the upper portion of the needle bar swing base 18 as the fulcrum thereof, so that the base line can be changed. This is the base line change mechanism.

Also, with regard to the swing width, due to the driving operation of the swing width motor 41 comprising a pulse motor, the swing movement is transmitted to the needle bar swing base 18 through the swing width arm 55, swing width lever 56, connecting link 45, needle swing cam lever 46, needle swing lever 47, needle swing arm 49 and needle swing cam 54, thereby causing the needle bar swing base 18 to swing with the swing fulcrum shaft 18*a* provided in the upper portion of the needle bar swing base 18 as the fulcrum thereof, so that the swing width can be changed. This is the needle swing width change mechanism.

Figure 6:
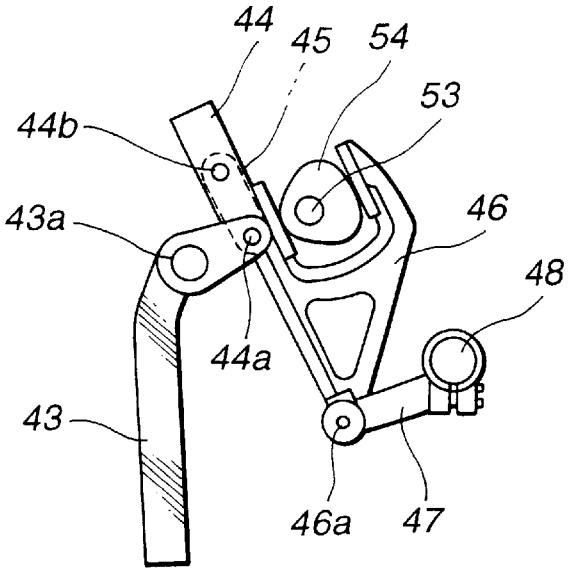
FIG. 6(*a*) is a view of the needle swing mechanism, showing a state thereof in which the cam top portion of a needle swing cam is situated on the base line side, and FIG. 6(*b*) is a view of the needle swing mechanism, showing a state thereof in which the cam top portion of a needle swing cam is situated on the cam swing width side.
Figure 6:
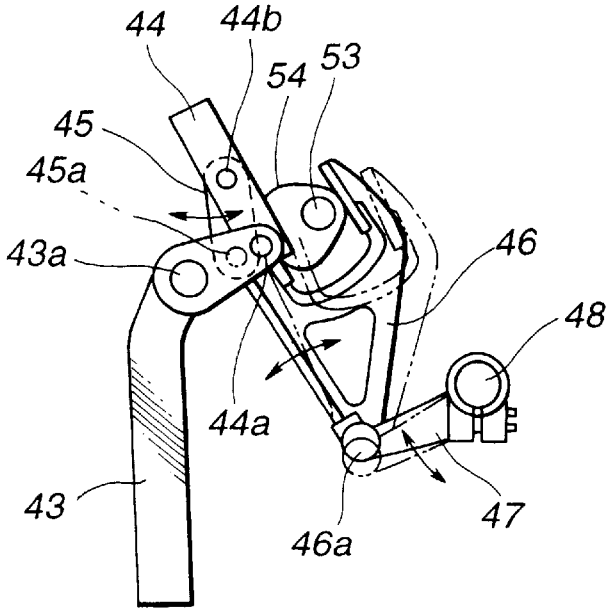

Here, the needle swing mechanism 42 is a mechanism which swings (increases) the swing width to the left with the base line position as a reference and, in the needle swing mechanism 42, as shown in FIG. 6(*a*), when the cam top portion of the needle swing cam 54 is situated on the base line side (in FIG. 6(*a*), on the right side), the dropping of the needle is decided in accordance with the position of the base line arm 43.

Figure 7:
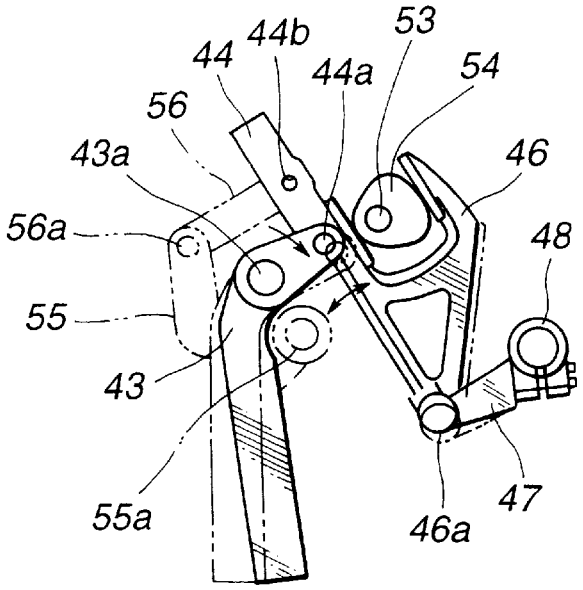
FIG. 7 shows the change of the base line position to be executed by the needle swing mechanism.

Also, as shown in FIG. 6(*b*), when the cam top portion of the needle swing cam 54 is situated on the cam swing width side (in FIG. 6(*a*), on the left side), the dropping of the needle is decided in accordance with the amount of the swing width with respect to the base line position. And, the movement of the base line position, as shown in FIG. 7, can be executed by the rotation of the base line arm 43.

Figure 8:
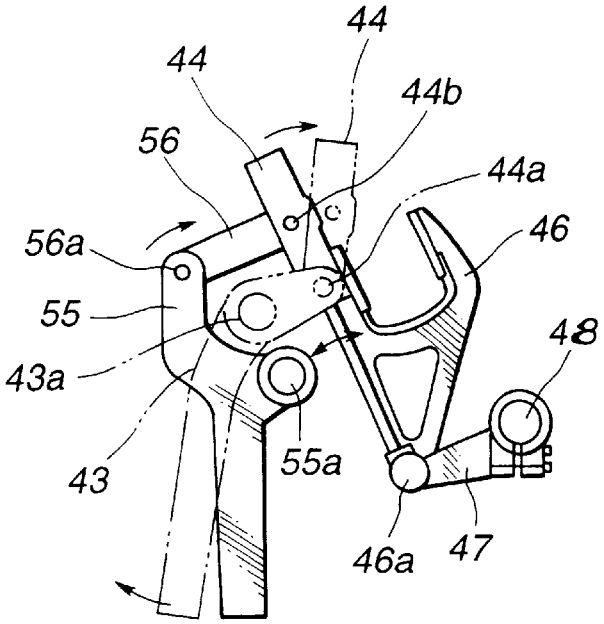
FIG. 8 shows the change of the swing width position to be executed by the needle swing mechanism.

Also, the change of the swing width, as shown in FIG. 8, can be executed by the rotation of the swing width arm 55 through the base line lever 44.

Now, when sewing, if the sewing machine motor 5 is driven, then the upper shaft 6 is rotated, the rotational movement of the upper shaft 6 is transmitted to the needle swing cam 54 provided in the counter shaft 53 through the reduction gears 51 and 52 so that the needle swing cam 54 is rotated at the reduction ratio of 1/2; the needle swing cam lever 46, which includes the cam engaging recessed portion 46*b* in engagement with the needle swing cam 54, is thereby caused to swing reciprocatingly; and, the reciprocating swing motion of the needle swing cam lever 46 is then transmitted to the needle bar swing base 18 through the needle swing lever 47, connecting shaft 48, needle swing arm 49 and needle swing cam 54.

As a result of this, based on the above-mentioned changes of the base line and swing width, the needle bar swing base 18 is reciprocatingly swung with the swing fulcrum shaft 18a on the upper end portion of the needle bar swing base 18 as the fulcrum thereof, thereby forming the stitches of the parallel portion (side sewing portion) and bar-tack portion (bar-tack sewing portion) in the buttonhole darning operation.

Figure 10:
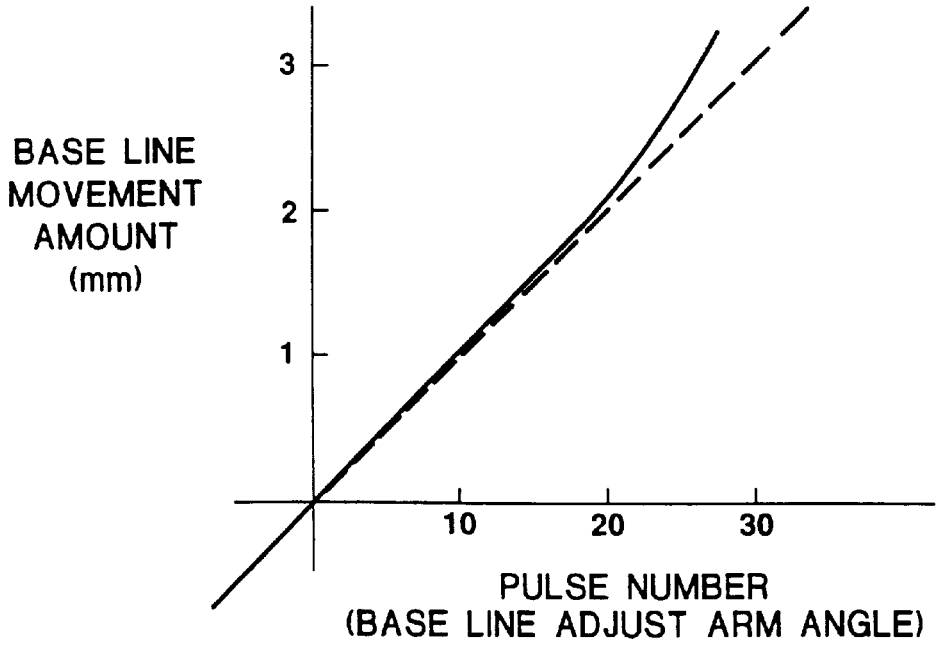
FIG. 10 is a graphical representation of the characteristics of the pulse number base line movement amount.

And, in the above mechanism which moves the base line in correspondence to the angle of the base line arm 43 functioning as a base line adjust arm, the base line arm 43 swings about a single shaft, with the result that the base line movement amount provides such amount as shown by a solid line in FIG. 10 in correspondence to the angles of the base line arm 43 depending on the generation of the number of the output pulses of the base line motor (pulse motor) 40.

Figure 11:
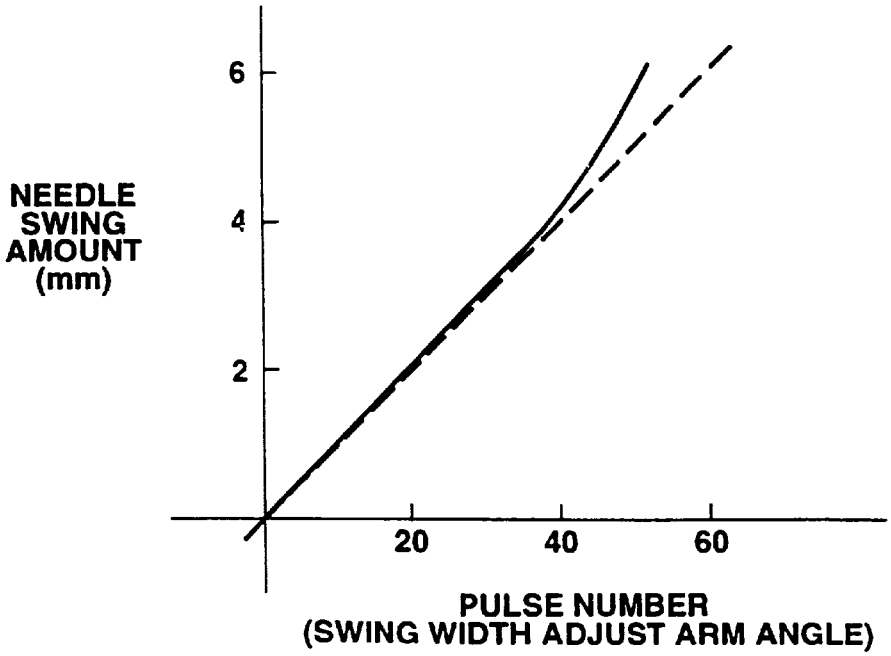
FIG. 11 is a graphical representation of the characteristics of the pulse number needle swing amount.

Also, similarly, there is obtained such needle swing amount as shown by a solid line in FIG. 11 in correspondence to the angles of the swing width arm 55 which functions as a swing width adjust arm depending on the generation of the number of the output pulses of the swing width motor 41 comprising a pulse motor.

On the contrary, with use of the above-mentioned needle swing mechanism 42, the output pulse numbers, $k_1$, $k_2$, $k_{n-1}$, $k_n$, with respect to the base line motor 40, which are shown in FIG. 9, are the pulse numbers that are so corrected as to approach an ideal line (a broken line shown in FIG. 10) and, similarly, the output pulse numbers, $h_1$, $h_2$, $h_{n-1}$, $h_n$ with respect to the swing width motor 41 are the pulse numbers that are so corrected as to approach an ideal line (a broken line shown in FIG. 11).

Figure 12A:
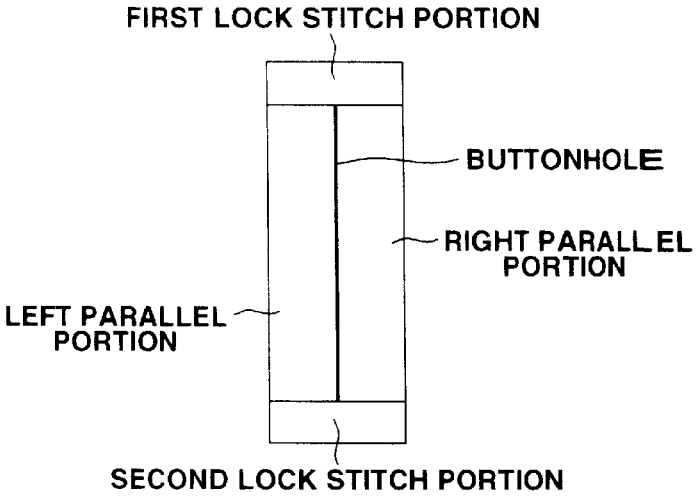
FIG. 12(*a*) shows the names of the respective portions of a buttonhole darning portion, FIG. 12(*b*) shows the right-handed pattern thereof, and FIG. 12(*c*) shows the righthanded pattern thereof.
Figure 12B:
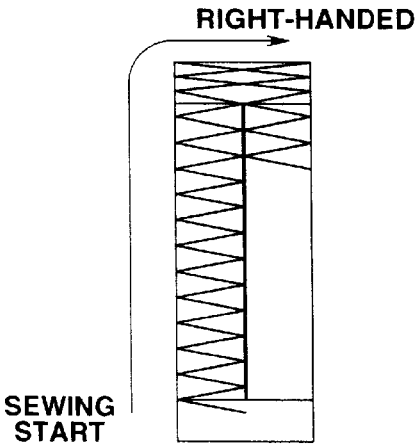
Figure 12C:
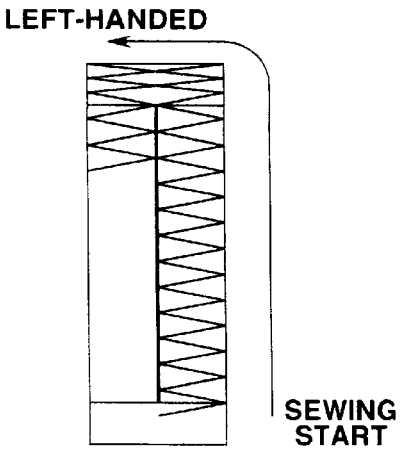

Next, FIG. 12(*a*) shows the names of the respective portions of the buttonhole darning and, as shown in FIG. 12(*a*), the left and right sides of the buttonhole are respectively a left parallel portion (a left side sewing portion) and a right parallel portion (a right side sewing portion), while the rear and front sides of the buttonhole are respectively a first bar-tack portion (a rear bar-tack sewing portion) and a second bar-tack portion (a front bar-tack sewing portion).

The buttonhole darning can be executed selectively in two ways by the above-structured buttonhole darning sewing machine, that is, one is a right-handed stitching, and the other is a left-handed stitching. In particular, the right-handed stitching, as shown in FIG. 12(*b*), starts at the left side of the second bar-tack portion (the front bar-tack sewing portion), after then, the left parallel portion (the left side sewing portion), first bar-tack portion (the rear bar-tack sewing portion), and right parallel portion (the left side sewing portion) are respectively executed in this order, and finally the right-handed stitching returns to the second lock stitch portion (the front bar-tack sewing portion). On the other hand, the left-handed stitching, as shown in FIG. 12(*c*), starts at the right side of the second bar-tack portion (the front bar-tack sewing portion), after then, the right parallel portion (the right side sewing portion), first bar-tack portion (the rear bar-tack sewing portion), and left parallel portion (the left side sewing portion) are respectively executed in this order, and finally the left handed stitching returns to the second bar-tack portion (the bar-tack stitch sewing portion).

Also, in the buttonhole darning sewing machine according to the present embodiment, the cloth cutting knife 16 is moved up and down a plurality of times during the buttonhole darning operation by driving the cloth cutting knife air cylinder unit 30 shown in FIG. 13, thereby forming a buttonhole.

That is, for example, as shown in FIG. 4(*a*), the cloth is cut once by the first downward motion of the cloth cutting knife 16, next, as shown in FIG. 4(*b*), the cloth is fed in a direction of an arrow shown in FIG. 4 and, after then, the cloth cutting knife 16 is moved downward again, thereby forming a buttonhole of a predetermined length.

Since the cloth cutting knife 16 having a cutting edge length shorter than the length of the side sewing portion of the buttonhole darning stitches is moved upward and downward a plurality of times to thereby form a buttonhole having a length corresponding to the length of the side sewing portion, a buttonhole having an arbitrary length can be formed by a single kind of cloth cutting knife 16.

Therefore, even if the length of a buttonhole varies, there is no need to replace the cloth cutting knife or it is not necessary to prepare several kinds of cloth cutting knives which correspond in number to the lengths of buttonholes.

Figure 15:
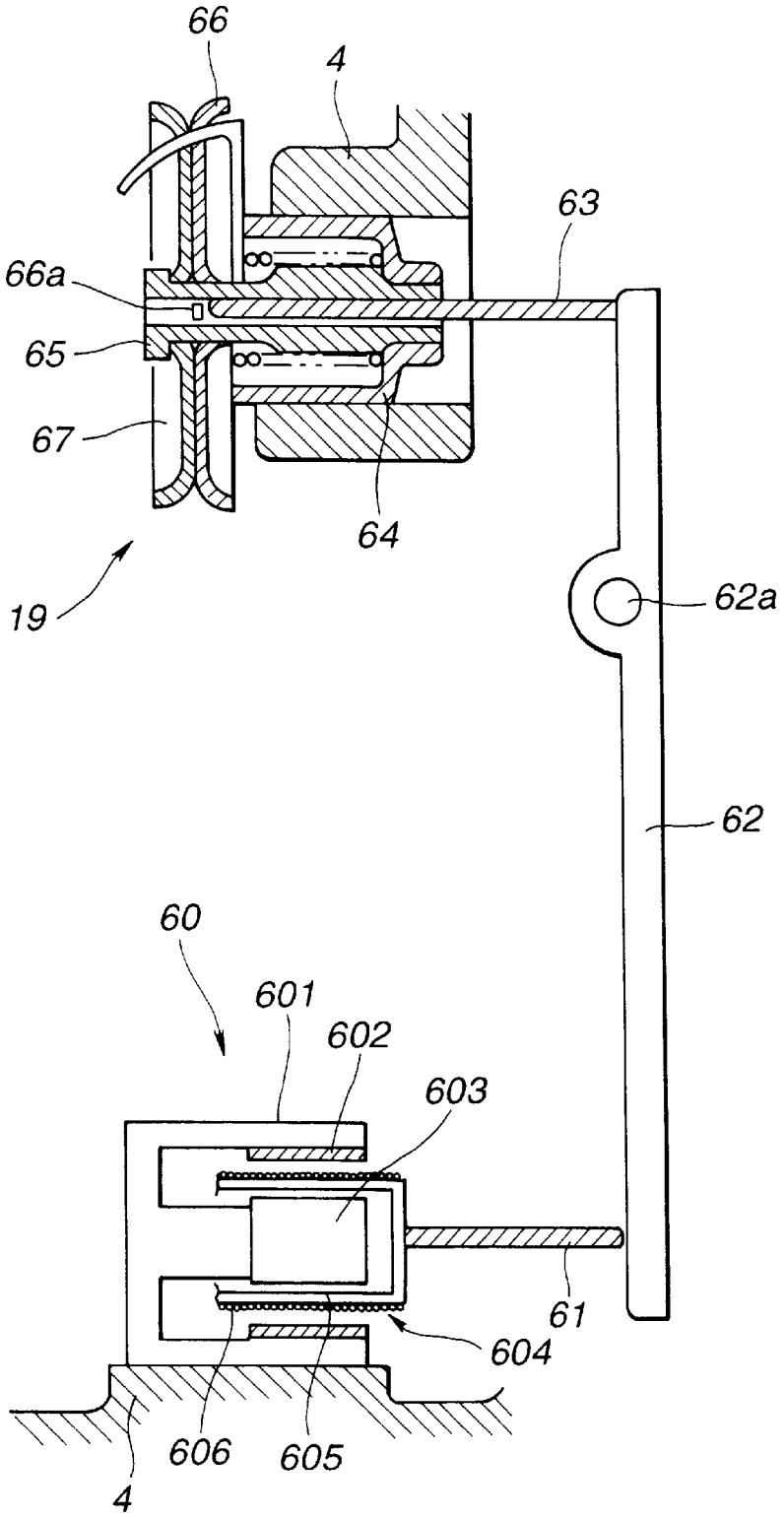
FIG. 15 is a section view of the structure of a tension block which can be variably controlled by a voice coil motor.

Now, FIG. 15 is a partial section view of the structure of the tension block 19 the tension of which is variably controlled by the voice coil motor 60, showing its assembled state.

That is, a plunger 61, which is provided in a voice coil motor 60 having an excellent linear characteristic, is butted against one end portion of a lever 62 including a pin 62*a* provided in the middle portion thereof and serving as the fulcrum thereof, a bearing case 64 and a hollow shaft 65 are assembled onto an operation shaft 63 in contact with the other end portion of the lever 62, and a pair of tension dishes 66 and 67 are slidably assembled onto the hollow shaft 65, thereby forming the tension block 19.

Since the tension block 19 is structured in this manner, a tension to be given to an upper thread can be changed by changing pressures to be applied to the pair of tension dishes 66 and 67 on the hollow shaft 65 through the operation shaft 63 according to the pressure (driving force) of the plunger 61 of the voice coil motor 60.

In more particular, the tension block 19 provided in the arm 4 is composed of a pair of inner and outer dishes 66 and 67; and, according to the present embodiment, a fixed dish 67 comprising an outer dish is assembled on the flange side of the leading end portion of the hollow shaft 65, and a movable dish 66, which consists of an inner dish and is disposed opposed to the fixed dish 67, is slidably assembled on the hollow shaft 65.

And, in the interior portion of the hollow shaft 65, there is disposed a contact piece 66*a* which can be pressed by the leading end portion of the operation shaft 63 when it is slidably inserted into the interior portion of the hollow shaft 65, while the contact piece 66*a* is formed integrally with the movable dish 66.

On the contrary to the present embodiment, the inner dish 66 may be used as a fixed dish and the outer dish 67 may be used as a movable dish. In this case, the contact piece may be formed integrally with the outer dish 67 serving as a movable dish, and the leading end portion of the operation shaft 63 may be connected to the contact piece through engagement or the like so that the contact piece can be pulled by the operation shaft 63.

In the above-structured tension block 19, the hollow shaft 65 is rotatably carried by the bearing case 64, while the bearing case 64 is inserted into and fixed to an assembling hole formed in the arm 4.

And, the operation shaft 63, which is to be inserted into the interior portion of the hollow shaft 65 of the tension block 19, can be driven by a voice coil motor 60 serving as a linear d.c. motor comprising a low inertia motor.

The present voice coil motor 60 comprises a cylindrical-shaped yoke 601 making a magnetic circuit, an outer pole 602 comprising a permanent magnet provided in the inner periphery of the end portion of the yoke 601, a center pole 603 comprising an iron core formed integrally in the central portion of the cylindrical yoke 601, and a cylindrical-shaped movable coil 604 interposed between the center pole 603 and outer pole 602.

Also, the movable coil 604 is composed of a compensation steel pipe 605 and a coil 606 provided on the outer periphery of the compensation steel pipe 605, and the movable coil 604 further includes the plunger 61 which is integrally provided in the central portion of a coil head thereof located in the leading end portion thereof.

In the above-structured voice coil motor 60, a magnetic field is applied to the movable coil 604 from the outer pole (permanent magnet) 602 disposed on the outer periphery of the center pole (iron core) 603 of the magnetic circuit, a control current is supplied from a control current supply circuit (CC) to the movable coil (coil 606) 604 under such magnetic field to thereby generate a thrust (or a sucking force), which causes the plunger 61 provided in the coil head to advance (or retreat), so that the operation shaft 63 is moved forward (or backward) within the hollow shaft 65 through the lever 62.

The above-structured voice coil motor 60 provides several characteristics as follows: that is, it is small in inductance and quick in response; it is small in inertia and quick in response because it includes only the movable coil 604 as a moving pan; the sucking force (or thrust) of the movable coil 604 is constant regardless of distance; and, a sucking force (or thrust) which is linear and in proportion to a current can be taken out.

Since the voice coil motor 60 has the above-mentioned characteristics, if the operation shaft 63 is driven to move forward (or backwards within the hollow shaft 65 through the lever 62 by the plunger 61 formed integrally with the movable coil 604, then the movable dish 66 can be pushed in the axial direction thereof through the contact piece 66*a* to thereby change the pressure applied between the movable dish 66 and fixed dish 67, so that a gripping force to be applied to a thread passing through the tension block 19 can be changed. That is, the voice coil motor 60 has an active tension function with respect to the upper thread (needle thread).

Figure 16A:
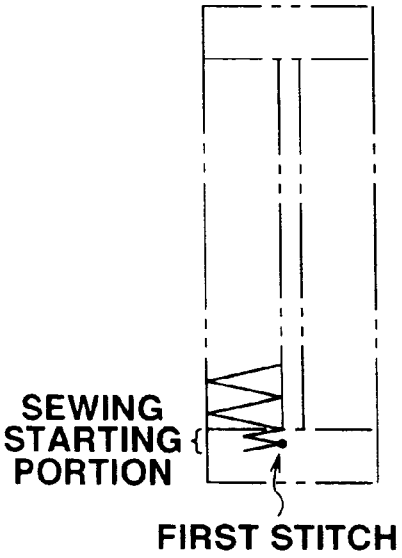
FIGS. 16(*a*) and 16(*b*) show the operation of stitches aided by the tension block having an active tension function through a voice coil motor; in particular FIG. 16(*a*) shows a sewing start portion including a first stitch, and FIG. 16(*b*) shows a bar-tack sewing portion including the last stitch.
Figure 16B:
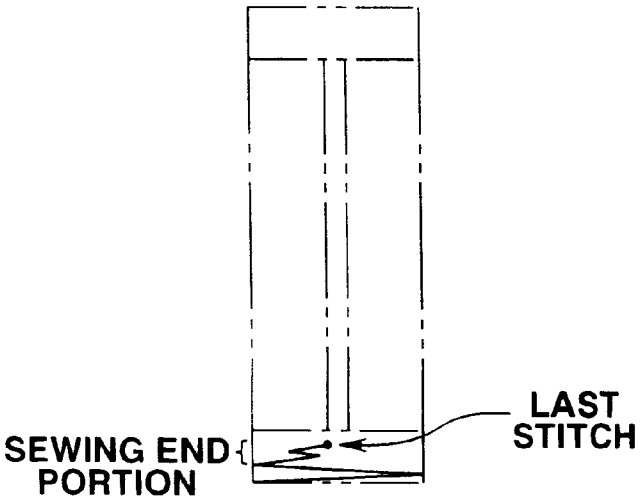

As described above, since the tension block 19 has the active tension function provided by the voice coil motor 60, for example, as shown in FIG. 16(*a*), in an initial sewing portion, from the first stitch to several following stitches, the tension block 19 is controlled by the voice coil motor 60 to apply a tension of almost 0 to the upper thread, thereby being able to connect the upper and lower thread to each other positively, so that the initial sewing portion can be sewn in the form of whip stitches in which the upper and lower threads balance well, which makes it possible to prevent a blooming phenomenon in which the upper thread slips off after the upper and lower threads are connected.

After then, while the tension to be applied to the upper thread by the tension block 19 is being adjusted properly under the control of the voice coil motor 60, the left parallel portion (left side sewing portion) is sewn in the form of pearl stitches (raised stitches), the first bar-tack portion (rear bar-tack sewing portion) is sewn in the form of whip stitches, the right parallel portion (the right side sewing portion) is sewn in the form of pearl stitches, and the second bar-tack portion (front bar-tack portion 3 is sewn in the form of whip stitches.

And, as shown in FIG. 16(*b*), in the bar-tack sewing portion after the sewing operation is resumed to the second bar-tack portion (front lock stitch portion), not only the tension to be applied to the upper thread by the tension block 19 under the control of the voice coil motor 60 is so increased as to be able to pull up the lower thread to the upper thread side, but also, in the cutting operation, by pulling in the lower thread, the end portion of the upper thread previously cut is pulled in behind the cloth, thereby being able to avoid a possibility that, in the last needle in which the needle swing width becomes small, any portion of the thread can be left on the upper side thereof.

Figure 32:
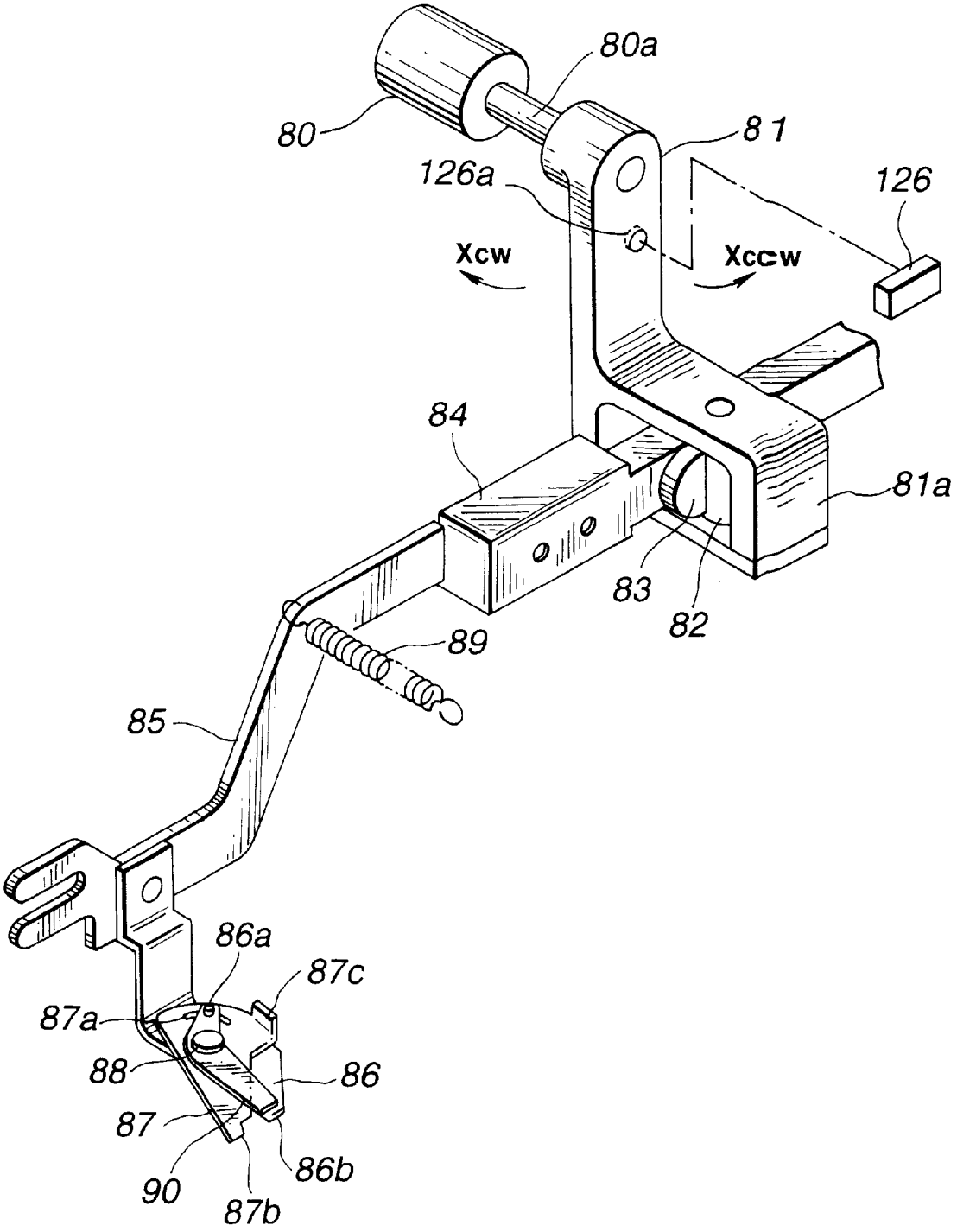
FIG. 32 is a perspective view of a pair of upper thread scissors and a drive mechanism therefor.

Now, FIG. 32 shows upper thread scissors and a drive mechanism for driving the same, in which reference character 81 designates an arm,82 a rotary shaft, 83 a rolling joins, 84 a lever, 85 a scissors mounting plate, 86 a fixed blade, 87 a movable blade, 88 a stepped screw, 89 a thread cutting spring (tension spring), and 90 a thread hold spring, respectively. In particular, the scissors mounting plate 85 is formed integrally with the lever 84; and, the fixed blade 86, movable blade 87 and thread hold spring 90 cooperating in forming the upper thread scissors for cutting and holding the upper thread are respectively disposed in the leading end portion of the scissors mounting plate 85.

That is, the fixed blade 86 is screwed and fixed to the leading end portion of the scissors mounting plate 85, the movable blade 87 is rotatably assembled on the upper surface of the fixed blade 86 by the stepped screw 88, and a small projection 86*a* provided on the fixed blade 86 faces an arc-shaped hole 87*a* formed in the movable blade 87. Also, the thread hold spring 90 is supported by the stepped screw 88 and small projection 86*a* in such a manner that it is prevented against rotation.

The fixed blade 86 includes a blade portion 86*b* in the leading end portion thereof and the movable blade 87 also includes in the leading end portion thereof a blade portion 87*b* which can be superimposed on the blade portion 86*b* of the fixed blade 86. Also, the movable blade 87 further includes a cam engaging portion 87*c* on one extension side of the arc-shaped hole 87*a*.

The thread cutting spring 89 is connected to the scissors mounting plate 85.

In the above-structured thread cutting mechanism, according to the present embodiment, as shown in FIG. 32, as the cloth feed direction moving means for the thread cutting means, instead of a conventional cut-off frame, there is employed a pulse motor 80, the rotary shaft 82 with the axis thereof extending in the vertical direction is rotatably assembled into the frame portion 81 a of the arm 81 fixed to the output shaft 80*a* of the pulse motor 80, and the lever 84 is assembled to the rotary shaft 82 through the rolling joint 83 which can be freely rotated about a horizontal axis thereof.

As described above, by connecting the pulse motor 80 to the upper thread scissors (comprising the fixed blade 86, movable blade 87 and thread hold spring 90), there is formed the above-structured drive mechanism; and, the drive mechanism can be operated as follows.

Figure 33:
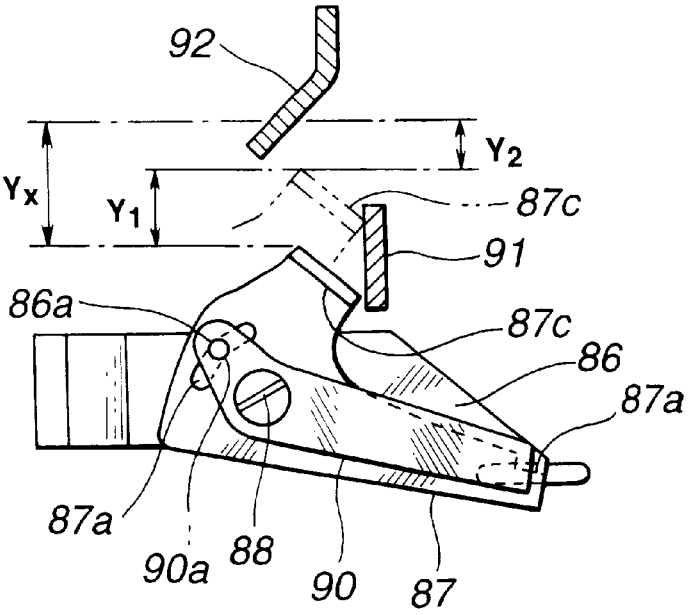
FIG. 33 is a plan view of a pair of upper thread scissors and a cam, showing the relation between them.

That is, as shown in FIGS. 119A and 120 or in FIG. 33, after completion of a sewing cycle, due to the presser lifting and thread cutting operation, the upper thread is cut by the fixed blade 86 and movable blade 87, while the thus cut end connected to the needle is held by and between the thread hold spring 90 and movable blade 87. Just after this thread cutting operation, the upper thread is moved by the pulse motor 80 to its retreat position $Y_x$ and waits there. A return position, a separation position and a retreat position in FIG. 120 are the positions that are viewed with respect to the Y direction (cloth feed direction).

At the next sewing machine starting time, the arm 81 is rotated by a given angle in the $X_{cw}$, direction by the pulse motor 80 in such a manner that the upper thread scissors can be moved by a distance Y2 in synchronization with the operation of the cloth feed motor (see the above-mentioned feed mechanism 21), in other words, substantially at the same speed as the cloth feed speed. As a result of this, the lever 84 is swung through the rotary shaft 82 and rolling joint 83 to thereby move forward the upper thread scissors to the separation position. After the pulse motor 80 stops, the cloth hold body is continuously moved by the cloth feed motor and, therefore, similarly to the conventional structure, the upper thread releases the upper thread end.

After then, at a given timing, the upper thread scissors are moved by the pulse motor to the return position which is located laterally of the needle vertical path, while the upper thread scissors remain latched in the opened state. Also, on completion of the sewing cycle, similarly to the conventional structure, the upper thread scissors are moved due to the presser lifting and thread cutting operation in such a manner that the scissors cross the needle thread path, with the result that the upper thread scissors are able to cut and hold the thread.

In this manner, by changing the distance Y2 (separation distance) for which the upper thread scissors are moved in synchronization with the operation of the cloth feed motor, the timing for opening the upper thread scissors (fixed blade 86 and movable blade 87) can be changed. Further, even if the cloth is moved by the cloth feed motor, the upper thread scissors move following the cloth, which makes it possible to weaken the tension of the thread in the range of the sewing start position to the scissors, thereby being able to loosen the thread.

Figure 34:
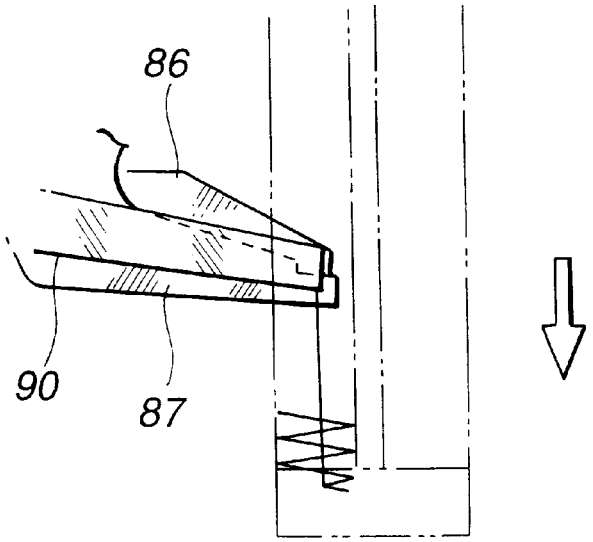
FIG. 34 is a plan view of the upper thread scissors, showing a state thereof in which it is moved in the same direction as the cloth feed direction while holding an upper thread.

Therefore, as shown in FIG. 34, since the upper thread scissors is moved in the same direction as the cloth feed direction to thereby be able not only to continue a state in which the upper thread scissors hold the upper thread between the movable blade 87 and thread hold spring 90, but also to weaken the tension of the upper thread, that is, loosen the upper thread.

This not only can improve the rising of the thread at the first stage of sewing of the parallel portion in the buttonhole darning operation but also allows the stitches at the first stage of sewing to be formed positively.

Alternatively, as shown in FIG. 119B, the timing, at which the pulse motor moves to the retreat position may be set as the time to start the operation of the sewing machine, and the movement of the pulse motor to the separation position may be controlled by a timer.

Second Embodiment

Figure 17:
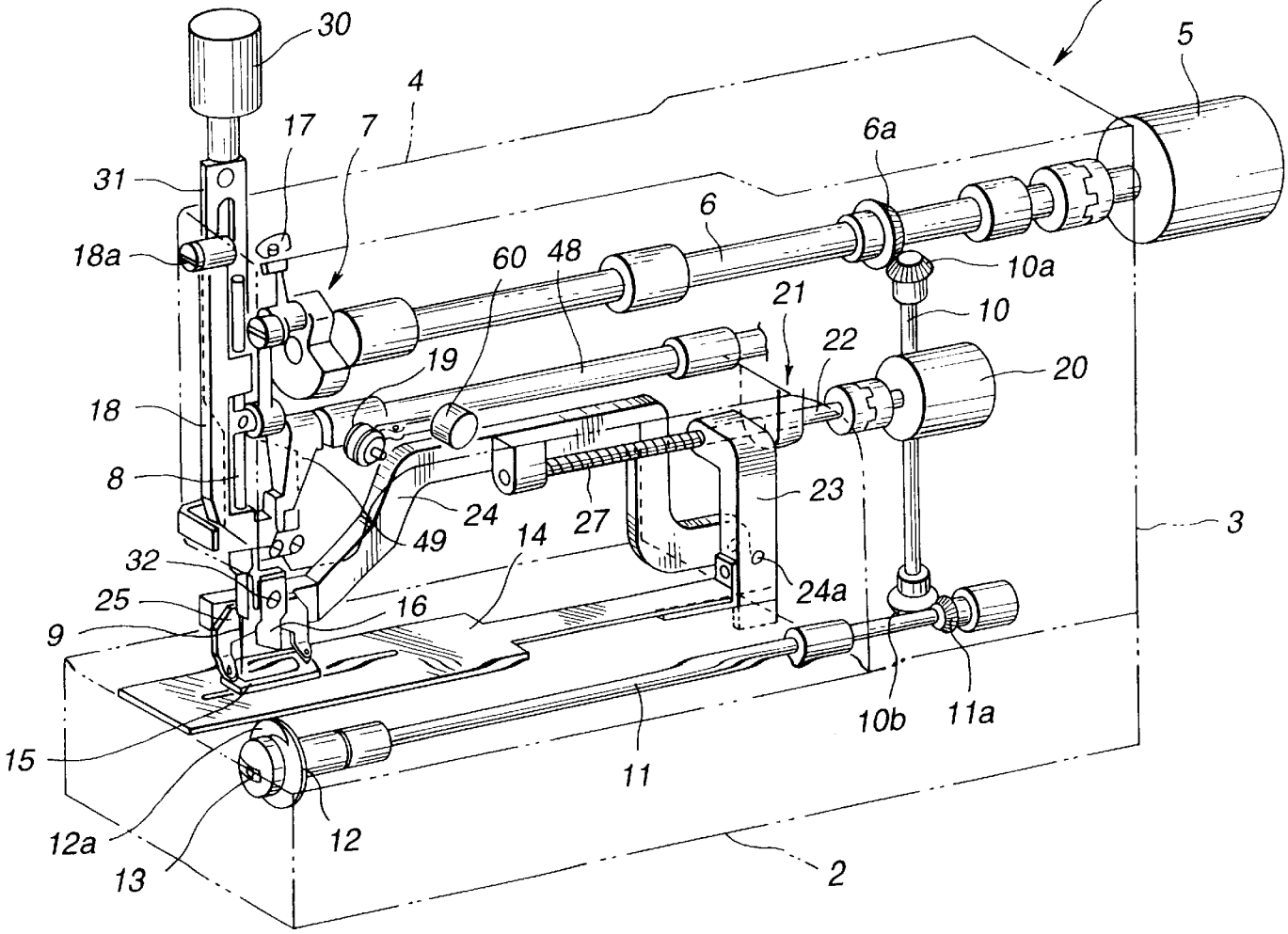
FIG. 17 is a schematic perspective view of a second embodiment of a buttonhole darning sewing machine according to the invention, showing the internal mechanism thereof similar to FIG. 2.

FIG. 17 shows a second embodiment of a feed mechanism and, in particular, FIG. 17, similarly to FIG. 2, is a general perspective view of the inner mechanism of the second embodiment.

In FIG. 17, like parts as in FIG. 2 are given the same designations and the description thereof is omitted. Here, description will be given below of the structures of only the parts that are different from those shown in FIG. 2.

That is, according to the second embodiment, as shown in FIG. 17, in the feed mechanism 21, the output shaft of a feed motor 20 with the axis thereof extending in the horizontal direction is connected directly with a feed shaft 22 which is formed coaxial with the feed motor 20 output shaft, there is formed a feed screw 27, and a bracket 23 is meshingly engaged with the feed screw 27 by means of a ball screw mechanism.

As described above, since the output shaft of the pulse motor (feed motor) 20 with the axis thereof extending in the horizontal direction is connected directly with the coaxial feed shaft 22 and the cloth hold arm 24 is meshingly engaged with the feed shaft 22 through the feed ball screw mechanism using the feed screw and ball, similarly to the previously described first embodiment, not only there can be obtained an effect which can be provided due to incorporation of the feed motor 20 within the vertical body portion 3, but also, while moving the feed shaft 22 in direct connection with the horizontally disposed pulse motor (feed motor) 20 linearly in the horizontal direction as the feed motor 20 is driven by the pulse motor 20, the cloth hold arm 24 can be moved in approaching and parting directions with respect to the vertical body portion 3 through the feed ball screw mechanism using the feed screw 27 and ball.

Third Embodiment

Figure 18:
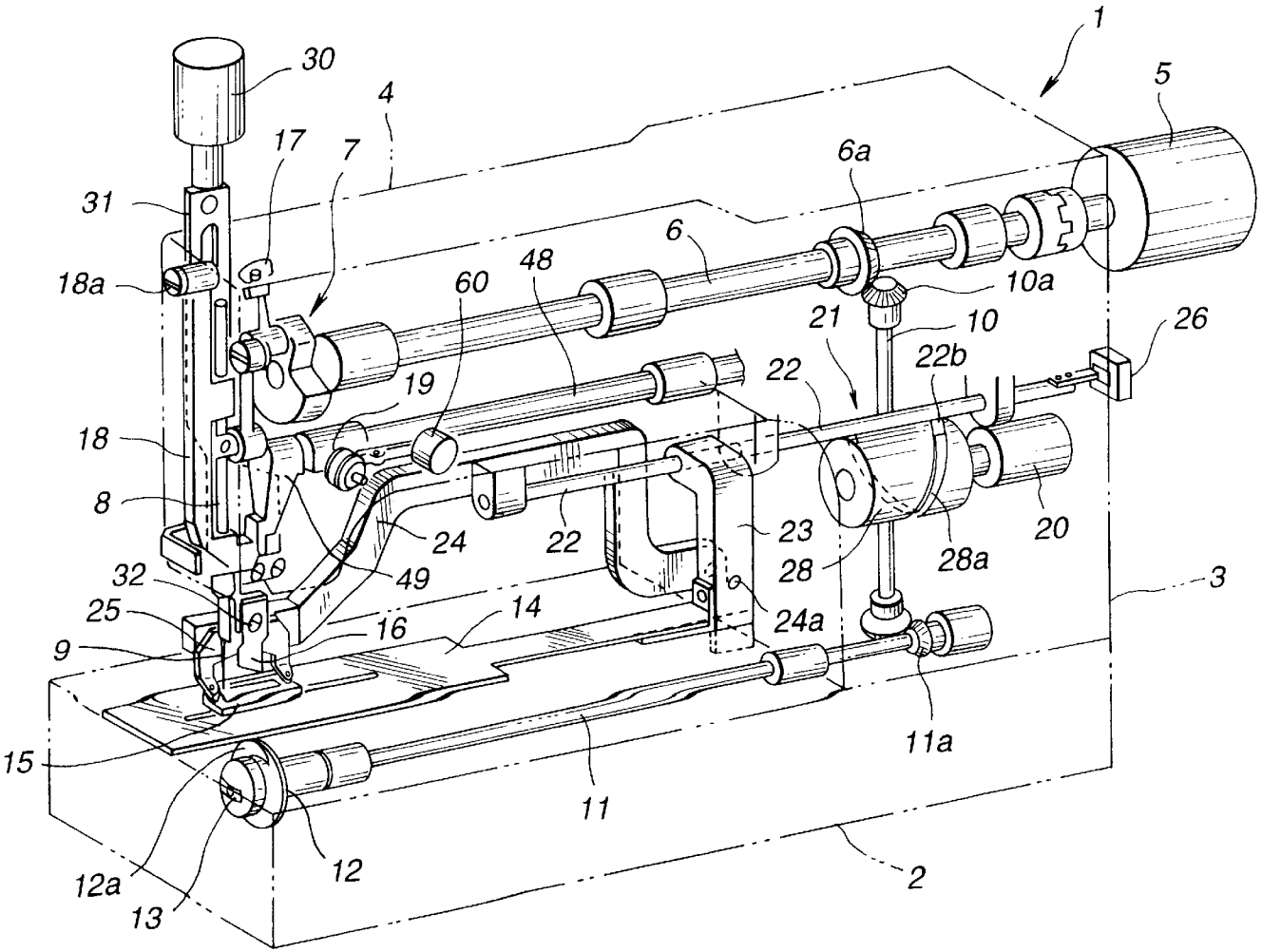
FIG. 18 is a schematic perspective view of a third embodiment of a buttonhole darning sewing machine according to the invention, showing the internal mechanism thereof similar to FIG. 2.

FIG. 18 shows a third embodiment of a feed mechanism and, in particular, FIG. 18, similarly to FIG. 2, is a general perspective view of the internal mechanism of the third embodiment.

In FIG. 18, like parts as in FIG. 2 are given the same designations and thus the description thereof is omitted. Here, description will be given below of the structures of only the parts that are different from those shown in FIG. 2.

That is, according to the third embodiment, as shown in FIG. 18, in the feed mechanism 21, a cylindrical-shaped groove cam 28 is fixed to the output shaft of a feed motor 20 with the axis thereof extending in the horizontal direction, and an engaging pin 22*b* provided on and projected from the outer periphery of the feed shaft 22 is engaged with a cam groove 28*a* which is formed along the outer periphery of the cylindrical-shaped groove cam 28.

As described above, since the cam groove 28*a* formed in the cylindrical-shaped groove cam 28 on the output shaft of the feed motor 20 with the axis thereof extending in the horizontal direction is engaged with the engaging pin 22*b* provided on the feed shaft 22 having a horizontally extending axis, and the cloth hold arm 24 is fixed to the feed shaft 22, similarly to the previously described first embodiment, not only there can be obtained an effect which can be provided due to incorporation of the feed motor 20 within the vertical body portion 3, but also, the feed shaft 22 can be moved linearly in the horizontal direction through the feed cam mechanism comprising the circumferential groove cam 28 and engaging pin 22*b* while the feed shaft 22 is driven by the pulse motor (feed motor) 20 which is so disposed as to extend in the horizontal direction, so that the cloth hold arm 24 can be moved in approaching and parting directions with respect to the vertical body portion 3.

Fourth Embodiment

Figure 19:
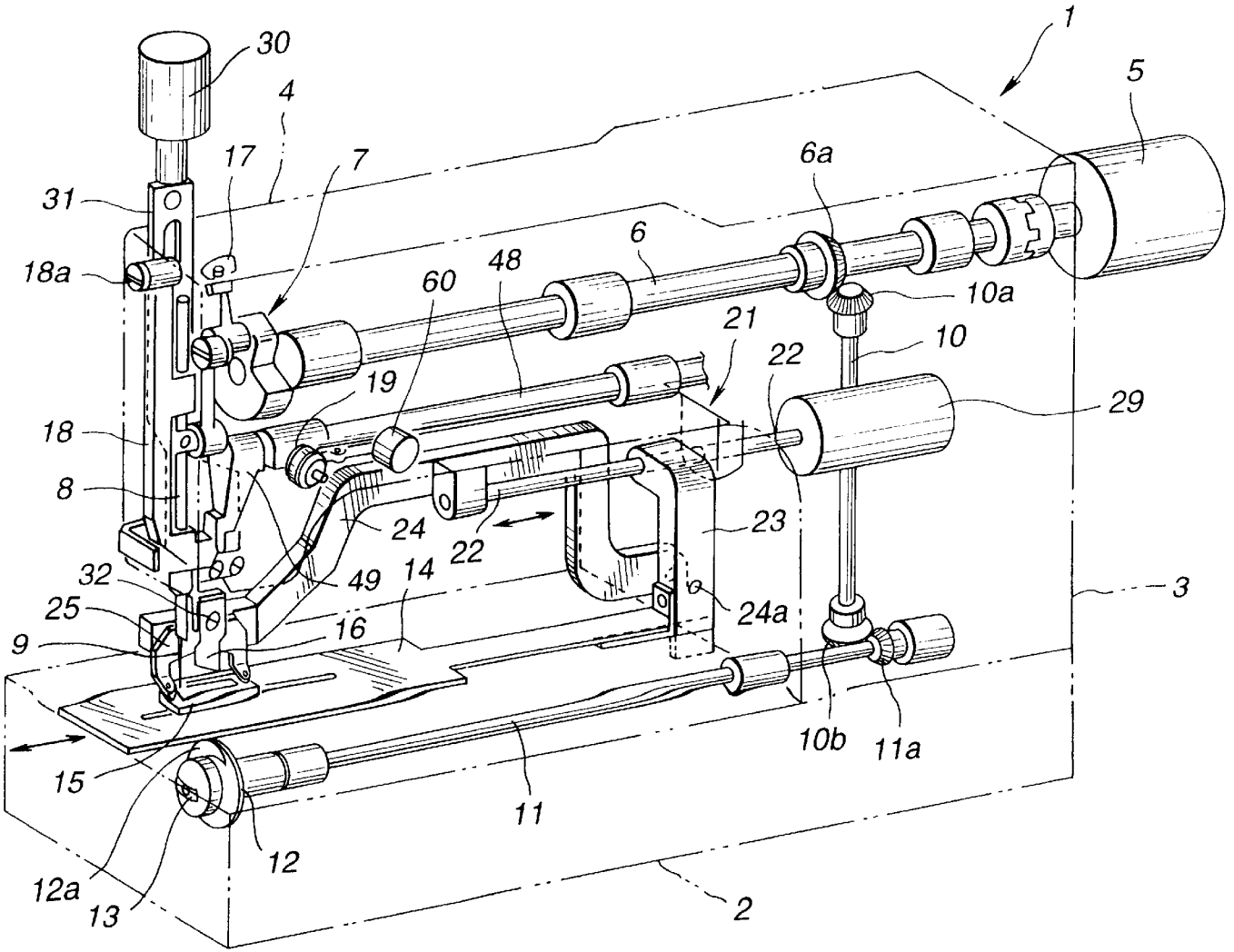
FIG. 19 is a schematic perspective view of a fourth embodiment of a buttonhole darning sewing machine according to the invention, showing the internal mechanism thereof similar to FIG. 2.

FIG. 19 shows a fourth embodiment of the feed mechanism and, in particular, FIG. 19, similarly to FIG. 2, is a general perspective view of the internal mechanism of the fourth embodiment.

In FIG. 19, like parts as in FIG. 2 are given the same designations and thus the description thereof is omitted. Here, description will be given below of the structures of only the parts that are different from those shown in FIG. 2.

That is, according to the fourth embodiment, as shown in FIG. 18, in the feed mechanism 21, instead of the feed motor 20 comprising a pulse motor, there is employed a feed motor 29 comprising a linear stepping motor which includes an output shaft with the axis extending in the horizontal direction and drives the output shaft to advance and retreat, and the feed shaft 22 is connected with the output shaft of the feed motor 29 comprising such linear stepping motor.

As described above, since the advancing and retreating output shaft of the linear stepping motor (feed motor) 20 with the axis thereof extending in the horizontal direction is connected directly with the feed shaft 22 which is formed coaxial with the motor 20 output shaft, and the cloth hold arm 24 is fixed to the feed shaft 22, similarly to the previously described first embodiment, not only there can be obtained an effect which can be provided due to incorporation of the feed motor 20 within the vertical body portion 3, but also, if driven by the horizontally-disposed linear stepping motor (feed motor) 20, the feed shaft 22 in direct connection with the stepping motor 20 can be moved linearly in the horizontal direction so that the cloth hold arm 24 can be moved in approaching and parting directions with respect to the vertical body portion 3.

Fifth Embodiment

Figure 20:
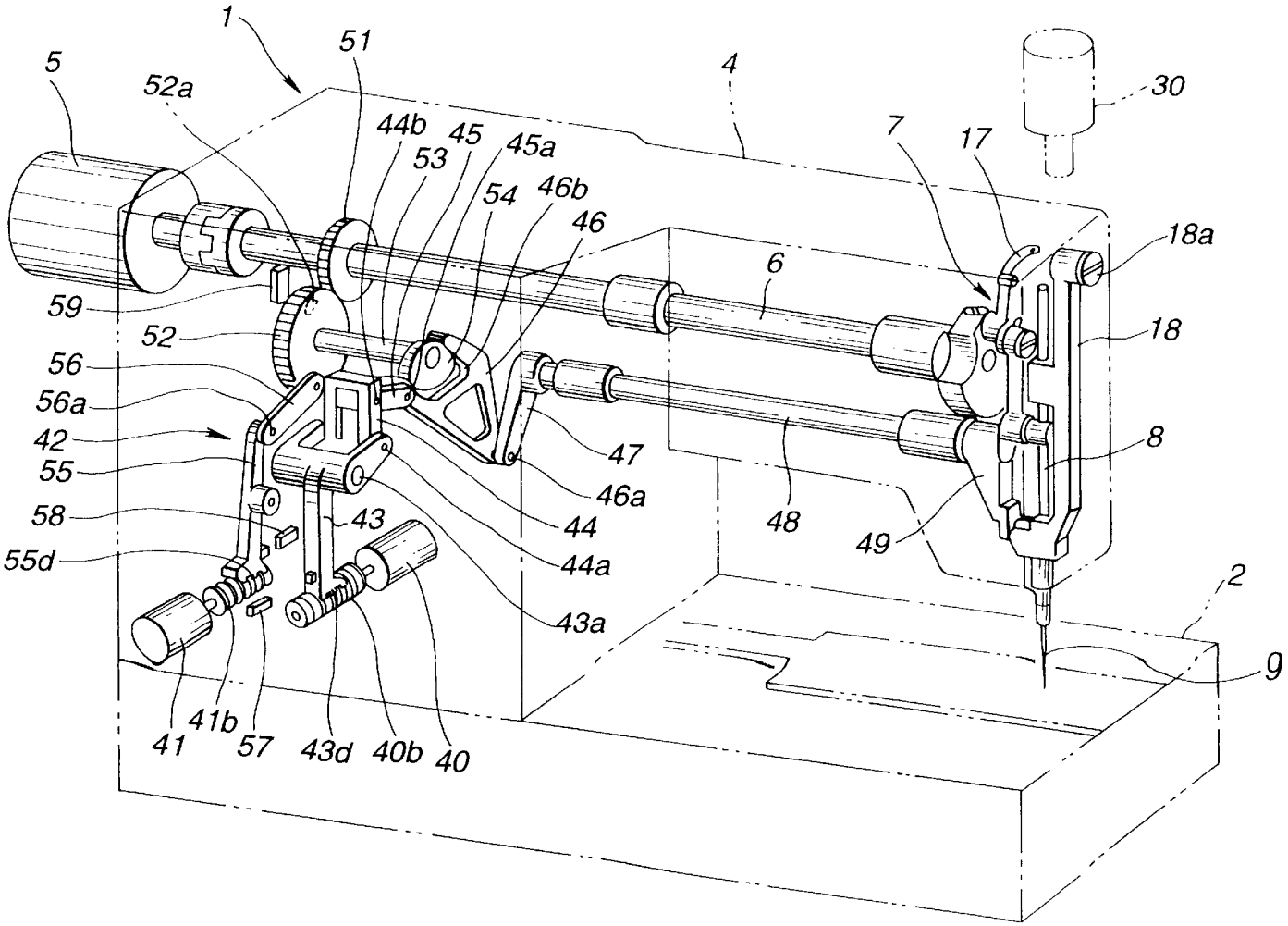
FIG. 20 is a schematic perspective view of a fifth embodiment of a buttonhole darning sewing machine according to the invention, that is, as another embodiment of the needle swing mechanism, showing the internal mechanism thereof similar to FIG. 3.

FIG. 20 shows another embodiment of the needle swing mechanism, that is, a fifth embodiment according to the invention; and, similarly to FIG. 3, FIG. 2 is a schematic perspective view of an internal mechanism of the present needle swing mechanism.

In FIG. 20, like parts as in FIG. 3 are given the same designations and thus the description thereof is omitted. Here, description will be given below of the structures of only the parts that are different from those shown in FIG. 3.

That is, according to the fifth embodiment, as shown in FIG. 20, in a needle swing mechanism 42, there are used a base line motor 40 and a swing width motor 41 respectively having axes which intersect the upper shaft 6 at right angles and extend in the horizontal direction, there are formed worms 40*b* and 41*b* respectively on the respective output shafts of the base line motor 40 and swing width motor 41, a sector gear 43*d* formed in the lower end portion of a base line arm 43 is in meshing engagement with the worm 40*b* of the base line motor 40, and a sector gear 55*d* formed in the lower end portion of a swing width arm 55 is in meshing engagement with the worm 41*b* of the swing width motor 41.

In this manner, in the buttonhole darning sewing machine, since the base line motor 40 and swing width motor 41, which respectively consist of pulse motors, are both stored within the vertical body portion 3 with their axes arranged in parallel to the upper surface of the bed 2, similarly to the previously described first embodiment, not only the space within the vertical body portion 3 can be used effectively but also the number of parts to be mounted on the outside portion of the sewing machine frame 1 can be reduced to thereby make neat the appearance of the sewing machine frame 1.

Sixth Embodiment

Figure 21:
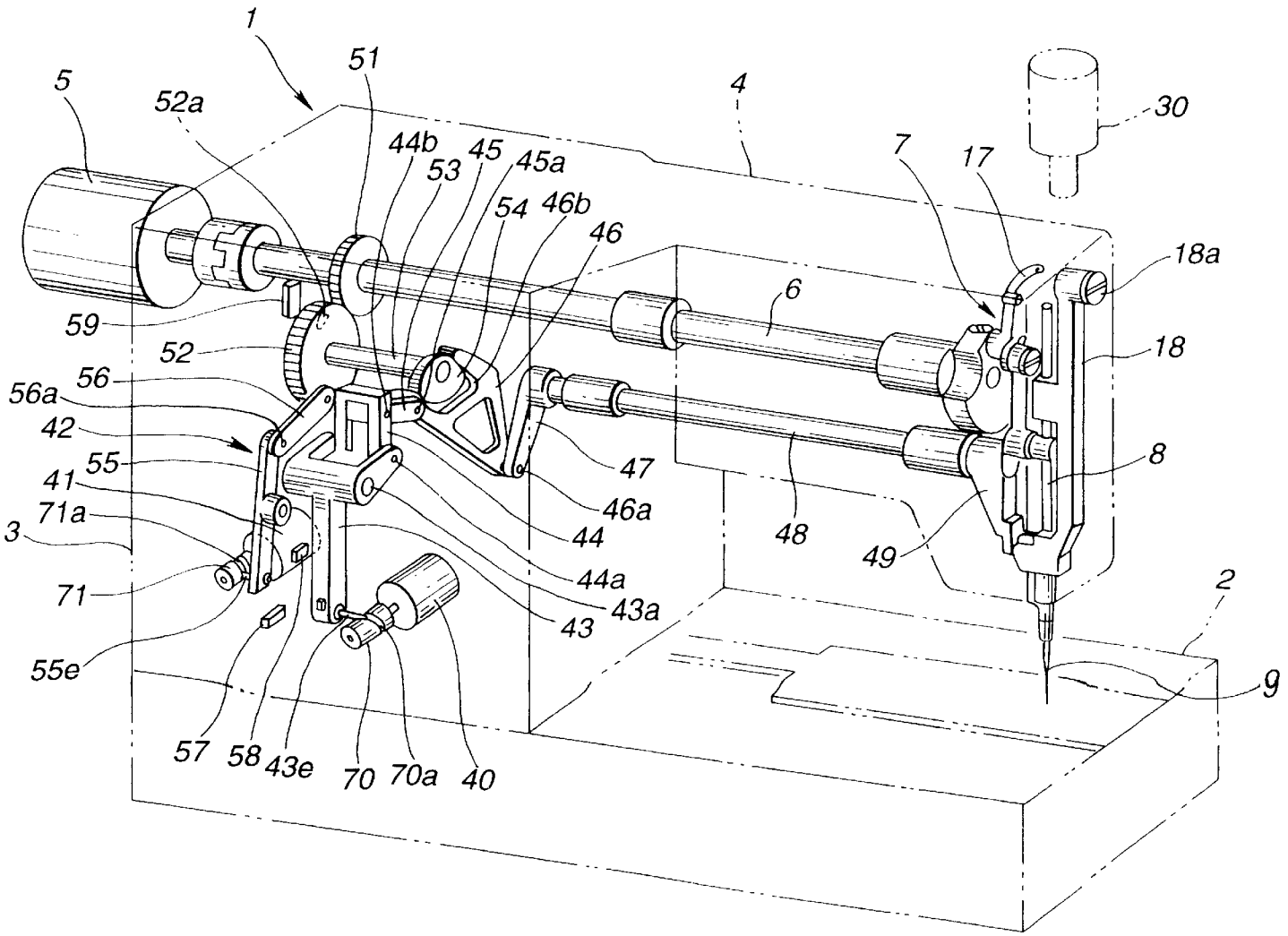
FIG. 21 is a schematic perspective view of a sixth embodiment of a buttonhole darning sewing machine according to the invention, showing the internal mechanism thereof similar to FIG. 3.

FIG. 21 shows another embodiment of the needle swing mechanism, that is, a sixth embodiment according to the invention; and, similarly to FIG. 3, FIG. 20 is a schematic perspective view of an internal mechanism of the present needle swing mechanism.

In FIG. 21, like parts as in FIG. 3 are given the same designations and thus the description thereof is omitted. Here, description will be given below of the structures of only the parts that are different from those shown in FIG. 3.

That is, according to the sixth embodiment, as shown in FIG. 21, in the needle swing mechanism 42, there are used a base line motor 40 and a swing width motor 41 respectively having axes which intersect the upper shaft 6 at right angles and extend in the horizontal direction, while cylindrical-shaped groove cams 70 and 71 are respectively connected to the output shafts of the base line motor 40 and swing width motor 41. And, an engaging pin 43*e* provided in the lower end portion of the base line arm 43 is engaged with a cam groove 70*a* formed in the outer periphery of the groove cam 70 of the base line motor 40, while an engaging pin 55*e* provided in the lower end portion of the swing width arm 55 is engaged with a cam groove 71*a* formed in the outer periphery of the groove cam 71 of the swing width motor 41.

In this manner, in the buttonhole darning sewing machine, since the base line motor 40 and swing width motor 41, which respectively consist of pulse motors, are both stored within the vertical body portion 3 with their axes arranged in parallel to the upper surface of the bed 2, similarly to the previously described first embodiment, not only the space within the vertical body portion 3 can be used effectively but also the number of parts to be mounted on the outside portion of the sewing machine frame 1 can be reduced to thereby make neat the appearance of the sewing machine frame 1.

Seventh Embodiment

Figure 22:
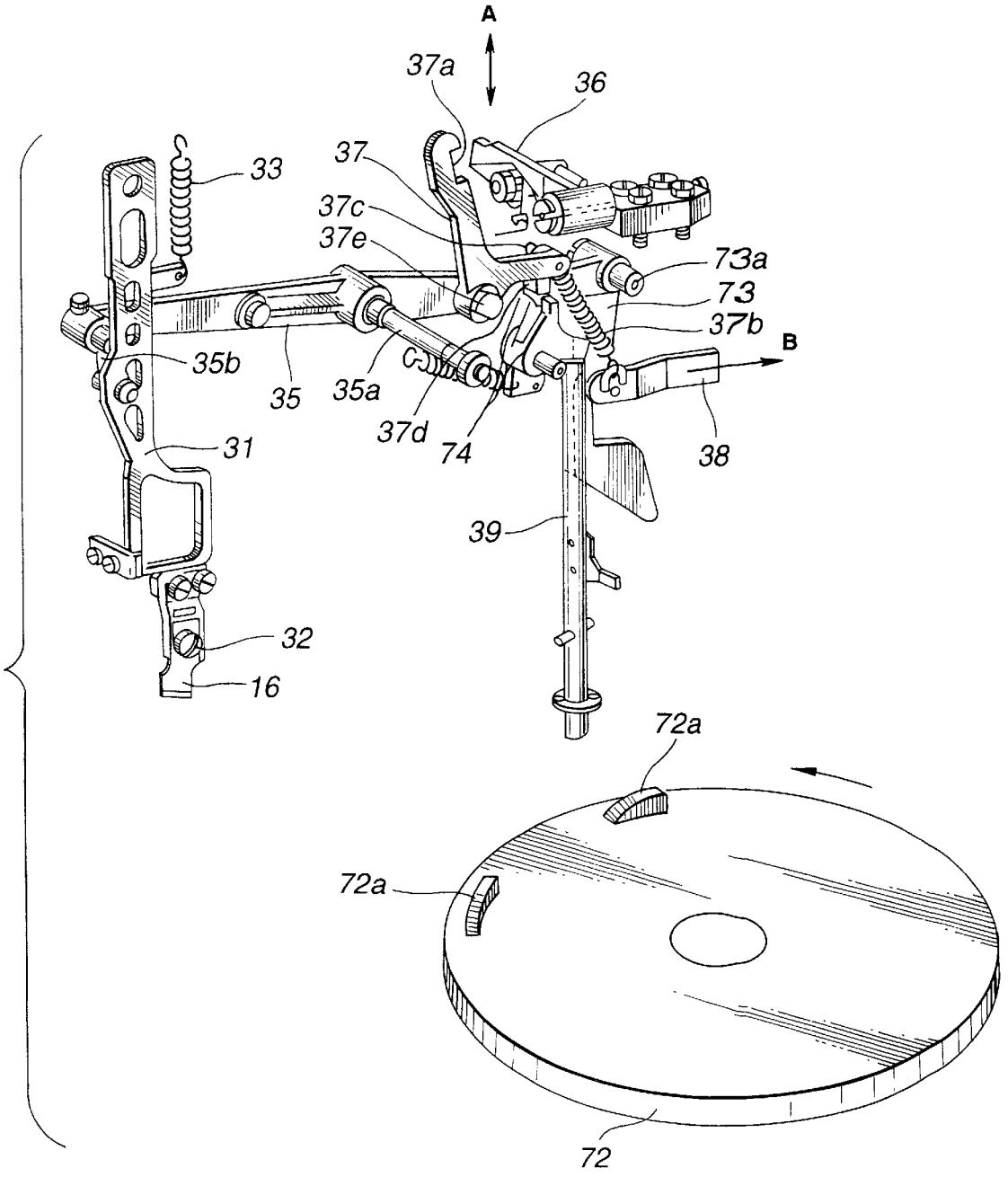
FIG. 22 shows a seventh embodiment of a buttonhole darning sewing machine according to the invention; in particular

FIG. 22 shows another embodiment of the cloth cuffing knife drive mechanism, which is a seventh embodiment of the invention; and, FIG. 22 is a perspective view of the present cloth cutting knife drive mechanism in which a cloth cutting knife is moved upward and downward by a mechanical drive mechanism and which, in particular, uses a mechanism disclosed in Japanese Patent Publication No. 7-14438 of Heisei.

In FIG. 22, like parts as in FIG. 13 are given the same designations and thus the description thereof is omitted. Here, description will be given below of the structures of only the parts that are different from those shown in FIG. 13.

That is, according to the seventh embodiment, as shown in FIG. 22, a knife mounting plate 31 having a cloth cutting knife 16 is connected through a link 35*b* to one end portion of a drive lever 35 journaled on a shaft 35*a*, whereas a drive hook 37 to be engaged with a knife drive arm 36 is rotatably supported on the other end portion of the drive lever 35. The knife drive arm 36 can be moved upward and downward, that is, in directions shown by an arrow A in FIG. 22 in linking with the upper shaft 6. on the other hand, the knife drive hook 37 includes in the upper end portion thereof an engaging recessed portion 37*a* to be engaged with the knife drive arm 36 and, nominally, it is energized and rotated clockwise by a spring 37*b*.

And, below the above-mentioned knife drive arm 36 and drive hook 37, there are disposed a start rod 38 and a push rod 39. The start rod 38 can be moved in a direction shown by an arrow B in FIG. 22 in linking with a start frame (not shown) provided in the sewing machine. On the other hand, the push rod 39, within the above-mentioned bed 2, can be moved upward and downward due to its engagement with a notch 72*a* formed on a main cam 72 which can be rotated in linking with the upper shaft 6.

Also, upwardly of the start rod 38, there is disposed a start arm 73. This start arm 73, when started, can be moved in the arrow B direction by the start rod 38 and, when the sewing machine is stopped, can be moved in the reversed direction into engagement with a pin 37*c* provided in the knife drive hook 37, thereby preventing the knife drive hook 37 against rotation.

Further, upwardly of the push rod 39, there is disposed an operation cam mechanism 74. The operation cam mechanism 74, in linking with the vertical movement of the push rod 39, rotates the drive hook 37 about a shaft 37*e* which is a connecting point between the drive lever 35 and drive hook 37.

According to the above-mentioned cloth cutting knife drive mechanism, if the sewing machine is driven, then the start rod 38 in linking with the start frame (not shown) is moved in the arrow B direction and thus the start arm 73 is rotated counterclockwise about the shaft 37*a*, so that the start arm 73 is removed from the engagement with the pin 37*c* of the knife drive hook 37. In response to this, a projecting portion 37*d* of the knife drive hook 37 is engaged with the operation cam mechanism 74 and, due to the operation of the operation cam mechanism 74, the knife drive hook 37 is set into its rotation allowable state. In this rotatable state, the buttonhole darning operation progresses and, in the process thereof, the push rod 39 moves in the vertical direction due to its engagement with the notch 72*a* on the main cam 72 which rotates in linking with the upper shaft 6.

And, due to the operation of the operation cam mechanism 74, the knife drive hook 37 is rotated clockwise about the shaft 37*e* by the rotational energizing force of the spring 37*b*, so that the engaging recessed portion 37*a* of the knife drive hook 37 is engaged with the vertically moving leading end of the knife drive arm 36.

That is, since the drive lever 35 is caused to swing about the shaft 35*a*, the cloth cutting knife 16 is moved upward and downward at a given timing to thereby cut a given portion of the cloth and form a buttonhole, which ends the buttonhole darning operation.

Eighth Embodiment

Figure 23:
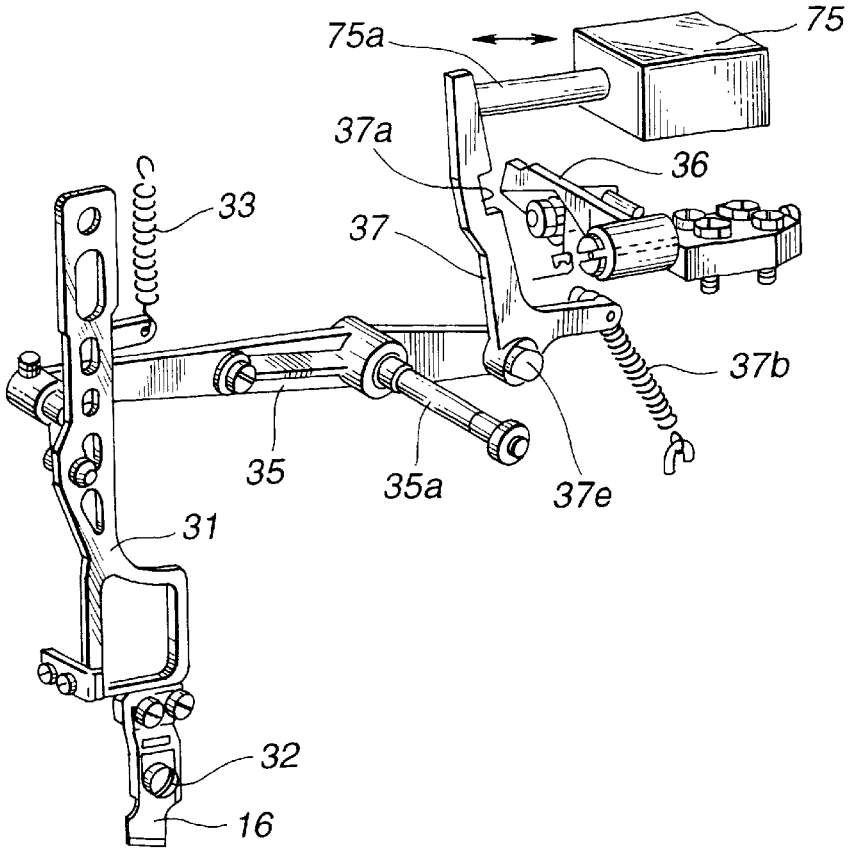
FIG. 23 shows an eighth embodiment of a buttonhole darning sewing machine according to the invention; in particular

FIG. 23 shows still another embodiment of the cloth cutting knife drive mechanism, which is an eighth embodiment of the invention; and, FIG. 23 is a perspective view of a drive system for driving a cloth cutting knife.

In FIG. 23, like parts as in FIG. 13 are given the same designations and thus the description thereof is omitted. Here, description will be given below of the structures of only the parts that are different from those shown in FIG. 13.

That is, according to the eighth embodiment, as shown in FIG. 23, a knife mounting plate 31 having a cloth cutting knife 16 is disposed in one end portion of a drive lever 35 journaled on a shaft 35*a*, whereas a drive hook 37 to be engaged with a knife drive arm 36 is disposed on the other end portion of the drive lever 35. The knife drive arm 36 can be moved upward and downward in linking with the upper shaft 6. on the other hand, the knife drive hook 37 includes in the middle portion thereof an engaging recessed portion 37*a* to be engaged with the knife drive arm 36 and, normally, it is energized and rotated clockwise by a spring 37*b*.

And, laterally of the upper end portion of the knife drive hook 37, there is disposed a solenoid 75. The solenoid 75 is structured such that it can bring its plunger 75*a* into contact with the upper end portion of the knife drive hook 37 to thereby separate the engaging recessed portion 37*a* from the knife drive arm 36 against the rotational energizing force of the spring 37*b*.

Therefore, if the plunger 75*a* of the solenoid 75 is caused to retreat, then the knife drive hook 37 is rotated clockwise about the shaft 37*e* by the rotational energizing force of the spring 37*b*, so that the engaging recessed portion 37*a* can be engaged with the vertically moving leading end of the knife drive arm 36.

Instead of the solenoid 75, an air cylinder unit can also be used.

Ninth Embodiment

Figure 24:
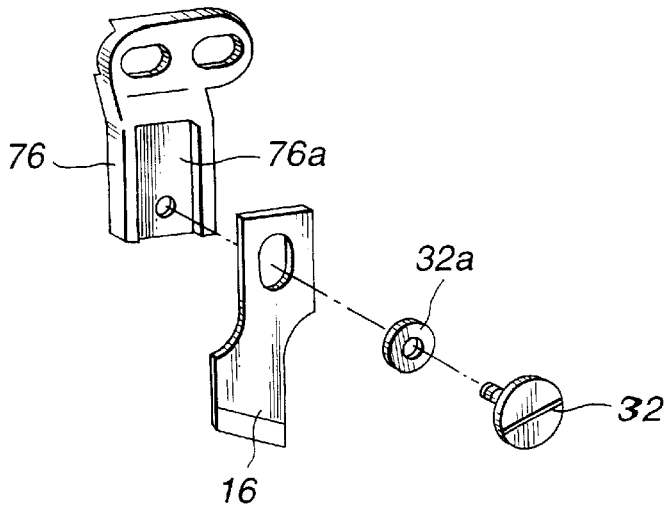
FIG. 24 is an exploded perspective view of a general example of a cloth cutting knife mounting structure.

FIG. 24 is an exploded perspective view of a general example of a cloth cutting knife mounting structure. In general, as shown in FIG. 24, the cloth cutting knife 16 is mounted into a mounting recessed portion 76*a*, which is formed in a knife mounting piece 76 to be screwed to the lower end portion of the above-mentioned knife mounting plate 31, by a set screw 32 through a washer 32*a*.

In the ninth embodiment, in order to prevent the possibility that a knife different in size from an exclusive cloth cutting knife can be mounted, there is provided a judge portion which functions as select means.

Figure 25:
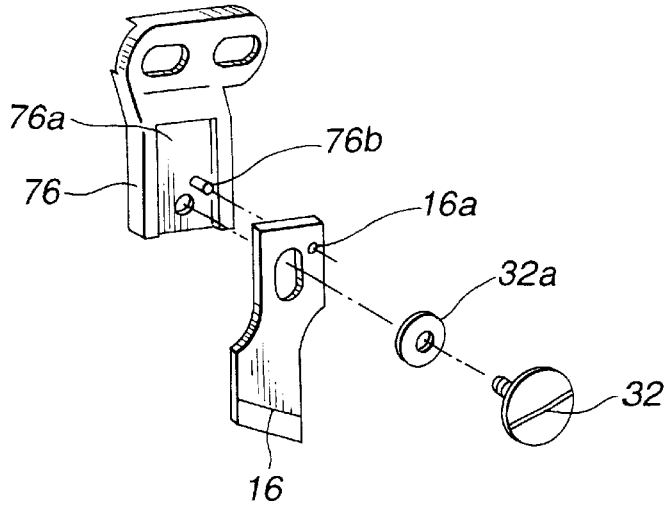
FIG. 25 shows a ninth embodiment of a buttonhole darning sewing machine according to the invention; in particular

That is, as shown in FIG. 25, in the mounting recessed portion 76*a* of the knife mounting piece 76, there is provided a small projection 76*b* for judgment and, in the exclusive cloth cutting knife 16, in particular, at the position thereof corresponding to the small projection 76*b*, there is formed a small hole 16*a* for judgment.

Figure 26:
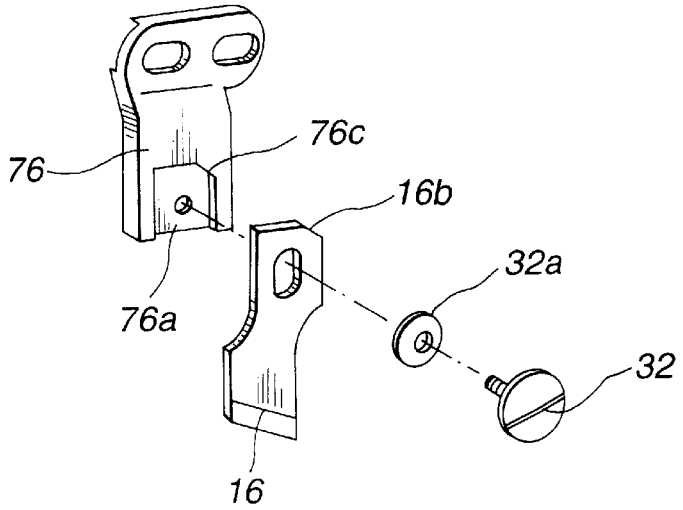
FIG. 26 is an exploded perspective view of the structure of a judgment portion, in which the structure shown in FIG. 25 is modified in part.

Or, as shown in FIG. 26, in the comer portion of the mounting recessed portion 76*a* of the knife mounting piece 76, there is formed an inclined portion 76*c* for judgment and, in the exclusive cloth cutting knife 16, in particular, in the comer portion thereof that corresponds to the inclined portion 76*c*, there is formed a cut-away portion 16*b*.

Tenth Embodiment

Figures 27A, 27B, 27C:
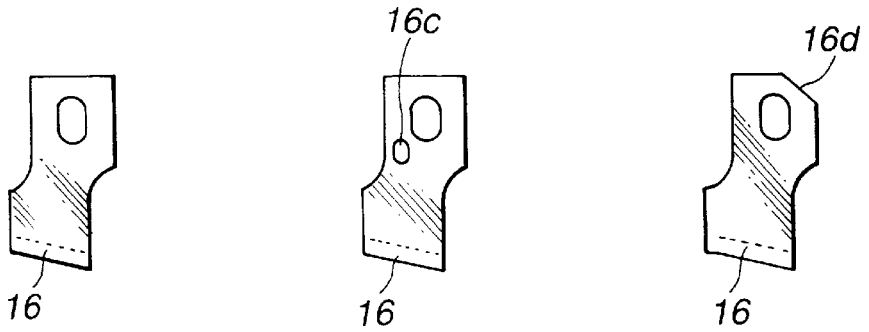
FIG. 27(*a*) is a view of an ordinary cloth cutting knife.

FIG. 27 shows an example of the shape of the cloth cutting knife. In this embodiment, in place of the normal cloth cutting knife 16 (FIG. 27(*a*)), as shown in FIG. 27(*b*), there is used an exclusive cloth cutting knife 16 having a switch escape hole 16*c*, or, as shown in FIG. 27(*c*), there is used an exclusive cloth cutting knife 16 including a cut-away portion 16*d* in the corner portion thereof.

Figure 28A:
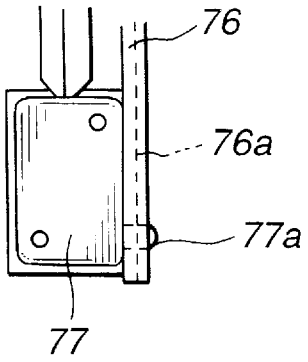
FIGS. 28(*a*) and 28(*b*) show a judgment portion mounting thereon a judging switch including a push switch portion corresponding to an escape hole; in particular FIG. 28(*a*) is a side view thereof, and FIG. 28(*b*) is a front view thereof.
Figure 28B:
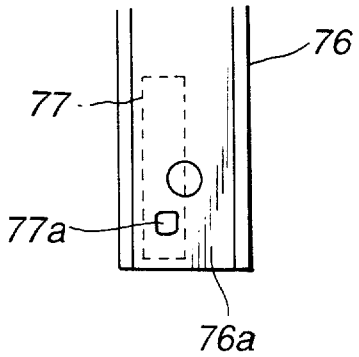

And, as shown in FIG. 27(*b*), when there is used the exclusive cloth cutting knife 16 having a switch escape hole 16*c*, as shown in FIGS. 28(*a*) and (*b*), a judgment switch 77 is mounted on the back surface of the knife mounting piece 76, while a push switch portion 77*a* of the judgment switch 77 is exposed to a position which corresponds to the switch escape hole 16*c* of the mounting recessed portion 76*a*.

Figure 29A:
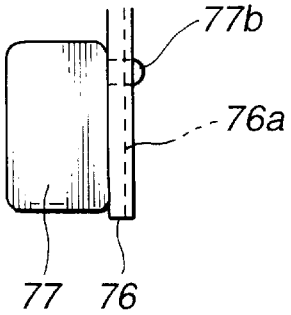
FIGS. 29(*a*) and 29(*b*) show a judgment portion mounting thereon a judging switch including a push switch portion corresponding to a cut-away hole; in particular FIG. 29(*a*) is a side view thereof, and FIG. 29(*b*) is a front view thereof.
Figure 29B:
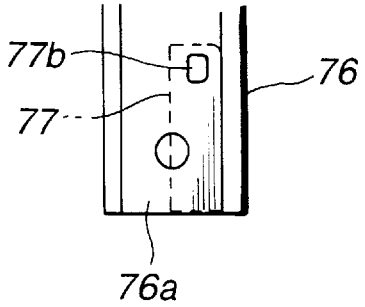

Also, as shown in FIG. 27(*c*), when there is used the exclusive cloth cutting knife 16 including the cut-away portion 16*d*, as shown in FIGS. 29(*a*) and (*b*), the push switch portion 77*a* of the judgment switch 77 mounted on the back surface of the knife mounting piece 76 is exposed to a position which corresponds to the cut-away portion 16*d* of the exclusive cloth cutting knife 16.

The above-mentioned judgment portion and judgment switch 77 also function as the select means.

Eleventh Embodiment

Figure 30:
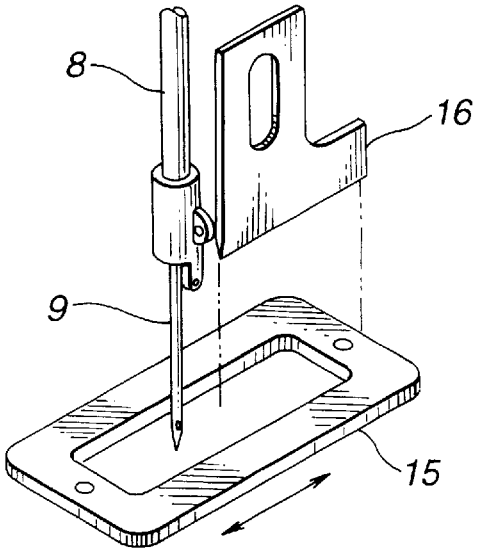
FIG. 30 is a perspective view of a cloth presser and a cloth cutting knife, showing the relation between them.

FIG. 30 shows an example of the relation between the cloth presser and cloth cutting knife. As shown in FIG. 30, for example, when there is set a cloth presser 15 having a size smaller than that of the cloth cutting knife 16, the cloth cutting knife 16 touches the cloth presser 15.

In view of this, according to the eleventh embodiment, there is provided a judgment portion for judging the size of the cloth presser 15.

Figure 31:
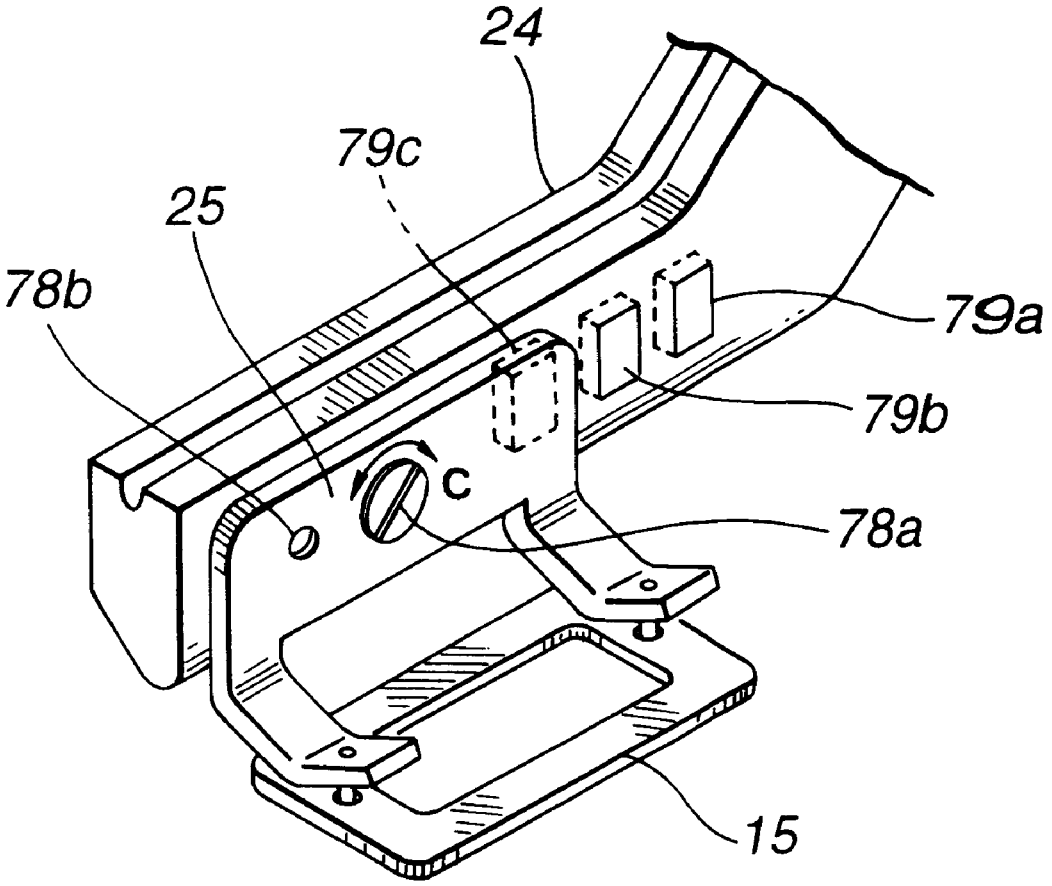
FIG. 31 shows an eleventh embodiment according to the invention; in particular

As shown in FIG. 31, a forked mounting piece 25 supporting the cloth presser 15 is supported on the leading end portion of the cloth hold arm 24 of the above-mentioned feed mechanism 21 by a stepped screw 78*a* and a support spring (coil spring) 78*b* in such a manner that the mounting piece 25 can be swung in directions shown by an arrow C in FIG. 31.

And, on the leading end portion side of the cloth hold arm 24 on which the mounting piece 25 for the cloth presser 15, as shown in FIG. 31, for example, there are embedded a plurality of (in the illustrated embodiment, three) judgment sensors 79*a*, 79*b*, 79*c* each of an optical type in such a manner that they are arranged side by side.

Therefore, as shown in FIG. 31, for example, if a small-sized cloth presser 15 is mounted, then the judgment sensor 79*c* is covered with a mounting piece 25 for the present cloth presser 15, which can tell that the small-sized cloth presser 15 is mounted.

Also, although not shown, if a medium-sized cloth presser is mounted, then the two judgment sensors 79*b* and 79*c* are both covered with a mounting piece for the medium-sized cloth presser, which can tell that the medium-sized cloth presser is mounted. Further, if a largesized cloth presser is mounted, then the three judgment sensors 79*a*, 79*b* and 79*c* are all covered with a mounting piece for the large-sized cloth presser, which can tell that the large-sized cloth presser is mounted.

As the judgment portion for judging the size of the cloth presser 15, not only the judgment sensors 79*a*, 79*b* and 79*c* of an optical type but also a judgment switch of a push button type can be used. Also, the number of sensors or switches used depends on the need.

Now, based on the judgment results, a numerical value, which corresponds to the current cloth presser and is to be set in the column No. 15 in FIG. 39, is read out from a previously stored table (not shown) and is then set in the column No. 15 in FIG. 39.

Next, description will be given below of a control system.

Figure 35:
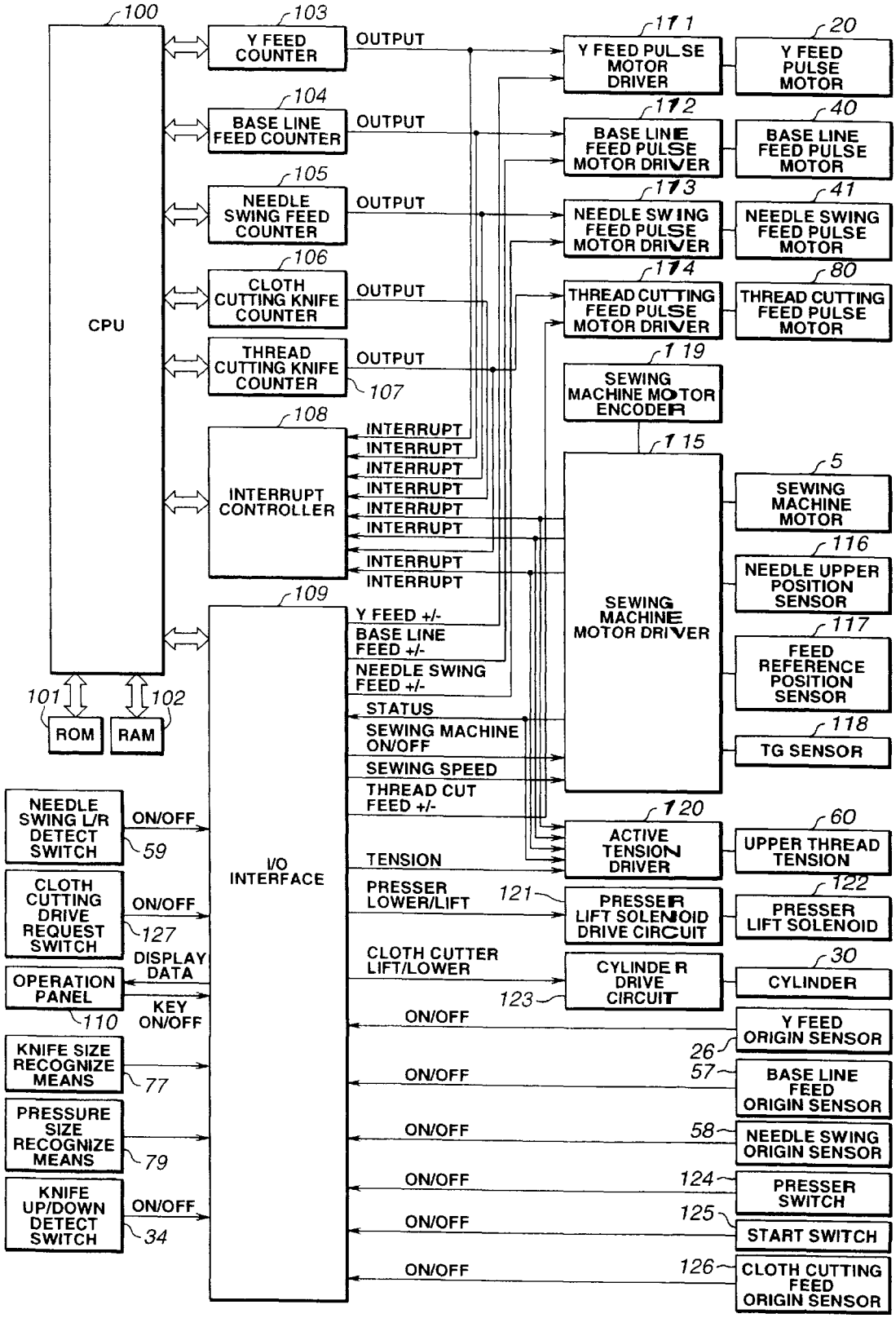
FIG. 35 is a block diagram of a control block used in a buttonhole darning sewing machine.

The above-structured buttonhole darning sewing machine is controlled according to a control block structure shown in FIG. 35.

That is, as shown in FIG. 35, to CPU TOO, there are connected through buses a ROM 101, a RAM 102, a Y feed counter 103, a base line feed counter 104, a needle swing feed counter 105, a cloth cutting knife counter 106, a thread cutting feed counter 107, an interrupt controller 108, and an I/O interface 109.

CPU 100 comprises various kinds of control portions and operation means: that is, sewing machine control means; sewing machine drive speed decide means; means for correcting the change amounts of the base line and needle swing width; means for specifying the stitch forming sequence; sewing data read-out means; means for specifying the start of sewing; knife control means; knife vertical movement timing decide means including knife downward movement timing decide means; means for judging the interval of the timings of the upward and downward movements of the knife; side stitch length change means; needle drop control means; means for deciding a reference point for pattern enlargement and reduction; various drive control means; and the like.

In the ROM 101, there are stored programs and defaults for control; for example, there are stored memory portions which are respectively used to store therein a sewing mode, a tension hook matching mode, a thread passing mode, and the like.

In the RAM 102, there are stored various variables for control; for example, there are stored sewing data, base line/needle swing data, and the like.

Each of the Y feed counter 103, base line feed counter 104, needle swing feed counter 105, cloth cutting knife counter 106, and thread cutting feed counter 107 is structured such that, if a count value is written thereinto and a counter start command is written thereinto, then it outputs a count signal of one pulse after passage of the time proportional to the count value, and repeats its counter output at a given cycle until a counter stop command is written thereinto. The interrupt controller 108 is a controller which, if an interrupt signal is input, then allows the CPU 100 to execute an interrupt processing corresponding to the interrupt signal input. The I/O interface 109 is an interface through which the CPU 100 interfaces an external input/output device.

Also, the respective count outputs of the Y feed counter 103, base line feed counter 104, needle swing feed counter 105, cloth cutting knife counter 106, and thread cutting feed counter 107 are connected to the interrupt controller 108 and, in accordance with the count outputs of the respective counters, interrupt processings corresponding to the respective counters are executed.

Figure 36:
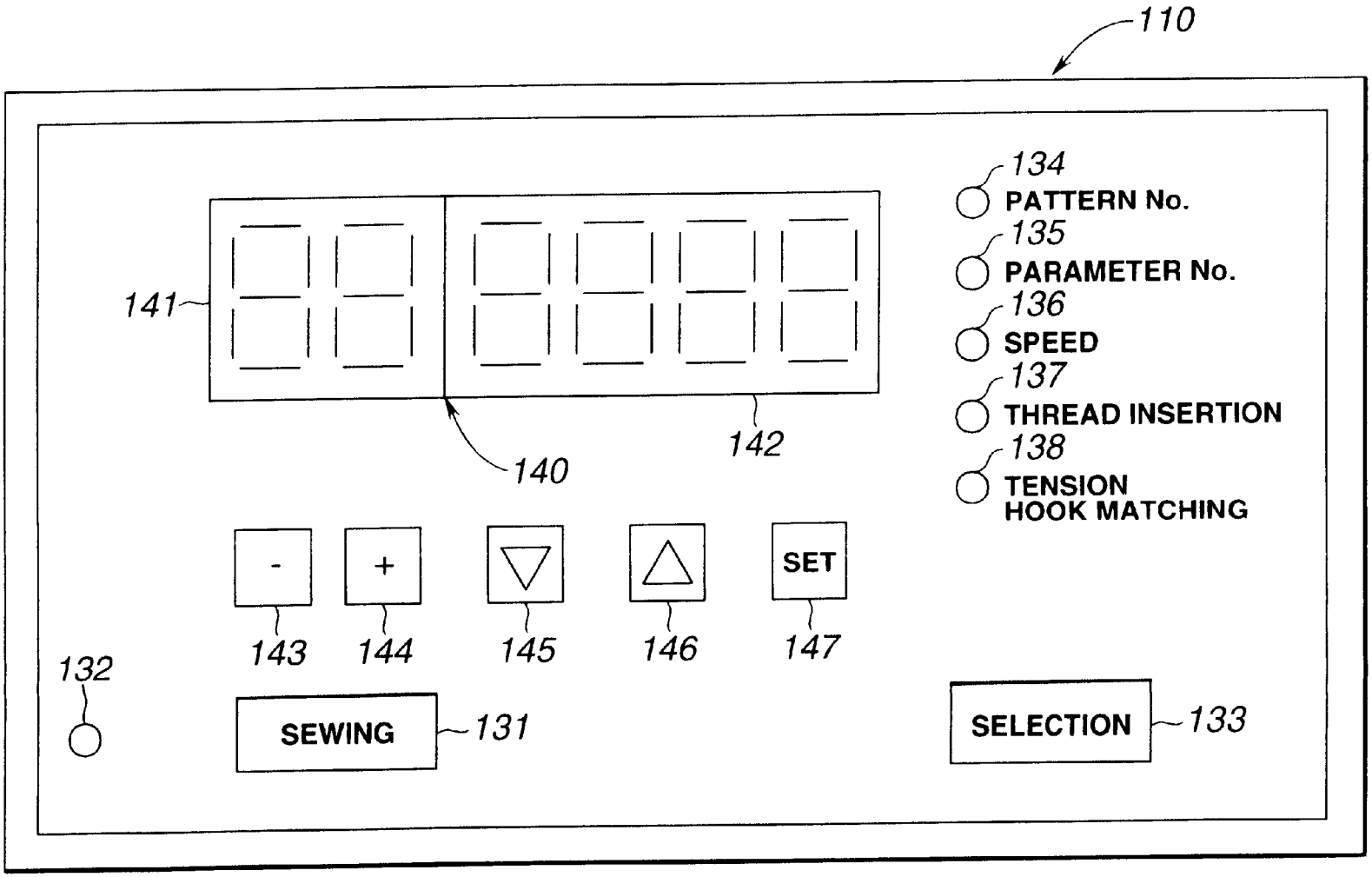
FIG. 36 is a front view of an operation panel.

And, in FIG. 35, an operation panel 110, as shown in FIG. 36, is composed of a display portion and various keys; that is, it is a panel through which an operator carries out various settings and operations necessary for sewing.

A Y feed pulse driver 111 is structured such that, when a Y feed counter output signal from the Y feed counter 103 and a Y feed direction +/− signal from the I/O interface 109 are input thereinto, then it rotates the Y feed pulse motor (that is, the above-mentioned feed motor) 20 by an amount equivalent to 1 pulse each counter output in accordance with +/− of the Y feed direction.

A base line feed pulse motor driver 112 is structured such that, when a base line feed counter output signal from the base line feed counter 104 and a base line feed direction +/signal from the I/O interface 109 are input thereinto, then it rotates the base line feed pulse motor (that is, the above-mentioned base line motor) 40 by an amount equivalent to 1 pulse each counter output in accordance with +/− of the base line feed direction.

A needle swing feed pulse motor driver 113 is structured such that, when a needle swing counter output signal from the needle swing feed counter 105 and a needle swing feed direction +/− signal from the I/O interface 109 are input thereinto, then it rotates the needle swing feed pulse motor (that is, the above-mentioned swing width motor) 41 by an amount equivalent to 1 pulse each counter output in accordance with +/− of the needle swing feed direction.

A thread cutting feed pulse motor driver 114 is structured such that, when a thread cutting feed counter signal from the thread cutting feed counter 107 and a thread cutting feed direction +/− signal from the I/O interface 109 are input thereinto, then it rotates the thread cutting feed pulse motor (that is, the above-mentioned pulse motor) 80 by an amount equivalent to 1 pulse each counter output in accordance with +/− of the thread cutting feed direction.

Also, the thread cutting feed pulse motor driver 114 outputs a signal from the thread cutting feed counter 107 to the interrupt controller 108 as a thread cutting feed counter interrupt.

A sewing machine motor driver 115 is structured such that, responsive to a sewing machine start/stop signal and a sewing machine speed signal from the I/O interface input thereinto, if the sewing machine is to be started, then it rotates the sewing machine motor 5 at a given number of rotations; whereas, if the sewing machine is to be stopped, based on the detection of a needle upper position sensor 116, it allows known constant position stop means to stop the sewing machine motor 5. Here, the needle upper position sensor 116 is used to detect the upper position of the above-mentioned needle bar 8. Also, the upper position detection output of the needle upper position sensor 116 is used as a needle number count input.

And, the sewing machine motor driver 115 outputs the stopping or rotating state of the sewing machine to the I/O interface 109 as a sewing machine status stopping or rotating signal, and also it outputs a signal from the needle upper position sensor 116 to the interrupt controller 108 as a needle upper position interrupt signal.

Further, the sewing machine motor driver 115 outputs signals from a feed reference position sensor 117 and a TG (Tacho-generator) generator 118 to the interrupt controller 108 respectively as a feed reference interrupt and a TG interrupt. The feed reference position sensor 117 is used to control the feed of the Y feed motor, base line feed motor, needle swing feed motor and the like. The TG generator 118 is a generator which generates a one-twenty-fourth square wave each rotation of the sewing machine motor.

A signal from a sewing machine motor encoder 119 is fed back to the sewing machine motor driver 115.

Now, an active tension driver 120, normally, in accordance with the data that is input thereinto from the RAM 102 through the I/O interface 109, controls the upper thread tension VCM (Voice Coil Motor, that is, the above-mentioned voice coil motor) 60 to thereby apply a tension; and, when the sewing machine status stopping/rotating signal, feed reference signal and TG signal are input thereinto from the sewing machine motor driver 115, that is, at given timings during the rotation of the sewing machine, it controls the upper thread tension VCM 60 to vary the tension thereof.

A presser lift solenoid drive circuit 121 drives a presser lift solenoid 122 in accordance with a presser down/up signal from the I/O interface 109.

A cloth cutting knife down cylinder drive circuit 123 drives a cloth cutting knife down cylinder (that is, the above-mentioned cloth cutting knife air cylinder unit) 30 in accordance with a cloth cutting down/up signal from the I/O interface 109.

A Y feed origin sensor shown in FIG. 35 is used to detect the origin position of the Y feed pulse motor 20, that is, this sensor is the above-mentioned feed origin detect sensor 26.

A base line feed origin sensor shown in FIG. 35 is used to detect the origin position of the base line feed pulse motor 40, that is, this sensor is the above-mentioned base line origin detect sensor 57.

A needle swing feed origin sensor shown in FIG. 35 is used to detect the origin position of the needle swing feed pulse motor 41, that is, this sensor is the above-mentioned swing width origin detect sensor 58.

A presser switch 124 is an operation switch through which an operator, in setting a workpiece, lifts and lowers the above-mentioned cloth presser 15 and thus the presser switch 124 is used in connection with an operation to depress the pedal of the sewing machine.

A start switch 125 is an operation switch through which an operator, in setting a workpiece, starts a sewing operation and thus this is also used in connection with the above-mentioned sewing machine pedal depressing operation.

A thread cutting feed origin sensor 126 is used to detect the moving origin position of the above-mentioned upper thread scissors. That is, in the upper thread scissors and the drive mechanism for driving the same which have been respectively discussed in connection with FIG. 32, for example, there is provided a thread cutting feed origin sensor 126 of a close approach type used to detect the origin position of the arm 81 which swings with the output shaft 80*a* of the pulse motor 80 as the fulcrum thereof; and, in the arm 81, there is provided a thread cutting feed origin detect magnet 126*a* which consists of the present thread cutting feed origin sensor 126.

Also, a needle swing right and left detect switch in FIG. 35 is the above-mentioned needle swing right and left position detect sensor 59.

A cloth cutting knife drive request switch 127 is used to lower and drive the above-mentioned cloth cutting knife 16.

A knife size recognize means in FIG. 35 is used to confirm whether the cloth cutting knife 16 of a proper size is mounted or not and, in particular, the present knife size recognize means is the above-mentioned judgment switch 77.

A presser size recognize means in FIG. 35 is used to confirm whether the above-mentioned cloth presser 15 of a proper size is mounted or not and, in particular, the present presser size recognize means is the above-mentioned judgment sensor 79 (79*a*, 79*b*, 79*c*).

A knife up/down detect switch in FIG. 35 consists of the above-mentioned cloth cutting knife up/down position sensors 34*a* and 34*b*.

And, the operation panel 110, as shown in FIG. 36, includes various keys and display portions.

That is, the operation panel 110 includes: a sewing key 131, and an LED display portion 132 which, when the sewing key 131 is depressed, is turned on to display that the sewing machine is set in a sewing mode; and, a select key 132, and LED display portions 134, 135, 136, 137, and 138 which, each time the select key 132 is depressed, are turned on sequentially to display the pattern No., parameter No., speed setting mode, thread insertion mode, tension hook matching mode.

The operation panel 110 further includes: a numeric value display portion 140 which is composed of a pattern display portion 141 comprising a two-digit LED segment, and a parameter display portion 142 comprising a four-digit LED segment; a minus key 143 and a plus key 144 respectively for decreasing or increasing the numeric value of the numeric value display portion 140 by +; a down key 145 and an up key 146 respectively for decreasing or increasing the numeric value of the numeric value display portion 140 each given unit; and, a set key 147 which is used as a thread insertion key or a tension hook matching key. Further, although not shown, in the operation panel 110, there is provided a switch which is used to select the above-mentioned right-handed or left-handed sewing of the buttonhole darning operation.

By the way, the operation panel 110, which includes the above-mentioned various keys, further has functions respectively serving as buttonhole/knife blade length setting means, buttonhole formation width direction position setting means, means for setting the interval between the lock stitch sewing portion and buttonhole end portion, pattern enlargement/reduction setting means, constant stitch number/pitch setting means, and the like.

Figure 37:
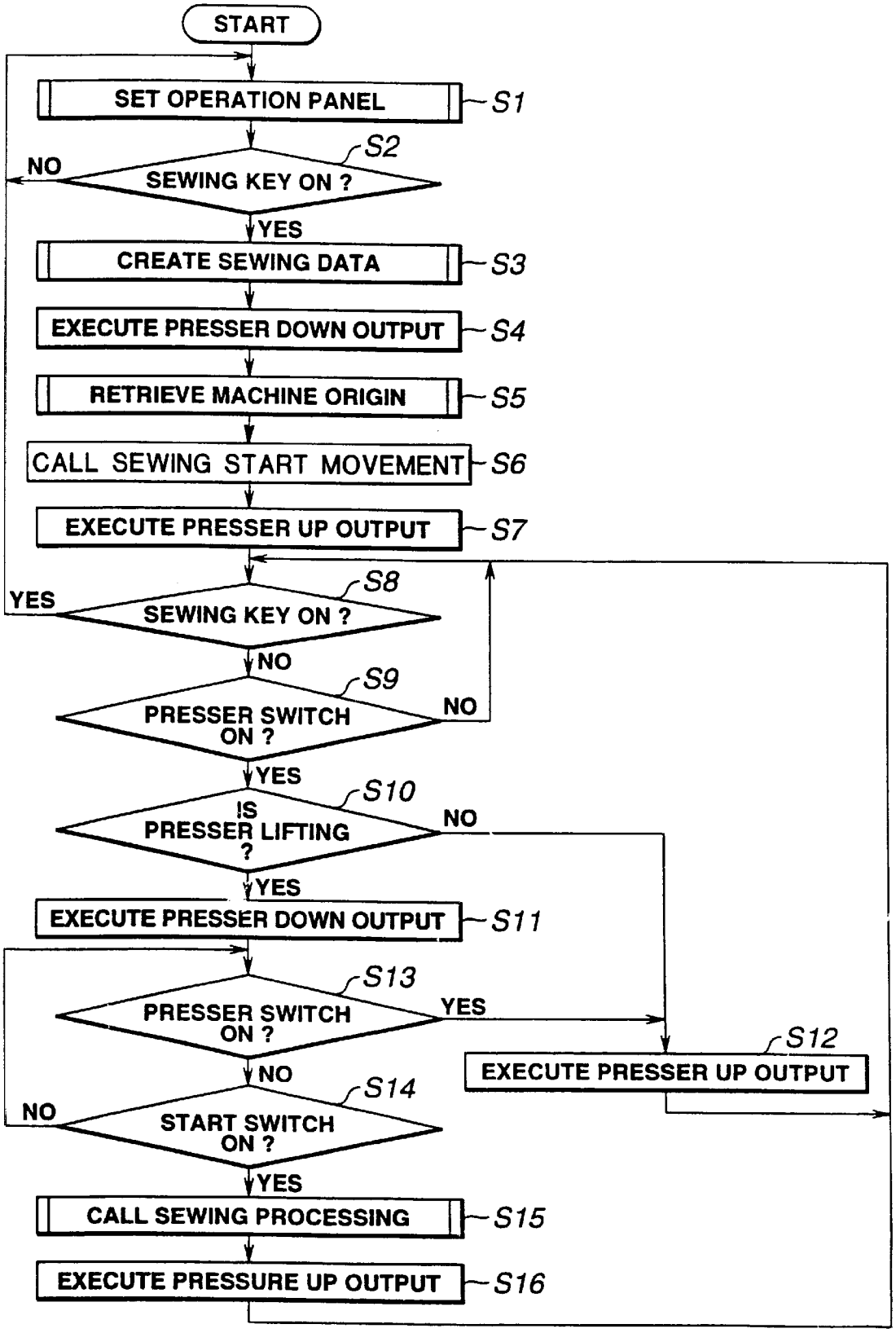
FIG. 37 is a general flow chart according to which control is executed by the control block shown in FIG. 35.

Next, description will be given below of a concrete embodiment of control with reference to FIG. 37 showing a general flow of control to be executed in accordance with the control blocks shown in FIG. 35.

The control to be discussed below can be executed through transmission and reception of signals between a CPU 100, a ROM 101, and a RAM 102: in particular, the CPU 100 includes various control portions (sewing machine control means, sewing machine speed decide means, base line and needle swing width change amount correct means, stitch formation sequence specify means, sewing data read-out means, start specify means for setting a sewing start position, knife control means, vertical movement timing decide means including knife lowering timing decide means, judging means for judging the interval between the upward and downward movement timings of the knife, side sewing length change means, needle drop control means, pattern enlargement/reduction reference point decide means, various drive control means, and the like) and operation means; the ROM 101 stores therein programs and defaults for control including, for example, memory portions respectively for storing sewing mode and tension hook matching mode, and a thread insertion mode, and the like; and, the RAM 102 stores therein various variables for control including, for example, sewing data, base line/needle swing data and the like. Also, the CPU 100 executes given controlling operations in accordance with signals input from the operation panel 110 which has the functions respectively serving as the buttonhole/knife blade length setting means, buttonhole formation width direction position setting means, means for setting the interval between the bar-tack sewing portion and buttonhole end portion, pattern enlargement/reduction setting means, constant stitch number/pitch setting means, and the like.

As shown in the general flow of FIG. 37, if the power supply is fumed on, then, at first, in Step S1, an operation panel setting processing is called and various setting processings are carried out by the operation panel 110. The various setting operation by the operation panel 110 is executed on until the sewing key 131 is switched on in the next step S2 and, after the sewing key 131 is fumed on, in the next step S3, a sewing data create processing is called and sewing data are created. By the way, in the above-mentioned step S2, if the sewing key 131 is not on, then the processing goes back to the above-mentioned step S1.

After the sewing data are created, in the next step S4, there is executed an output for lowering the cloth presser 15 and, next, in Step S5, a machine origin retrieval processing is called, thereby retrieving the machine origins of the Y feed pulse motor 20, base line feed pulse motor 40, and needle swing feed pulse motor 41. After then, in Step S6, a sewing start movement processing is called, in which the Y feed pulse motor 20, base line feed pulse motor 40, and needle swing feed pulse motor 41 are driven and moved to the sewing start positions. Next, in Step S7, there is executed an output for lifting the cloth presser 15 and, after then, the processing advances to the next step S8.

In Step S8, the state of the sewing key 131 is checked: that is, if the sewing key 131 is on, then the processing goes back the above-mentioned step S1, in which the operation panel setting processing is performed again; or, if the sewing key 131 is not on, then the processing goes to the next step S9. In Step S9, the presser switch 124 is checked for the state thereof: that is, if the presser switch 124 is on, then the processing advances to the next step S10; or, if the presser switch 124 is not on, then the processing goes back to the above-mentioned step S8.

In Step S510, it is checked whether the cloth presser 15 is lifting or not: that is, if it is found lifting, then there is executed an output for lowering the cloth presser 15 in the next step S11; or, if it is found not lifting, then there is executed an output for lifting the cloth presser 15 in the next step S12 and, after then, the processing returns to the above-mentioned step S8.

After execution of the cloth presser lowering output, in the next step S113, the presser switch 124 is checked for the state thereof: that is, if the presser switch 124 is on, then in the above-mentioned step S12, there is executed an output for lifting the cloth presser 15 and, after then, the processing goes back to the above-mentioned step S8; or, if the presser switch 124 is not on, then the processing advances to the next step S14. In Step S14, the start switch 125 is checked: that is, if the start switch 125 is found "on", then the processing advances to the next step S15; or if the start switch 125 is found "not on", then the processing goes back to the above-mentioned step S13.

And, in Step S15, a sewing processing is called and a sewing operation is thereby started. After the sewing operation is finished, in the next step S116, there is executed an output for lifting the cloth presser 15 and, after then, the processing returns to the above-mentioned step S8.

Next, description will be given below in detail of the above-mentioned operation panel setting processing (Step S1), sewing data creation processing (Step S3), mechanical origin retrieval processing (Step S5), and sewing processing (Step S15) respectively to be carried out according to the general flow shown in FIG. 37.

Figure 38:
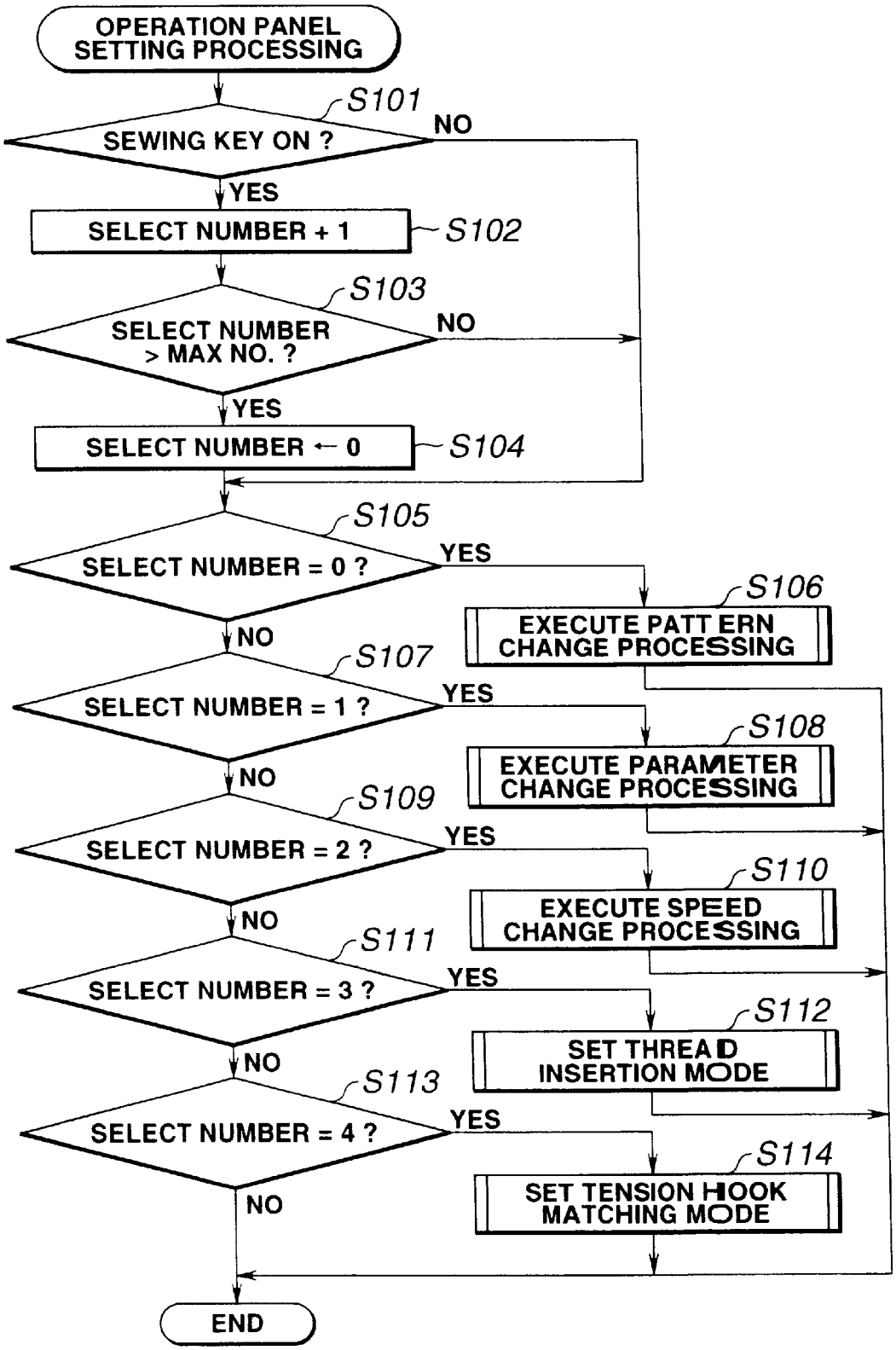
FIG. 38 is a flow chart of a subroutine for an operation panel setting processing (Step S1)

In particular, FIG. 38 shows a subroutine for the operation panel setting processing (Step S1), in which, firstly, in Step S101, the select key 133 is checked: that is, if it is on, then the select number is incremented by 1 in the next step S102 and, after then, the processing advances to the next step S103; or, if it is not on, then the processing advances to Step S105.

In Step S103, the select number is checked: that is, if the select number exceeds the maximum number [4], then [0] is set in the select number to return the select number to 0 in the next step S104 and, after then, the processing advances to the next step S105; or, if the select number is the maximum number [4] or less, then the processing advances to Step S105.

In Step S105, it is checked whether the select number is 0 or not: that is, if it is 0, then the processing advances to Step S106, in which a pattern change processing is executed, and, after then, the processing advances to the above-mentioned step S2 of the general flow (FIG. 37); or, if it is not 0, then the processing advances to step S107.

In Step S107, it is checked whether the select number is 1 or not: that is, if it is 1, then the processing advances to Step S108, in which a parameter change processing is executed, and, after then, the processing advances to the above-mentioned step S2 of the general flow (FIG. 37); or, if it is not 1, then the processing advances to step S109.

In Step S109, it is checked whether the select number is 2 or not: that is, if it is 2, then the processing advances to Step S110, in which a speed change processing is executed, and, after then, the processing advances to the above-mentioned step S2 of the general flow (FIG. 37); or, if it is not 2, then the processing advances to step S111.

In Step S111, it is checked whether the select number is 3 or not: that is, if it is 3, then the processing advances to Step S112, in which a thread insertion mode is set, and, after then, the processing advances to the above-mentioned step S2 of the general flow (FIG. 37); or, if it is not 3, then the processing advances to step S113.

In Step S113, it is checked whether the select number is 4 or not: that is, if it is 4, then the processing advances to Step S114, in which a tension hook matching mode is set, and, after then, the processing advances to the above-mentioned step S2 of the general flow (FIG. 37); or, if it is not 4, then the processing directly advances to the above-mentioned step S2.

Next, description will be given below sequentially in detail of the pattern change processing (Step S106), parameter change processing (Step S108), speed change processing (Step S110), thread insertion mode (Step S112) and tension hook matching mode (Step S114) respectively included in the above-mentioned operation panel setting processing (Step S1).

Here, prior to description of the respective processings, description will be given of the setting item table shown in FIG. 39 and conditions shown in FIG. 40.

In the setting item table shown in FIG. 39, not only there are included pattern Nos. 1 to 6 in which parameters are previously set, but also there are included setting items which respectively correspond to parameter Nos. 1 to 19 to be variably set according to needs and are stored in the above-mentioned RAM 102: that is, cloth cutting length; knife width; lock stitch length; bar-tack width; parallel portion pitch; bar-tack portion pitch; gap length between cloth cutting knife and first bar-tack; gap length between cloth cutting knife and second bar-tack; knife drop right and left position; parallel portion tension; bar-tack portion tension; sewing start tension; sewing end tension; cloth cutting knife size; presser size; enlargement/reduction ratio; constant stitch number in enlargement and reduction; knife drop timing correcting needle number; sewing machine speed at knife drive start time. In the respective pattern Nos. there are stored the defaults that have been stored in the above-mentioned ROM 101.

And, in correspondence to the respective parameter Nos. and setting items, there are provided setting ranges and units thereof.

Figure 40:
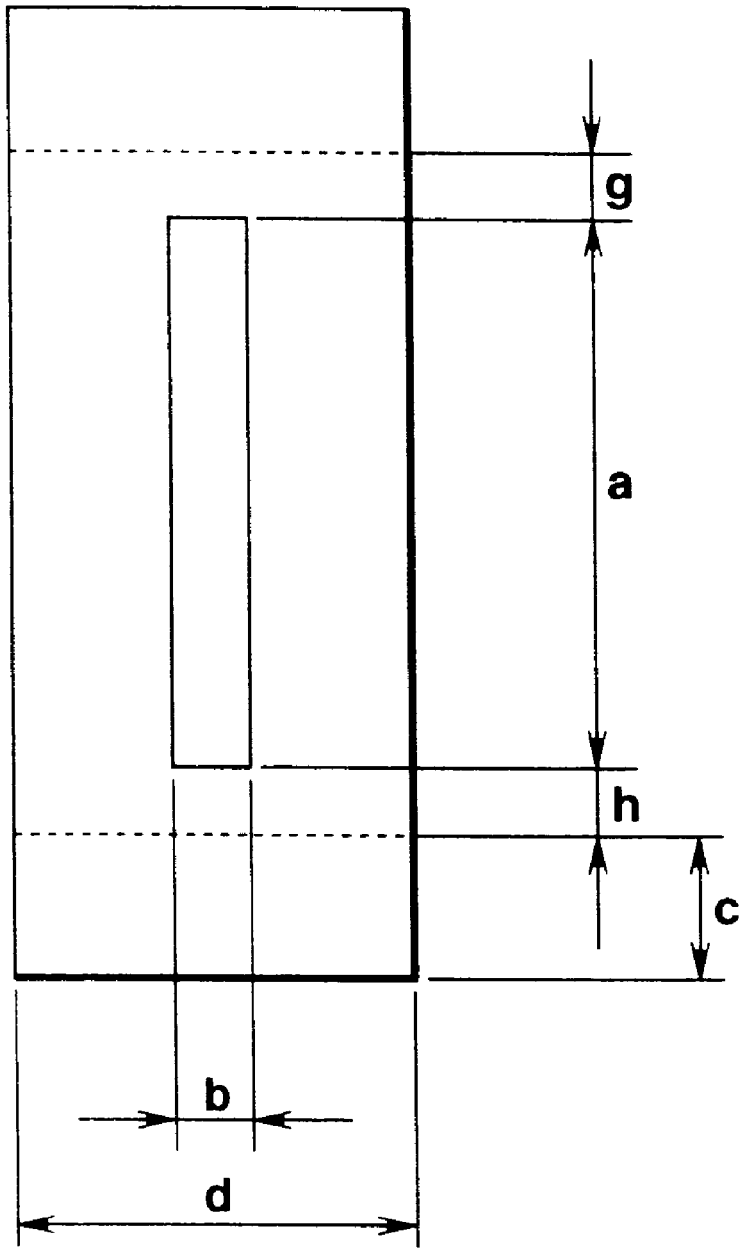
FIG. 40 shows conditions set for a buttonhole darning portion.

Also, as in the conditions shown in FIG. 40, when darning a buttonhole, the sewing operation is executed after setting the cloth length a, knife width b, bar-tack length c, bar-tack width d, parallel portion pitch e, bar-tack portion pitch f, gap length g between cloth cutting knife and first bar-tack portion, and gap length h between cloth cutting knife and second bar-tack portion.

In the above-mentioned RAM 102, there are set parameters in which pattern Nos. are registered and set; and, the parameters can be used in correspondence to the registered and set pattern Nos., or the parameters can be used after they are changed according to cases.

Figure 41:
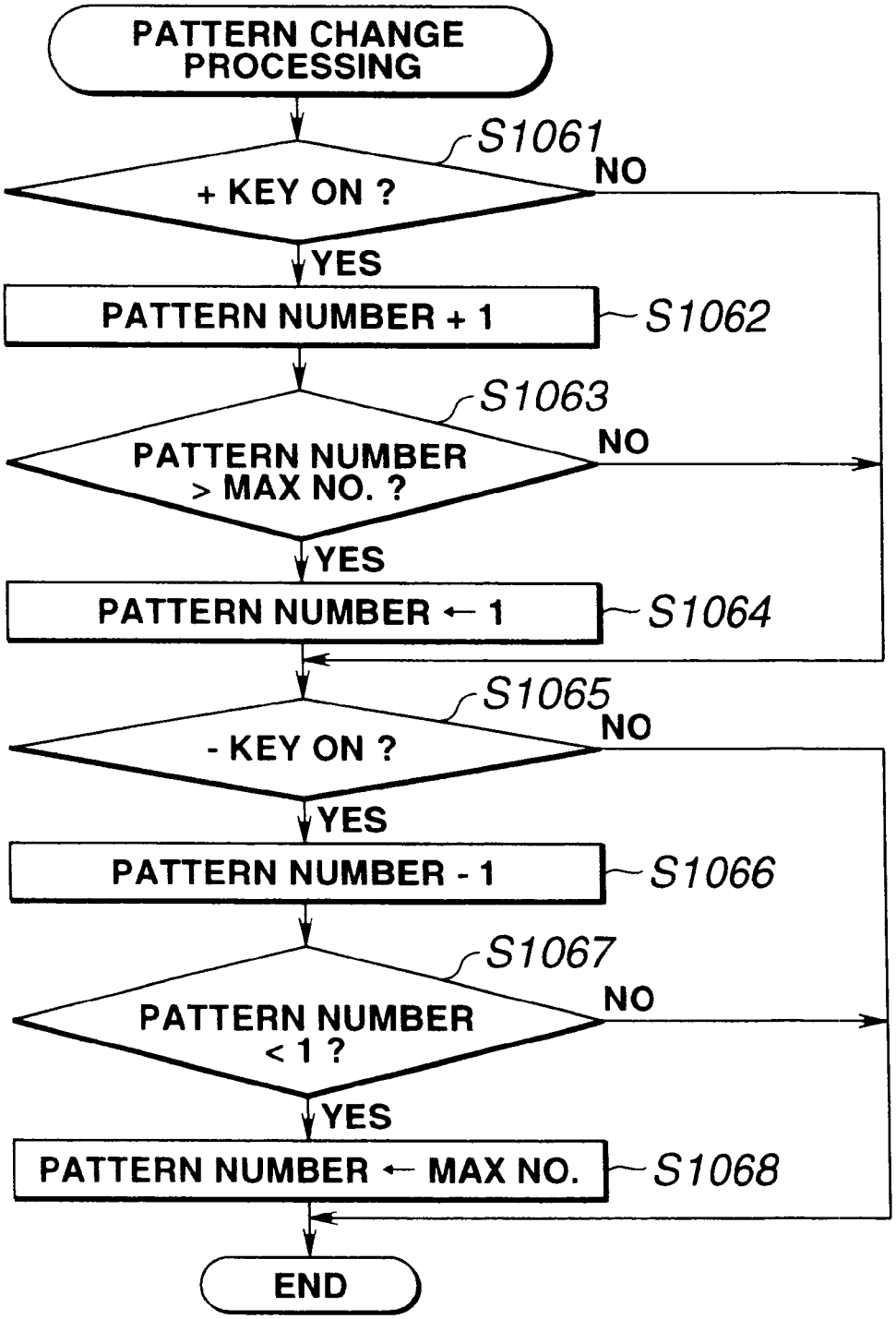
FIG. 41 is a flow chart of a subroutine for a pattern change processing (Step S106)

Now, FIG. 41 shows a subroutine for the pattern change processing (Step S106). That is, at first, in Step S1061, the plus key 144 is checked. If the plus key 144 is on, then in the next-step S1062, the pattern number is incremented by 1 and, after then, the processing advances to the next step S1063; or, if the plus key 144 is not on, then the processing advances directly to Step S1065.

In Step S1063, the pattern number is checked. If the pattern number exceeds the maximum number [6], then in the next step S1064, [1] is set in the pattern number and, after then, the processing goes to the next step S1065; or, if the pattern number is the maximum number [6] or less, then the processing goes directly to Step S1065.

In Step S1065, the minus key 143 is checked. If the minimum key 143 is on, then in the next step S1066, the pattern number is decremented by 1 and, after then, the processing advances to the next step S1067; or if the minimum key 143 is not on, then the processing advances directly to the above-mentioned step S2 in the general flow (FIG. 37).

In Step S1067, the pattern number is checked. If the pattern number is less than the minimum number [1], then in the next step S1068, the maximum number [6] is set in the pattern number and, after then, the processing advances to the above-mentioned step S2 in the general flow (FIG. 37).

Figure 42:
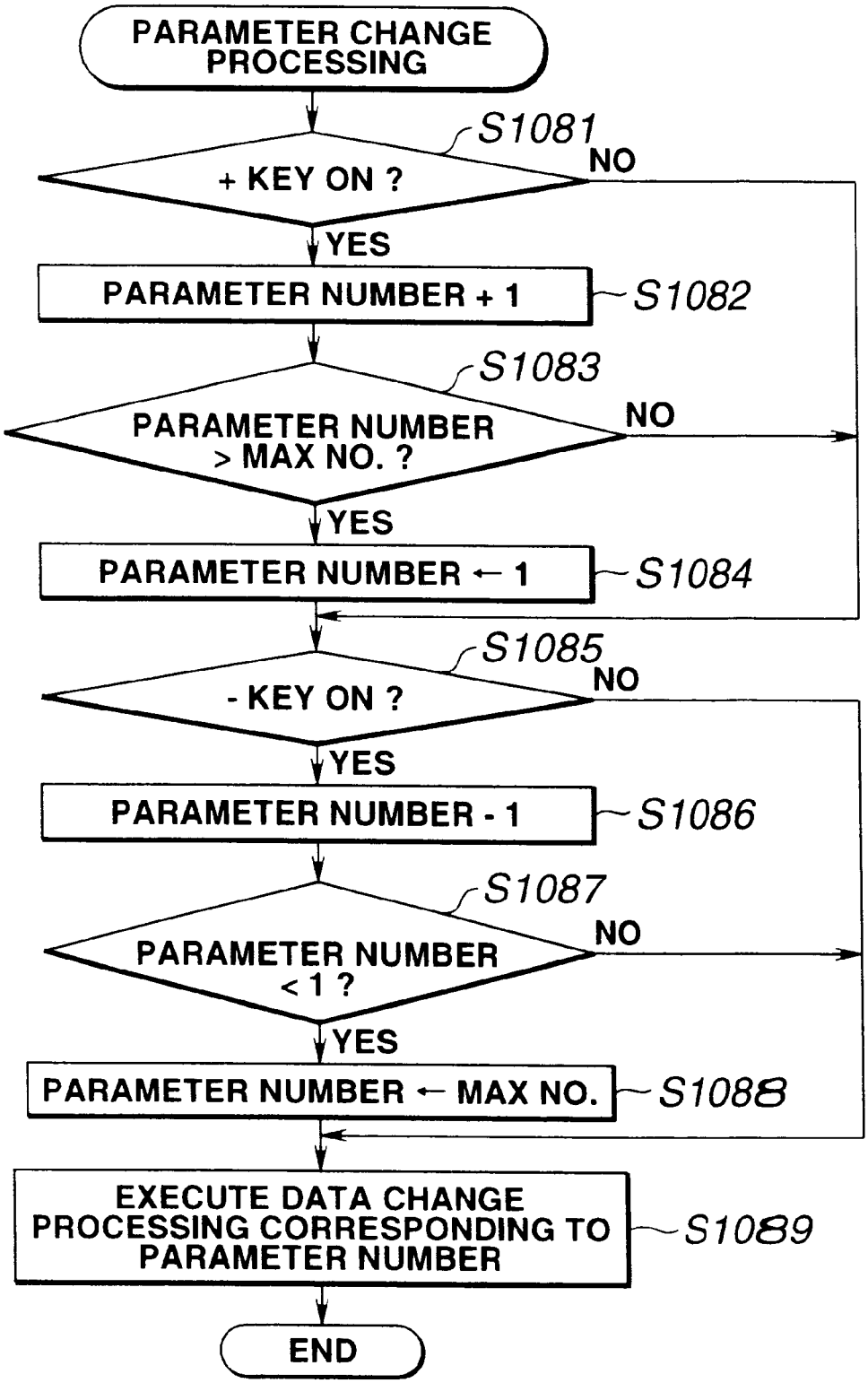
FIG. 42 is a flow chart of a subroutine for a parameter change processing (Step S108)

Now, FIG. 42 shows a subroutine for the parameter change processing (Step S108). At first, in Step S1081, the plus key is checked. If the plus key 144 is on, then in the next step S1082, the pattern number is incremented by 1 and, after then, the processing advances to the next step S1083; or, if the plus key 144 is not on, then the processing advances directly to Step S1085.

In Step S1083, the pattern number is checked. If the pattern number exceeds the maximum number [19], then in the next step S1084, [1] is set in the pattern number and, after then, the processing goes to the next step S1085; or, if the pattern number is the maximum number [19] or less, then the processing goes directly to Step S1085.

In Step S1085, the minus key 143 is checked. If the minus key 143 is on, then in the next step S1086, the pattern number is decremented by 1 and, after then, the processing advances to the next step S1087; or, if the minus key 143 is not on, then the processing advances directly to Step S1089.

In Step S1087, the pattern number is checked. If the pattern number is less than the minimum number [1], then in the next step S1088, the maximum number [19] is set in the pattern number and, after then, the processing advances to the next Step S1089; or, if the pattern number is not less than the minimum number [1], then the processing advances directly to Step S1089.

And, in Step S1089, a desired data change processing corresponding to the parameter number is executed by operating the down key 145 or up key 146 and, after then, the processing advances to the above-mentioned step S2.

Figure 43:
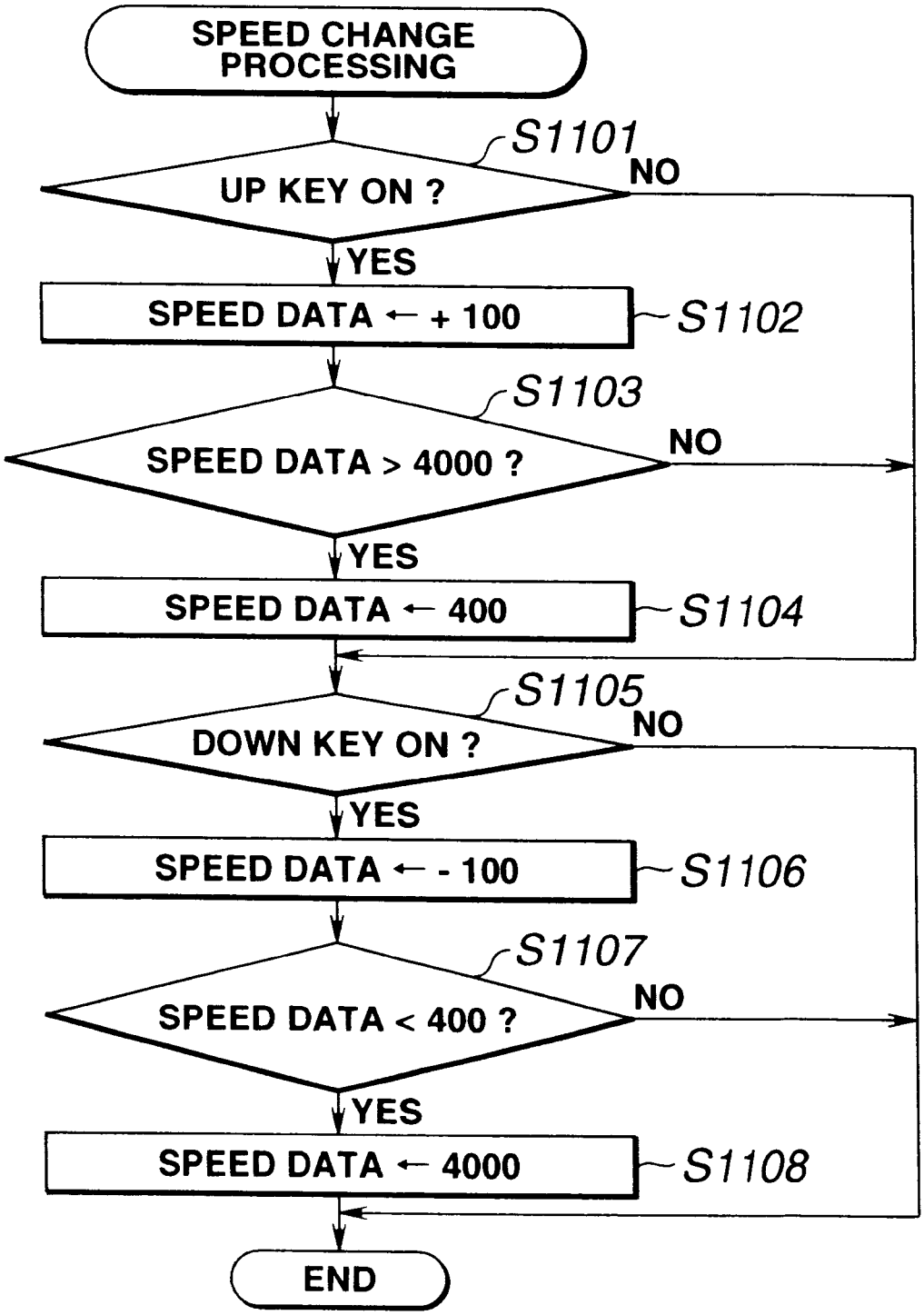
FIG. 43 is a flow chart of a subroutine for a speed change processing (Step S110)

Now, FIG. 43 shows a subroutine for the speed change processing (Step S110). In the present subroutine, the sewing machine speed change processing is carried out. In the sewing machine speed, as the number of stitches per minute [spm; that is, stitches/minute], there is employed a setting range from [400] to [4000] and the change unit thereof is [100].

In the present speed change processing, as shown in FIG. 43, at first, in Step S1101, the up key 146 is checked. If the up key 146 is on, then in the next step S1102, the speed data is incremented by 100 and, after then, the processing advances to the next step S1103; or, if the up key 146 is not on, then the processing advances directly to Step S1105.

In Step S1103, the speed data is checked. If the speed data exceeds the maximum value [4000], then in the next step S1104, [400] is set in the speed data and, after then, the processing advances to the next step S105; or, if the speed data is less than the maximum value [4000], then the processing advances directly to Step S1105.

In Step S1105, the down key 145 is checked. If the down key is on, then in the next step S106, the speed data is decremented by 100 and, after then, the processing advances to the next step S107; or, if the down key is not on, then the processing advances to the above-mentioned step S2 in the general flow (FIG. 37).

In Step S1107, the speed data is checked. If the speed data is less than the minimum value [400], the in the next step S1108, the maximum value [4000] is set in the speed data and, after then, the processing goes to the above-mentioned step S2 in the general flow (FIG. or, if the speed data is not less than the minimum value [400], then the processing advances directly to the above-mentioned step S2.

Figure 44:
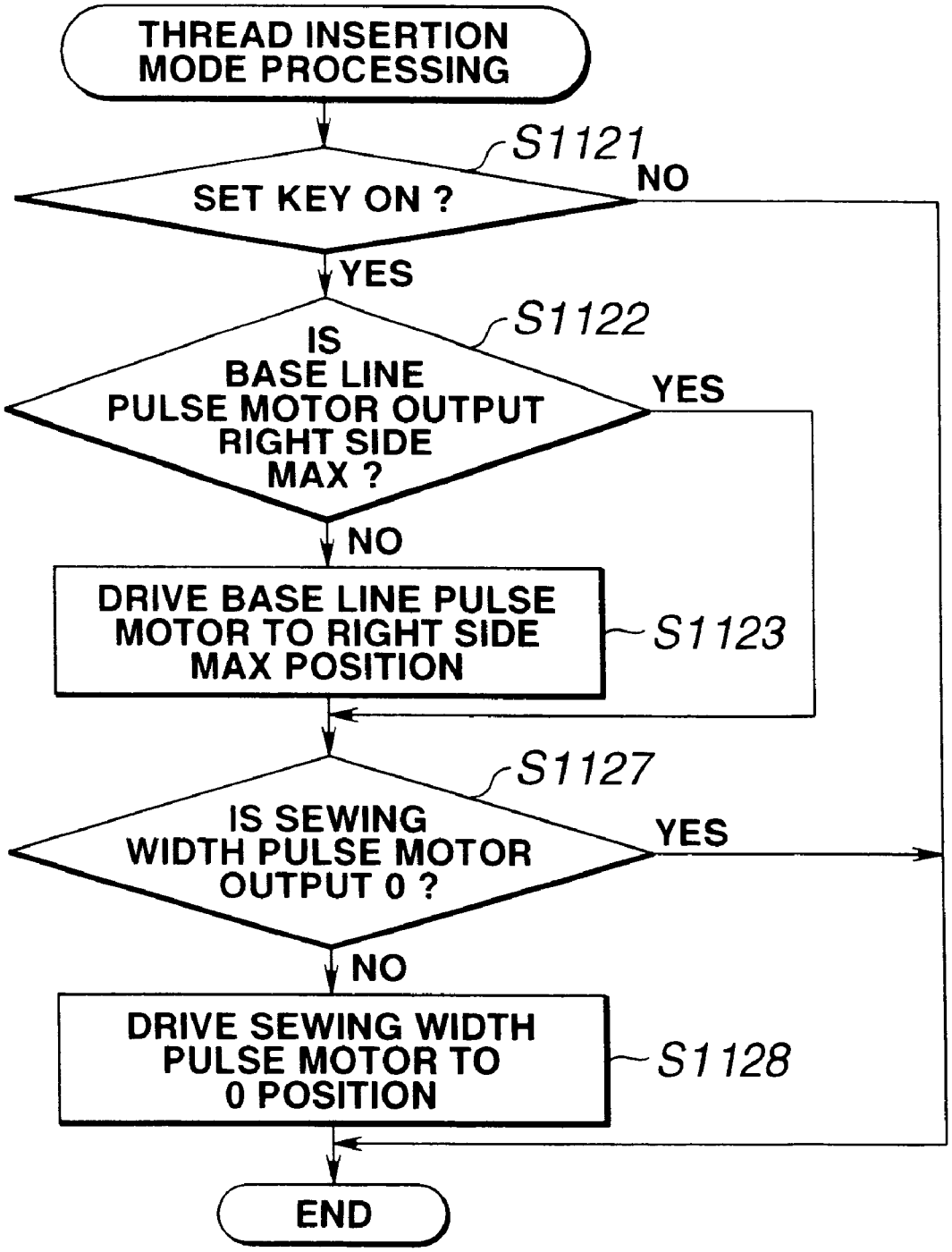
FIG. 44 is a flow chart of a subroutine for a thread insertion processing (Step S112)
Figure 45A:
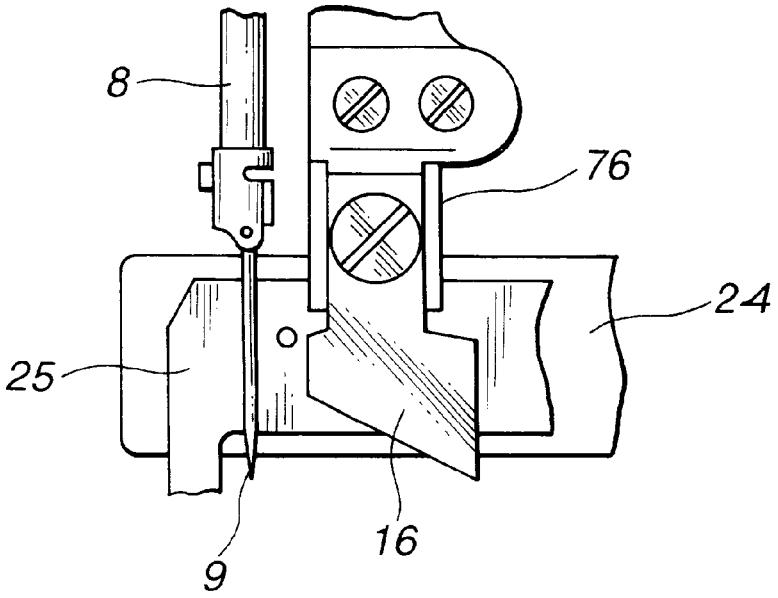
FIGS. 45(*a*) and 45(*b*) show the relation between a needle and a cloth cutting knife situated in the rear of the needle in the thread insertion operation; in particular FIG. 45(*a*) is a side view thereof, and FIG. 45(*b*) is a front view thereof, showing a state in which the needle is swung to the right up to the maximum position with respect to the cloth cutting knife.
Figure 45B:
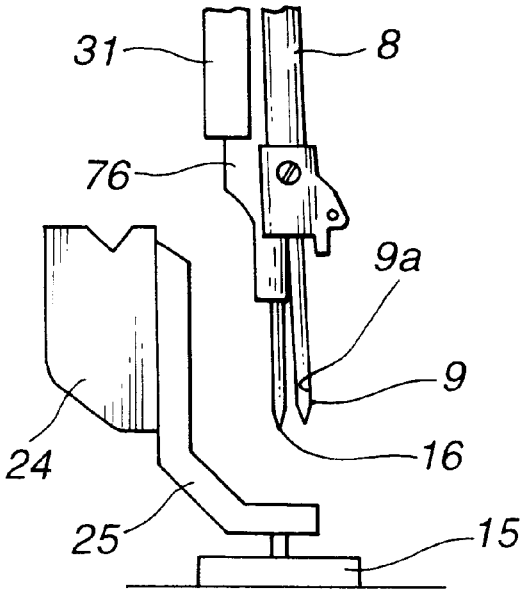

Now, FIG. 44 shows a subroutine for the thread insertion mode (Step S112). In the present subroutine, when a thread is inserted, as shown in FIG. 45(*a*), the needle 9 is close to the position of the cloth cutting knife 16 situated on the rear side thereof and, therefore, as shown in FIG. 45(*b*), the needle 9 is swung right as much as possible with respect to the vertically extending cloth cutting knife 16, thereby being able to facilitate the insertion of the thread through the needle eye 9*a*.

In the present thread insertion mode, as shown in FIG. 44, at first, in Step S1121, the set key 147 is checked. If the set key 147 is on, then the processing advances to the next step S1122; or, if the set key 147 is not on, then the processing advances directly to the above-mentioned step S2 in the general flow (FIG. 37).

In Step S1122, it is checked whether the output of the base line feed pulse motor 40 is the right-side maximum value or not. If it is not the right side maximum value, then in the next step S1123, the base line feed pulse motor 40 is driven by the pulse motor driver 112 so that it can provide the right side maximum value and, after then, the processing advances to Step S1127; or, if the output of the base line feed pulse motor 40 is the right side maximum value, then the processing advances directly to Step S1127.

And, in Step S1127, it is checked whether the output of the swing width pulse motor (needle swing feed pulse motor) 41 is 0 or not, that is, whether the output of the swing width pulse motor 41 is situated on the above-mentioned base line or not. If it is 0, then the processing advances directly to the above-mentioned step S2 in the general flow (FIG. 37); or, if it is not 0, then in the next step S1128, the swingwidth pulse motor (needle swing feed pulse motor) 41 is driven to the 0 position by the needle swing feed pulse motor driver 114 and, after then, the processing advances to the above-mentioned step S2 in the general flow (FIG. 37).

Figure 46:
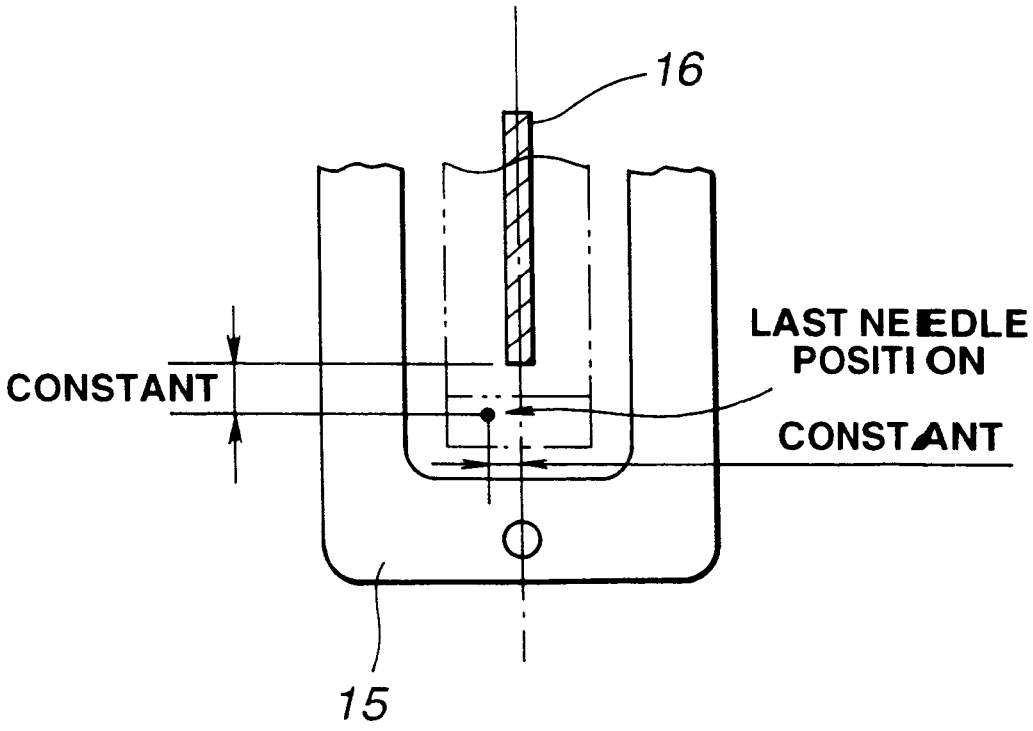
FIG. 46 shows the last needle which is dropped to the left side with respect to the cloth cutting knife.

As described above, in the thread insertion operation, if an operator operates the set key 147 on the panel, then, as shown in FIG. 45(*b*), the needle 9 can be swung right to the full with respect to the vertically extending cloth cutting knife 16 to thereby shift the needle eye 9*a* to the right beyond the cloth cutting knife 16, which makes it possible to facilitate the insertion of the thread through the needle eye 9*a*. Also, as shown in FIG. 46, even in the case of the last needle that drops on the left with respect to the cloth cutting knife 16, if the needle 9 is similarly swung to the right as much as possible with respect to the cloth cutting knife 16, then it is easy to insert the thread through the needle eye 9*a*.

Instead of the above-mentioned control in which the needle is swung right beyond the cloth cutting knife 16 in connection with the operation of the set key 147, there can also be employed another controlling method in which, when a sewing machine stop instruction is issued during the formation of the buttonhole darning stitches, the sewing machine is caused to stop at the needle upper position according to its constant position stop operation through a similar processing to a step S1624 to be discussed later and, at the same time, as described above, the needle is caused to swing to the right as far as possible.

Further, in the needle swing control to be executed at the time when the sewing machine is caused to stop during the sewing operation, the present subroutine may be so set as to store the right side stop as the specified stop position of the needle through the operation of the select switch 111 and set key 147; and, in the above-mentioned sewing machine stop operation, the needle is checked for the stop setting thereof and, if the right side stop is set, then the needle may be swung right to the full before it is stopped.

Figure 47:
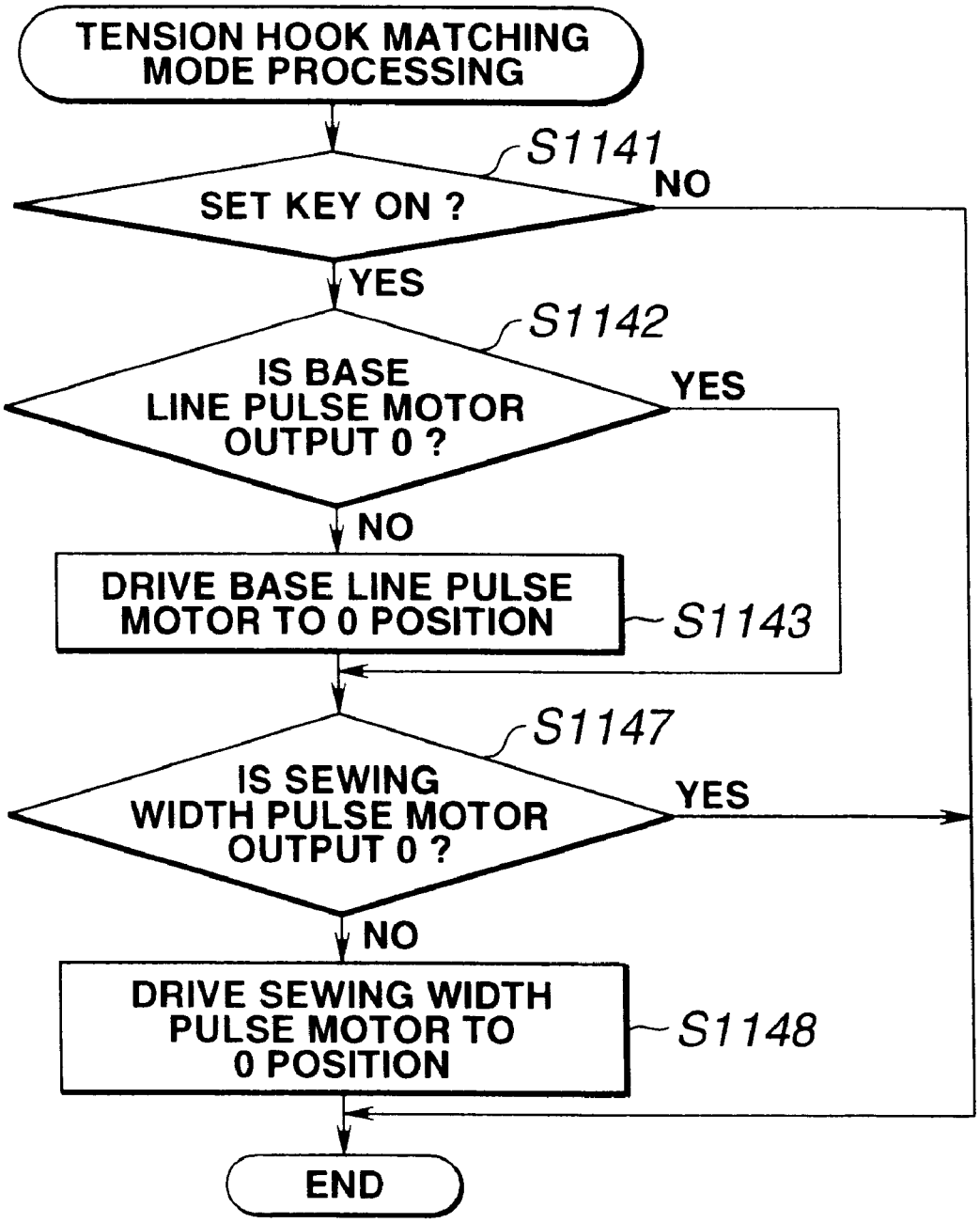
FIG. 47 is a flow chart of a subroutine for a tension hook matching processing (Step S114)
Figure 48A:
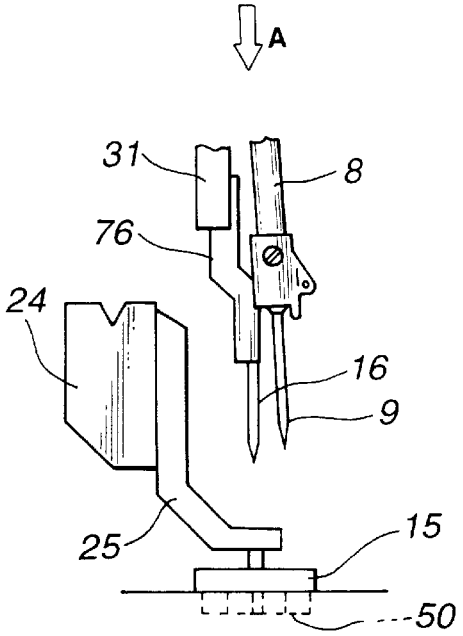
FIG. 48(*a*) is a front view of a state in which the needle is stopped on the right of the cloth cutting knife, FIG. 48(*b*) is a plan view of a state in which the needle is moved to the needle hole center of the cloth presser, FIG. 48(*c*) is a front view of a state in which the needle is moved downward, and FIG. 48(*d*) is a front view of a state in which the needle bar is moved downward from its stop position.
Figure 48B:
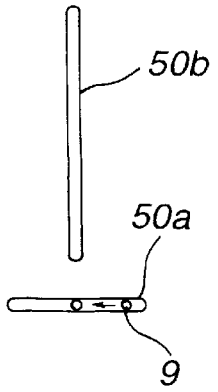
Figure 48C:
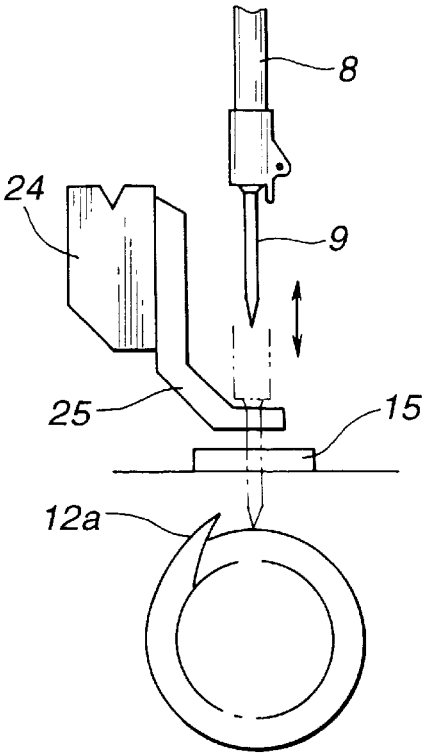
Figure 48D:
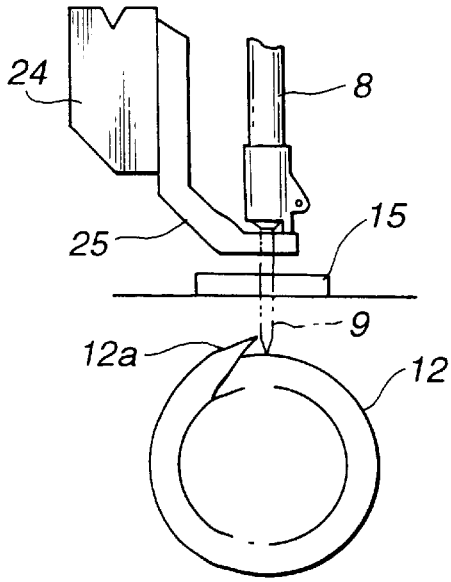

Now, FIG. 47 shows a subroutine for the tension hook matching mode (Step S114) for matching the tip end 12*a* of the tension hook 12 to the axis of the needle 9. In the present subroutine, at first, as shown in FIGS. 48(*a*) and 48(*b*), the needle 9 situated in front of the cloth cutting knife 16 is moved to the center of the hole 50*a* (on the extension of the knife groove 50*b*) of the cloth needle plate S0 and, as shown in FIG. 48(*c*), the needle 9 is controlled so that it is situated at such a needle swing position allowing the needle 9 to be identical in axis with the tension hook 12.

And, as shown in FIGS. 48(*c*) to 48(*d*), the needle bar 8 is lowered down from its stop position, is passed through the lowest point, and is stopped at a slightly lifted position (tension hook matching timing position). At this position, the matching is executed.

In the present tension hook matching mode, as shown in FIG. 47, at first, in Step S141, the set key 147 is checked. If the set key 147 is on, then the processing goes to the next step S1142; or, if the set key 147 is not on, then the processing advances directly to the above-mentioned step S2 in the general flow (FIG. 37).

In Step S1142, it is checked whether the output of the base line feed pulse motor 40 is 0 or not. If it is not 0, then in the next step S143, the base line feed pulse motor 40 is driven to the 0 position by the base line feed pulse motor driver 112; or, if it is 0, then the processing goes directly to Step S1147.

And, in Step S1147, it is checked whether the output of the swing width pulse motor (needle swing feed pulse motor) 41 is 0 or not. If it is 0, then the processing advances directly to the above-mentioned step S2 in the general flow (FIG. 37); or, if it is not 0 then in the next step S1148, the swing width pulse motor (needle swing feed pulse motor) 41 is driven by the needle swing feed pulse motor driver 114 and, after then, the processing advances to the above-mentioned step S2 in the general flow (FIG. 37).

By means of the above-mentioned operation, in the tension hook matching mode, the needle is swung by operating the set key 147 to the needle swing position (center of the needle swing range) corresponding to the axis of the tension hook 12 and, after then, the axis of the needle and the tip end of the tension hook are adjusted, thereby being able to match them to each other.

As will be described in another control system to be discussed later, if the rotation phase of the main shaft is detected to thereby control the stop of the drive motor of the sewing machine, then not only the needle swing control but also the needle vertical movement position control can be carried out automatically and continuously.

Figure 49:
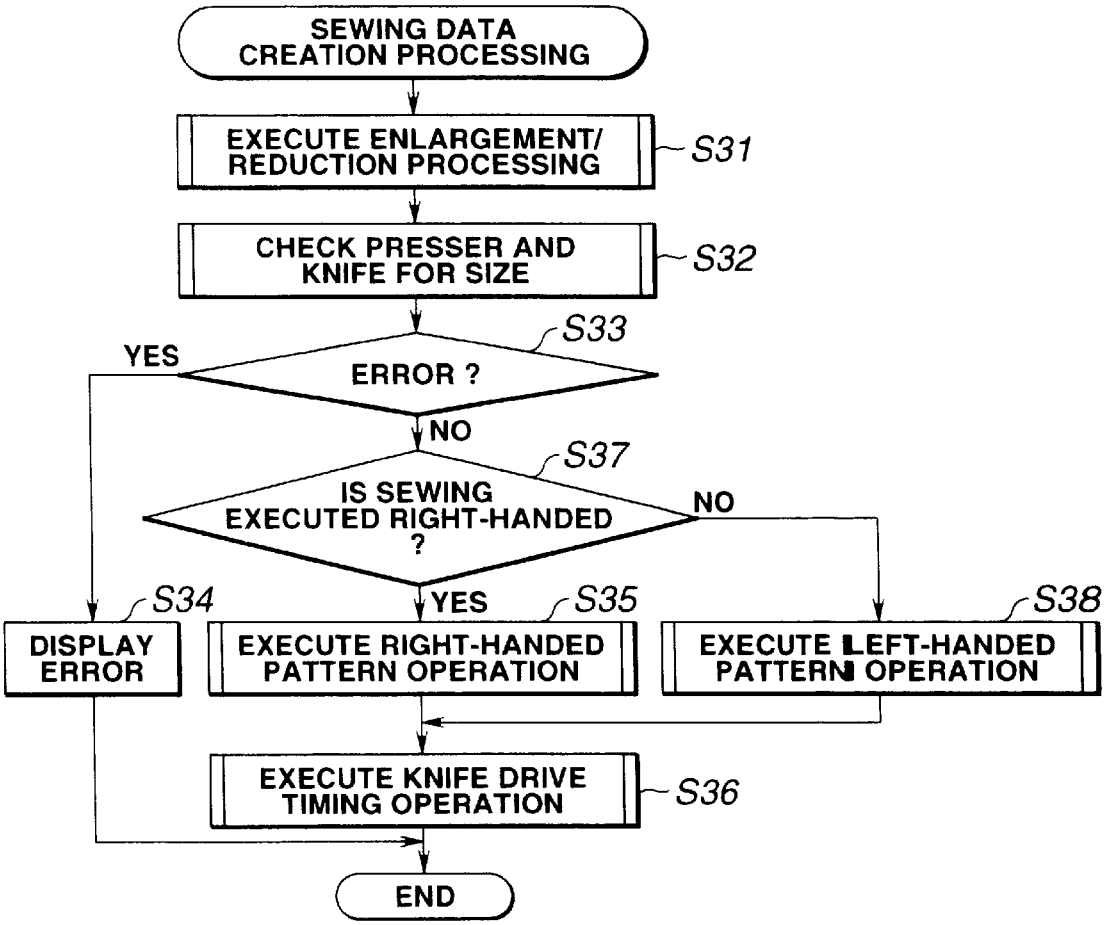
FIG. 49 is a flow chart of a subroutine for a sewing data creation processing (Step S3)

Now, FIG. 49 shows a subroutine for the sewing data creation processing (Step S3). In this subroutine, firstly, in Step S31, there is executed an enlargement/reduction processing, in the next step S32, the cloth presser 15 and cloth cutting knife 16 are respectively checked for the sizes thereof and, in the next step S33, a size error is checked.

And, if there is found a size error between the cloth presser 15 and cloth cutting knife 16, then the processing advances directly to Step S34, in which an error display is carried out, and, after then the processing advances to the above-mentioned step S4 in the general flow (FIG. 37). on the other hand, if no size error is found between the cloth presser 15 and cloth cutting knife 16, then in the next step S37, there is checked the above-mentioned switch (not shown) which is provided in the operation panel 114 in order to select the above-mentioned right-handed or left-handed sewing and, after then, the processing advances to Step S35 or Step S38.

In Step S35 or Step S38, a pattern operation is executed, next, in Step S36, a knife drive timing operation is executed and, after then, the processing advances to the above-mentioned step S4 in the general flow (FIG. 37). That is, in Step S37, if it is judged that the sewing operation is executed in the right-handed manner, then the right-handed pattern operation is carried out in Step S33; or, if it is judged that the sewing operation is not executed in the right-handed manner, then the left-handed pattern operation is executed in Step S38.

Next, description will be given below sequentially in detail of the enlargement/reduction processing (Step S31), presser/knife size check processing (Step S32), right-handed pattern operation (Step S35), knife drive timing operation (S36), and left-handed pattern operation (Step S38) which are respectively included in the above-mentioned sewing data creation processing (Step S3).

Figure 50:
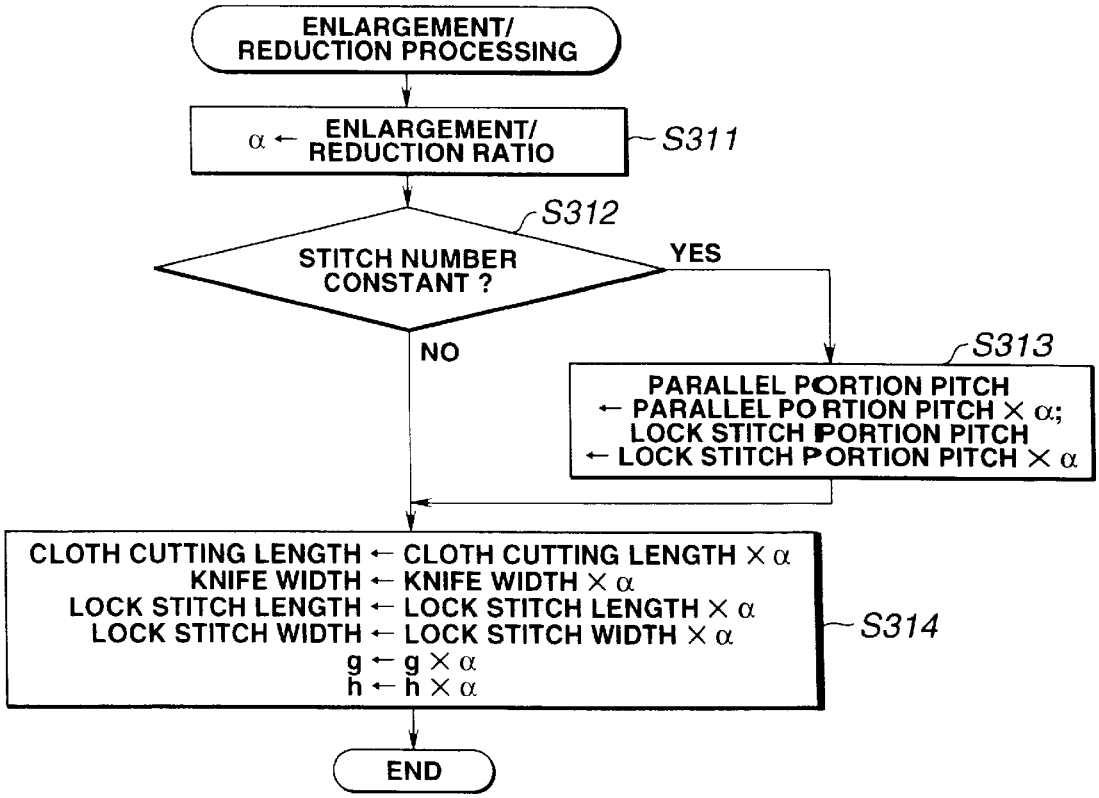
FIG. 50 is a flow chart of a subroutine for an enlargement/reduction processing (Step S31)
Figure 51A:
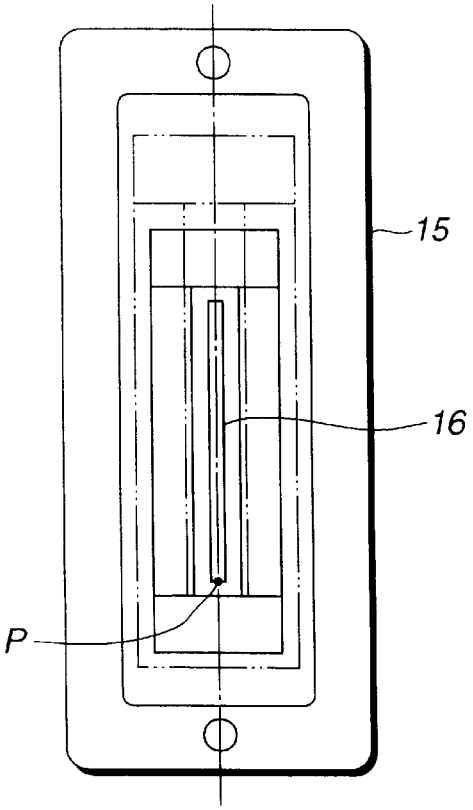
FIGS. 51(*a*) and 51(*b*) are explanatory views of an enlargement/reduction processing to be executed in a buttonhole darning operation; in particular FIG. 51(*a*) is a view of a reference point used in the enlargement/reduction processing, and FIG. 51(*b*) is a view of the designations of the respective portions of the buttonhole darning operation.
Figure 51B:
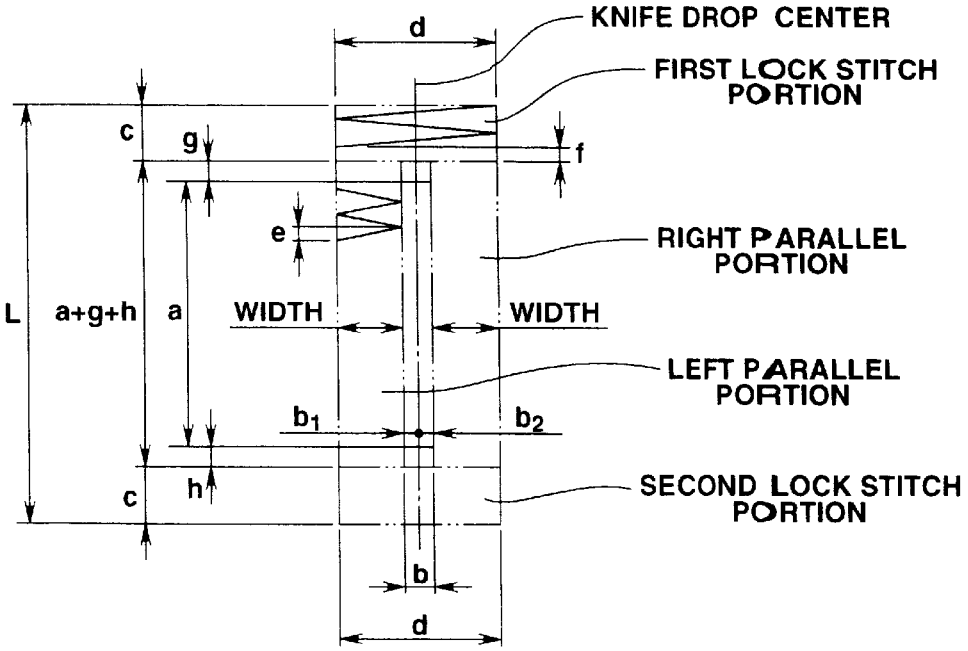

Now, FIG. 50 shows a subroutine for the enlargement/reduction processing (Step S31). In this subroutine, in order to carry out the enlargement/reduction processing for the buttonhole darning operation, as shown in FIG. 51(*a*), the front end portion of the cloth cutting knife 16 is used as a reference point P for the enlargement/reduction and, as shown in Now, FIG. 51(*b*), set values for (the parallel portion pitch e and lock stitch portion pitch f) and/or (the cloth cutting length a, knife width b, lock stitch length c and lock stitch width d) are controlled, that is, are enlarged or reduced.

In the present sewing data creation processing, as shown in FIG. 50, at first, in Step S311, the enlargement/reduction ratio is set to a and, after then, in the next step S312, it is checked whether the stitch number is constant or not. If it is found constant, then the processing goes to Step S313; or, if it is found not constant, then the processing goes to Step S314.

In Step S313, as the set value for the parallel portion pitch e and bar-tack portion pitch f, the parallel portion pitch x a and the bar-tack portion pitch x a respectively shown in the table in FIG. 39 are set and, after then, the processing advances to the next step S314.

And, in Step S314, as the set values for the cloth cutting length, knife width, length and bar-tack width, the cloth cutting length x a, knife width x $\alpha$, bar-tack length x a, lock stitch width x a, knife-first lock stitch length g x a, and knife-first lock stitch length h x a, are respectively set and, after then, the processing advances to the above-mentioned step S32 in the flow shown in FIG. 49.

Figure 52:
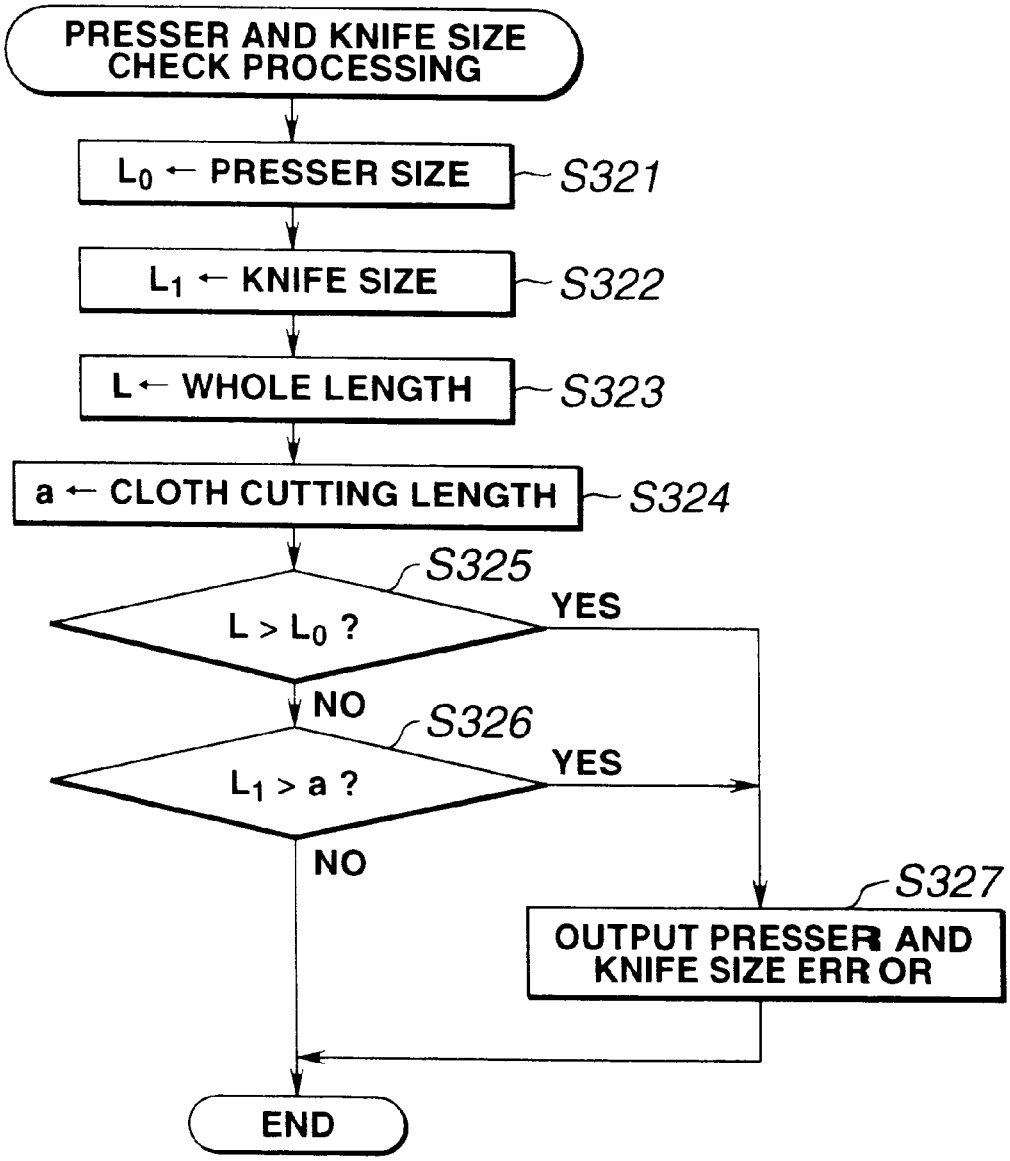
FIG. 52 is a flow chart of a subroutine for a presser/knife size check processing (Step S32)

Now, FIG. 52 shows a subroutine for the presser and knife size check processing (Step S32). In this subroutine, at first, according to the respective parameter set values of the pattern number, in Step S321, the size of the cloth presser 15 is set to L0, next, in Step S322, the size of the cloth cutting knife 16 is set to L1, next, in Step S323, the whole length (FIG. 51(*b*)) is set to L, next in Step S324, the cloth cutting length is set to a, and, after then, the processing advances to the next Step S325.

In Step S325, it is checked whether L>L0 or not. If not L>L0, then the processing goes to the next step S326; or, if L>L0, then the processing goes to the next step S327.

In Step S326, it is checked whether L1>a or not. If not L1>a, then the processing advances to the above-mentioned step S43 in the subroutine (FIG. 49); or, If L1>a, then the processing advances to Step S327.

And, in Step S327, if L>L0 is found, that is, if the presser size is smaller than the whole length. or, if L1>a is found, that is, if the knife size is larger than the cloth cutting length, then a presser/knife error is output and, after then, the processing advances to the above-mentioned step S33 in the flow shown in FIG. 49.

Figure 53:
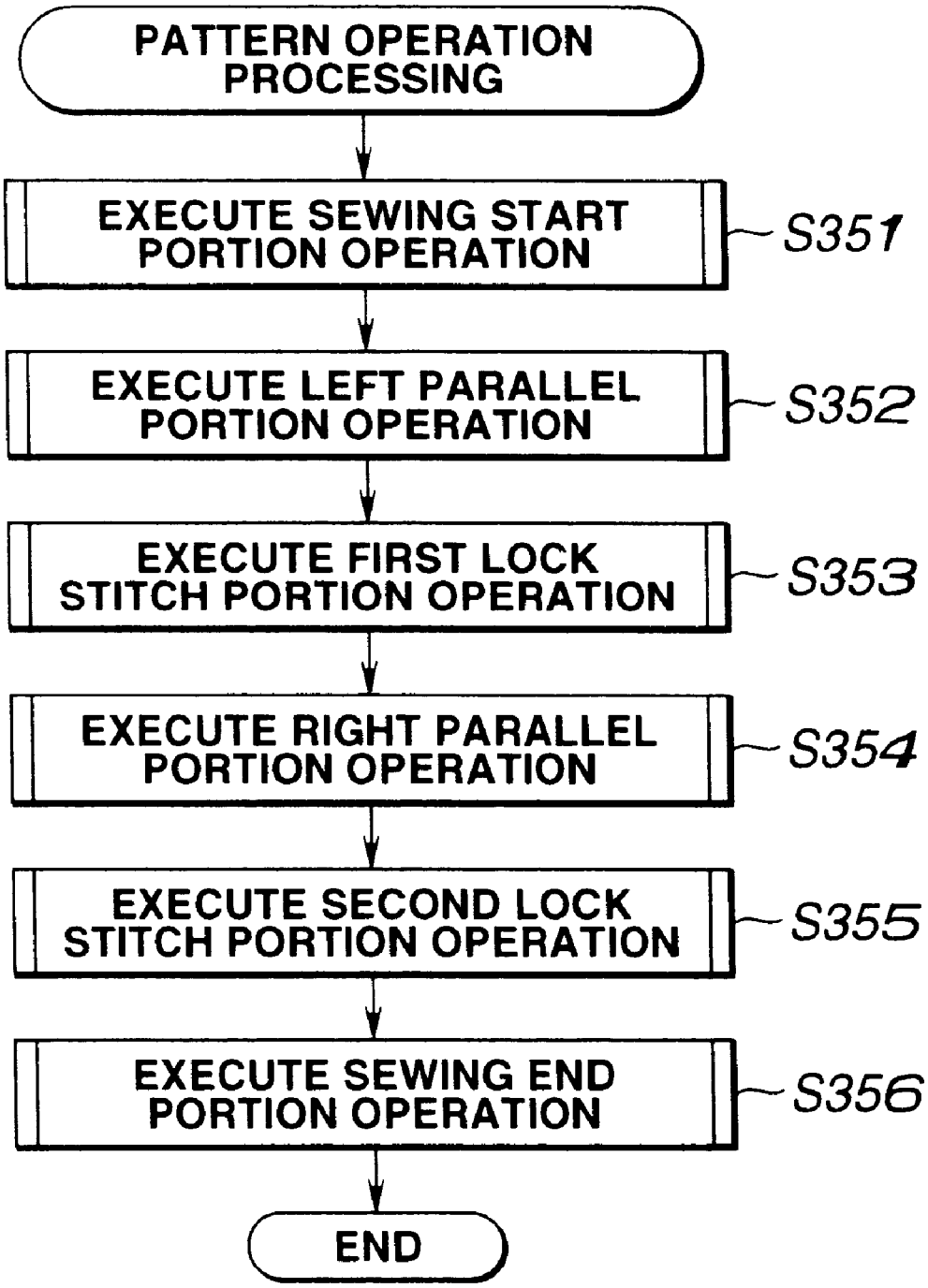
FIG. 53 is a flow chart of a subroutine for a pattern operation processing (Step S35)

Now, FIG. 53 shows a subroutine for the pattern operation (Step S35). In this subroutine, firstly, in Step S351, a sewing start position is operated, in the next step S352, a left parallel portion is operated, and, in the further next step S353, a first bar-tack portion is operated.

And, in the next step S354, a right parallel portion is operated, next, in Step S355, a second bar-tack portion is operated, and in Step S356, a sewing end is operated and, after then, the processing advances to the above-mentioned step S36 in the flow shown in FIG. 49.

Next, description will be given below sequentially in detail of the following processings included in the above-mentioned pattern operation (Step S35): that is, the sewing start position operation (Step S351), left parallel portion operation (Step S352), first bar-tack portion operation (Step S353), right parallel portion operation (Step S354), second bar-tack portion operation (Step S355), and sewing end operation (Step S356).

Here, prior to description of the respective operation processings, the sewing sequence and conditions will be described.

Figure 54:
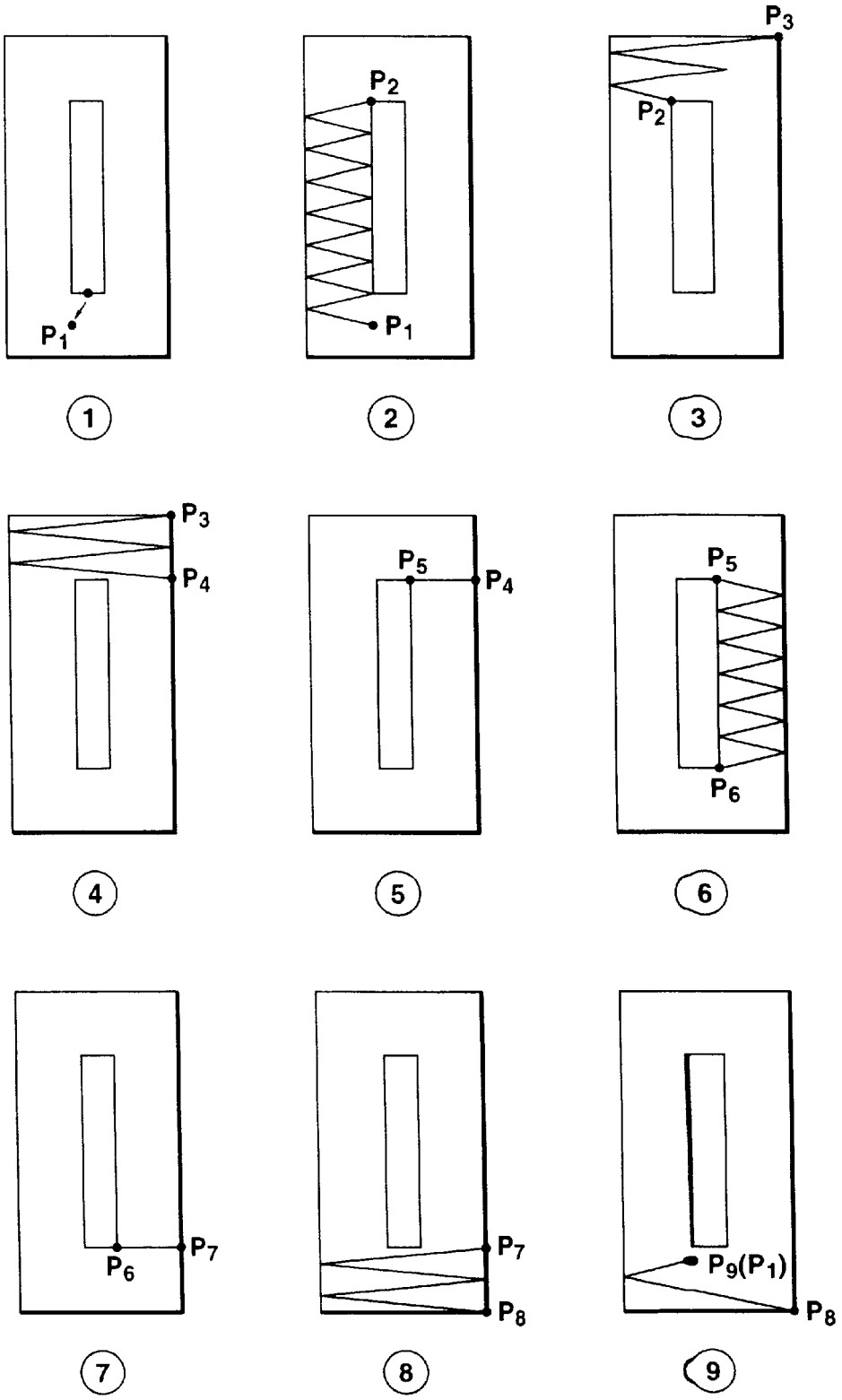
FIG. 54 is a view of a right-handed sewing sequence.

FIG. 54 shows the sewing sequence: in particular, FIG. 54 (1) shows a step from the machine origin to the sewing start position, FIG. 54 (2) shows a step of sewing the left parallel portion after the step shown in FIG. 54 (1), FIG. 54 (3) shows a step of sewing the first bar-tack portion up to the middle portion thereof, FIG. 54 (4) shows a step of sewing the first bar-tack portion up to the completion thereof, FIG. 54 (5) shows the start of sewing of the right parallel portion, FIG. 54 (6) shows a step of sewing the right parallel portion, FIG. 54 (7) shows the start of sewing of the second bar-tack portion, FIG. 54 (8) shows a step of sewing the second bar-tack portion up to the middle portion thereof, and FIG. 54 (9) shows the end of sewing (that is, the end of sewing of the second bar-tack portion), respectively. By the way, the movement to the machine origin is executed only when the sewing mode is switched on.

Figure 56:
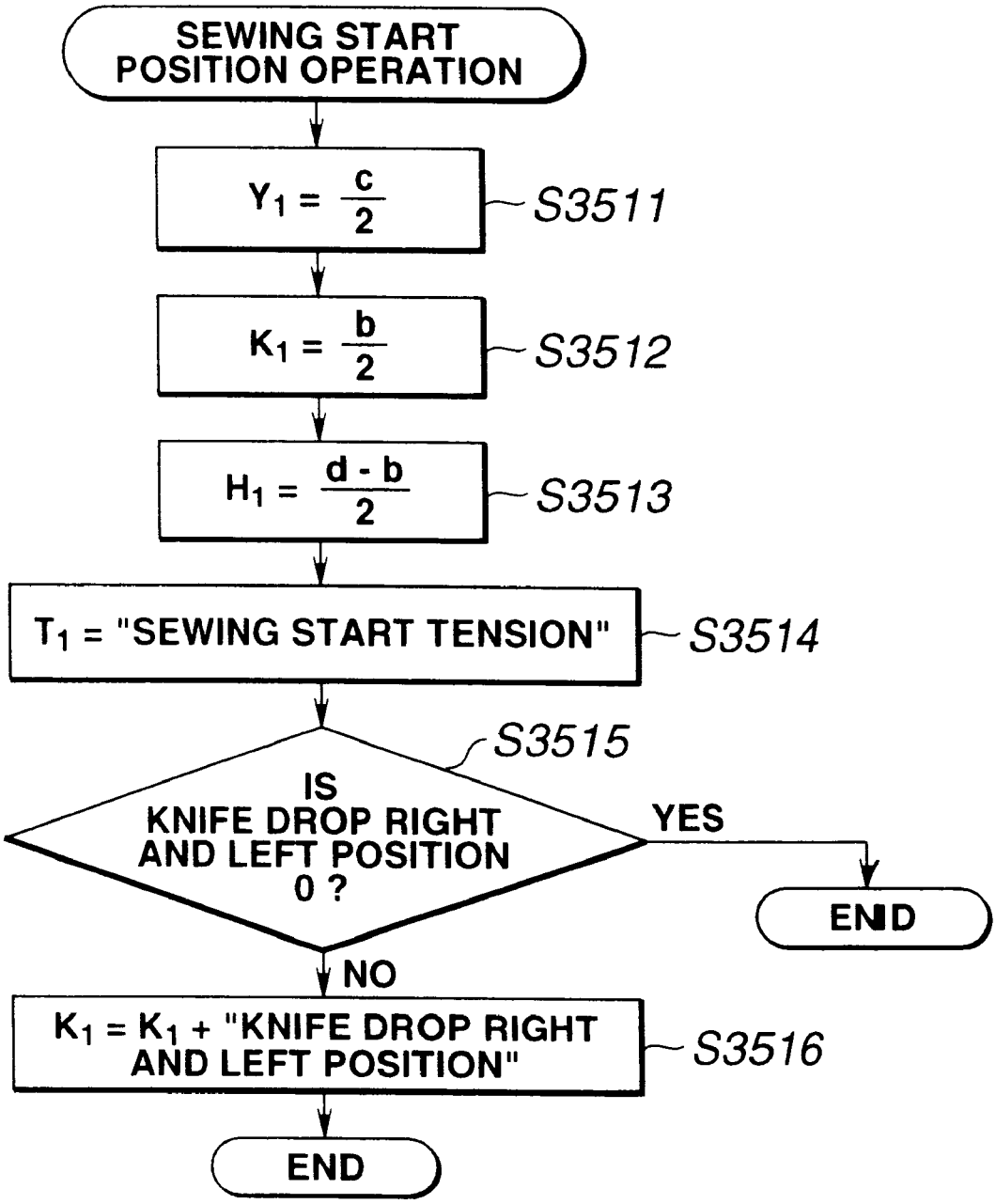
FIG. 56 is a flow chart of a subroutine for a sewing start position operation processing (Step S351)
Figure 63:
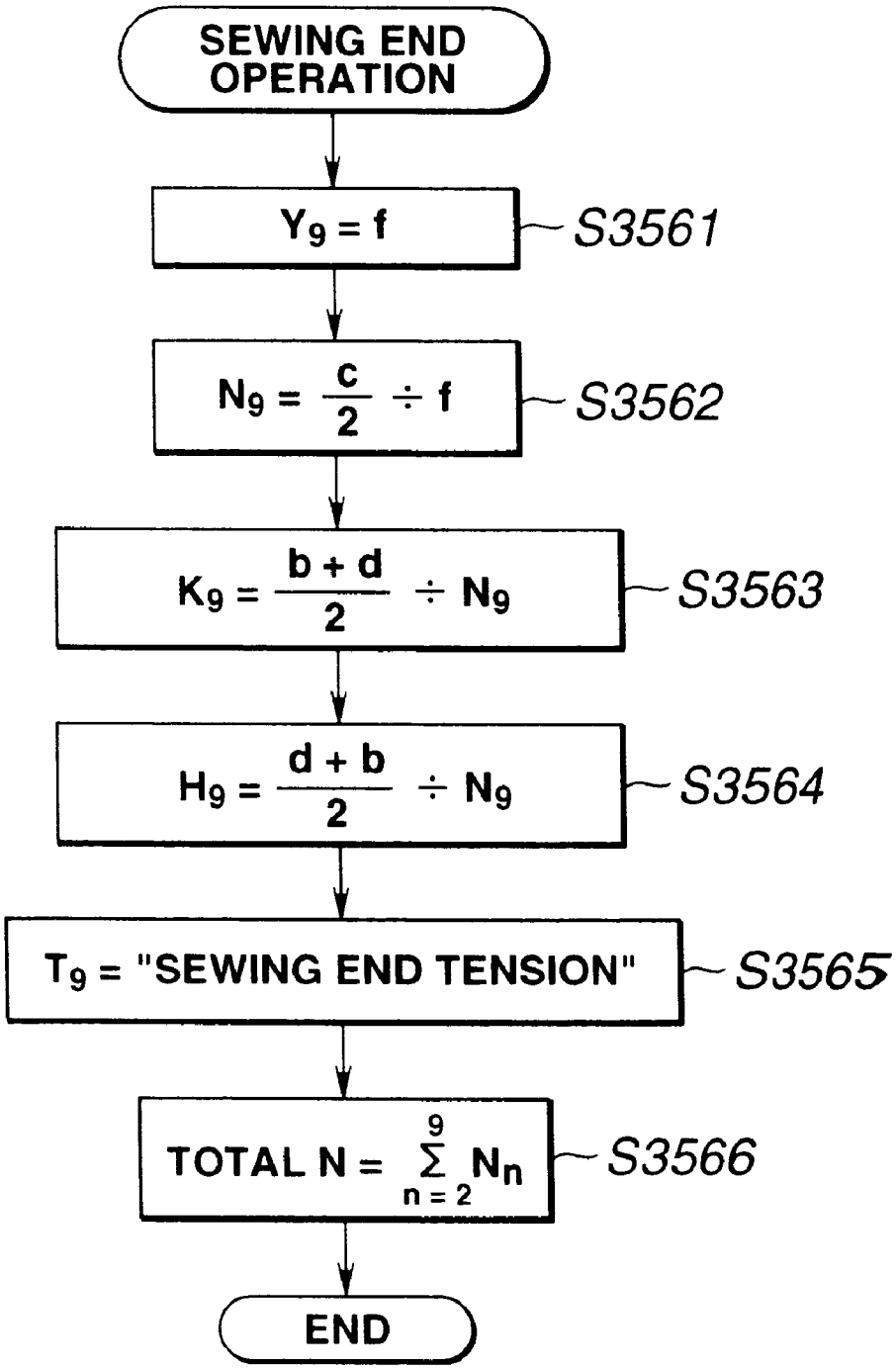
FIG. 63 is a flow chart of a subroutine for a sewing end operation processing (Step S356)

And, FIG. 55 is a table which shows the sewing data operation results, while such operation results can be obtained according to the operations that are shown in FIGS. 56 and 63 which will be discussed later. In this table, N represents the repetition number (number of stitches), Y the Y feed, K the base line, H the swing width, and T the thread tension value, respectively, where subscripts respectively correspond to the sewing sequences (data points), that is, (1), (2), (3), (4), (5), (6), (7), (8), and (9) shown in FIG. 54.

By the way, in the following operations, there are used the dimensions based on the conditions shown in FIG. 40: that is, the dimensions include the cloth length a, knife width b, bar-tack length c, bar-tack width d, parallel portion pitch e, bar-tack portion pitch f, gap length g between cloth cutting knife and first bar-tack, and gap length h between cloth cutting knife and second bar-tack.

The above-mentioned sewing data operation results are stored in the above-mentioned RAM 102.

FIG. 56 shows a subroutine for the sewing start portion operation (Step S351). In this subroutine, at first, in Step S3511, $Y_1$=c/2 is operated, next, in Step S3512, $K_1$=b/2 is operated, next, in Step S3513, $H_1$=(d−b)/2 is operated, and in the next step S3514, $T_1$=sewing start tension is set.

And, in the next step S3515, it is checked whether the panel set value of the knife drop right and left position 11 is 0 or not. If it is found 0, then the processing advances to the above-mentioned step S352 in the flow shown in FIG. 53; or, if not 0, then in the next step S3516, $K_1$=$K_1$+[knife drop right and left position] is set and, after then, the processing advances to the above-mentioned step S352.

Figure 57:
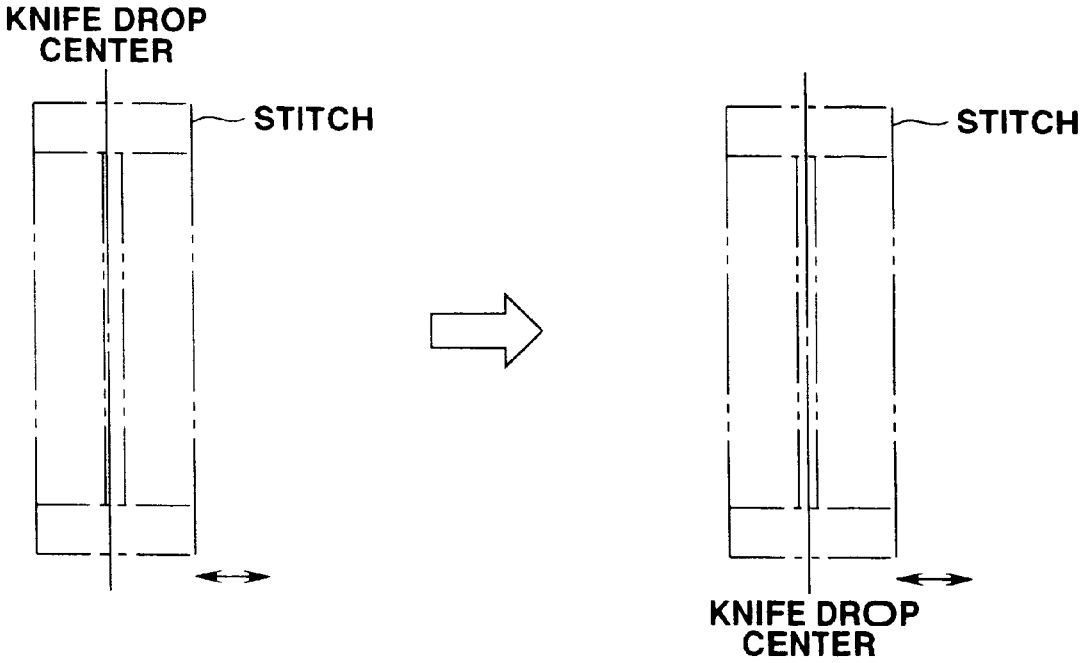
FIG. 57 shows how to decide a knife drop center position.

In other words, if the sewing start position (K,) is set in accordance with the set value of the knife drop right and left position, then there can be provided a knife width position adjusting function employing the knife drop position as the center thereof, that is, as shown in FIG. 57, the right-and-left direction center position of the stitch shape can be set at the knife drop position.

Figure 58:
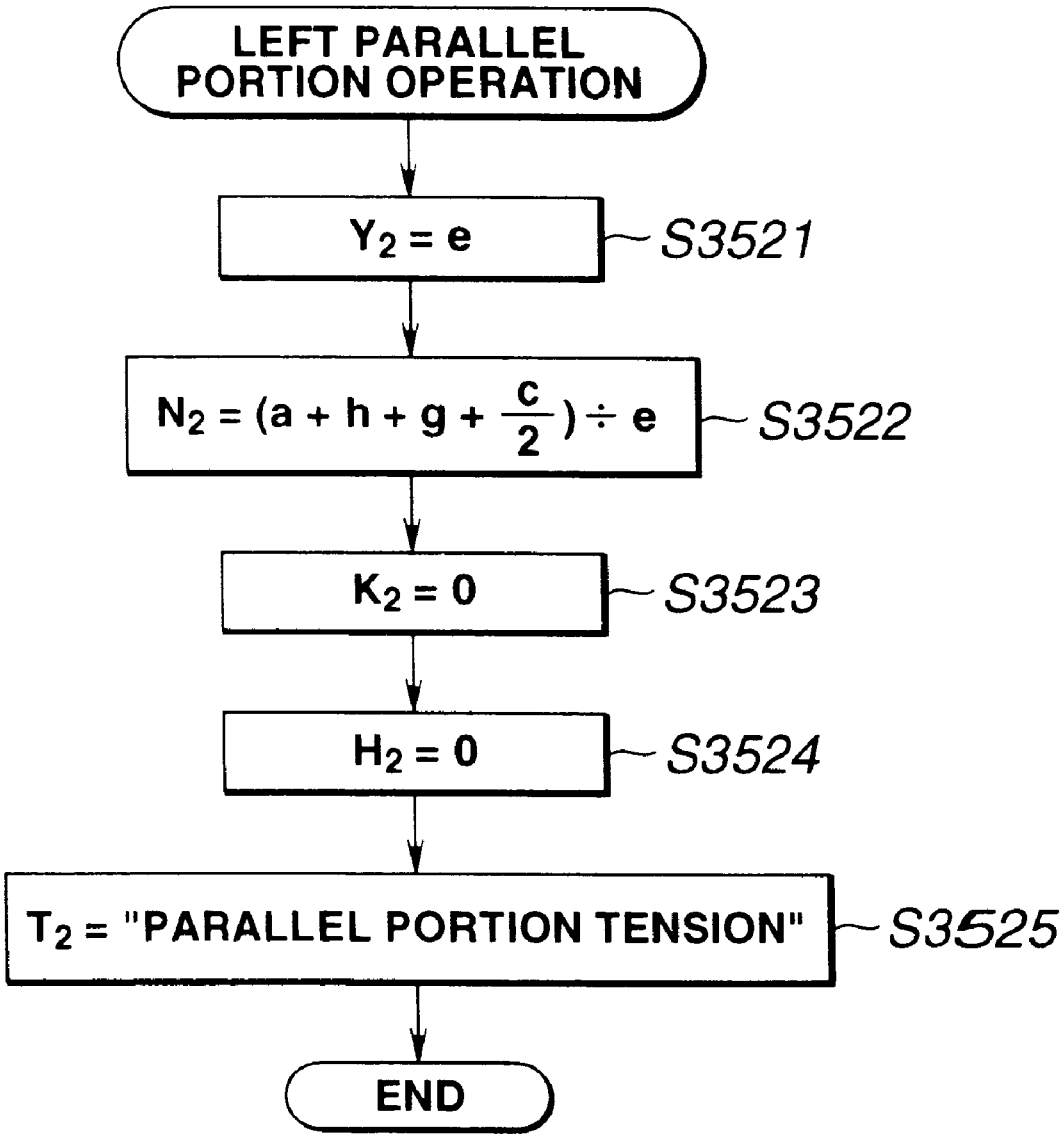
FIG. 58 is a flow chart of a subroutine for a left parallel portion operation processing (Step S352)

Now, FIG. 58 shows a subroutine for the left parallel portion operation (Step S352). In this routine, at first, in Step S3521, $Y_2$=e is set and, after then, in the next step S3522, $N_2$=(a+h+g+(c/2)÷e is operated. In this operation equation, if h and g are changed without changing a, the interval between the lock stitch portion and buttonhole end portion can be corrected.

And, in the next step S3523, $K_2$=0 is set, in the next step S3524, $H_2$=0 is set, in the next step S3525, $T_2$=parallel portion tension is set and, after then, the processing advances to the above-mentioned step S353 in the flow shown in FIG. 53.

Figure 59:
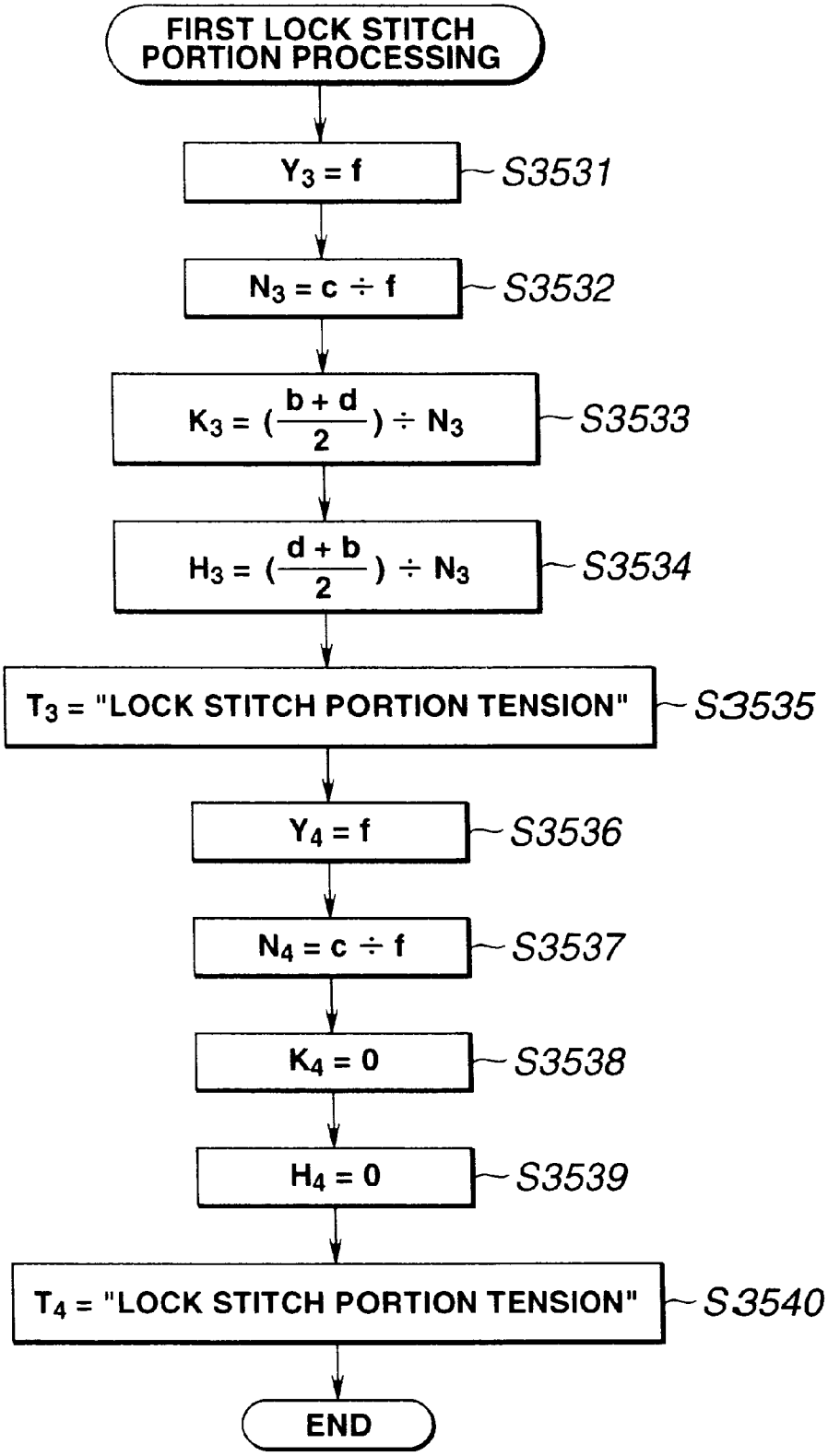
FIG. 59 is a flow chart of a subroutine for a first bar-tack portion operation processing (Step S353)

Now, FIG. 59 shows a subroutine for the first bar-tack portion operation (Step S353). In this subroutine, at first, in Step S3531, $Y_3$=f is set, in the next step S3532, $N_3$=c. f is operated, in the next step S3533, $K_3$=((b+d)/2). N3 is operated and, after then, in the next step S3534, $H_3$=((b+d)/2) . . . $N_3$ is operated.

After then, in the next step S3535, $T_3$=bar-tack portion tension is set, in the next step S3536, $Y_4$=f is set and, after then, in the next step S3537, $N_4$=c. f is operated.

And, in the next step S3538, $K_4$=0 is set, in the next step S3539, $H_4$=0 is set, in the next step S3540, $T_4$=bar-tack portion tension is set and, after then, the processing advances to the above-mentioned step S354 in flow shown in FIG. 53.

Figure 60:
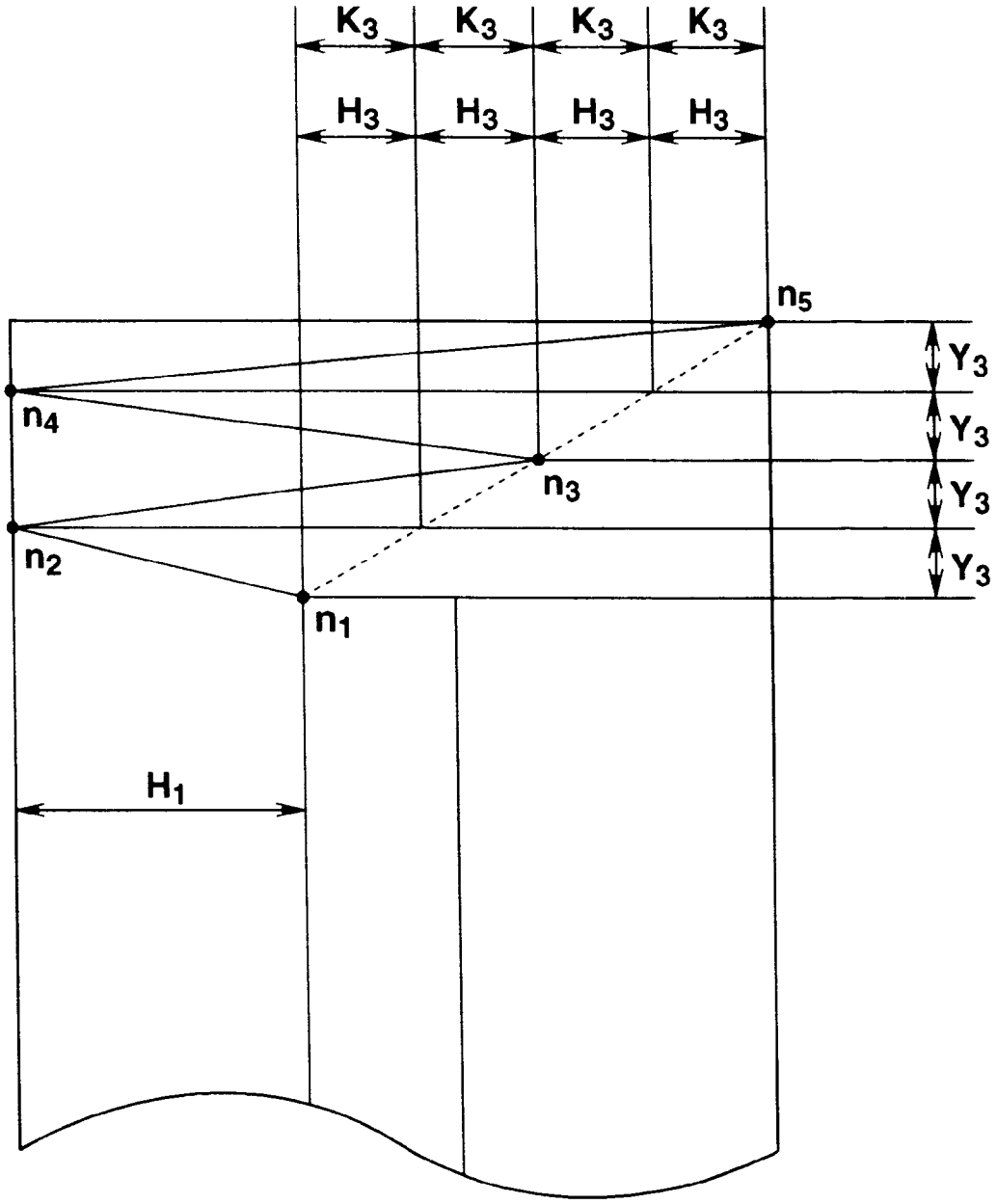
FIG. 60 is a view of an analysis of the details of the first bar-tack portion up to the middle thereof.

By the way, FIG. 60 shows the results obtained by analyzing in detail the step of sewing the first bar-tack portion up to the middle portion thereof, which is shown in (3) of FIG. 54. Here, description will be given below of the operation principle of the needle swing mechanism in this case.

At first, as described before, the needle 9 is set in such a manner that it can be swung left beyond the base line by the above-mentioned needle swing mechanism 42 including the base line mechanism. Therefore, when the needle 9 is dropped at two right and left positions, the base line position set by the base line mechanism is the right side needle drop position, while a position, to which the needle 9 is swung left by a needle swing amount set by the needle swing mechanism 42 with the base line as the reference, is the left side needle drop position.

In other words, in FIG. 60 which shows the details of the sewing of the bar-tack portion to the middle portion thereof in (3) of FIG. 54, the right side needle drop point n, is situated on the base line; and, the left side needle drop point $n_2$, unless the base line is changed, is situated on the left, by a needle swing amount $H_1$ which can be decided by the needle swing mechanism 42, with respect to the right side needle drop point $n_1$. However, if the base line, in the left side needle drop point $n_2$, is moved right by $K_3$, then the needle swing amount necessary to secure the left side needle drop point $n_2$ is $H_1+H_3(K_3)$.

And, when the left side needle drop point n2 is changed to the next needle drop point n3, the position can be decided by the setting of the base line. That is, since the base line is moved right by an amount of $K_3$ from the base line of needle drop point $n_2$, the base line position moved by $K_3$ itself is the needle drop point $n_3$.

Similarly, when the right side needle drop point n, is changed to the next left side needle drop point n4, the needle swing amount from the base line (it is moved to the right by $K_3$ from the base line of the needle drop point $n_3$) is $H_1+H_3+H_3+H_3$.

Further, when the left side needle drop point n4 is changed to the next needle drop point $n_5$, if the base line is moved, then the thus moved base line position itself provides the needle drop point.

Figure 61:
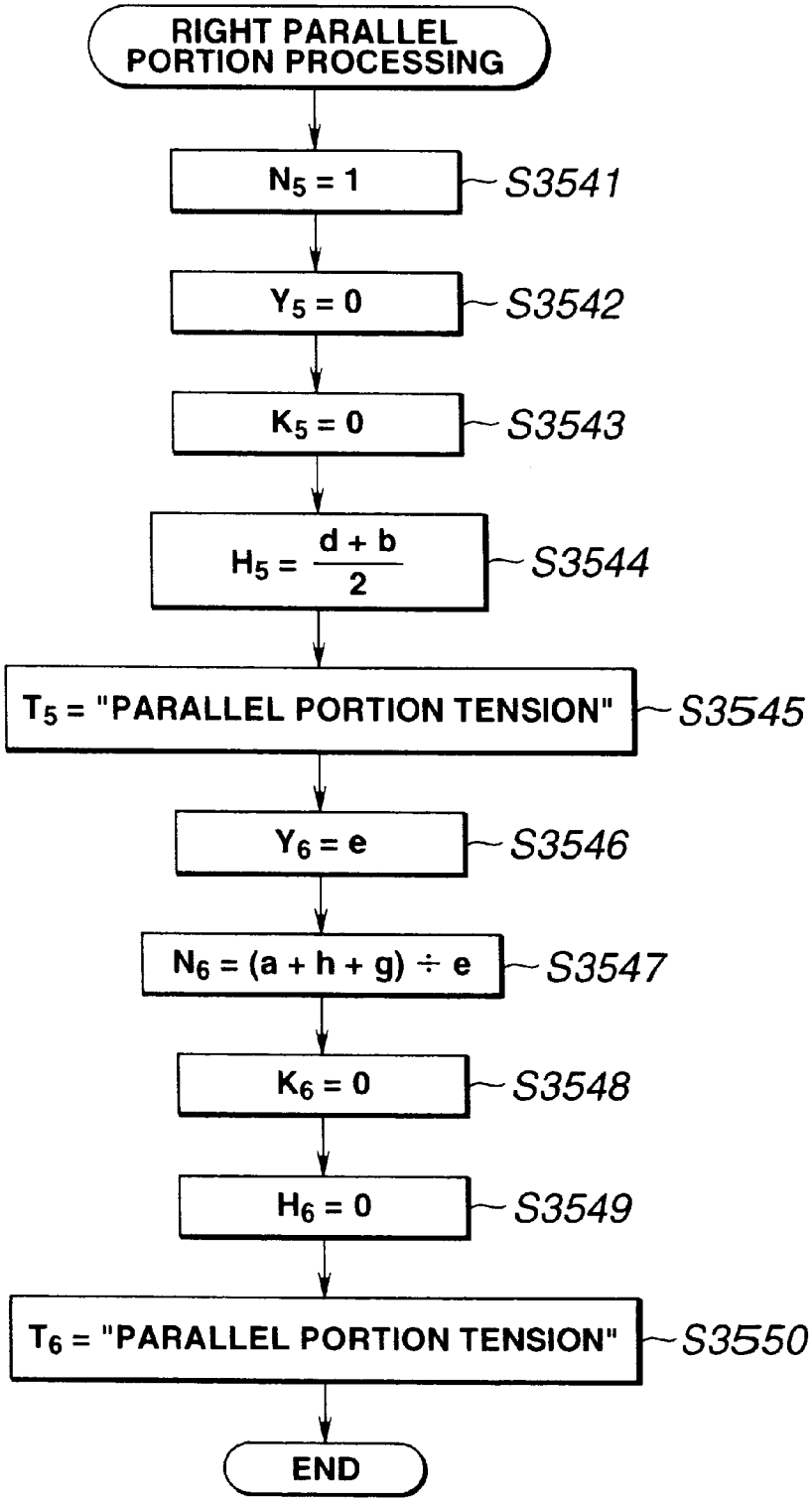
FIG. 61 is a flow chart of a subroutine for a right parallel portion operation processing (Step S354)

Now, FIG. 61 shows a subroutine for the right parallel portion operation (Step S354). In this subroutine, at first, in Step S3541, $N_5$=1 is set, next, in Step S3542, $Y_5$=0 is set, and, next, in Step S3543, $K_5$=0 is set. And, in the next step S3544, $H_5$=(d+b)/2 is operated and, after then, in Step S3545, $T_5$=parallel portion tension is set.

And, in the next step S3546, $Y_6$=e is set and, after then, in Step S3547, $N_6$=(a+h+g). e is operated. Next, in Step S3548, $K_6$=0 is set, in the next step S3549, $H_6$=0 is set, in the next step S3550, $T_6$=parallel portion tension is set and, after then, the processing advances to the above-mentioned step S355 in the flow shown in FIG. 53.

Figure 62:
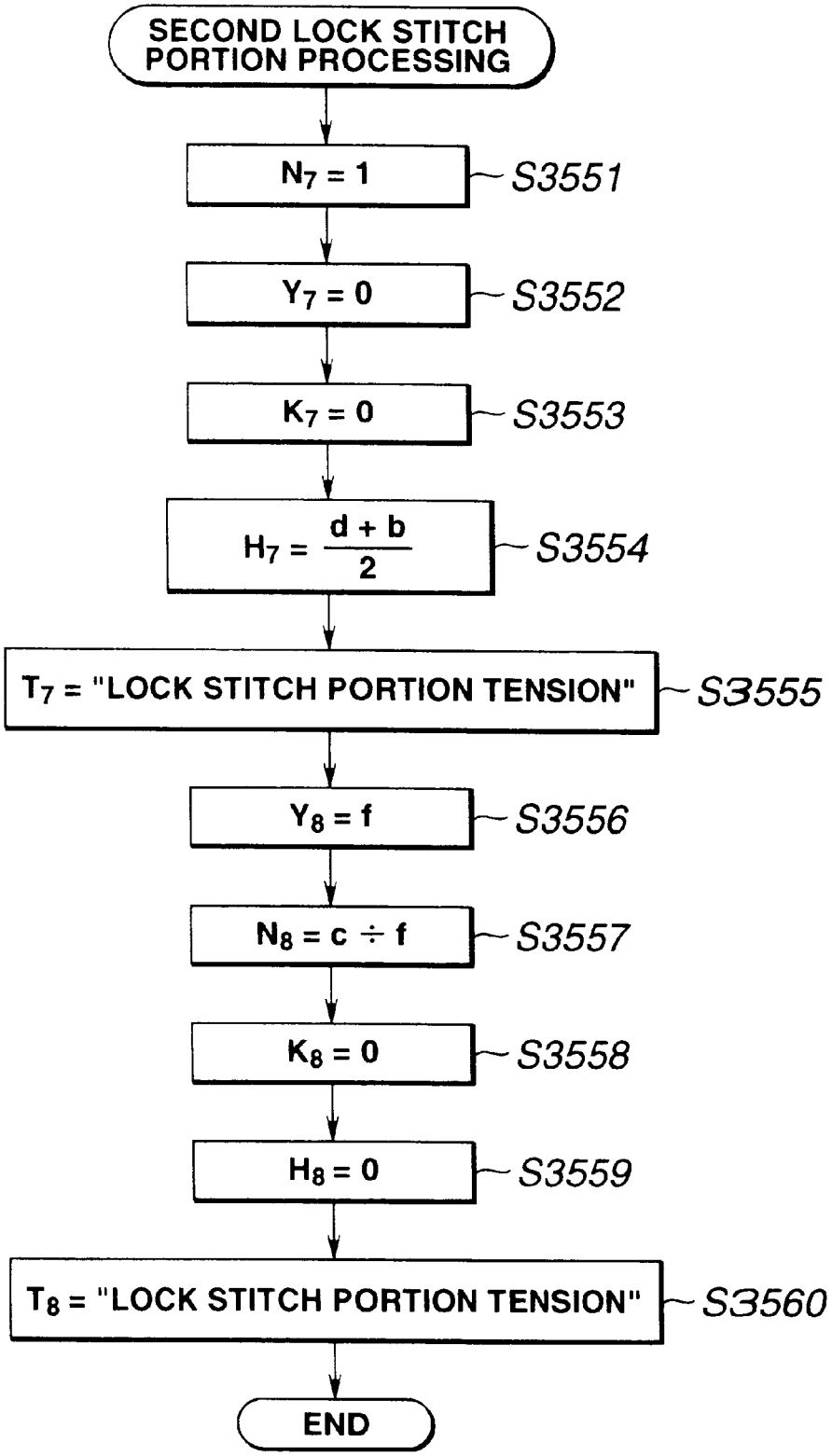
FIG. 62 is a flow chart of a subroutine for a second bar-tack portion operation processing (Step S355)

Now, FIG. 62 shows a subroutine for the second bar-tack portion operation (Step S355). In this subroutine, at first, in Step S3551, $N_7$=1 is set, next, in Step S3552, $Y_1$=0 is set, and, in the next step S3553, $K_7$=0 is set. Next, in the step S3554, $H_1$=(d+b)/2 is operated and, after then, in step S3555, $T_7$=bar-tack portion tension is set.

And, in the next step S3556, $Y_8$=f is set and, in the next step S3557, $N_8$=c. f is operated. After then, in the next step S3558, $K_8$ is set, in the next step S3559, $H_8$=0 is set, in the next step S3560, $T_8$=bar-tack portion tension is set and, after then, the processing advances to the above-mentioned step S356 in the flow shown in FIG. 53.

FIG. 63 shows a subroutine for the sewing end operation (Step S356). In this subroutine, at first, in Step S3561, $Y_9$=f is set, in the next step S3562, $N_9$=(c/2). f is operated and, after then, in Step S3563, $K_9$=(b+d)/2÷$N_9$ is operated.

And, in the next step S3564, $H_9$=(b+d)/2÷$N_9$ is operated, in the next step S3565, $T_9$=sewing end tension is set, in the next step S3566, total stitch number $N={}^{9}\Sigma_{n=2}N_n$ is operated and, after then, the processing advances to the above-mentioned step S36 in the flow shown in FIG. 49.

Figure 64:
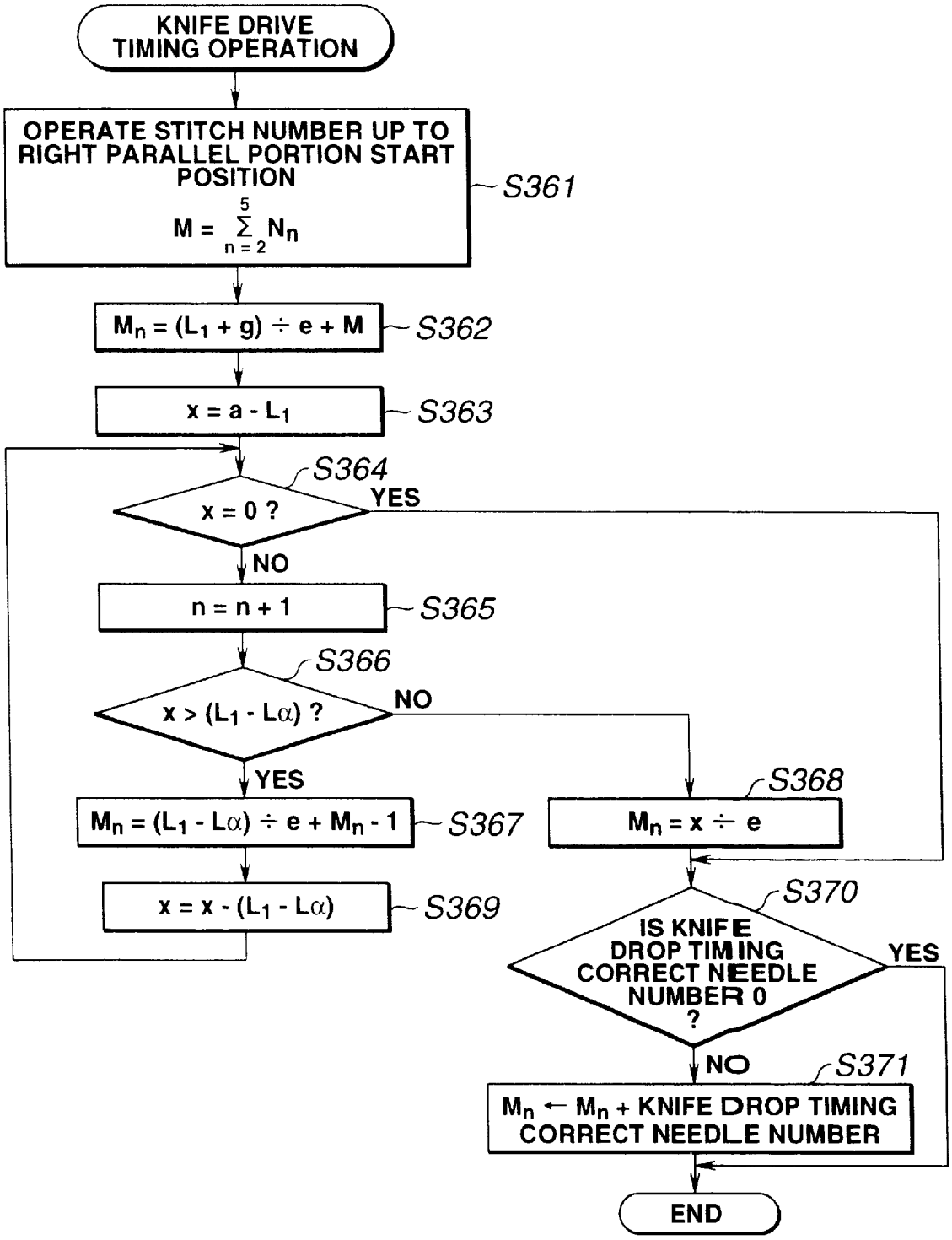
FIG. 64 is a flow chart of a subroutine for a knife drive timing operation processing (Step S36)
Figures 65, 66:
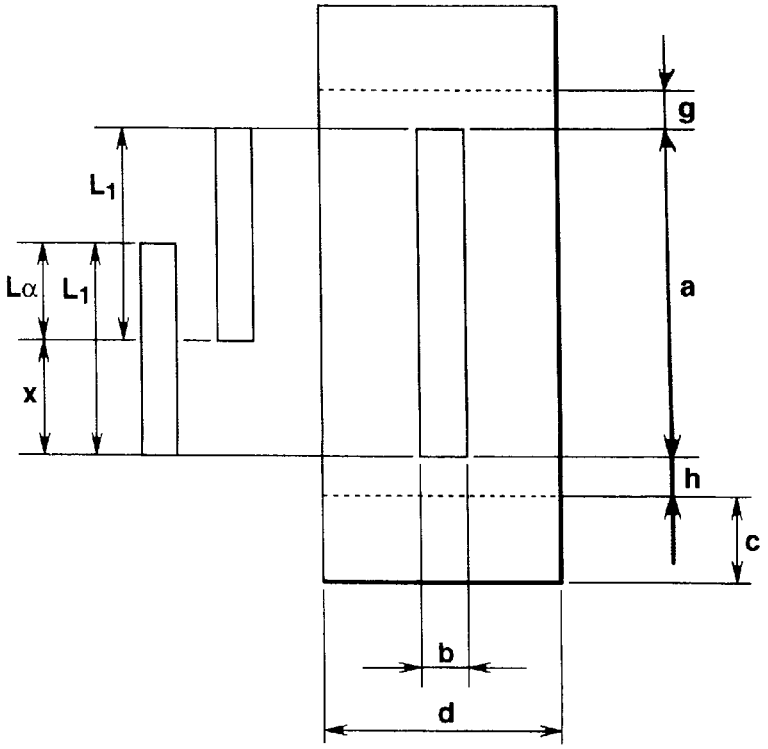
FIG. 65 is a table of the stitch number which is the number of times of the knife drive operations corresponding to the number of times of knife drivings.
FIG. 66 is a table of conditions used in a buttonhole darning portion.

Next, FIG. 64 shows a subroutine for the knife drive timing operation (Step S36). In this case, as shown in a table in FIG. 65, the operation timings for the knife driving that correspond to the knife drive numbers 1~n provide the stitch numbers $M_1$~$M_n$, and the conditions of this subroutine are as shown in FIG. 66.

The above-mentioned knife drive stitch numbers $M_1$~$m_n$, corresponding to the knife drive numbers 1~n are stored into the above-mentioned RAM 102.

In the present knife drive timing operation, as shown in FIG. 64, at first, in Step S361, the stitch number up to the right parallel portion start position $M={}^{5}\Sigma_{n=2}N_n$ is operated, in the next step S362, $Mn=((L_1+g)\div e+M$ is operated, and, in the next step S363, as described above, since the knife size is shorter than the cloth cutting length (side stitch portion), a dimension which is a remainder obtained by subtracting the knife size from the cloth cutting length, that is, $x=a-L_1$ is operated.

And, in the next step S364, it is checked whether x=0 or not. If it is not 0, then in the next step S365, n is incremented by 1 and, after then, the processing advances to the next step S366; or, if x=0, then the processing advances directly to Step S370.

In Step S366, it is checked whether $x>(L_1-L\alpha)$ or not. Here, $L\alpha$ is the overlap amount of the knife.

That is, in Step S366, if $x>(L_1-L\alpha)$, then in the next step S367, $M_n=\{(L_1-L\alpha)\div e\}+M_{n-1}$ is operated; or, if not $x>(L_1-L\alpha)$, then the processing advances to Step S368, in which $M_n=x\div e$ is operated.

Further, after operation of $M_n=\{(L_1-L\alpha)+e\}+M_{n-1}$ in the next step S369, $x=x-(L_1L\alpha)$ is operated and, after then, the processing returns to the above-mentioned step S364.

Also, after operation of $M_n=x\div e$, in the next step S370, it is checked whether the knife drop timing correct stitch number is 0 or not. If 0, then the processing advances directly to the above-mentioned step S4 in the general flow (FIG. 37); or, if not 0, then in the next step S371, Mn+knife drop timing correct stitch number is set in $M_n$, and, after then, the processing advances to the above-mentioned step S4.

Figure 68A:
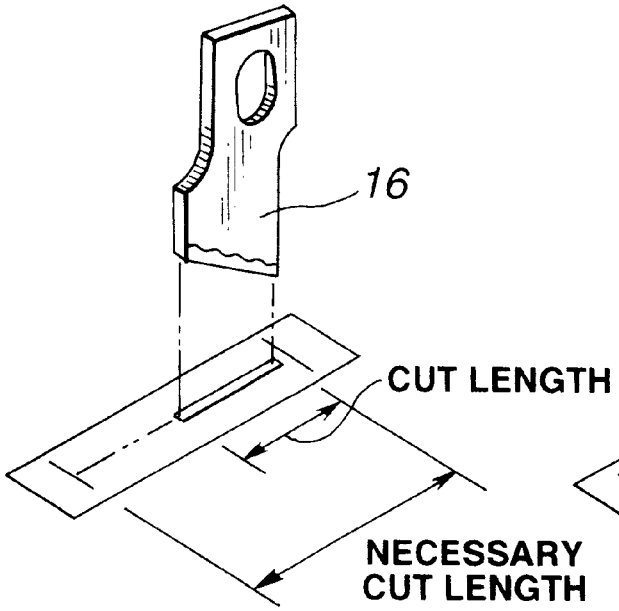
FIG. 68(*a*) is a perspective view of a state after a cloth is cut by the first upward-and-downward movement of the cloth cutting knife, and FIG. 68(*b*) is a perspective view of a state after the remaining portion of the cloth is cut by the second upward-and-downward movement of the cloth cutting knife.
Figure 68B:
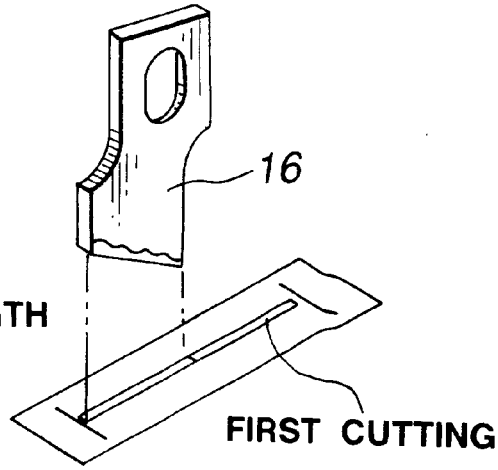

By the way, in the two-times vertical or up-and-down movements of the cloth cutting knife 16, as shown in FIG. 68(*a*), for a cutting length necessary for formation of a given buttonhole, by the first vertical movement of the cloth cutting knife 16, the cloth is cut by a cutting length corresponding to the length of the cutting edge of the cloth cutting knife 16 and, after then, by the second vertical movement of the cloth cutting knife 16, the cloth is cut by the remaining portion of the necessary cutting length.

Figure 69A:
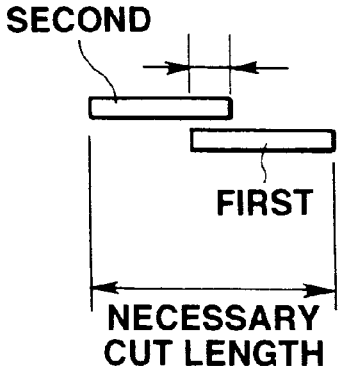
FIGS. 69(*a*) and 69(*b*) are explanatory views of the two-times of the upward-and-downward movement of a cloth cutting knife; in particular FIG. 68(*a*) is a view of a state in which first and second knife drops are overlapped on each other, and FIG. 68(*b*) is a view of a state in which the first and second knife drops are greatly overlapped.
Figure 69B:
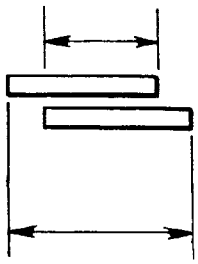

In the above-mentioned two-times vertical movements of the cloth cutting knife 16, as shown in FIG. 69(*a*), the first and second knife drops are overlapped with each other so as to be able to cope with the necessary cutting length, while the overlapping length thereof may be set large depending on the length of the buttonhole, for example, as shown in FIG. 69(*b*).

Figure 70:
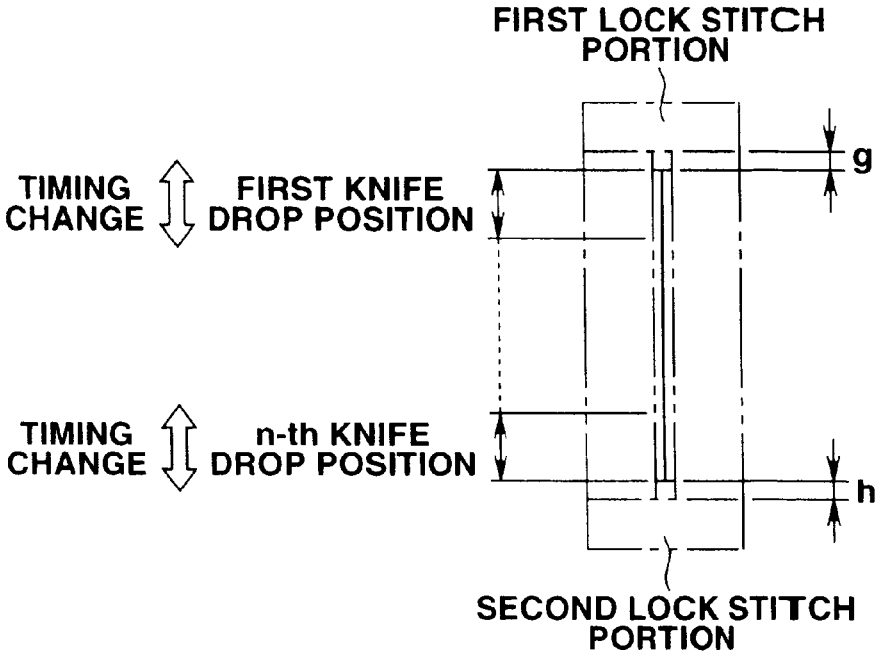
FIG. 70 is a view of the change of a knife drop timing.

And, in two or more times (n times) of the knife drops including the above-mentioned two-times knife drops, as shown in FIG. 70, a gap between the first bar-tack portion (rear lock stitch portion) and the first knife drop portion is set as a gap g and a gap between the second bar-tack portion (front lock stitch portion) and the n-th knife drop portion is set as a gap h; and, the gaps between them are respectively to be corrected by changing the respective knife drop timings.

That is, as shown by arrows in FIG. 70, by changing the first knife drop timing, the gap g between the first bar-tack portion (rear lock stitch portion) and the first knife drop portion can be corrected; and, by changing the n-th knife drop timing, the gap h between the second bar-tack portion (front bar-tack portion) and the n-th knife drop portion can be corrected.

Figure 71:
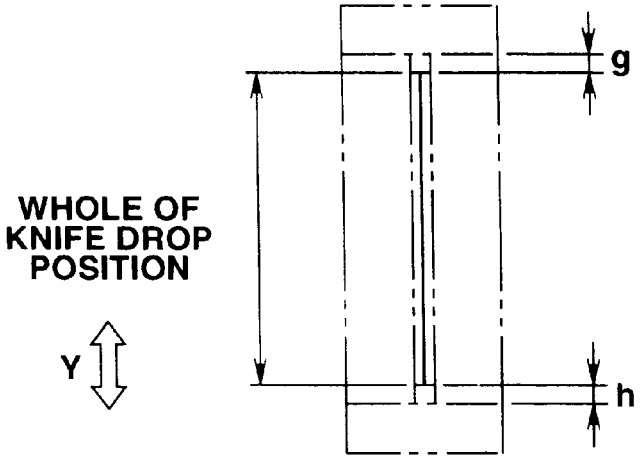
FIG. 71 is a view of the movement of the whole knife drop position.

Also, as the results of the above-mentioned steps S370 and S371, as shown in FIG. 71, a gap between the first bar-tack portion (rear bar-tack portion) and the first knife drop portion is set as a gap g and a gap between the second bar-tack portion (front bar-tack portion) and the nth knife drop portion is set as a gap h; and, while the total sum of the front and rear gaps is set constant, the whole knife drop position can be changed.

That is, while (g+h) is set arbitrarily constant, as shown by arrows in FIG. 71, the whole knife drop position can be moved in the Y direction.

Figure 72:
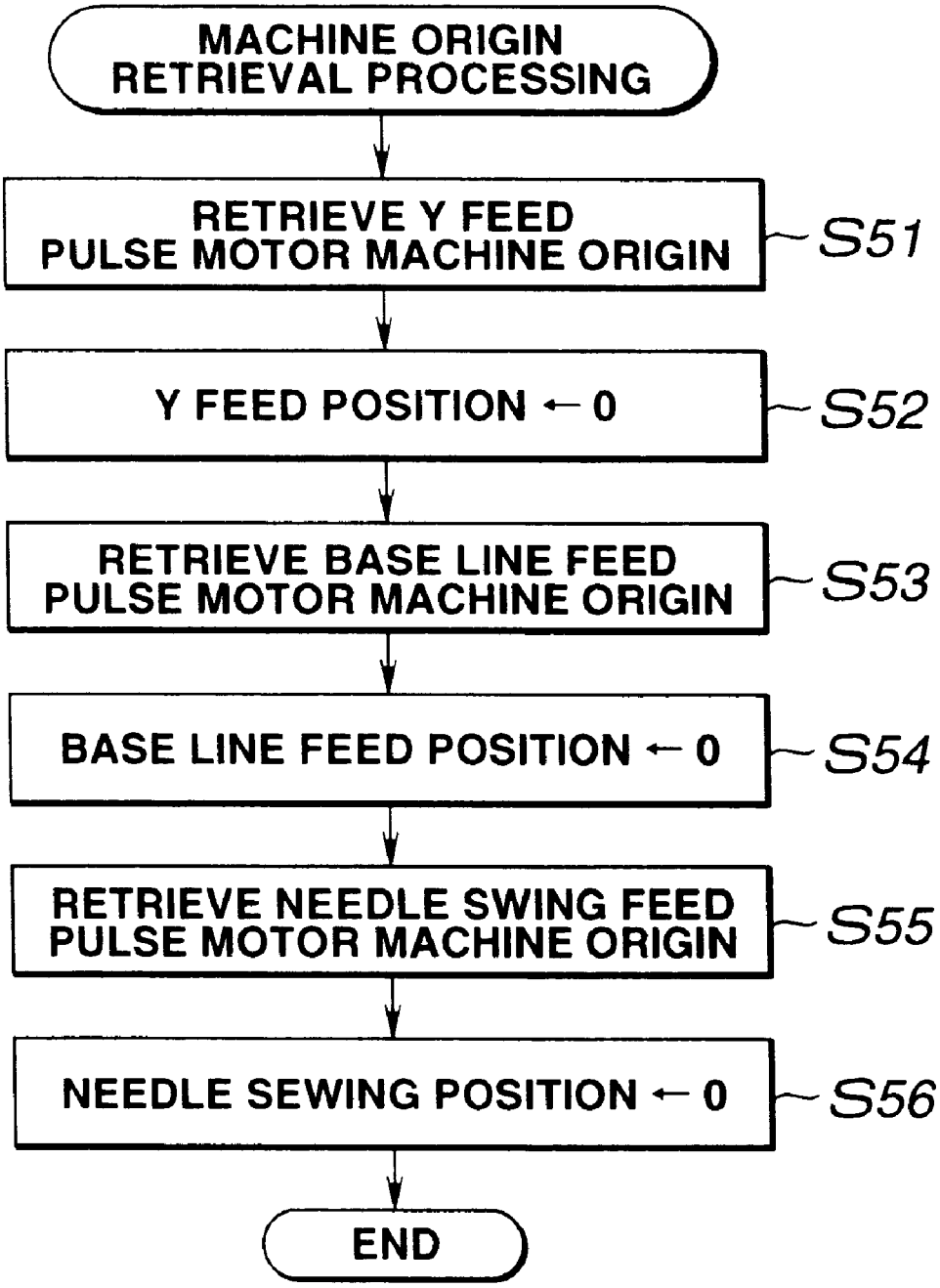
FIG. 72 is a flow chart of a subroutine for a machine origin retrieval processing (Step S5)

Next, FIG. 72 shows a subroutine for the machine origin retrieval processing (Step S5).

In this subroutine, at first, in Step S51, the Y feed pulse motor 20 is driven while checking the Y feed origin sensor 26, thereby retrieving the origin position of the Y feed pulse motor 20.

After retrieval of the origin position of the Y feed pulse motor 20, in the next step S52, 0 is set in the Y feed position.

Next, in Step S53, the base line feed pulse motor 40 is driven while checking the base line feed origin sensor 57, thereby retrieve the ongoing position of the base line feed pulse motor 40. After then, in the next step S54, 0 is set in the base line feed position.

And, in the next step S55, the needle swing feed pulse motor 41 is driven while checking the needle swing origin sensor 58, thereby retrieving the origin position of the needle swing feed pulse motor 41. Next, in Step S56, 0 is set in the needle swing feed position. After then, the processing advances to the above-mentioned step S6 in the general flow (FIG. 37).

Figure 73:
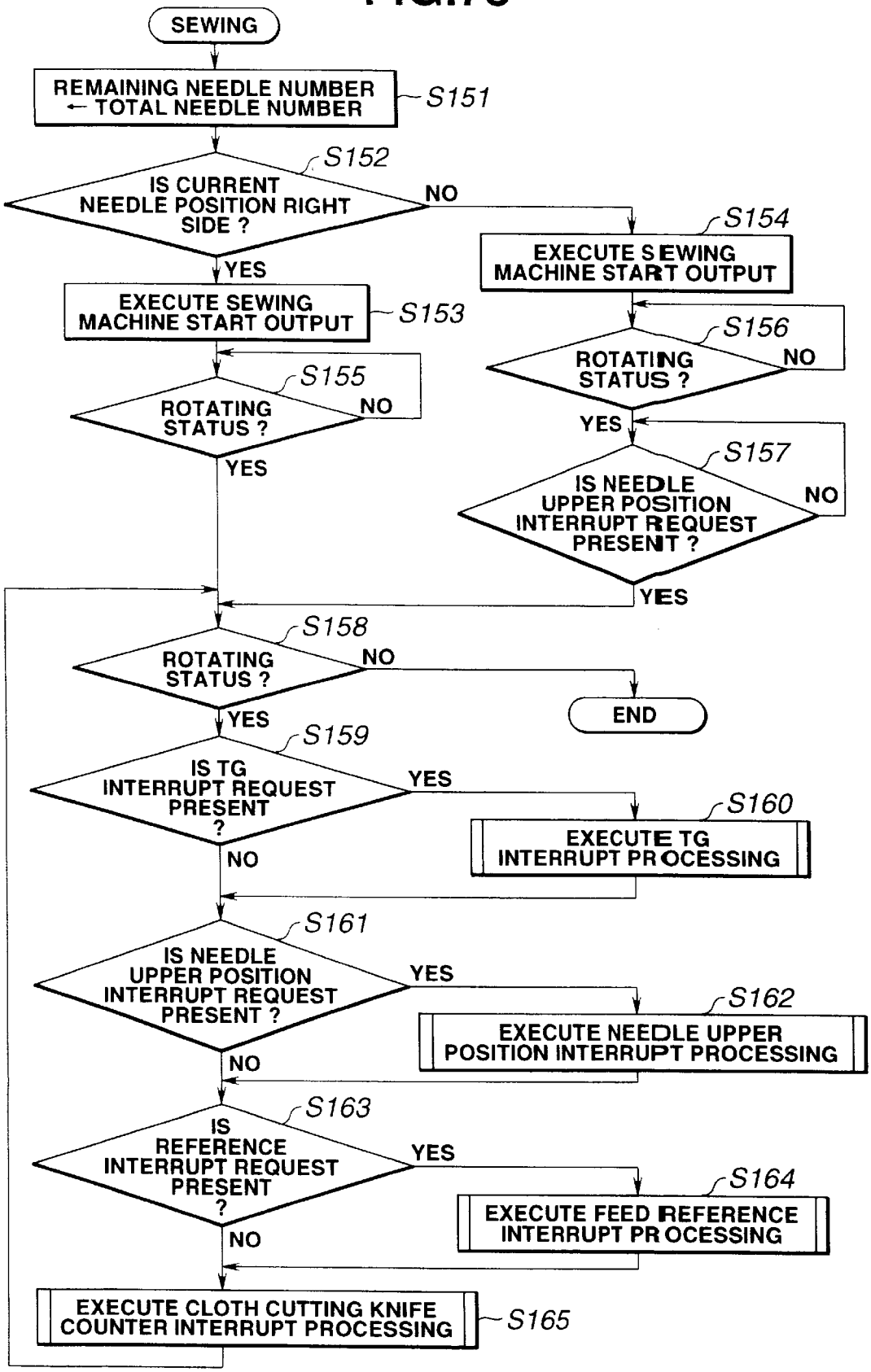
FIG. 73 is a flow chart of a subroutine for a sewing operation processing (Step S15)

Next, FIG. 73 shows a subroutine for the sewing operation (Step S15). In this subroutine, at first, in Step S151, the total stitch number is set as the remaining stitch number and; in the next step S152, while checking the needle swing right and left detect sensor 59, it is judged whether the current needle swing position is the right side (base line side) or not. If it is the right side, then in the next step S153, a sewing machine start output is executed and, after then, the processing advances to the next step S155.

Also, if the current needle swing position is not the right side, then the processing advances to Step S154, in which a sewing machine start output is executed and, after then, the processing advances to the next step S156.

In Step S155, it is checked from a pulse from the sewing machine encoder 119 whether the sewing machine status is a rotating status or not. If it is a rotating status, then the processing advances to the next step S158; or, if not, the processing returns to Step S155.

Also, in Step S156, it is checked from a pulse from the sewing machine encoder 119 whether the sewing machine status is a rotating status or not. If it is a rotating status, then the processing advances to the next step S157; or, if not, the processing returns to Step S156. Next, in Step S157, while checking the needle upper position sensor 116, it is judged whether a needle upper position interrupt request is present or not in the interrupt controller 108. If the needle upper position interrupt request is present, then the processing advances to the next step S158; or, if the needle upper position interrupt request is not present, then the processing returns to Step S157.

And, in Step S158, it is checked from a Fulse from the sewing machine encoder 119 whether the sewing machine status is a rotating status or not. If it is a rotating status, then the processing advances to the next step S159; or, if not, the processing advances to the abovementioned step S16 in the general flow (FIG. 37).

In Step S159, while checking the TG generator 118, it is judged whether a TG interrupt request is present or not in the interrupt controller 108. If the TG interrupt request is present, then in the next step S160, the TG interrupt processing is executed and, after then, the processing advances to the next step S161; or, if the TG interrupt request is not present, then the processing advances directly to Step S161.

In Step S161, it is judged whether a needle upper position interrupt request is present or not in the interrupt controller 108. If the needle upper position interrupt request is present, then in the next step S162, the upper needle position interrupt processing is executed and, after then, the processing advances to the next step S163; or, if the needle upper position interrupt request is not present, then the processing advances directly to Step S163.

In Step S163, while checking the feed reference position sensor 117, it is judged whether a feed reference interrupt request is present or not in the interrupt controller 108. If the feed reference interrupt request is present, then in the next step S164, the feed reference interrupt processing is executed and, after then, the processing advances to the next step S165; or, if the feed reference interrupt request is not present, then the processing advances directly.

Next, in Step S165, a cloth cutting knife counter interrupt processing is executed and, after then, the processing returns to the above-mentioned step S158.

Next, description will be given below sequentially in detail of the TG interrupt processing (Step S160), needle upper position interrupt processing (Step S162), feed reference interrupt processing (Step S164), and cloth cutting knife counter interrupt processing (Step S165) respectively included in the sewing operation (Step S15).

Figure 74:
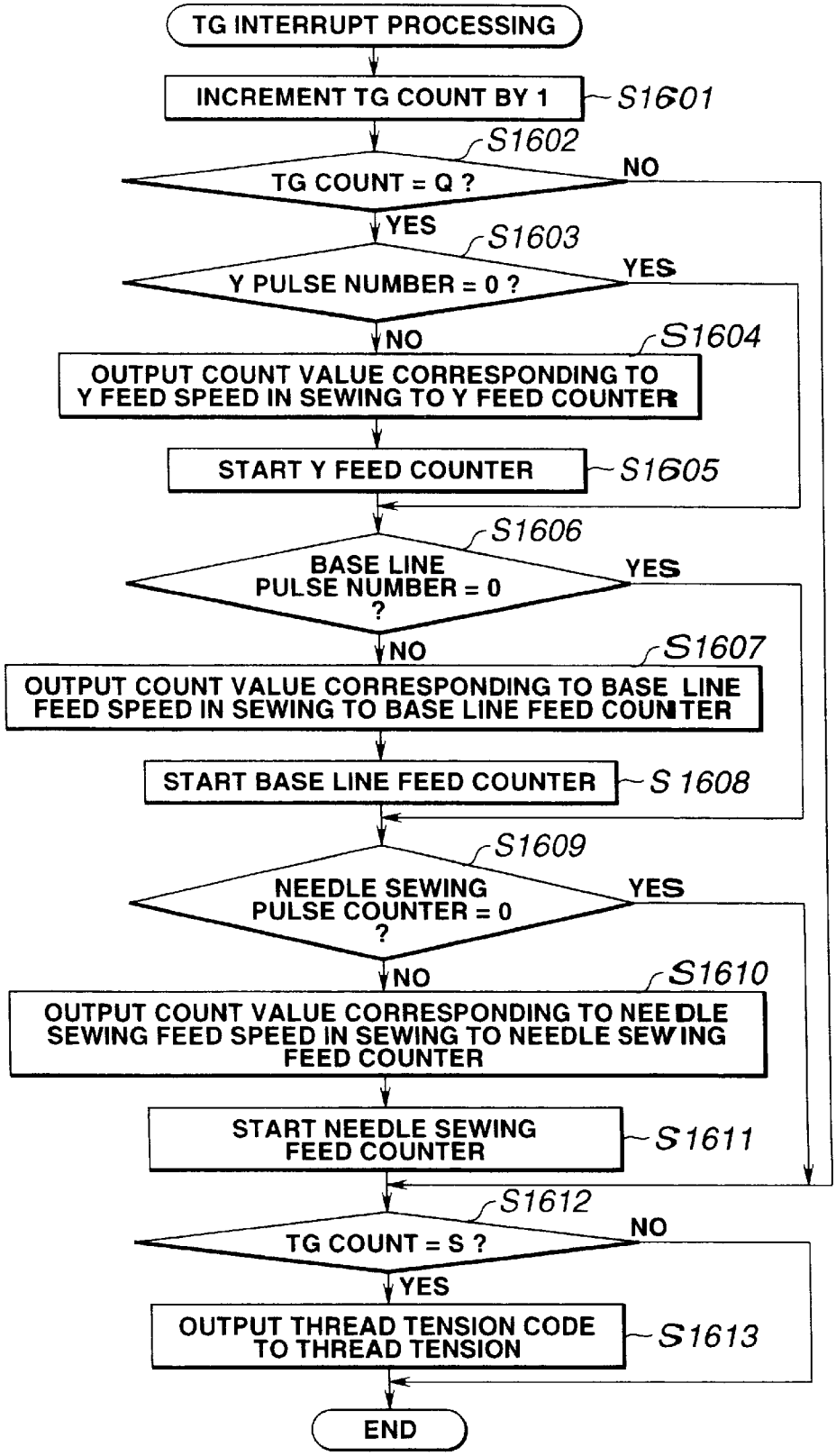
FIG. 74 is a flow chart of a subroutine for a TG interrupt processing (Step S160)

Now, FIG. 74 shows a subroutine for the TG interrupt processing (Step S160). In this subroutine, at first, in Step S1601, the TG count is incremented by 1 and, in the next Step S1602, it is checked whether the TG count is Q or not. If the TG count is Q, then the processing advances to the next step S1603; or, if it is not Q, then the processing advances directly to Step S1612.

In Step S1603, it is checked whether the Y feed pulse number is 0 or not. If it is 0, then the processing advances directly to Step S1606; or, if it is not 0, the processing advances to the next step S1604. In Step S1604, a count value corresponding to the Y feed speed in sewing is output to the Y feed counter 103, next, in Step S1605, the Y feed counter 103 is started and, after then, the processing advances to the next step S1606.

In Step S1606, it is checked whether the base line pulse number counted by the base line feed counter 104 is 0 or not. If it is 0, then the processing advances directly to Step S1609; or, if it is not 0, then the processing advances to the next step S1607. In Step S1607, a count value corresponding to the base line feed speed in sewing is output to the base line feed counter 104, in the next step S1608, the base line feed counter 104 is started and, after then, the processing advances to the next step S1609.

In Step S1609, it is checked whether the needle swing feed pulse number counted by the needle swing feed counter 105 is 0 or not. If it is 0, then the processing advances directly to Step S1612; or, if it is not 0, the processing advances to the next step S1610. In Step S1610, a count value corresponding to the needle swing feed speed in sewing is output to the needle swing feed counter 105, in the next step S1611, the needle swing feed counter 105 is started and, after then, the processing advances to the next step S1612.

And, in Step S1612, it is checked whether the TG count is S or not. If it is S, then in the next step S1613, a thread tension code is output to the thread tension and, after then, the processing advances to the above-mentioned step S161 in the flow shown in FIG. 73; or, if the TG-count is not S, then the processing advances directly to the above-mentioned step S161.

Figure 75:
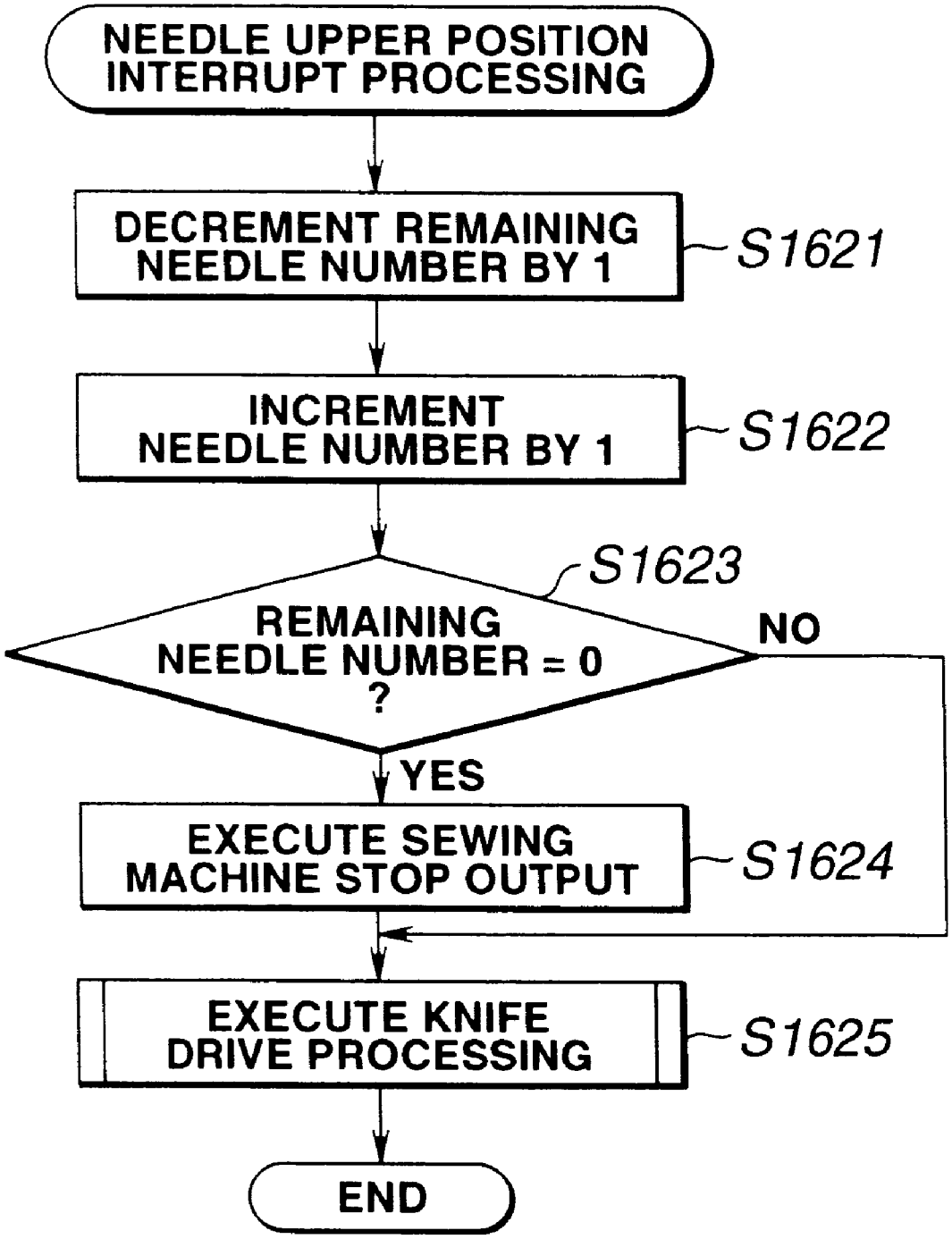
FIG. 75 is a view of the change of a needle upper position interrupt processing (S162)

Next, FIG. 75 shows a subroutine for the needle upper position interrupt processing (Step S1629). In this subroutine, at first, in Step S1621, the remaining stitch number is decremented by 1, in the next step S1622, the stitch number count is incremented by 1 and, after then, the processing advances to the next step S1623.

In Step 1623, it is checked whether the remaining stitch number is 0 or not. If it is 0, then in the next step S1624, a sewing machine stop output is executed; or, if it is not 0, then the processing advances directly to Step S1625.

And, in Step S1625, a knife drive processing is executed and, after then, the processing advances to the above-mentioned step S163 in the flow shown in FIG. 73.

Figure 76:
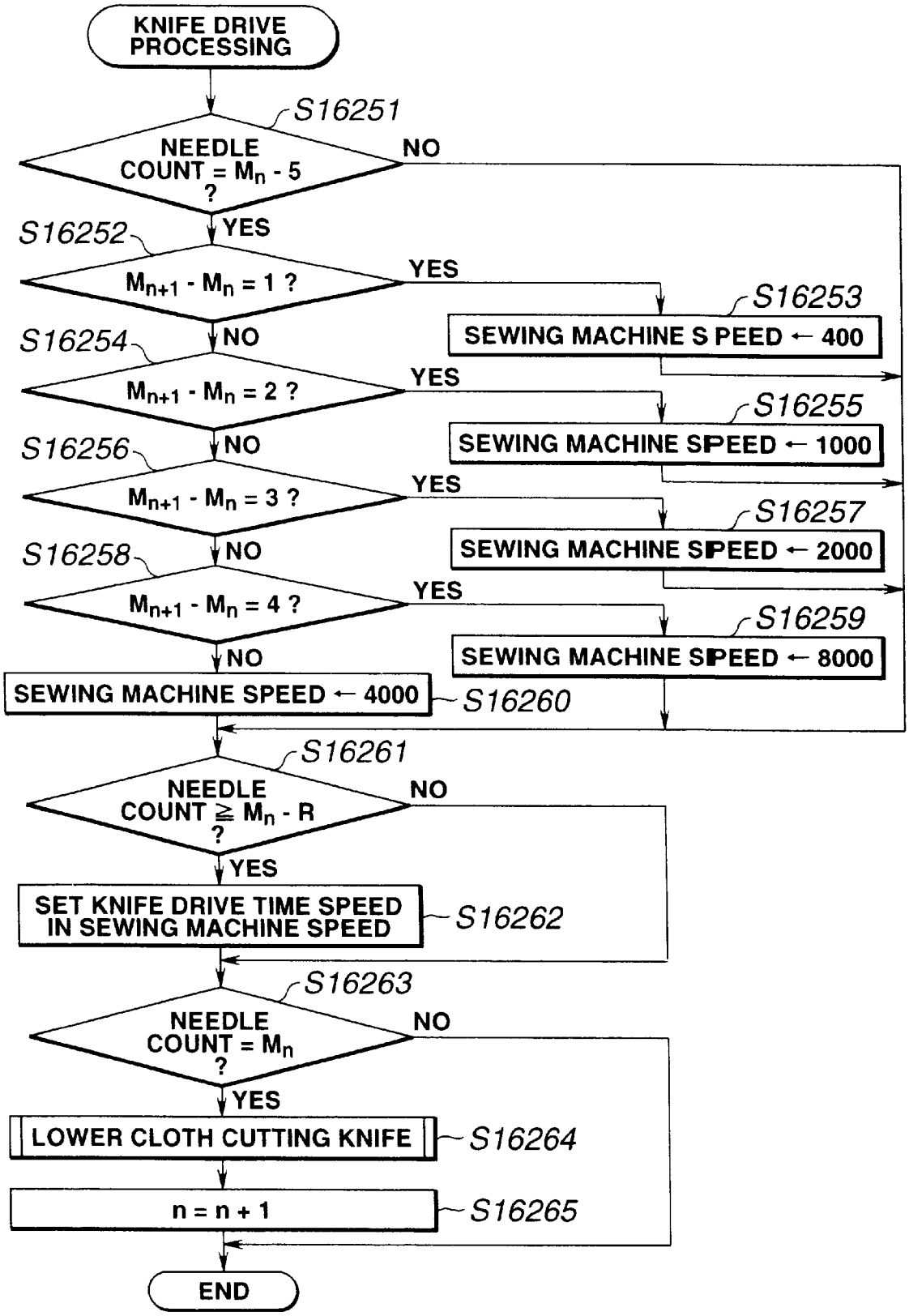
FIG. 76 is a view of a knife drive processing (Step S1625)

Now, FIG. 76 shows a subroutine for the needle upper position interrupt processing (Step S162). In this subroutine, at first, in Step S16251, it is checked whether the stitch number count is $M_n$−5 or not. If the stitch number count is $M_n$−5, then the processing advances to the next step S16252; or, if the stitch number count is not $M_n$−5, then the processing advances directly to Step S16261.

In Step S16252, it is checked whether $M_{n+1}-M_n$ that is, a difference between a former knife down stitch number $M_n$ and a latter knife down stitch number $M_{n+1}-M_n$ is 1 or not. If it is 1, then the processing advances to Step S16253, in which 400 [spm] is set in the sewing machine speed and, after then, the processing advances to Step S16261; or, if $M_{n+1}-M_n$ is not then the processing advances to the next step S16254.

In Step S16254, it is checked whether $M_{n+1}-M_n$ is 2 or not. If it is 2, then the processing advances to Step S16255, in which 1000 [spm] is set in the sewing machine speed and, after then, the processing advances to Step S16261; or, if $M_{n+1}-M_n$ is not 2, then the processing advances to the next step S16256.

In Step S16256, it is checked whether $M_{n+1}-M_n$ is 3 or not. If it is 3, then the processing advances to Step S16257, in which 2000 [spm] is set in the sewing machine speed and, after then, the processing advances to Step S16261; or, if $M_{n+1}-M_n$ is not 3, then the processing advances to the next step S16258.

In Step S16258, it is checked whether $M_{n+1}-M_n$ is 4 or not. If it is 4, then the processing advances to Step S16259, in which 3000 [spm] is set in the sewing machine speed and, after then, the processing advances to Step S16261; or, if $M_{n+1}-M_n$ is not 4, then in the next step S16260, 4000 [spm] is set in the sewing machine speed and, after then, the processing advances to the next step S16261.

Since the sewing machine speed can be controlled according to the operation intervals (stitch numbers) of the cloth cutting knife by means of the above-mentioned control in the steps S16251 to S16260, after the first downward movement of the cloth cutting knife, the cloth cutting knife can be surely returned to the lifted position before the cloth cutting knife moves downward next time.

And, in Step S16261, it is checked whether the stitch number count is $M_n$−R or more. If the stitch number count is $M_n$−R or more, then in the next step S16262, a knife drive time speed is set in the sewing machine speed and, after then, the processing advances to the next step S16263; or, if the stitch number count is not $M_n$−R or more, then the processing advances directly to Step S16263. The knife drive time speed should be set to such a speed (including "stop") as can prevent a possibility that, when the cloth presser is moved in harmony with the sewing machine, the cloth can be torn or shifted by the downward moving cloth cutting knife.

In Step S16263, it is checked whether the stitch number count is $M_n$ or not. If the stitch number count is $M_n$, then the processing advances to the next step S16264; or, if the stitch number count is not $M_n$, then the processing advances directly to the above-mentioned step S163 in the flow shown in FIG. 73.

Further, in Step S16264, the cloth cutting knife is lowered down, in the next step S16265, n is incremented by 1 and, after then, the processing advances to the above-mentioned step S163 in the flow shown in FIG. 73.

Figure 77:
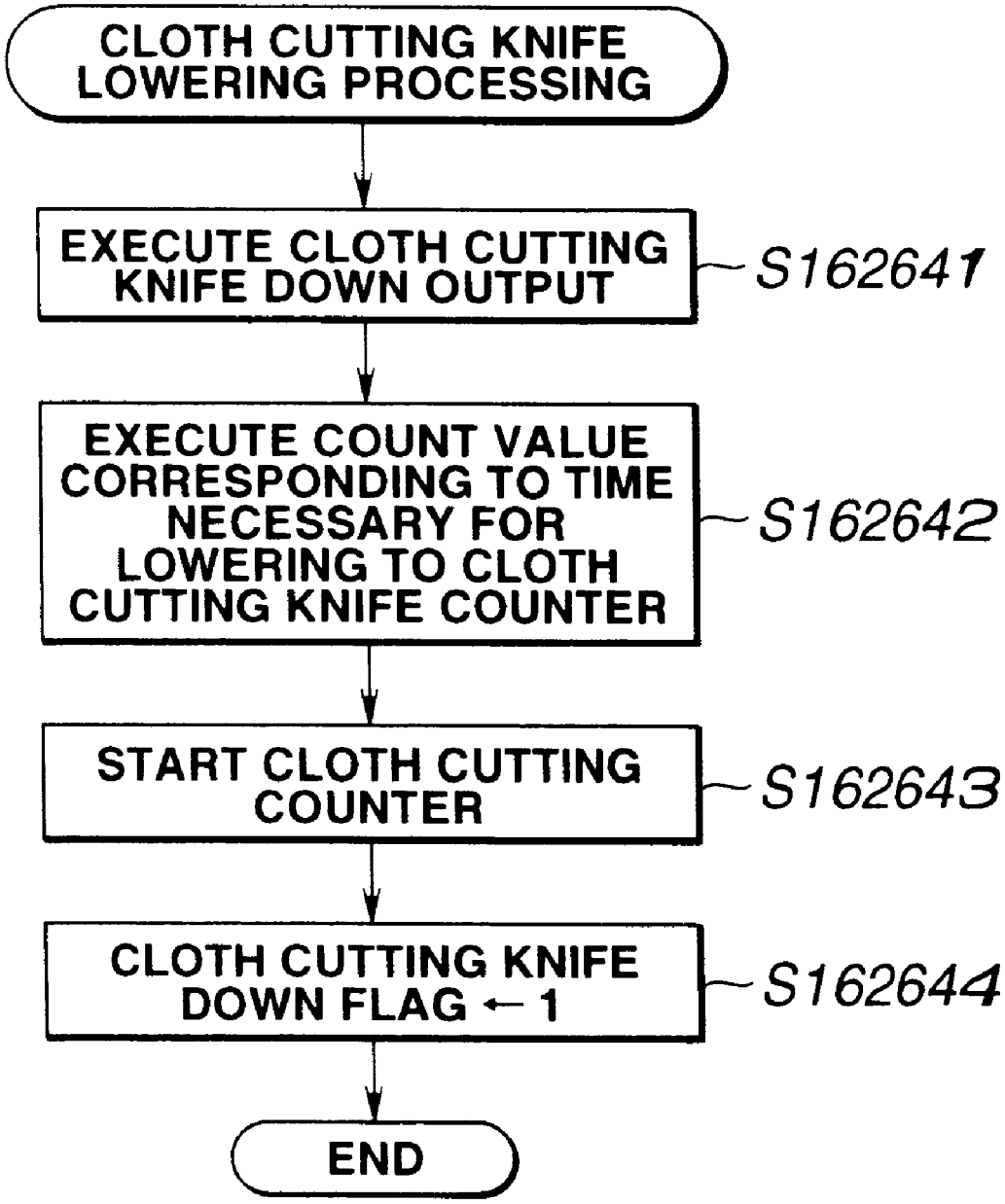
FIG. 77 is a flow chart of a subroutine for a cloth cutting knife downward-movement processing (Step S16264)

Now, FIG. 77 shows a subroutine for the cloth cutting knife downward movement (Step S16264) in the knife drive processing (Step S1625). In this subroutine, at first, in Step S162641, a cloth cutting knife downward movement output is issued to the cloth cutting knife down cylinder drive circuit 123 in accordance with a given stitch number count, with the result that the cloth cutting knife down cylinder 30 drives the cloth cutting knife 16 to move downward.

Next, in Step S162642, a count value corresponding to the time necessary for the downward movement of the cloth cutting knife 16 is output to the cloth cutting knife counter 107 and, in the next step S162643, the cloth cutting knife counter 106 is started.

And, in the next step S162644, 1 is set in a cloth cutting knife down flag and, after then, the processing advances to the above-mentioned step S16265 in the flow shown in FIG. 76.

Figure 78:
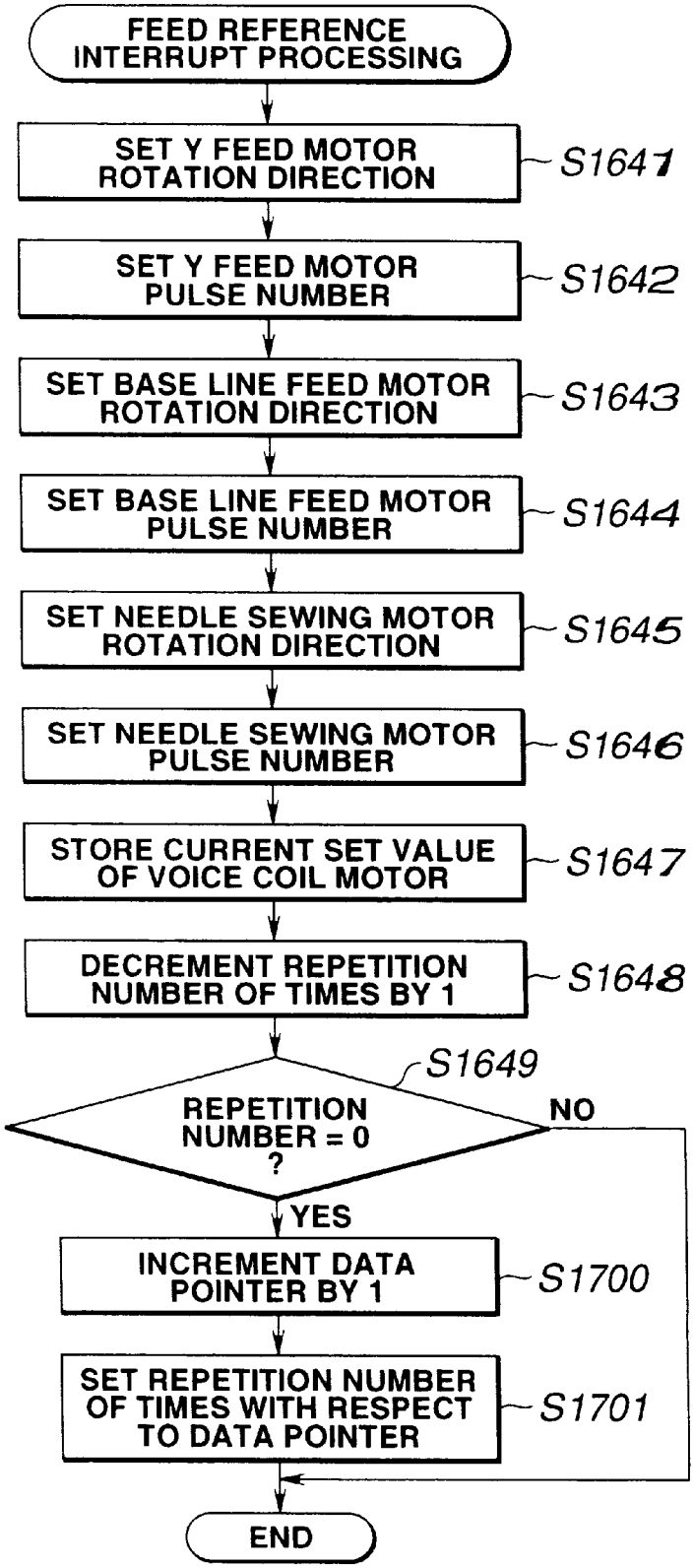
FIG. 78 is a flow chart of a subroutine for a feed reference interrupt processing (Step S164)

Next, FIG. 78 shows a subroutine for the feed reference interrupt processing (Step S164). In this subroutine, at first, in Step S1641, the rotation direction of the Y feed pulse motor 20 is set and, after then, in the next step S1642, the pulse number of the Y feed pulse motor 20 is set.

Next, in Step S1643, the rotation direction of the base line feed pulse motor 40 is set and, after then, in the next step S1644, the pulse number of the base line feed pulse motor 40 is set.

After then, in the next step S1 645, the rotation direction of the needle swing feed pulse motor 41 is set and, after then, in the next step S1646, the pulse number of the needle swing feed pulse motor 41 is set.

And, in the next step S1647, the current set value of the voice coil motor (upper thread tension VCM) for variably controlling the tension of the tension block 19 and, after then, in the next step S1648, the repetition number is decremented by 1.

After then, in the next step S1649, it is checked whether the repetition number is 0 or not. If the repetition number is 0, then in the next step S1700, the data pointer is incremented by 1, next, in Step S1701, the repetition number with respect to the data pointer is set and, after then, the processing advances to the above-mentioned step S165 in the flow shown in FIG. 73.

By the way, in the above-mentioned step S1649, if the repetition number is not 0, then the processing advances directly to the above-mentioned step S165.

Figure 79:
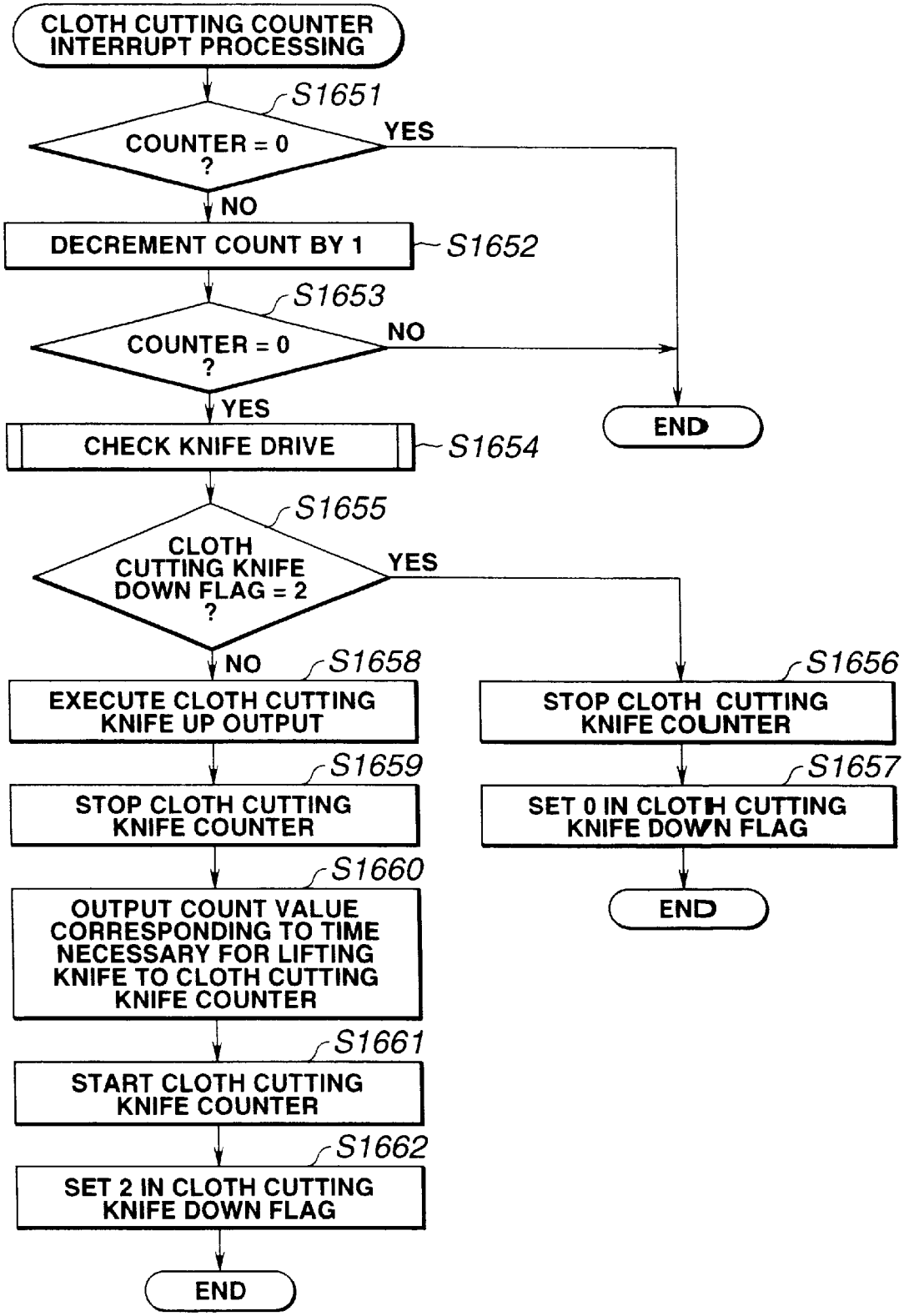
FIG. 79 is a flow chart of a subroutine for a cloth cutting knife counter interrupt processing (Step S165)

Next, FIG. 79 shows a subroutine for the cloth cutting knife counter interrupt processing (Step S165). In this subroutine, at first, in Step S1651, it is checked whether the count of the cloth cutting knife counter 106 is 0 or not. If the count is 0, then the processing returns directly to the above-mentioned step S158 in the flow shown in FIG. 73; or, if the count is not 0, then in the next step S1625, the count is decremented by 1.

After then, in the next step S1653, it is checked again whether the count is 0 or not. If the count is 0, then in the next step S1654, the knife drive check is executed; or, if the count is not 0, then the processing returns directly to the above-mentioned step S158.

After the knife drive check is executed, in the next step S1655, it is checked whether the cloth cutting down flag is 2 or not. If the down flag is 2, then the processing advances to Step S1656; or, if the down flag is not 2, then the processing advances to Step S1658.

That is, in Step S1656, the cloth cutting knife counter 106 is stopped, next in Step S1657, 0 is set in the cloth cutting knife down flag and, after then, the processing returns to the above-mentioned step S158 in the flow shown in FIG. 73.

Also, in Step S1658, a cloth cutting knife up output is issued to the cloth cutting knife down cylinder drive circuit 123, with the result that the cloth cutting knife down cylinder 30 drives the cloth cutting knife 16 to move upward.

After then, in the next step S1659, the cloth cutting knife counter 106 is stopped and, in the next step S1660, a count value corresponding to the time necessary for the upward movement of the cloth cutting knife 16 is output to the cloth cutting knife counter 106.

And, in the next step S1661, the cloth cutting knife counter 106 is started, next, in Step S1662, 2 is set in the cloth cutting knife down flag and, after then, the processing returns to the above-mentioned step S158 in the flow shown in FIG. 73.

Figure 80:
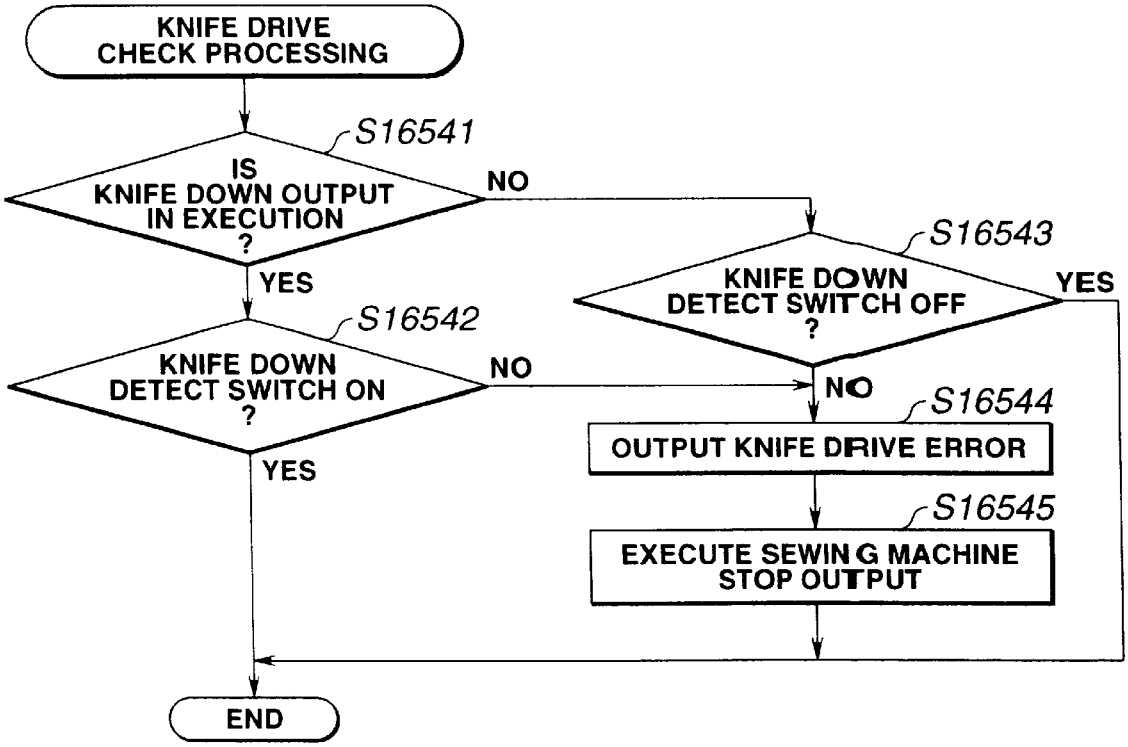
FIG. 80 is a flow chart of a subroutine for a cloth cutting knife drive check processing (Step S1654)

Next, FIG. 80 shows a subroutine for the knife drive check processing (Step S1654). In this subroutine, at first, in Step S16541, it is checked whether a cloth cutting knife down signal to the cloth cutting knife down cylinder drive circuit 123 is being output or not. If the signal is being output, then the processing advances to the next step S16542; or, if the signal is not being output, then the processing advances to Step S16543.

In Step S16542, it is checked whether the knife down detect switch **34*b* is on or not. If the switch is on, then the processing returns to the above-mentioned step S1675 in the flow shown in FIG. 79; or, if the switch is not on, then the processing advances to Step S16544**.

Also, in Step S16543, a knife down detect switch **34*b* is off or not. If the switch is off, then the processing returns to the above-mentioned step S1675 in the flow shown in FIG. 79; or, if the switch is not off, then the processing advances to Step S16544**.

And, in Step S16544, a knife drive error is output. Then, in the next step S16545, the sewing machine stop output is issued and, after then, the processing returns to the above-mentioned step S1675. Therefore, when the knife drive error occurs, the sewing machine is caused to stop at the needle upper position.

In a buttonhole darning sewing machine having the above-mentioned control system according to the present embodiment of the invention, description will be given below of the buttonhole sewing operation employing the sewing sequence (data point) ranging from (1) to (9) shown in FIG. 54. That is, after an operator sets necessary numerical values on the operation panel 110, the sewing machine is moved due to the sewing start operation in Step S6 and is thereby situated at a sewing start position, that is, a point P, shown in FIG. 54 with the cloth presser 15 lowered down. If the start switch is operated by the operator, then the sewing operation according to Step S15 is started.

According to this sewing subroutine, the left side sewing (left parallel portion) corresponding to the data point (2) is started, the respective pulse motors are operated in accordance with the setting of the respective pulses which is executed by the feed reference interrupt processing S164 at a timing set by the TG interrupt processing S160. When the repetition number of times of the feed reference interrupt processings is judged 0 (Step S1649), that is, when the stitch number (the number of stitches) reaches a given value, the data point is set to (3) (Step S1700); and, similarly, the stitches are formed according to the TG interrupt processing and feed interrupt processing. After then, similarly, the data point (4) and (5) are carried out to thereby form the first bar-tack portion.

In the data point (6), that is, during the right side sewing (right parallel portion sewing), in the knife drive processing routine of the needle upper position interrupt processing (Step S161), when the count value reaches the operation set value M, to the stitch number count, the cloth cutting knife 16 is moved downward in accordance with the processing of the cloth cutting knife down subroutine. At the then time, in accordance with the set value (which is previously set) of R of Step S16261, several stitches before the cloth cutting knife 16 is lowered down or when the cloth cutting knife 16 is lowered down, the sewing machine speed is reduced down to the above-mentioned knife drive speed. And, this operation is repeated a number of times corresponding to the numerical value n operated in the above-mentioned manner (S16265). Also, the repetition interval of the cloth cutting knife downward movements is judged and, in accordance with the judgment result, the sewing machine speed is set (Steps S16251 to S16260).

In the needle upper position interrupt processing on the data point (9), at the point P9, that is, at the sewing start position P1, if the remaining stitch number is 0, that is, if the buttonhole darning sewing is completed, then the sewing machine stop output is issued so that the sewing machine is stopped at the needle upper position by the conventionally known constant position stop means.

Figure 89:
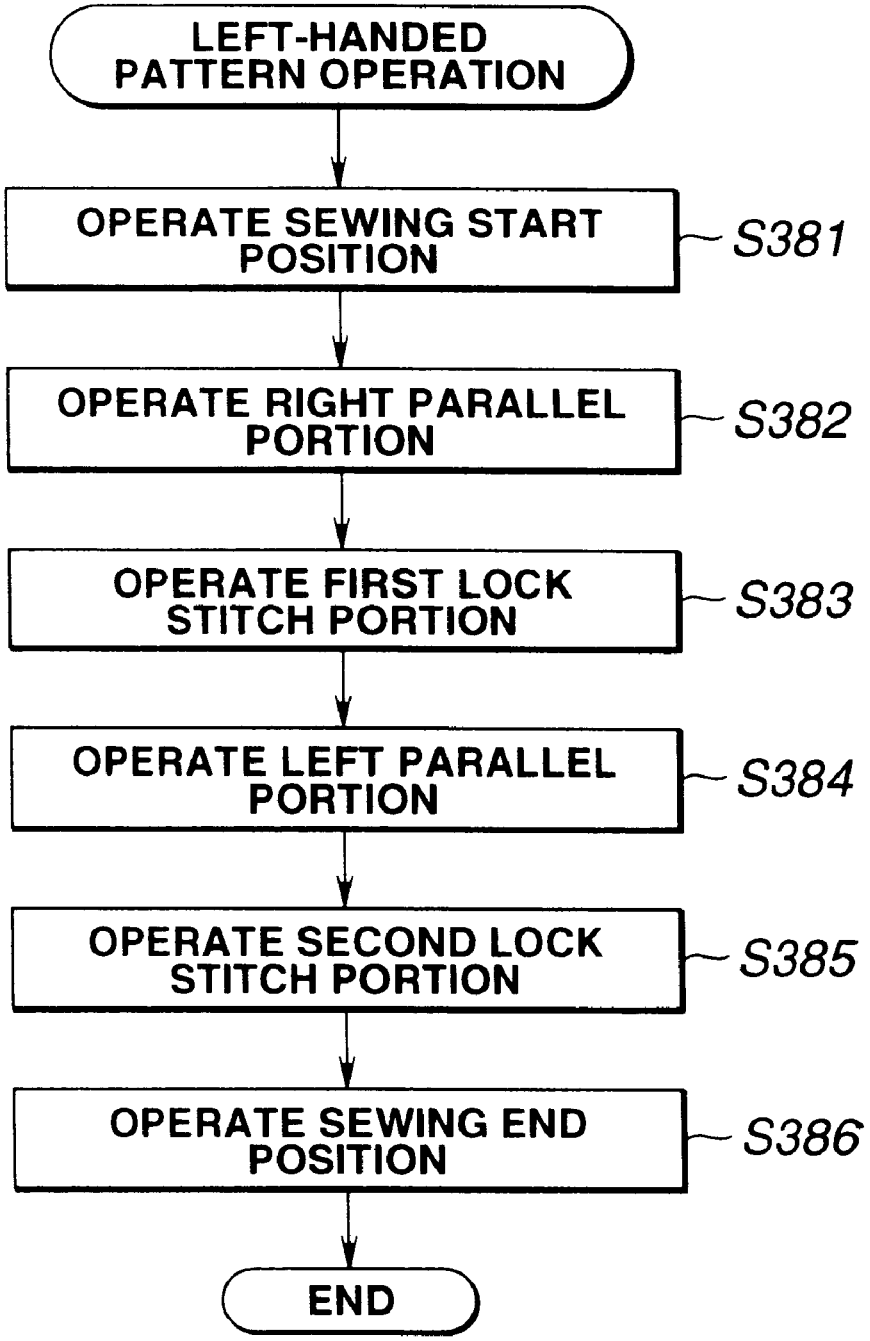
FIG. 89 is a flow chart of a subroutine for a left-handed pattern operation processing (Step S38)

Now, FIG. 89 shows a subroutine for the left-handed pattern operation (Step S38). In this subroutine, at first, in Step S381, a sewing start position is operated, in the next step S382, the right parallel portion is operated and, in the next step S383, the first bar-tack portion is operated.

Figure 90:
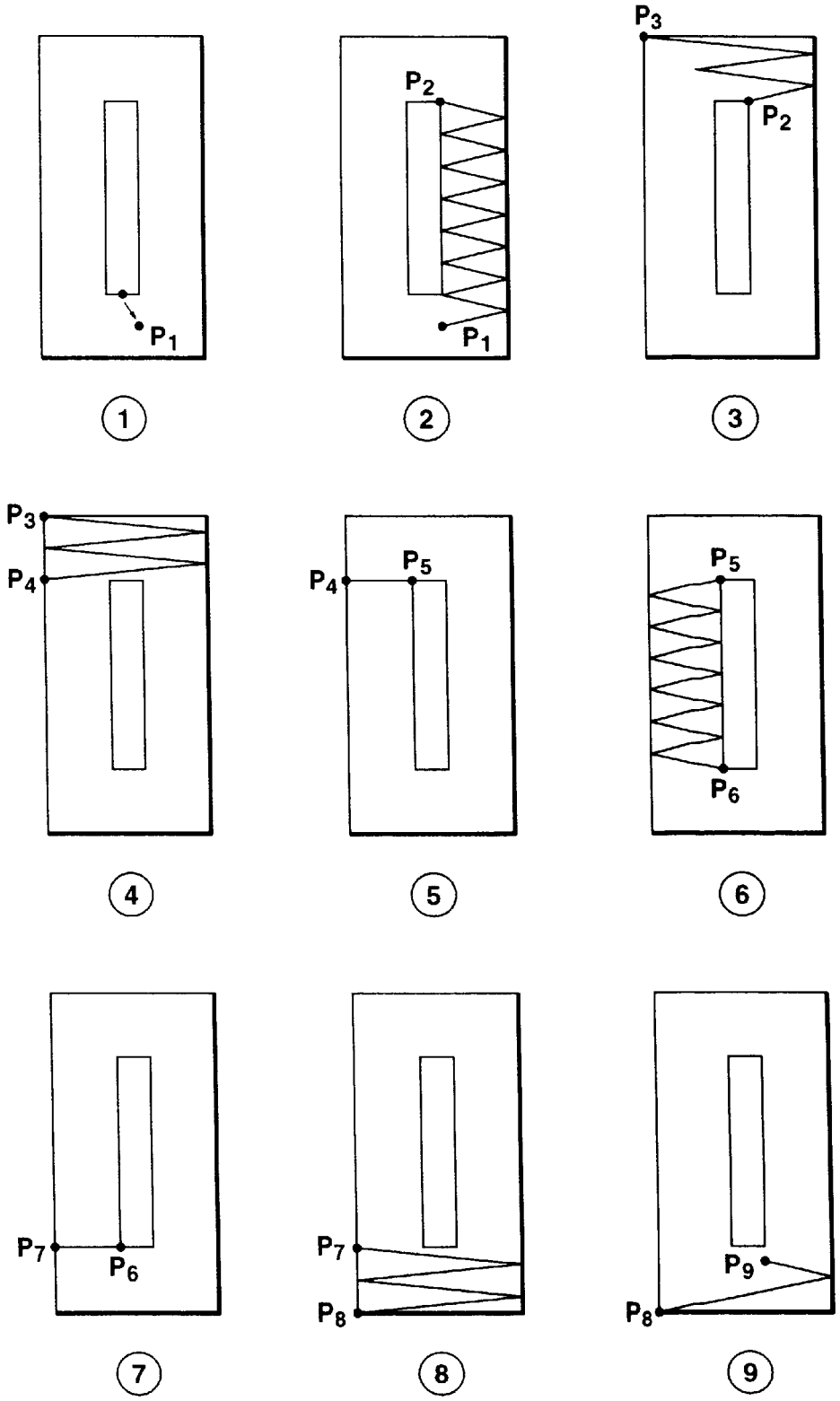
FIG. 90 is a view of a left-handed sewing sequence.

And, in the next step S384, the left parallel portion is operated, in the next step S385, the second lock stitch portion is operated, in the next step S386, the sewing end is operated and, after then, the processing advances to the above-mentioned step S36 in the flow shown in FIG. 90.

Next, description will be given below in detail of the above-mentioned lefthanded pattern operation (Step S38); in particular, the sewing start position operation (Step S381), right parallel portion operation (Step S382), first bar-tack portion operation (S383), left parallel portion operation (S384), second bar-tack portion operation (S385), and sewing end operation in this order.

Here, prior to the description of the respective operation processings, the sewing sequence and conditions will be described.

FIG. 90 shows the sewing sequence: in particular, FIG. 90 (1) shows the movement of the sewing machine from the machine origin to the sewing start position; FIG. 90 (2) shows the sewing of the right parallel portion following FIG. 90 (1); FIG. 90 (3) shows the sewing of the first bar-tack portion up to the middle portion thereof; FIG. 90 (4) shows the end of the sewing of the first bar-tack portion; FIG. 90 (5) shows the start of the sewing of the left parallel portion; FIG. 90 (6) shows the sewing of the left parallel portion; FIG. 90 (7) shows the start of the sewing of the second bar-tack portion; FIG. 90 (8) shows the sewing of the second bar-tack portion up to the middle portion thereof; and, FIG. 90 (9) shows the end of the sewing (the end of the sewing of the second bar-tack portion). By the way, the movement of the sewing machine to the machine origin is executed only when the sewing machine is switched over to the sewing mode.

Figure 92B:
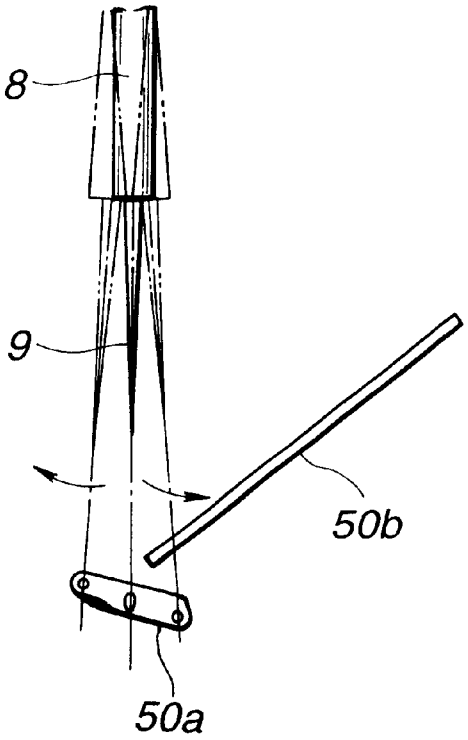
FIGS. 92(*a*) and 92(*b*) are explanatory views of the left- and right-handed operations to be executed by a needle swing mechanism; in particular FIG. 92(*a*) is a front view to show the movement of a base line, and FIG. 92(*b*) is a side view thereof.
Figure 92A:
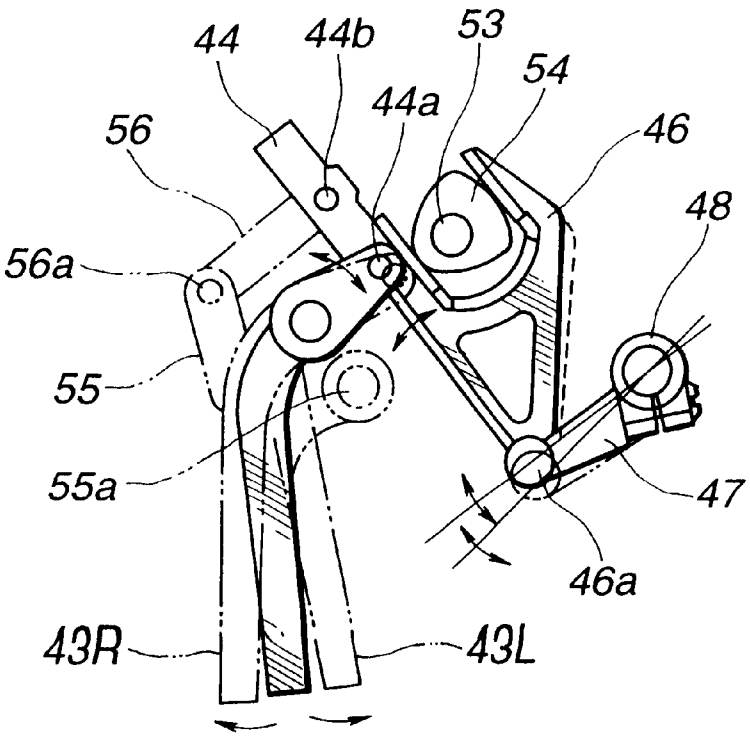

Further, in FIG. 92, there is shown another embodiment of the left-handed pattern operation, which explains the operation of the needle swing mechanism 42 in the left-handed and-right-handed pattern operations. In particular, as shown in FIGS. 92(*a*) and (*b*), the base line arm 43 moves to the base line right side when the base line of the swing of the needle 9 is swung to the left in FIG. 92(*a*) (a dotted line portion 43R, in FIG. 92(*a*)), with the origin position (shown by a solid line) situated in the knife groove 15*b* position (the center of the needle eye 15*a*) as the reference thereof; and, the base line arm 43 moves to the base line left side when the base line of the swing of the needle 9 is swung to the right in FIG. 92(*a*) (a dotted line portion 43L, in FIG. 92(*a*)).

Figure 93C:
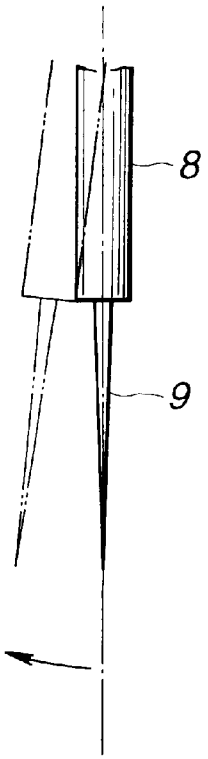
FIGS. 93(*a*) to 93(*c*), similarly to FIGS. 92(*a*) and 92(*b*), are explanatory views of the left- and right-handed operations to be executed by a needle sewing mechanism; in particular FIG. 93(*a*) is a front view to show the change of a needle swing amount, FIG. 93(*b*) is a left side view thereof, and FIG. 93(*c*) is a right side view thereof.
Figure 93A:
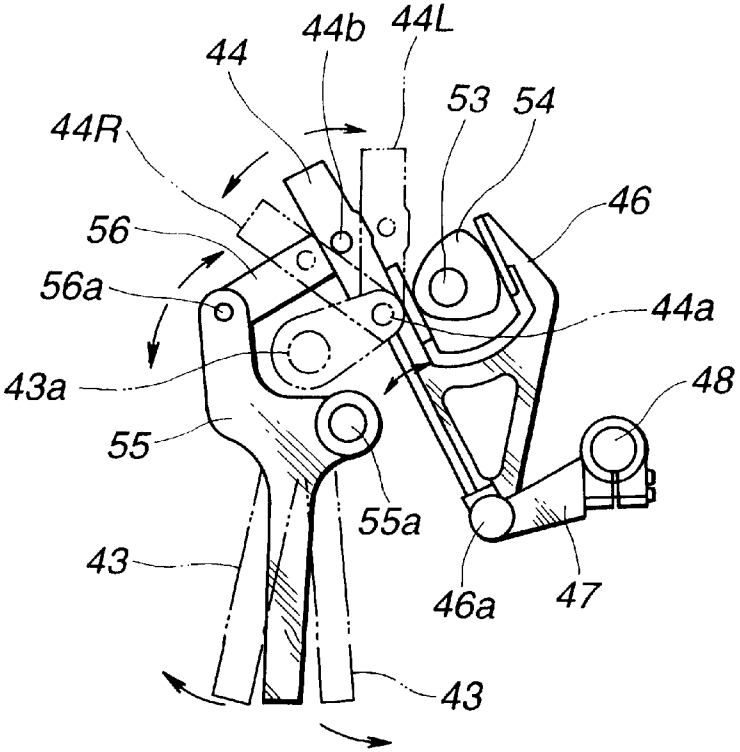
Figure 93B:
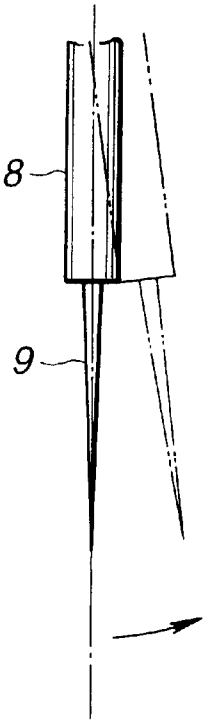

Also, as shown in FIGS. 93(*a*), 93(*b*), and 93(*c*), when the base line lever 44 is swung to the left in FIG. 93 (a dotted line portion 44R in FIG. 93(*a*)) with the origin position of the needle swing amount zero position as the reference thereof, the needle swing amount of the needle 9 increases in the right direction with the base line as the reference thereof.; whereas when the base line lever 44 is swung to the right in FIG. 93 (a dotted line portion 44L in FIG. 93(*a*)), the needle swing amount of the needle 9 increases in the left direction with the base line as the reference thereof. In the table shown in FIG. 55, when the data on the base lines $K_1$, - - - , $K_9$, and data on the swing width $H_1$, - - - , $H_9$, are respectively given minus signs, that is, are reversed, then there are obtained such data as stated in the table shown in FIG. 91, with the result that operation is executed in the left-handed manner. In FIG. 91, N designates a repetition number of times (stitch number), Y the Y feed, K the base line, H the swing width, and T the thread tension value, respectively. Subscripts given to them respectively correspond to the sewing sequences (1) (2) (3) (4) (5) (6) (7) (8) (9) that are shown in FIG. 90.

Modification of Control System

Next, description will be given below of FIG. 81 which shows a modified general flow obtained by changing in part the before-described general flow shown in FIG. 37.

Figure 81:
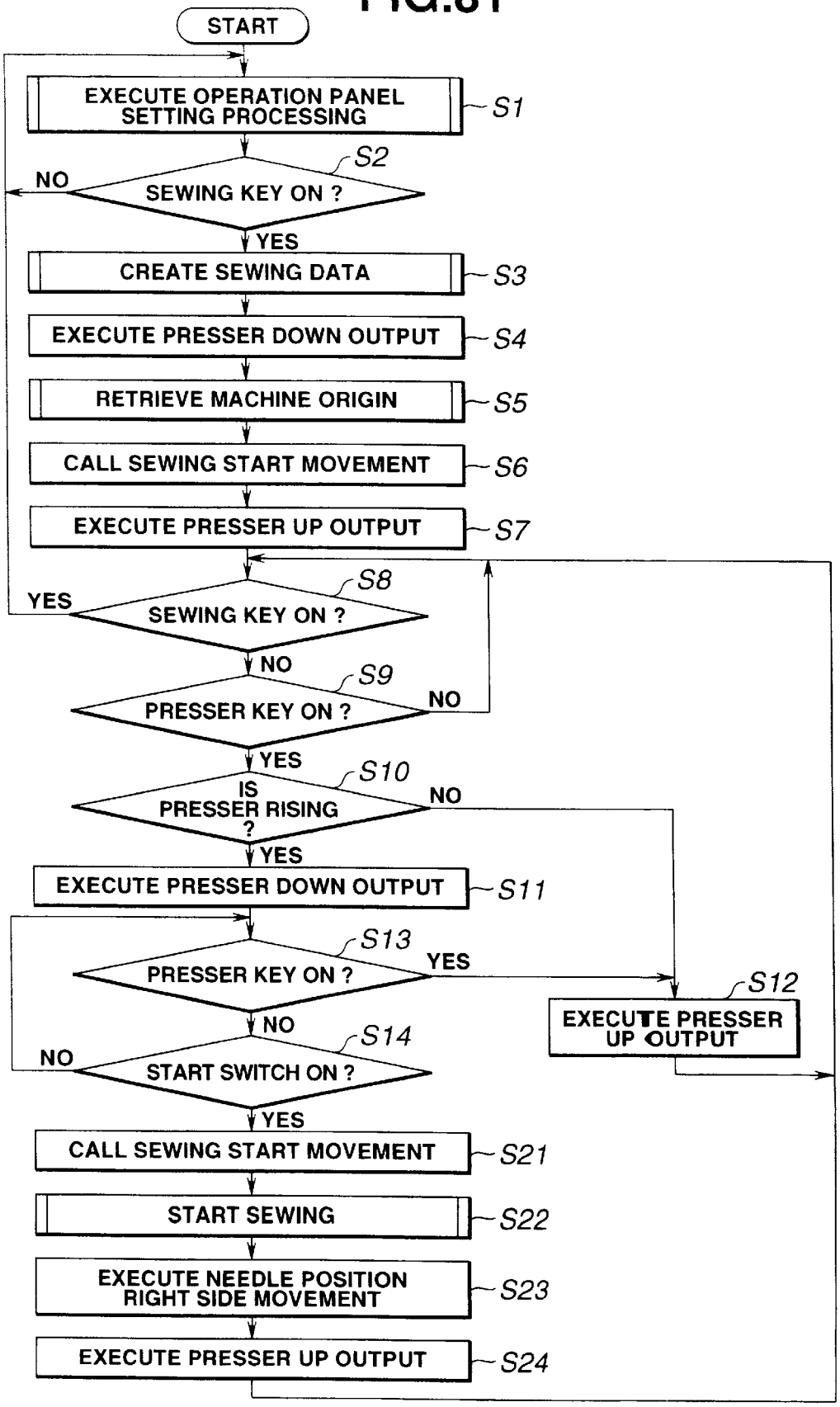
FIG. 81 shows a modification of a control system; in particular

In the general flow shown in FIG. 81, Steps S1~S14 are the same as in the general flow shown in FIG. 37. Therefore, from now on, description will be given of new steps S21 to S24 employed instead of the above-mentioned steps S15 to S16.

Figure 82:
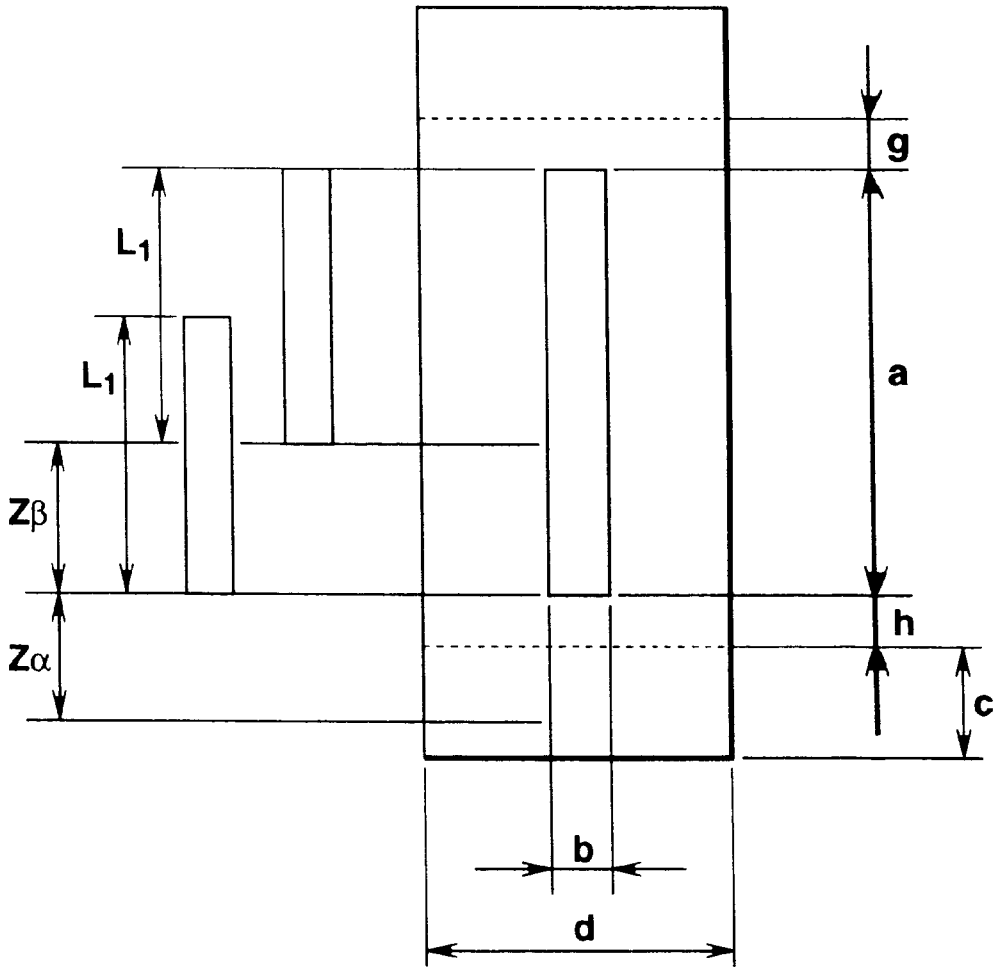
FIG. 82 shows conditions used in a buttonhole darning operation.

By the way, FIG. 82 shows the conditions for the buttonhole darning operation which not only include the conditions shown in FIG. 40, that is, the cloth cutting length a, knife width b, bar-tack length c, bar-tack width d, parallel portion pitch e, bar-tack portion pitch f, knife-first bar-tack gap g, knife-second bar-tack gap h, but also a knife size $L_1$, cloth movement amount from the sewing start position to the first knife end position (y feed motor pulse number) Zαa, and cloth movement amount from the first knife end position to the second knife end position (y feed motor pulse number) Zαa. The timing of the downward movement of the cloth cutting knife 15 is decided in accordance with the addition value (absolute value) of the y feed motor pulse numbers corresponding to the cloth movement amount Zα.

Here, for a middle knife cutting operation, in FIG. 82, the down timing thereof is decided in accordance with the addition value (absolute value) of the pulse numbers during the right side sewing; and, for a pre-sewing cutting-operation and a post-sewing cutting operation, in FIG. 82, the down times thereof are decided in accordance with the addition value (absolute value) of the pulse numbers from the sewing start position. However, the number of pulses corresponding to the knife size L, can be obtained according to an equation, L, (the feed~length of 1 pulse), that is, by dividing L, by the feed pulse of 1 pulse.

As shown in FIG. 81, after the above-mentioned step S14, in Step S21, the sewing start movement is called, and the Y feed pulse motor 20, base line feed pulse motor 40 and needle swing feed pulse motor 41 are respectively driven to the sewing start position. After then, in the next step S22, the sewing processing is called, so that the sewing operation is started.

After end of the sewing operation, in the next step S23, after the needle position right side movement is executed, in the next step S24, the cloth presser 15 lift output is executed and, after then, the processing returns to the above mentioned step S8. Therefore, in the present embodiment, when a given buttonhole darning or sewing operation is completed, then the needle is swung to the right beyond the cloth cutting knife and is thereby stopped at its upper position and, when a next buttonhole darning operation is started, the needle is moved to its sewing start position before it starts the side sewing operation.

Next, description will be given below of the sewing processing to be executed in the above-mentioned step S22.

Figure 83:
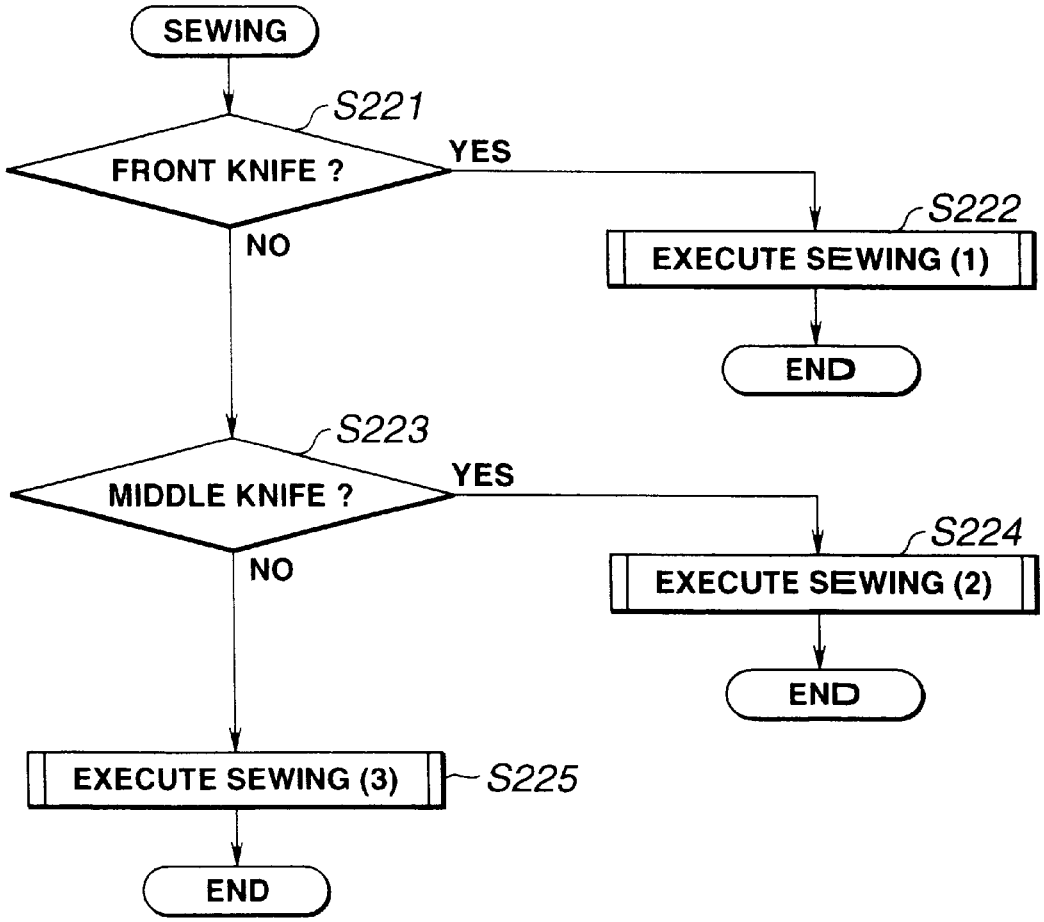
FIG. 83 is a flow chart of a subroutine for a sewing processing (Step S22)

FIG. 83 shows a subroutine for the sewing processing (Step S22). In this subroutine, at first, in Step S221, it is checked whether the knife cutting is a pre-sewing or not. If it is a pre-sewing cutting operation, then in Step S222, a sewing processing (1) is executed and, after then, the processing advances to the above-mentioned step S23 in the general flow (FIG. 81); or, if it is not a pre-sewing cutting operation, then the processing advances to the next step S223.

In Step S223, it is checked whether the knife cutting operation is a inter-sewing cutting operation or not. If it is a inter-sewing cutting operation, then in Step S224, a sewing processing (2) is executed and, after then, the processing advances to the above-mentioned step S23; or, if it is not a middle knife cutting operation, then in the next step S225, a sewing processing (3) is executed and, after then, the processing advances to the above-mentioned step S23.

Referring to the operation on the knife drive timing corresponding to the above-mentioned respective sewing processings, when selecting one of the pre-sewing and post-sewing cuttings, the movement amount of the Y feed pulse motor 20 is operated; and, when selecting the inter-sewing cutting operation, the stitch number is operated.

Next, description will be given below of the sewing processing (1) of the above-mentioned step S222 for the pre-sewing cutting operation, sewing processing (2) of the above-mentioned step S224 for the inter-sewing cutting operation, and sewing processing (3) of the above-mentioned step S225 for the post-sewing cutting operation, respectively.

Here, the sewing processing (2) (Step S224) in which the cloth is cut during the buttonhole darning operation using the inter-sewing cutting operation is the same as the above-mentioned sewing processing (Step S15) in the general flow shown in FIG. 37, that is, the contents of the sewing processing (2) are the same as those described in connection with the flow shown in FIG. 73. However, for the inter-sewing cutting, as described above, the downward movement timing is decided in accordance with the addition value (absolute value) of the pulse numbers during the right side sewing operation in FIG. 82.

Therefore, in the following description, description will be given of only the sewing processing (1) (Step S222) in which the cloth is cut by the pre-sewing cutting operation before starting the buttonhole darning operation and sewing processing (3) (Step S225) in which the cloth is cut by the post-sewing cutting operation after completion of the buttonhole darning operation.

Figure 84:
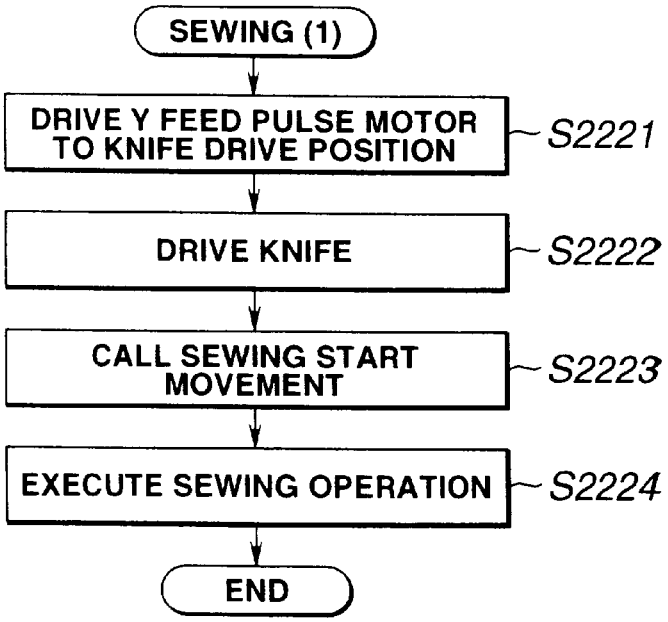
FIG. 84 is a flow chart of a subroutine for a sewing processing (1) (Step S222)

Now, FIG. 84 shows a subroutine for the sewing processing (1) (Step S222) using a pre-sewing cutting operation. In this subroutine, at first, in Step S2221, the Y feed pulse motor 20 is driven up to the knife drive position and, in the next step S2222, the cloth cutting knife 15 is driven to move downward.

And, in the next step S2223, the sewing start movement processing is called to thereby drive the Y feed pulse motor 20, base line feed pulse motor 40 and needle swing feed pulse motor 41 to the sewing start position. After then, in the next step S2224, the sewing processing is called, so that the sewing operation is started.

That is, during the sewing operation, the knife drive processing is not executed.

By the way, after completion of the sewing operation, the processing advances to the above-mentioned step S23 in the flow shown in FIG. 81.

That is, in the case of the pre-sewing cutting operation, as described above, the timing for the downward movement thereof is decided in accordance with the addition value (absolute value) of the pulse numbers from the sewing start position shown in FIG. 82.

Figure 85:
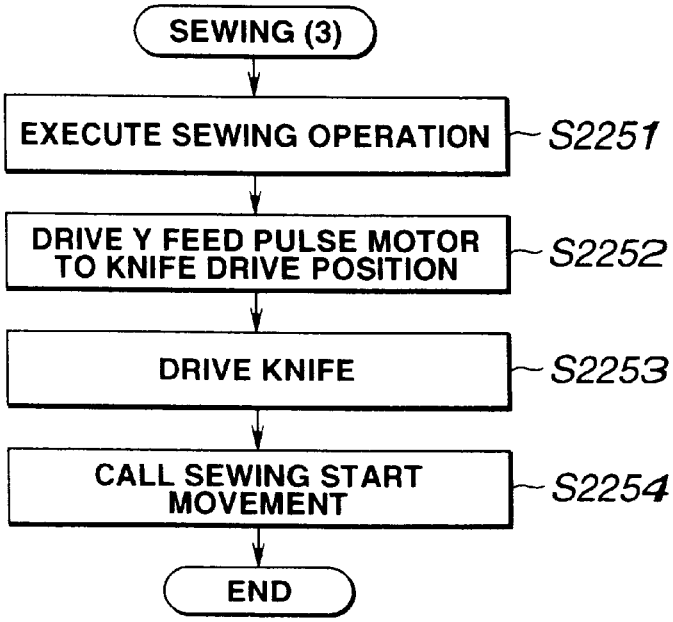
FIG. 85 is a flow chart of a subroutine for a sewing processing (3) (Step S225)

Now, FIG. 85 shows a subroutine for the sewing processing (3) (Step S225) using a post-sewing cutting. In this subroutine, at first, in Step S2251, the sewing processing is called to thereby start the sewing operation.

And, after completion of the sewing operation, in the next step S2252, the Y feed pulse motor 20 is driven up to the knife drive position and, in the next step S2253, the cloth cutting knife 15 is driven to move downward.

Further, in the next step S2254, the sewing start movement processing is called to thereby drive the Y feed pulse motor 20, base line feed pulse motor 40 and needle swing feed pulse motor 41 to the sewing start position. After then, the processing advances to the above-mentioned step S23 in the flow shown in FIG. 81.

In the case of the post-sewing cutting operation as well, the timing for the downward movement thereof is decided in accordance with the addition value (absolute value) of the pulse numbers from the sewing start position shown in FIG. 82.

Figure 86A:
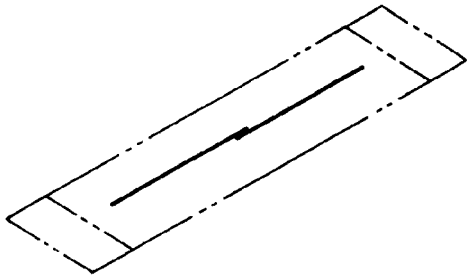
FIGS. 86(*a*) to 86(*c*) show a difference between a pre-sewing cutting operation and a inter-sewing cutting operation; in particular FIG. 86(*a*) is view of the pre-sewing cutting operation to be executed prior to sewing of buttonhole darning stitches, FIG. 86(*b*) is a view of a post-sewing cutting operation to be executed after completion of sewing of buttonhole darning stitches, and FIG. 86(*c*) is view of a inter-sewing to be executed while the buttonhole darning stitches are being sewn.
Figure 86B:
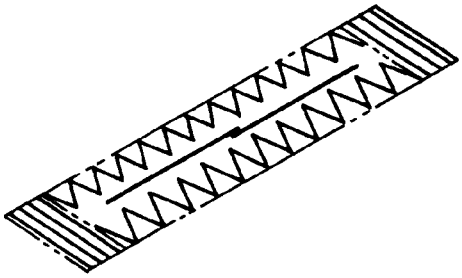
Figure 86C:
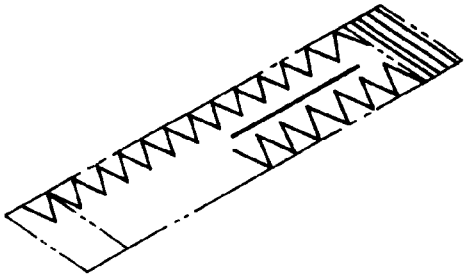

Here, FIG. 86 shows a difference between the front knife cutting operation, postsewing cutting operation and inter-sewing cutting operation. At first, the pre-sewing cutting operation is a cutting operation in which, as shown in FIG. 86(*a*), a knife is dropped in order to previously open up a buttonhole before sewing buttonhole darning stitches.

And, the post-sewing cutting operation is a cutting operation in which, as shown in FIG. 86(*b*), after completion of sewing of the buttonhole darning stitches, a knife is dropped to thereby open up a buttonhole.

Also, as shown in FIG. 86(*c*), a inter-sewing cutting operation is a cutting operation in which, while buttonhole darning stitches are being sewn, a knife is dropped to thereby open up a button hole.

Figure 87A:
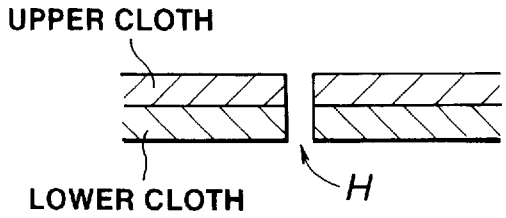
FIG. 87(*a*) is a side view to show how upper and lower cloths are cut in the presewing cutting operation, FIG. 87(*b*) is a side view of hemstitching obtained when a needle is passed through a buttonhole to thereby connect together lower and upper threads, and FIG. 87(*c*) is a side view to show that no material thread(weaving yam) of the cloth is left in the buttonhole.
Figure 87B:
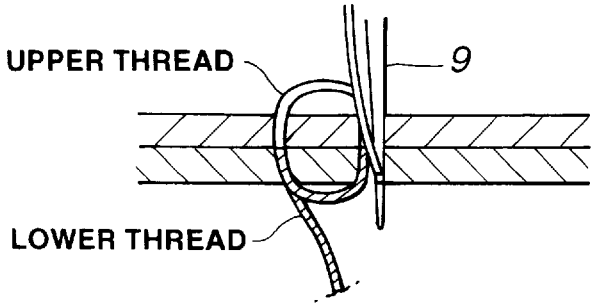
Figure 87C:
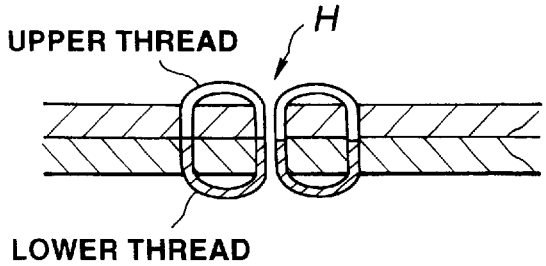

Next, FIG. 87 shows the state of the buttonhole darning stitches in the case of the pre-sewing cutting. At first, as shown in FIG. 87(*a*), for example, when the upper and lower cloths are cut by the pre-sewing cutting operation to thereby open up a buttonhole H, as shown in FIG. 87(*b*), during the sewing operation, the needle 9 having an upper thread inserted therethrough is passed through the buttonhole H to connect together the lower and upper threads, thereby executing hemstitching.

And, after completion of the sewing operation comprising the above-mentioned hemstitching executed by the needle 9 passing through the buttonhole H, as shown in FIG. 87(*c*), no material thread (weaving yam) of the cloth can be left in the buttonhole H.

Figure 88:
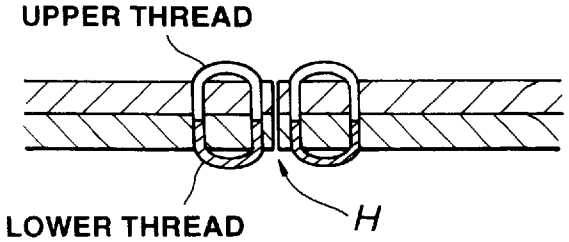
FIG. 88 is a side view of the state of buttonhole darning stitches formed in the rear and post-sewing and inter-sewing cutting operations.

On the other hand, FIG. 88 shows the stat of the buttonhole stitches in the case of the post-sewing cutting and inter-sewing cutting operations.

Here, in the post-sewing cutting and inter-sewing cutting operations, after the buttonhole darning stitches are sewn, the cloth is cut by the knife to thereby form or open up the buttonhole H. In this case, in order not to cut the stitches, a given gap must be secured between the stitches of the right and left side sewing portions.

Therefore, as shown in FIG. 88, on the right and left of the buttonhole H, there are left cloths between the stitches of the respective side sewing portions.

Figure 94:
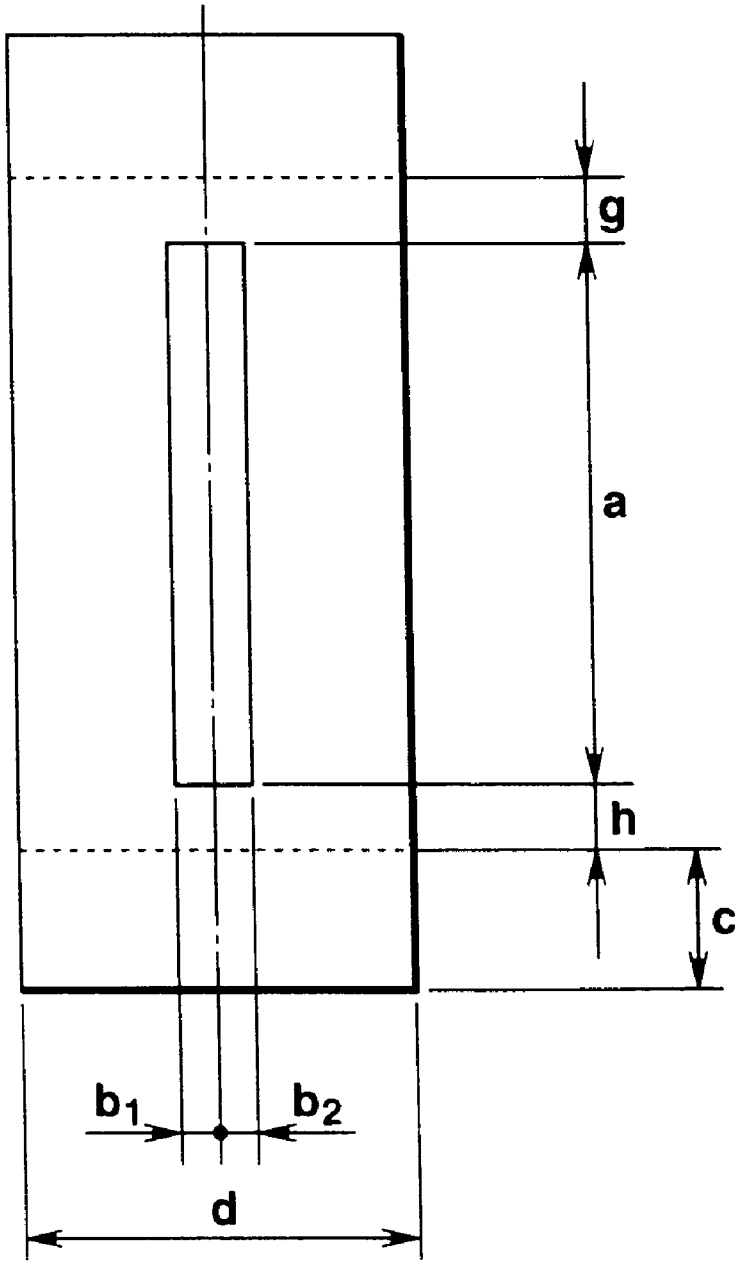
FIG. 94 is a view of conditions used in a buttonhole darning operation.

Further, there is available another embodiment of the pattern operation subroutine, in which, in the following operations, there are used the dimensions based on the conditions shown in FIG. 94: that is, cloth cutting length a, left knife width $b_1$, right knife width $b_2$, bar-tack length c, bar-tack width d, parallel portion pitch e, bar-tack portion pitch f, knife-first bar-tack gap g, and knife-second lock stitch gap g.

Also, in a setting item table shown in FIG. 95, the knife width in the table shown in FIG. 39 is divided into the left knife width b, and right knife width $b_2$, while the knife drop right and left position is omitted.

Figure 96:
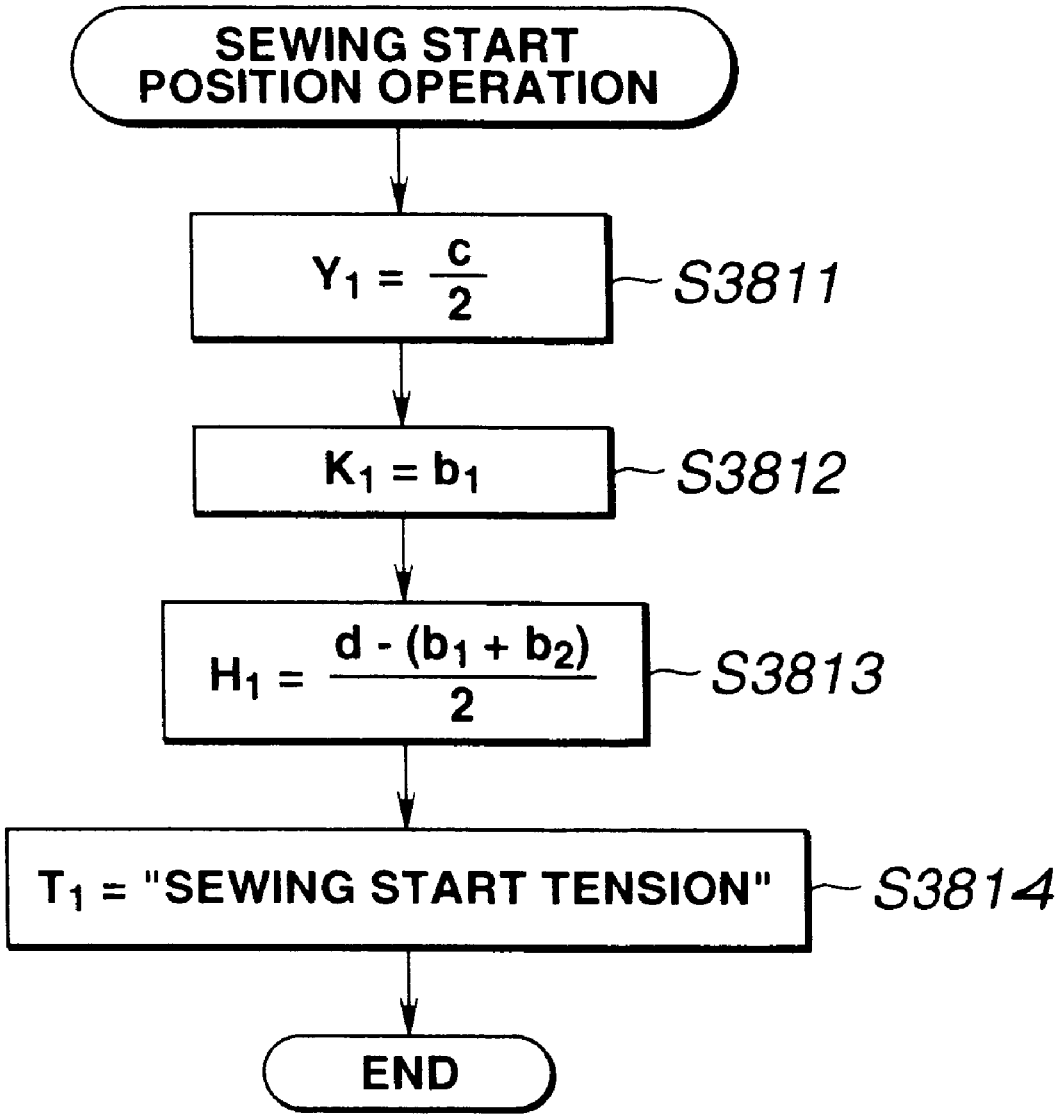
FIG. 96 is a flow chart of a subroutine for a sewing start position operation processing (Step S381)

FIG. 96 shows a subroutine for the sewing start position operation (Step S381). In this subroutine, at first, in Step 3811, $Y_1$, =c/2 is operated, in the next step S3812, $K_1=b_1$ is set, in the next step S3813, $H_1=\{d-(b_1+b_2)/2$ is operated, in the next step S3814, $T_s$=sewing start tension is set and, after then the processing advances to the above-mentioned step S382 in the flow shown in FIG. 89. Also, by specifying the above-mentioned b, and b2 separately, gaps from the knife drop point to the right and left side sewing portions can be adjusted separately.

Figure 97:
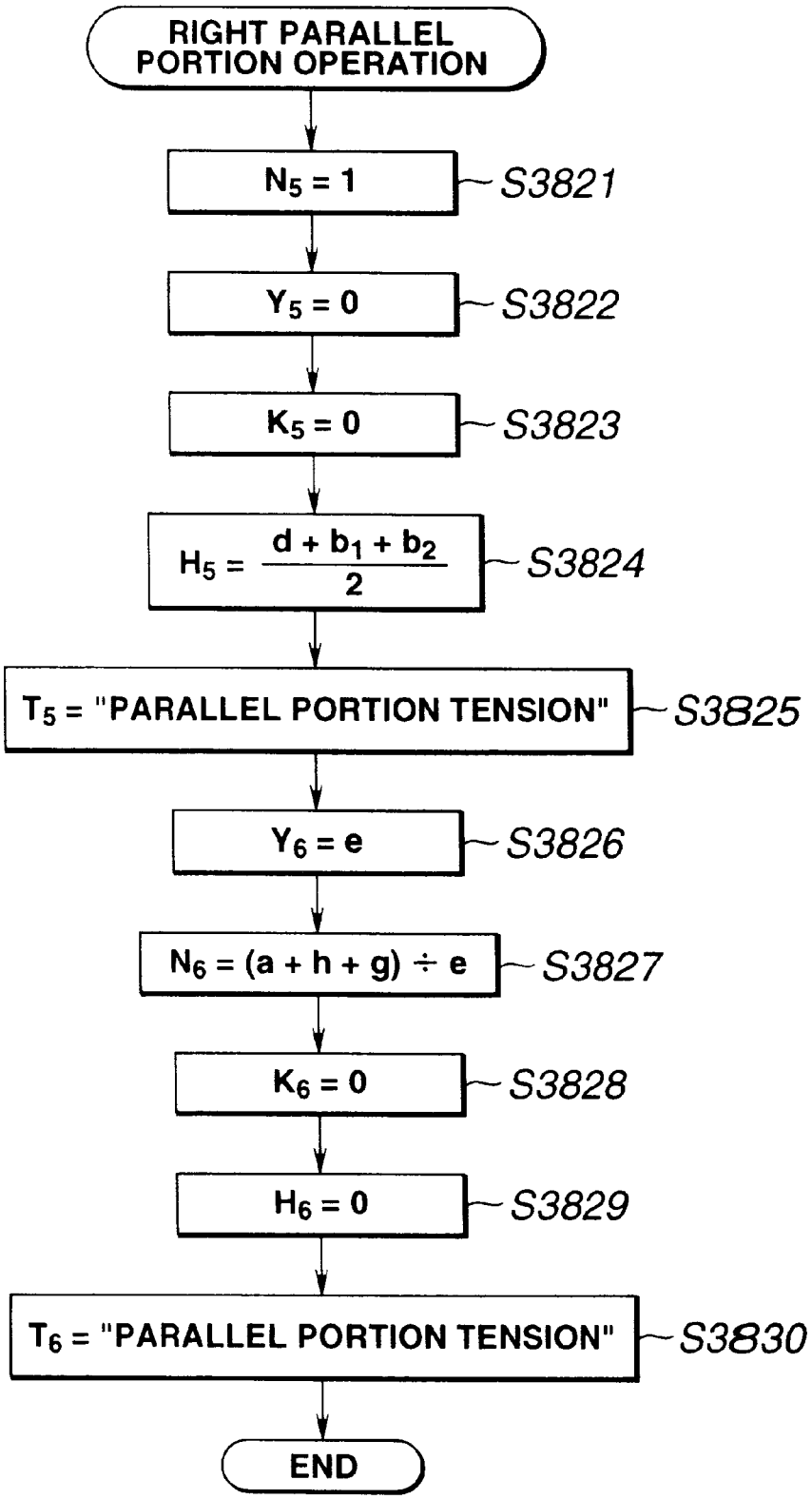
FIG. 97 is a flow chart of a subroutine for a right parallel portion operation processing (Step S382)

Now, FIG. 97 shows a subroutine for the right parallel portion operation (Step S382). In this subroutine, at first, in Step S3821, $N_s=1$ is set, in the next step S3822, $Y_5=0$ is set, and in the next step S3823, $K_5=0$ is set. Next, in Step S3824, $H_5=(d+b_1+b_2)/2$ is operated and, after then, in the next step S382S, $T_5$=parallel portion tension is set.

And, in the next step S3826, $Y_6$=e is set and, in the next step S3827, $N_6=(a+h+g)\div e$ is operated. After then, in the next step S3828, $K_6=0$ is set, in the next step S3829, $H_6=0$ is set, in the next step S3530, $T_6$=parallel portion tension is set and, after then, the processing advances to the above-mentioned step S383 in the flow shown in FIG. 89.

Figure 98:
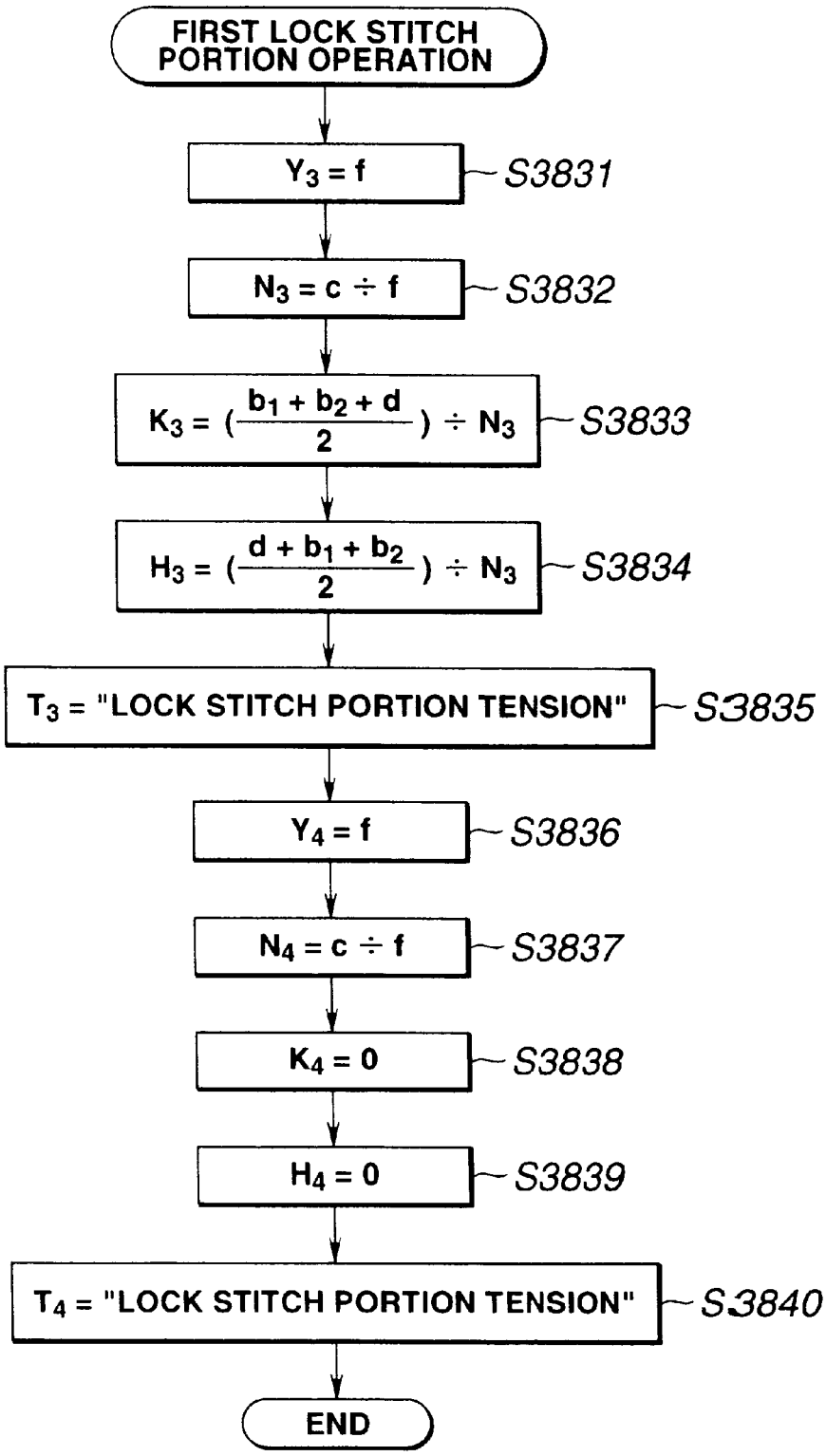
FIG. 98 is a flow chart of a subroutine for a first bar-tack portion operation processing (Step S383)

Now, FIG. 98 shows a subroutine for the first bar-tack portion operation (Step S383). In this subroutine, at first, in Step S3831, $Y_3$=f is set, in the next step S3832, $N_3$=c.÷.f is operated, in the next step S3833, $K_3=\{(d+b_1+b_2)/2\}\div N_3$ is operated and, in the next step S3834, $H_3=\{(d+b_1+b_2)/2\}\div.N_3$ is operated.

After then, in the next step S383S, $T_3$=bar-tack portion tension is set, in the next step S3836, $Y_4$=f is set and, in the next step S3837, $N_4$=c.f is operated.

After then, in the next step S3838, K4=0 is set, in the next step S3839, $H_4$32 0 is set, in the next step S3840, $T_4$="bar-tack portion tension" is set and, after then, the processing advances to the above-mentioned step S384 in the flow shown in FIG. 89.

Figure 99:
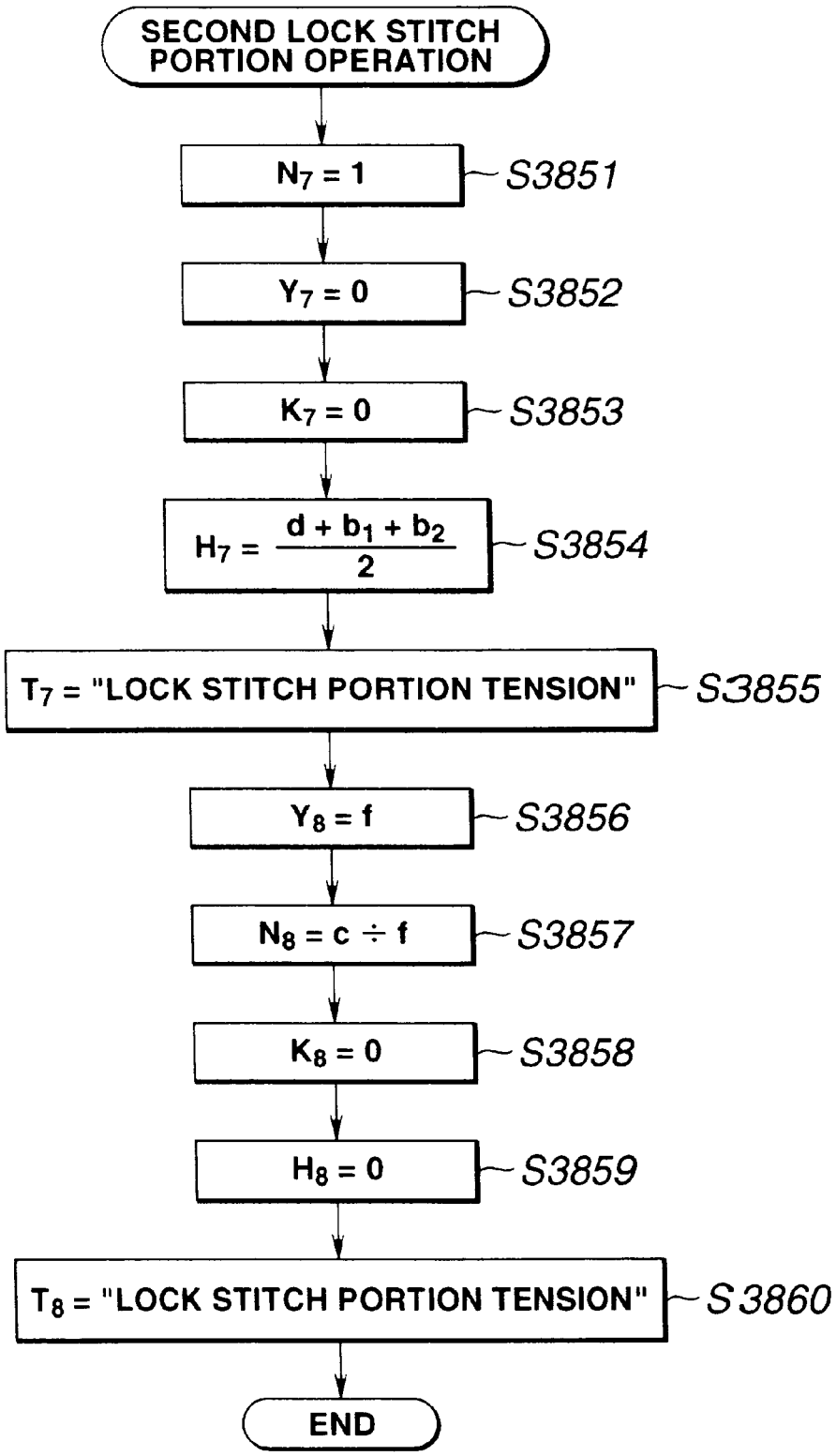
FIG. 99 is a flow chart of a subroutine for a second bar-tack portion operation processing (Step S385)

Now, FIG. 99 shows a subroutine for the second bar-tack portion operation (Step S385). In this subroutine, at first, in Step S3851, $N_7=1$ is set, in the next step S3852, $Y_7=0$ is set, and, in the next step S3853, $K_7=0$ is set. After then, in the next step S3854, $H_7=(d+b_1+b_2)/2$ is operated and, in the next step S3855, $T_7$="bar-tack portion extension" is set.

And, in the next step S3856, $Y_8$=f is set and, in the next step S3857, $N_8$=c÷f is operated. After then, in the next step S3858, $K_8=0$ is set, in the next step S3859, $H_8$=÷ is set, in the next step S3860, $T_8$=bar-tack portion tension is set and, after then, the processing advances to the above-mentioned step S386 in the flow shown in FIG. 89.

Figure 100:
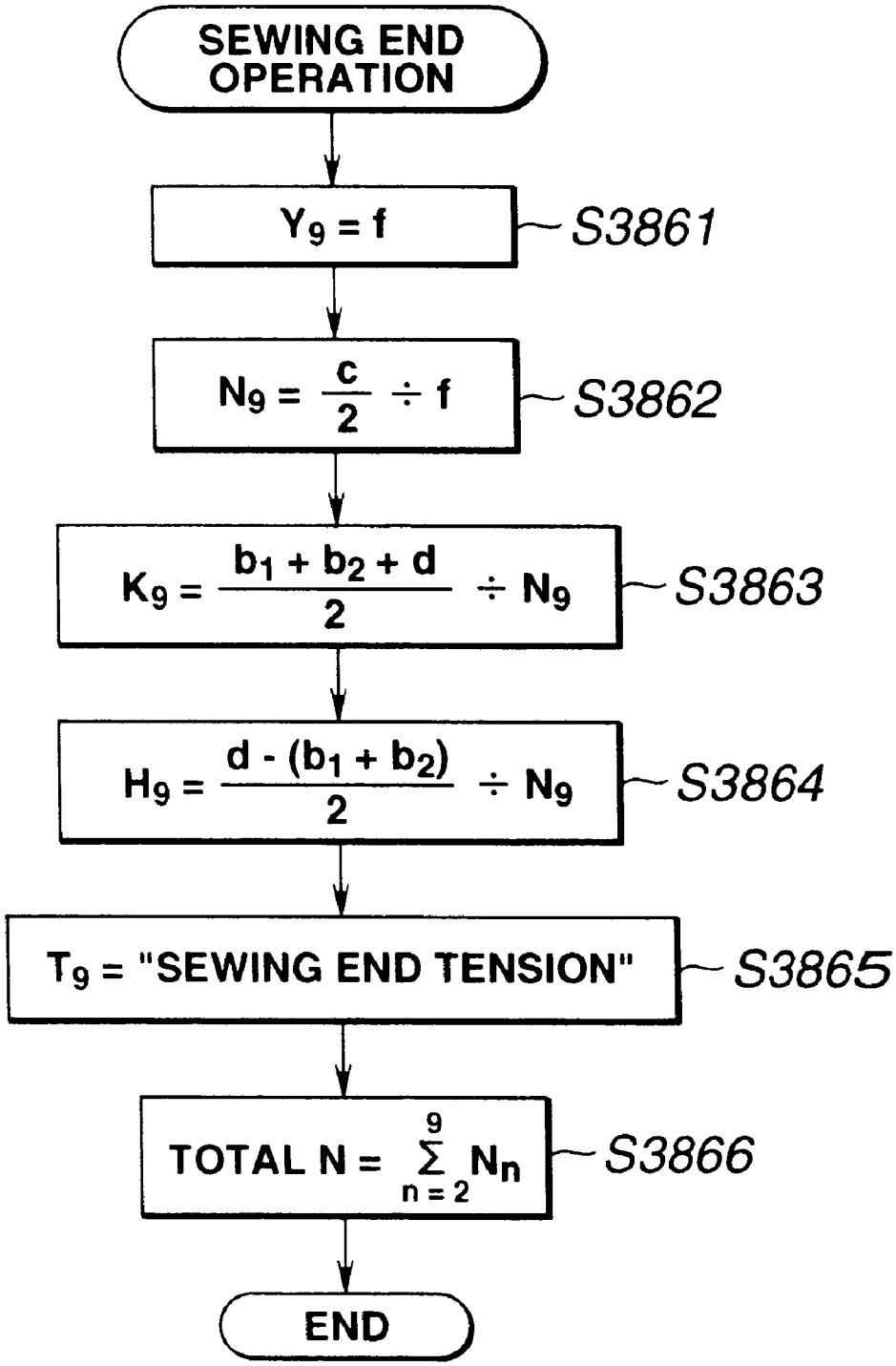
FIG. 100 is a flow chart of a subroutine for a sewing end operation processing (Step S386)

Now, FIG. 100 shows a subroutine for the sewing end operation (Step S386). In this subroutine, at first, in Step S3861, $Y_9$=f is set, in the next step S3862, $N_9$=(c/2).f is operated and, in the next step S3863, $K_9=\{d-(b_1+b_2)/2\div N_9$ is operated.

And, in the next step S3864, $H_9=\{d-(b_1+b_2)/2.\div.N_9$ is operated, in the next step S3865, $T_9$="sewing end tension" is set, in the next step S3866, a total stitch number=$^{9}\Sigma_{n=2}$ Nn is operated and, after then, the processing advances to the above-mentioned step S36 in the flow shown in FIG. 49.

Figure 101:
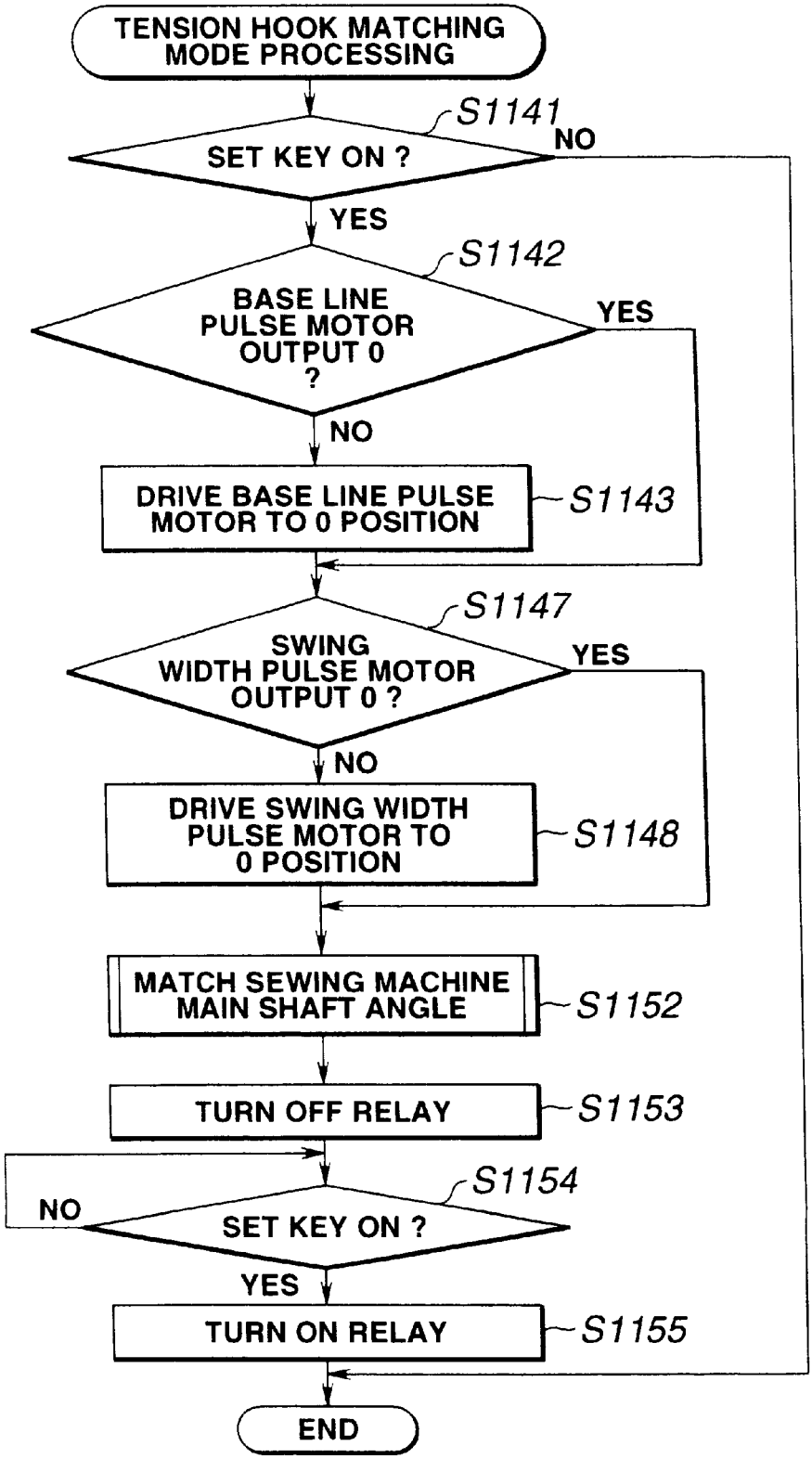
FIG. 101 is a flow chart of an additional processing embodiment 1 of a subroutine for a tension hook matching mode processing (Step S114)

Next, FIG. 101 shows another embodiment of the tension hook matching mode processing. In this embodiment, after the step S1148 of the tension hook matching mode processing (Step S114) shown in FIG. 47, a sewing machine main shaft angle matching processing (Step S1152), a relay off instruction processing (Step S1153), a processing for judging whether a set key is on or not (Step S1154), and a power supply on instruction processing (Step S1155) are executed in this order.

That is, in Step S1148, the swing width pulse motor (needle swing feed pulse motor) 41 is driven by the needle swing feed pulse motor driver 114, in the next Step S1152, the sewing machine main shaft angle is matched and, in the next step S1153, the power supply relay is fumed off, while an operator executes a tension hook matching operation.

After then, in the next step S11154, it is checked whether the set key 147 is on or not. If the set key 147 is on, then the processing advances to the next step S1155; or, if the set key 147 is not on, then the processing returns again to the step S1154.

In Step S1155, after the power supply relay is fumed off, the processing advances to the above-mentioned step S2 in the general flow (FIG. 37).

Figure 102:
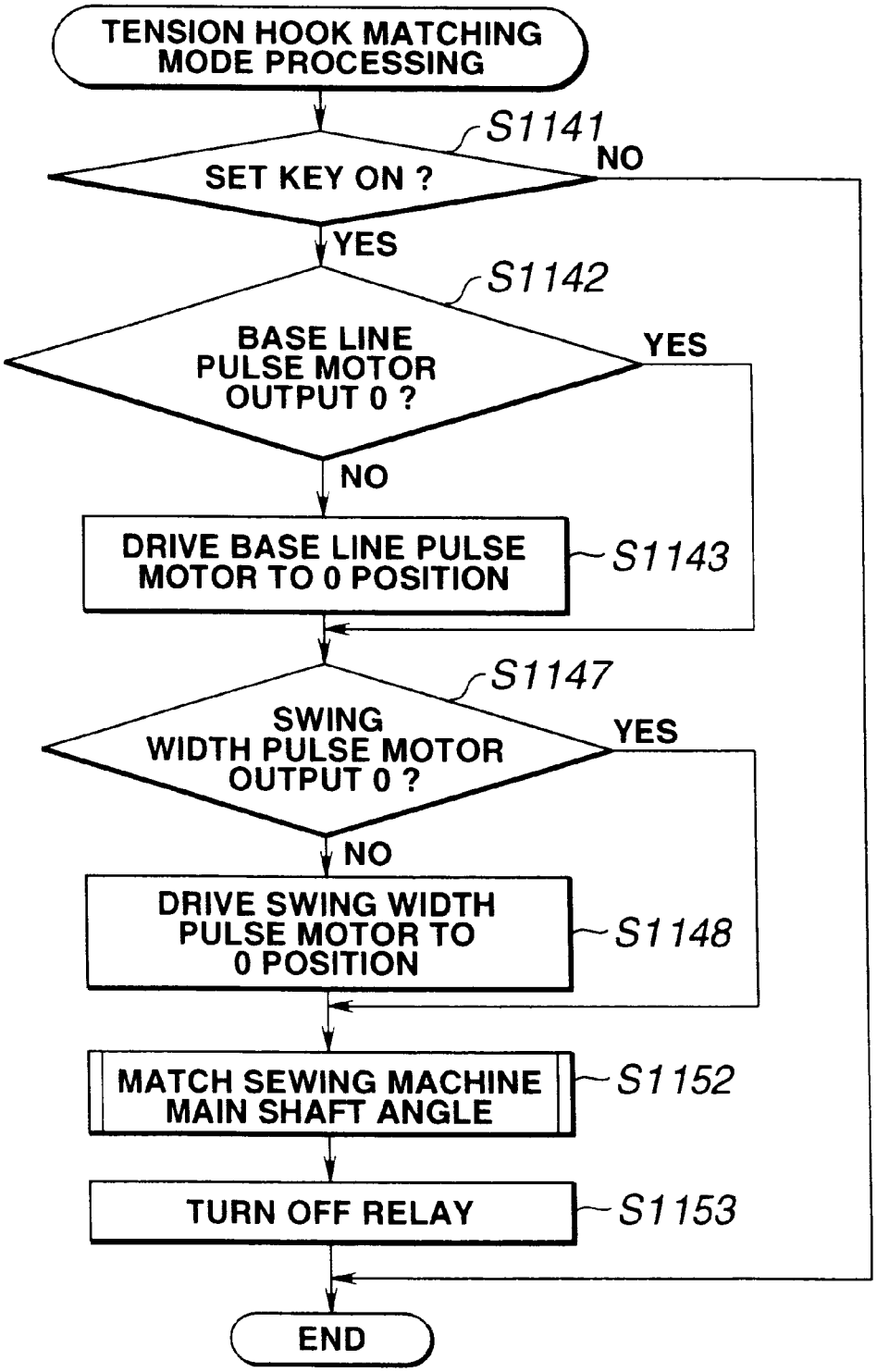
FIG. 102, similarly to FIG. 101, is a flow chart of an additional processing embodiment 2 of a subroutine for a tension hook matching mode processing (Step S114)

In a case shown in FIG. 102, in Step S1148, the swing width pulse motor (needle swing feed pulse motor) 41 is driven by the needle swing feed pulse motor driver 114, in the next Step S152, the sewing machine main shaft angle is matched and, in the next step S1153, the power supply relay is fumed off, while an operator executes a tension hook matching operation.

Figure 103:
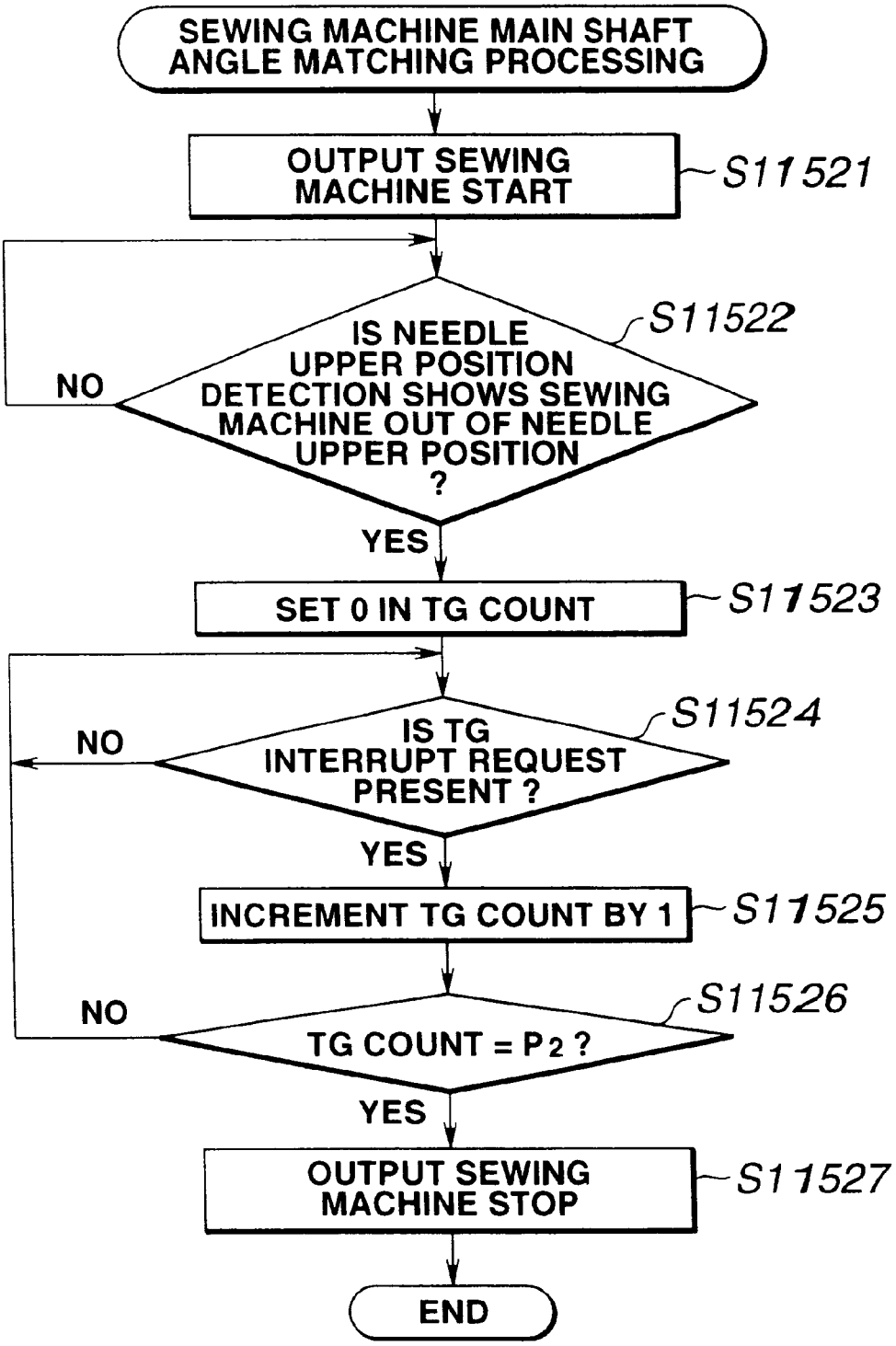
FIG. 103 is a flow chart of the subroutine for a sewing main shaft angle matching processing (Step S1152)

Now, FIG. 103 shows a subroutine for the sewing machine main shaft angle matching processing (Step S152). In this subroutine, at first, in Step S11521, the sewing machine start is output and, in the next step S1522, it is checked whether the needle upper position detection shows the unjustified positioning of the sewing machine or not. If the needle upper position detection shows the unjustified positioning, then the processing advances to the next step S11S23; or, if the needle upper position detection does not show the unjustified positioning, then the processing returns again to the step S11S22.

In Step S11S23, 0 is set in the TG count and, in the next step S11S24, it is checked whether the TG interrupt request is present or not. If the TG interrupt request is present, then in the next step S11S25, the TG count is incremented by 1 and, after then, the processing advances to the next step S11S26; or, if the TG interrupt request is not present, then the processing returns again to the step S11524.

In Step S11526, it is checked whether the TG count is P2 (tension hook matching main shaft angle) or not. If the TG count is not P-2, then the processing returns again to the step S11524; or, if the TG count is P2, then the processing advances to the next step S11527, in which the sewing machine is stopped and, after then, the processing advances to the above-mentioned step S1153 in the flow shown in FIG. 101 or FIG. 102.

Figure 104:
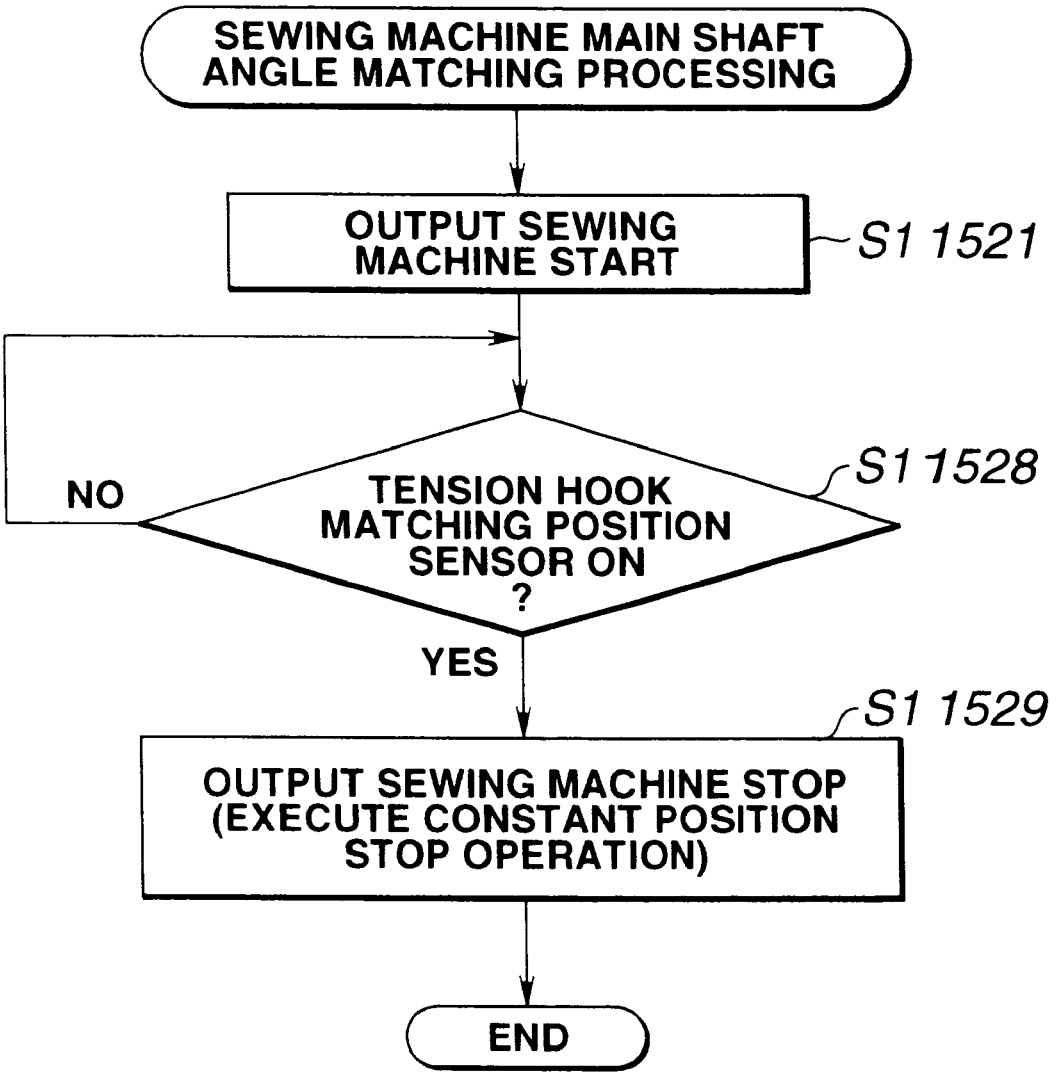
FIG. 104 is a flow chart of a modification of the subroutine for a sewing main shaft angle matching processing (Step S1152)

In a case shown in FIG. 104, a sensor or the like for detecting the tension hook matching position is provided in the sewing machine main shaft, whereby the sewing machine can be stopped at the tension hook matching position. In particular, at first, in Step S11521, the sewing machine start is output and, in the next step S1522, it is checked whether the tension hook position sensor is on or not. If the tension hook position sensor is on, then the processing advances to the next step S11529; or, if the tension hook position sensor is not on, then the processing returns again to the step S11528.

In Step S11529, after the sewing machine stop is output, the processing advances to the above-mentioned step S1153 in the flow shown in FIG. 101 or FIG. 102.

Here, the output of the sewing machine stop in Step S11529 is executed by a constant position stop operation so that the sewing machine can be stopped by a signal from position detect means which is provided in the main shaft of the sewing machine.

Figure 105:
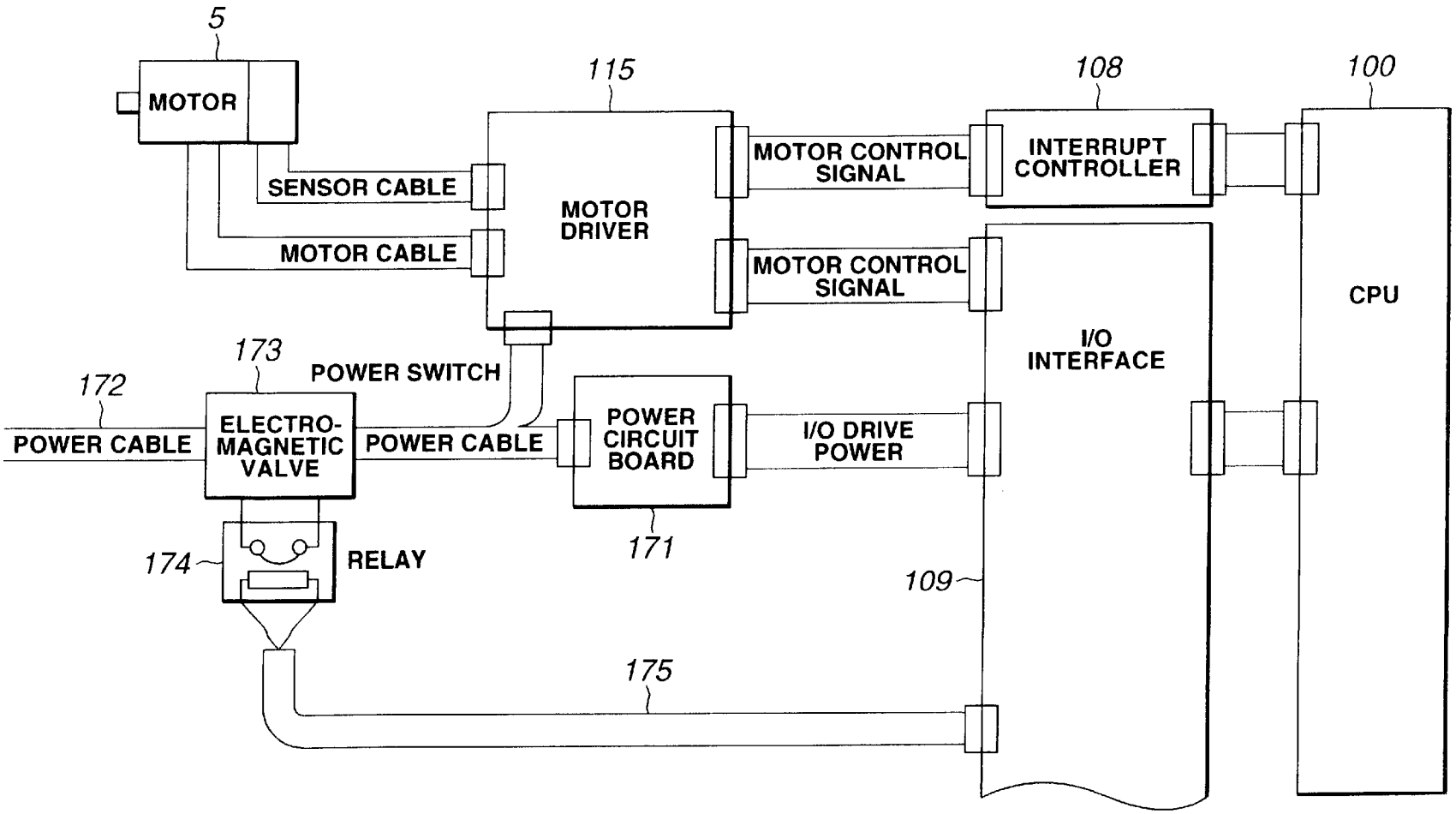
FIG. 105 is a circuit diagram, showing the arrangement of a relay used to cut off power.

Now, FIG. 105 shows the arrangement of a relay which is used to cut off power. In particular, in FIG. 105, a power cable 172 is connected not only to a power circuit board 171 to be connected to an I/O interface 109 but also to a sewing machine motor driver 115, a power switch (an electromagnetic opening/closing device) 173 is provided in the power cable 172, a relay 174 is connected to the power switch (electromagnetic opening/closing device) 173, and a cable 175 on the other terminal side of the relay 174 is connected to the I/O interface 109.

The power relay, which has been described in connection with the above-mentioned FIGS. 101 and 102, is the relay 174 that is connected to the power switch (electromagnetic opening/closing device) 173 in this manner.

Here, when such relay 174 connected to the power switch (electromagnetic opening/closing device) 173 is used as the power relay described in connection with FIG. 102, if the relay 174 is fumed off, then the power of the whole system is cut off, which makes it impossible to supply power again from the CPU 100.

Figure 106:
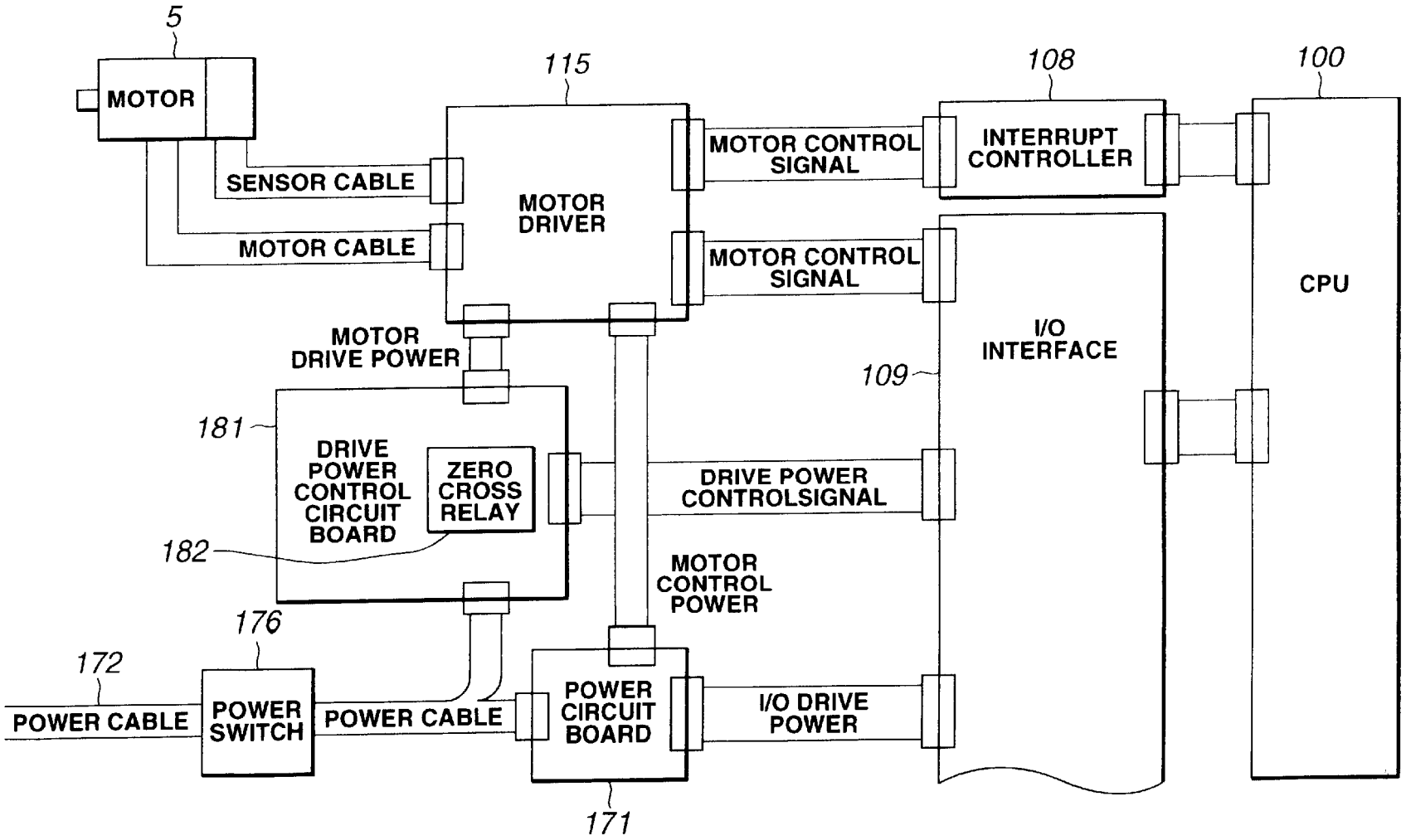
FIG. 106 is a circuit diagram, showing the arrangement of a modification of the relay used to cut off power.

Also, FIG. 106 shows another arrangement of the relay used to cut off power. In FIG. 106, a power cable 172 is connected not only to a power circuit board 171 to be connected to an I/O interface 109 but also to a drive power control circuit board 181 to be connected a sewing machine motor driver 115, and a power switch 176 is provided in the power cable 162; and, a zero cross relay 182 is mounted on the drive power control circuit board 181.

Such zero cross relay 182 may also be used as the power relay described in connection with FIG. 102.

Here, when such zero cross relay 182 is employed as the power relay described in connection with FIG. 101, even if the motor drive power is cut off by the relay 182, the power are still left supplied in the peripheral devices of the CPU 100 and, therefore, if the set key 147 is fumed on again, then the motor drive power can be turned on.

Figure 107:
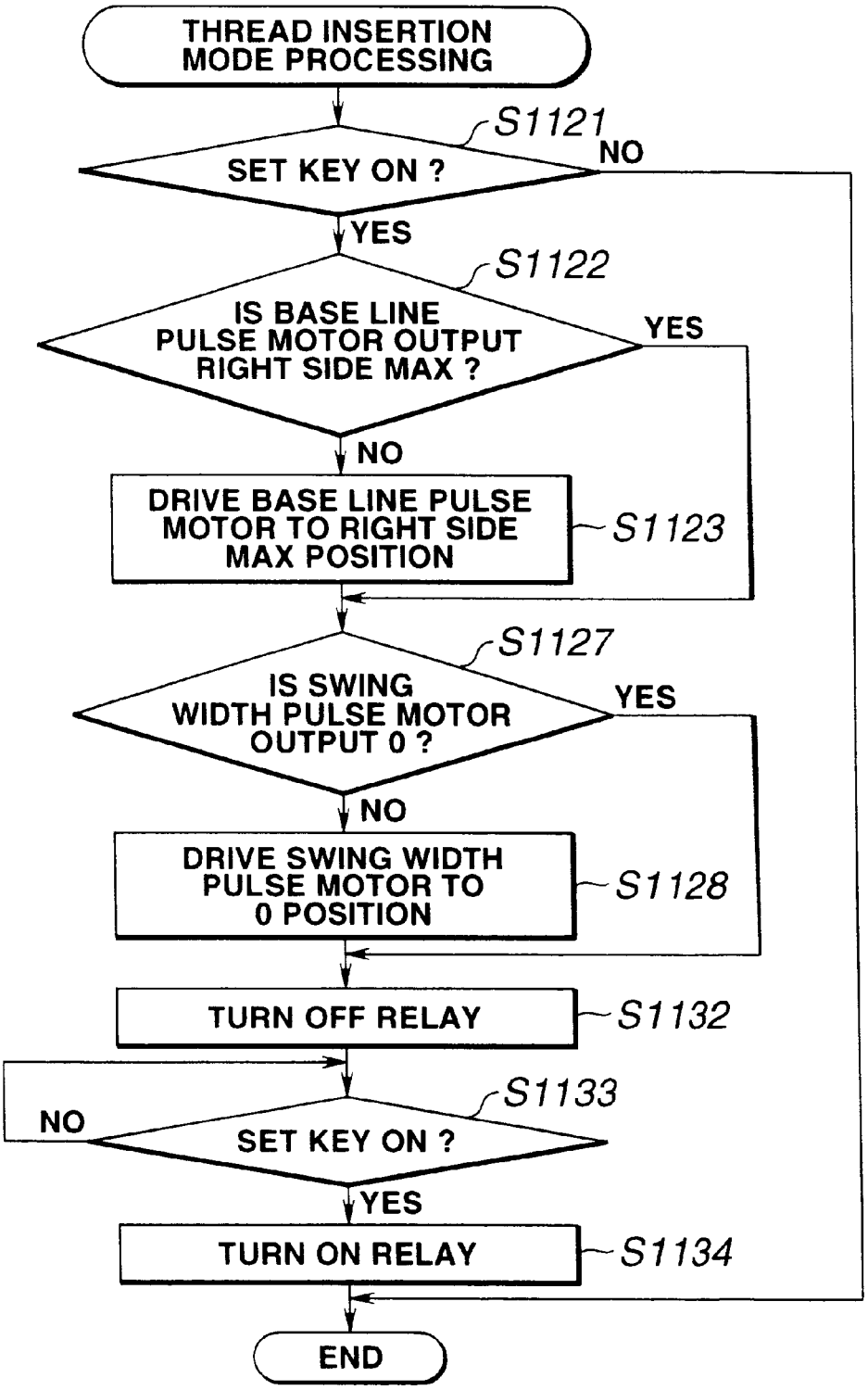
FIG. 107 is a flow chart of a first additional processing embodiment 1 of the subroutine for the thread insertion mode processing shown in FIG. 44 (Step S112)

Next, FIG. 107 shows another embodiment of the thread insertion mode processing. In particular, in the present embodiment shown in FIG. 107, after execution of the step S1128 of the thread insertion mode processing (Step S112), a relay off instruction processing (Step S132), a processing for checking whether the set key is on or not (Step S1133), and a power relay on instruction processing (Step S1134) are executed in this order.

That is, in Step S1132, the power relay is fumed off and, after then, in the next step S1133, it is checked whether the set key 147 is on or not. If the set key 147 is on, then the processing advances to the next step S134; or, if the set key 147 is not on, then the processing returns again to the step S1133.

In Step S1134, the power relay (the zero cross relay 182 shown in FIG. 106) is fumed on and, after then, the processing advances to the above-mentioned step S2 in the general flow (FIG. 37).

Figure 108:
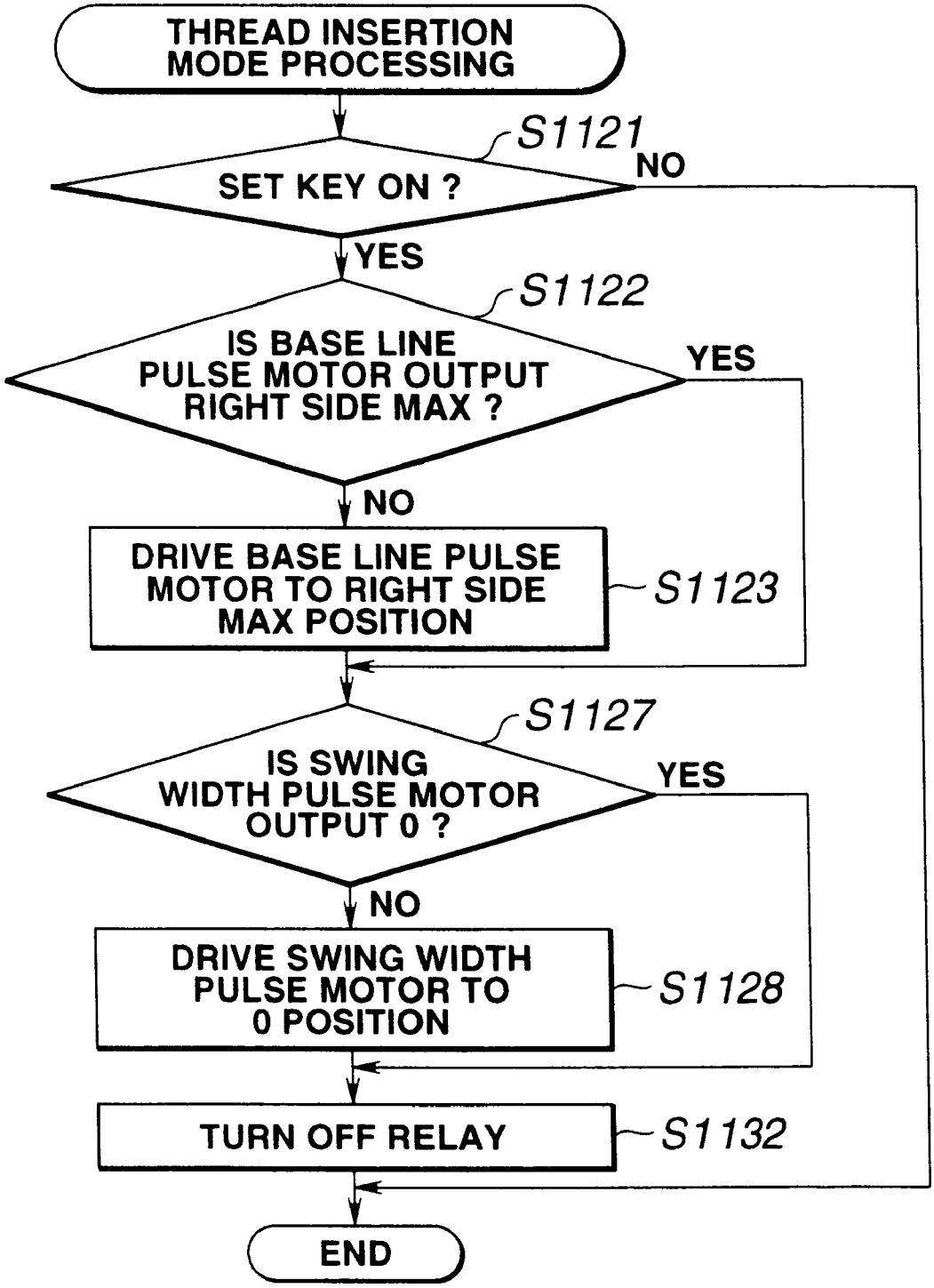
FIG. 108, similarly to FIG. 107, is a flow chart of a second additional processing embodiment 1 of the subroutine for the thread insertion mode processing shown in FIG. 44 (Step S112)

As in an embodiment shown in FIG. 108, in Step S1132, the power relay (the relay 174 shown in FIG. 105) may be fumed off.

Here, similarly to the above-mentioned bobbin case matching mode processing, when the zero cross relay 182 shown in FIG. 106 is used as the power relay described in connection with FIG. 107, even if the motor drive power is cut off by the relay 182, the power are still left supplied in the peripheral devices of the CPU 100 and, therefore, if the set key 147 is fumed on again, then the motor drive power can be fumed on.

Also, when the relay 174 shown in FIG. 105 is used as the power relay described in connection with FIG. 108, if the relay 174 is fumed off, then the power of the whole system is cut off, which makes it impossible to supply power again from the CPU 100.

Figure 109:
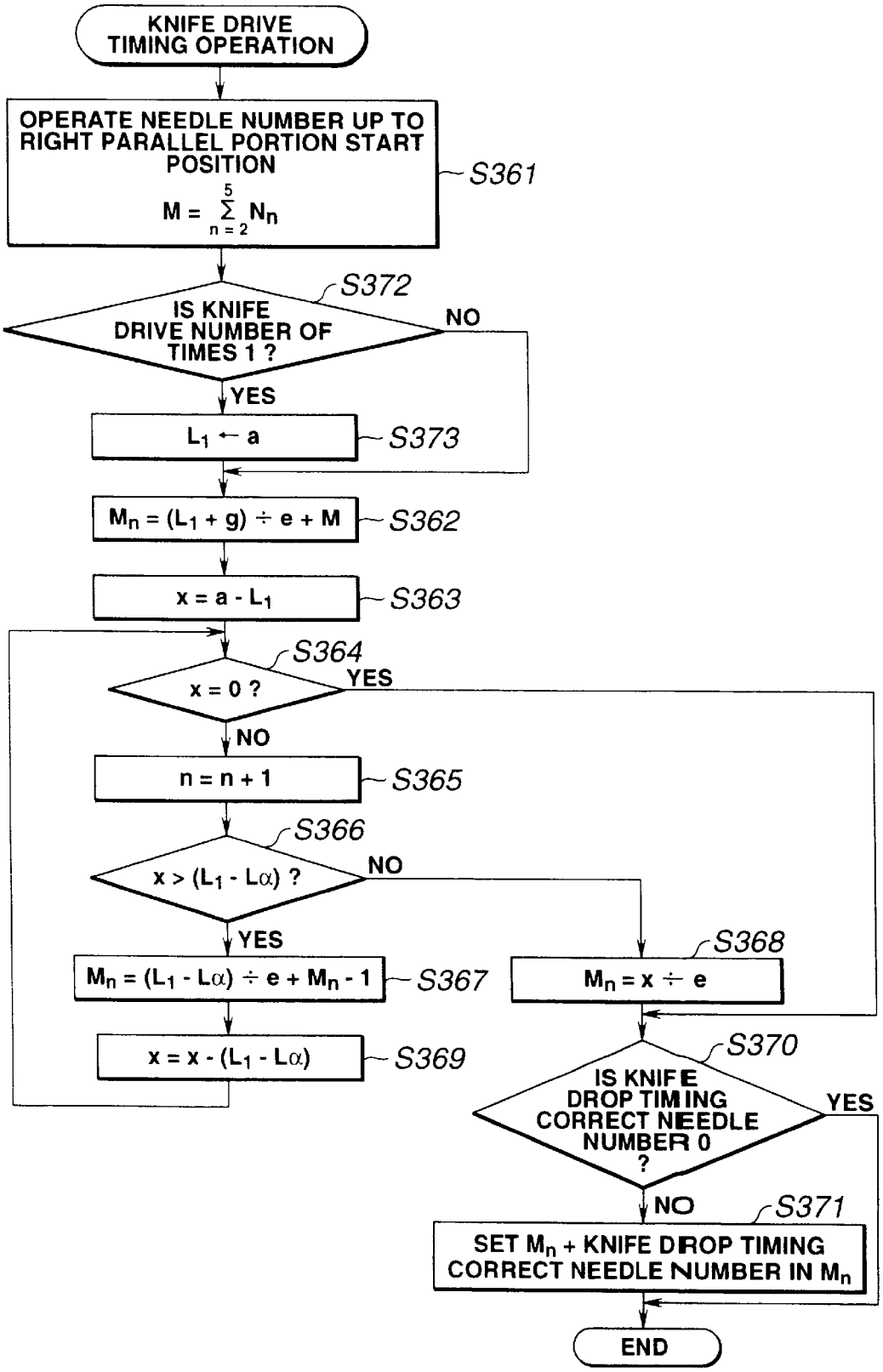
FIG. 109 is a flow chart of an additional processing embodiment of the subroutine for the knife drive timing operation processing (Step S36)

Next, FIG. 109 shows a modification of the knife drive timing operation (Step S36). In this modification, between the step S361 for operation of the stitch number ${}^{5}\Sigma_{n=2}$ Nn up to the right parallel portion start position and the step S362 for operation of $Mn=((L_1+g)\div e)+M$ in the above-mentioned subroutine shown in FIG. 64, there are included a step for checking of the knife drive number of times (Step S372) and a step for setting of $L_1$ (Step S373).

That is, in Step S361, $M=\Sigma_{n=2}$ Nn is operated and, after then, in the next step S372, it is checked whether the number of times of setting of the knife drives is once or two or more. If the number is once, then in the next step S373, a is set in L, and, after then, in the next step S362, $Mn=((L_1+g)\div e)+M$ is operated.

Also, in Step S372, if the knife drive number of times is not once, then the processing advances directly to Step S362.

In this case, if the cloth cutting length and knife size are set equal to each other, then the number of times of the knife drives is once or one time.

If "one time" is set in the panel, then a is set in L, and, in Step S364, x=0 is always "yes".

Embodiment of Formation of Eyelet Buttonhole Darning Stitches

Figure 110:
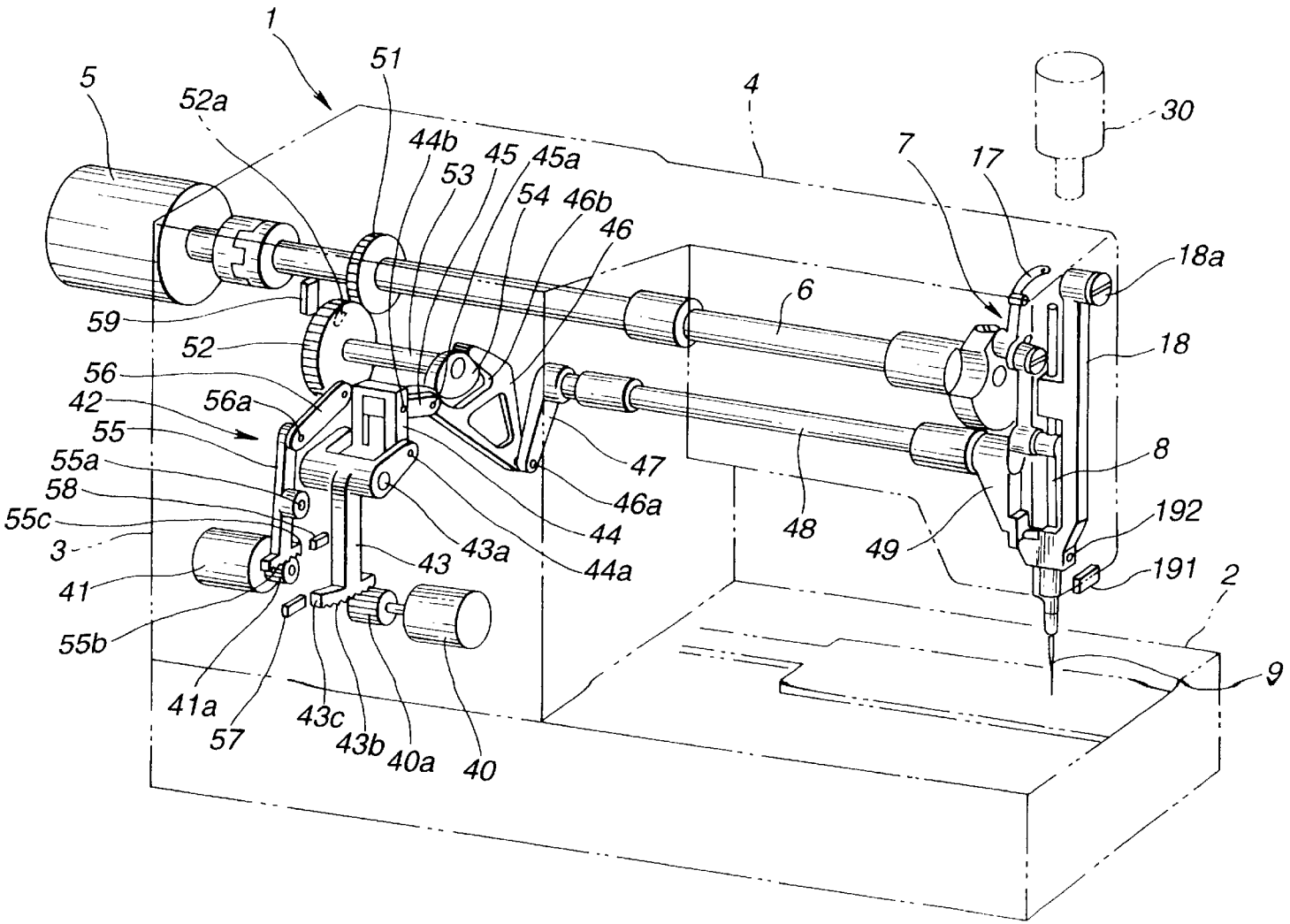
FIG. 110 is a perspective view of an embodiment in which a needle position sensor is provided.

FIG. 110 shows an embodiment of eyelet buttonhole darning stitches. In this case, for example, referring to the data on the (base line, swing width and feed) of the needle drop points, in the relation between needle drop points A ($a_1$, $b_1$, $y_1$) provided when the above-mentioned needle swing cam 54 is situated on the needle swing side and needle drop points B ($a_2$, $b_2$, $y_2$) provided when the needle swing cam 54 is situated on the base line side, there are found the following problems.

That is, when the needle swing cam 54 is situated on the base line side, the needle drop points A ($a_1$, $b_1$, $y_1$) do not take such shape as shown in FIG. 110 but they take such shape as shown in FIG. 113.

Figure 111A:
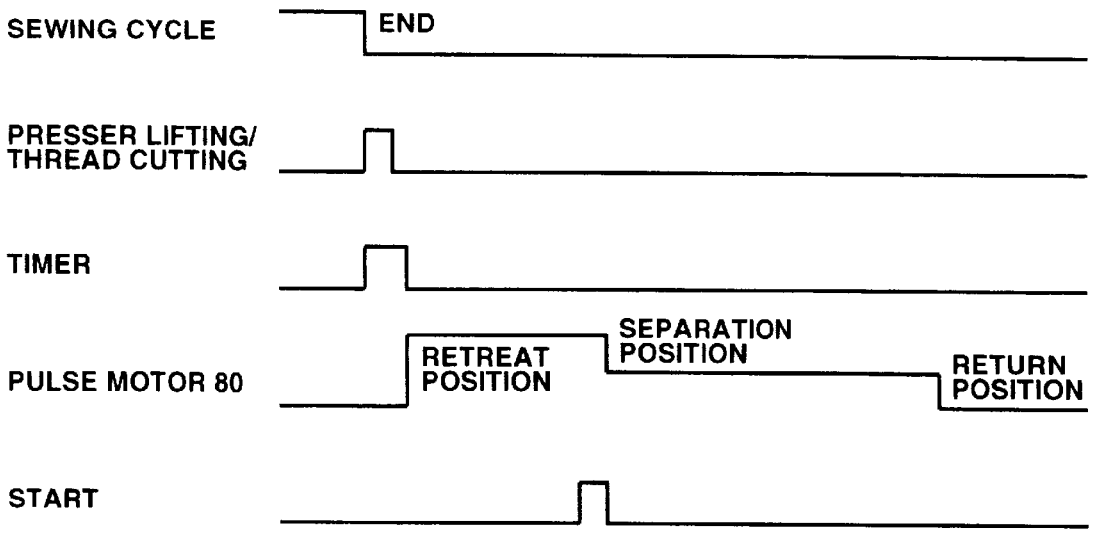
FIG. 111(A) is an operation timing chart of a thread cutting mechanism according to the invention.
Figure 111B:
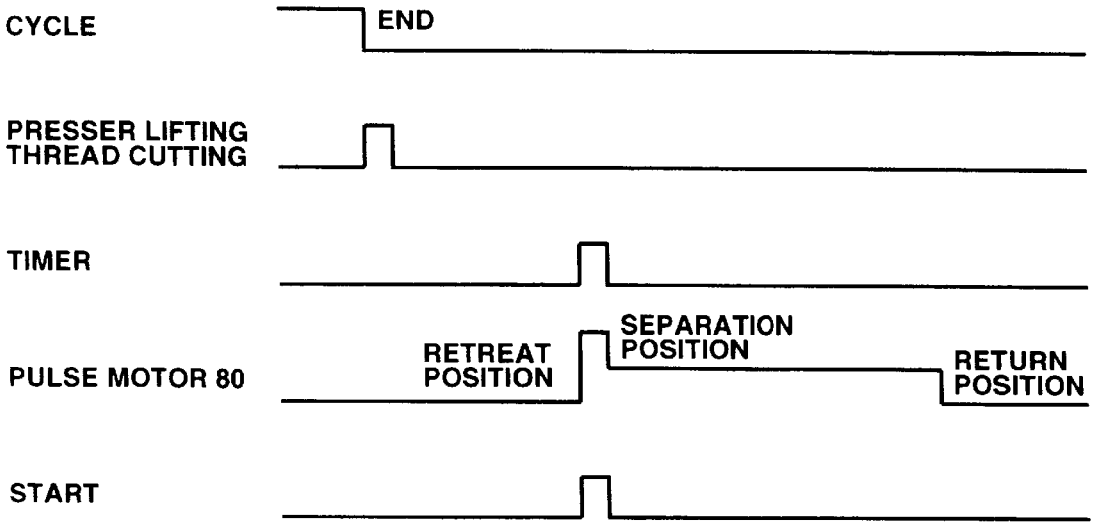
FIG. 111(B) is an operation timing chart of another embodiment of the thread cutting mechanism according to the invention; and, FIG. 112 is an explanatory view of the movement position of a pair of upper thread scissors employed in another embodiment according to the invention.

In forming the eyelet buttonhole darning stitches, as shown in FIG. 111, the base line is reversed and the needle drop points are set sequentially. FIG. 111 shows a case in which a needle drop point 1 is set when dropping the needle on the base line side and, as shown in FIG. 111, needle drop points 8 and 9 are so set as to drop the needle substantially coaxially. In FIG. 111, black round marks respectively represent needle drop points set for the base line side needle dropping, whereas white round marks respectively represent needle drop points set for the needle swing side needle dropping.

Figure 112:
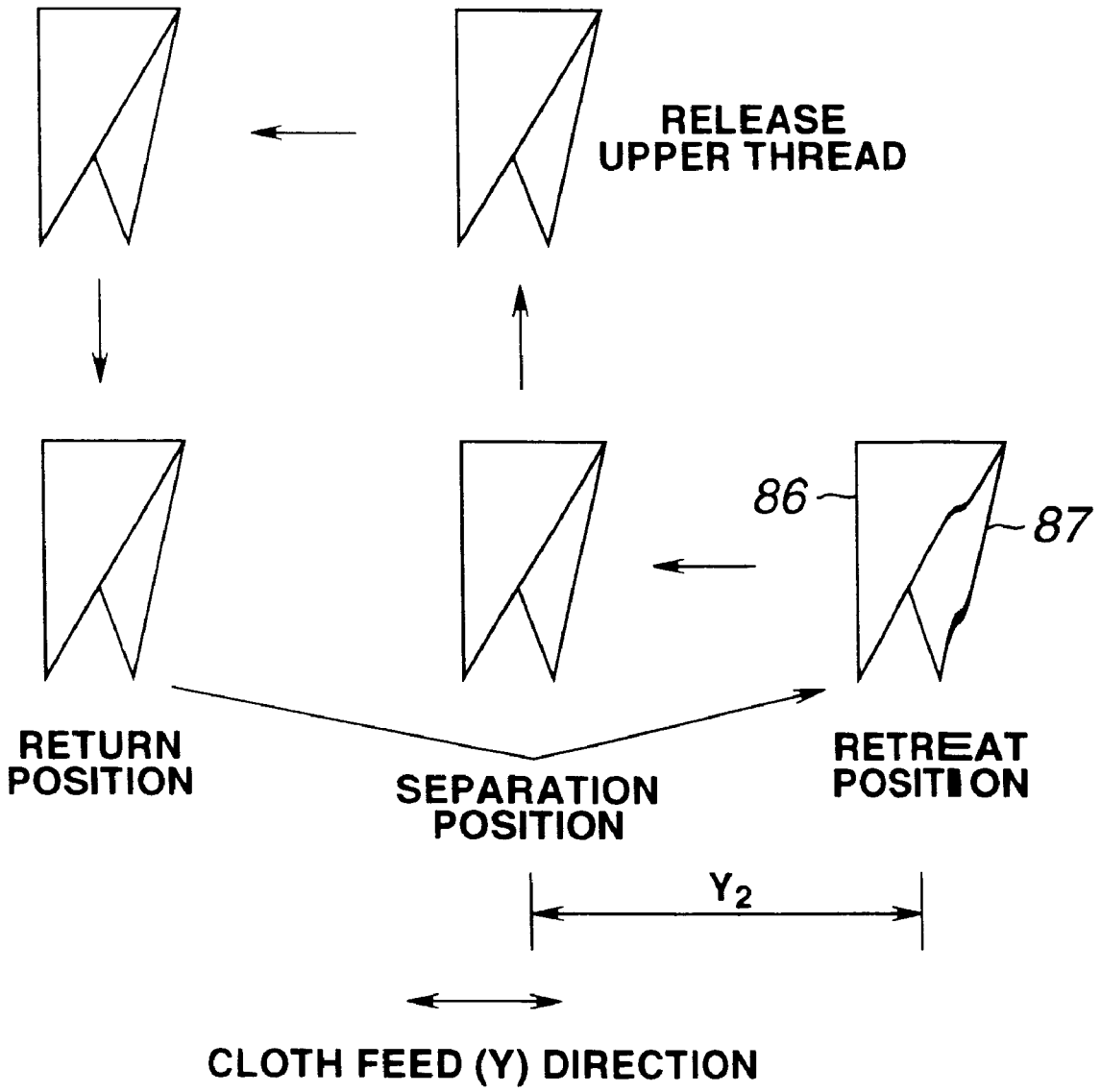

The above-mentioned respective needle drop points are decided according to a table shown in FIG. 112.

In order to form such eyelet buttonhole darning stitches, there is provided the above-mentioned needle swing right and left position detect sensor 59.

The reason for provision of the needle swing right and left position detect sensor 59 is as follows: that is, in FIG. 111, the needle drop point 1 is situated at the base line position but, as shown in FIG. 113, when the needle is dropped on the needle swing side, the needle drop point 1 is shifted to a needle drop point 1'. Due to this, as in an eyelet hole, when the Y feed is swung to plus and minus sides, a pattern formed is disarranged. Therefore, there arises the need to detect the right and left positions of the needle swing.

And, when forming the stitches of an eyelet portion in the above-mentioned eyelet buttonhole darning stitches, the needle drop points are switched over to the right and left sides alternately with the center of the eyelet portion as the reference thereof: that is, a needle drop point on the outside contour line of one of the right and left sides of the eyelet portion is regarded as a needle swing position to be set by a needle swing amount setting mechanism, and a needle drop point on the inside contour line thereof is regarded as a base line position to be set by a base line setting mechanism; and, a needle drop point on the outside contour line of the other of the right and left sides of the eyelet portion is regarded as a base line position to be set by a base line setting mechanism, and a needle drop point on the inside contour line thereof is regarded as a needle swing position to be set by a needle swing amount setting mechanism.

Also, FIG. 114 shows an embodiment in which the stitches of the eyelet buttonhole darning are formed by moving only the base line with the swing amount set as 0. In FIG. 114, a black round mark represents the base line side needle drop, a white round mark stands for the needle swing side needle drop, and a double round mark expresses the needle swing width needle drop by means of the movement of the base line with the swing amount set as 0. By the way, for a needle drop point 16, the swing width amount is set as the parallel portion width before the needle is dropped there.

The respective needle drop points are decided according to a table shown in FIG. 115.

Also, FIG. 116 shows an embodiment in which the stitches of the eyelet buttonhole darning are formed by increasing or decreasing the needle swing amount with the base line position set as 0 (needle eye center). In FIG. 116, a black round mark stands for a base line side needle drop, while a white round mark expresses a needle swing side needle drop. By way, the needle points 3, 5, 7, 9, 11, 13, and 14 are respectively needle points which are substantially concentric with the needle eye center.

The respective needle drop points are decided according to a table shown in FIG. 117.

Other Embodiments

Figure 67:
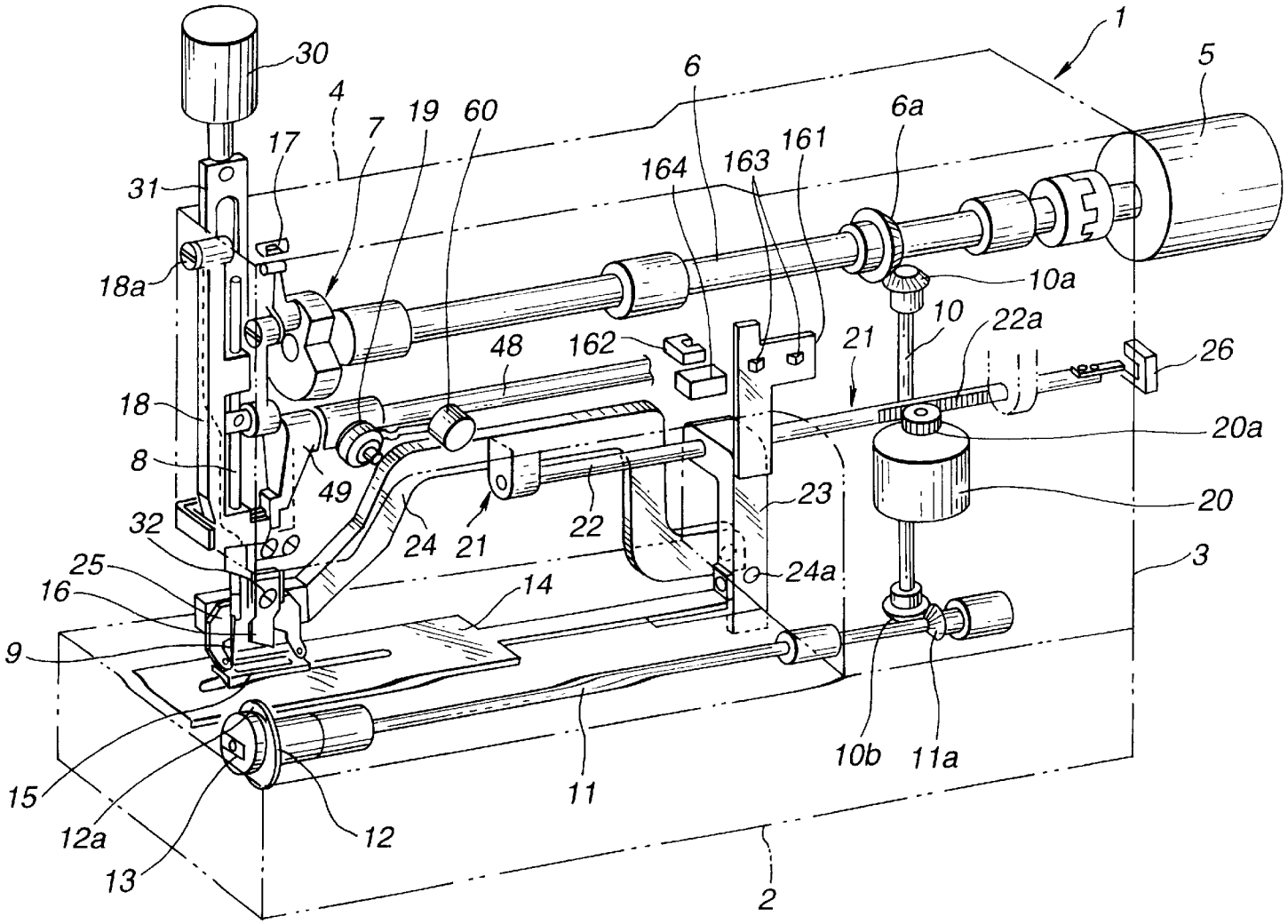
FIG. 67 is a perspective view of a structure including a feed sensor and a knife drop switch in order to time the operation of a cloth cutting knife from the Y feed.

Further, FIG. 67 shows another embodiment structured such that a feed sensor and a knife drop switch are provided in order to time the operation of the cloth cutting knife from the Y feed. In particular, at fist, on the bracket 23 fixed to the feed shaft 22 of the feed mechanism 21, there is vertically fixed a detect plate 161 with the plate faces facing laterally; and, a close approach type of a feed sensor 162 serving as sewing movement position detect means, which is used to detect in accordance with-the Y direction movement position of the detect plate 161 whether the sewing movement is an advancing movement or a retreating movement, is disposed opposed to the detect plate 161 in the moving direction of the detect plate 161.

And, on one side surface of the detect plate 161, there are formed a pair of front and rear projecting portions 163 and 163, while a knife drop switch 164 a portion to be detected of which can be pressed by one of the pair of projecting portions 163 and 163 is disposed opposed to the projecting portions 163 in the moving path of the projecting portions 163. That is, in the embodiment shown in FIG. 67, each time the knife drop switch 164 is pressed by the two front and rear projecting portions 163 and 163, the cloth cutting knife air cylinder 30 is driven to thereby move up and down the cloth cutting knife 16 twice.

In the present embodiment, the knife drop switch 164 is used as knife down movement start timing setting means.

FIG. 118 shows another embodiment in which there is provided a needle position sensor. As shown in FIG. 118, in this embodiment, a needle position sensor 191 comprising a close approach type of magnetic sensor is disposed on the lower portion front surface side of the needle bar swing base 18, while a magnet 192 to be detected is embedded in the lower portion front surface of the needle bar swing base 18.

In other words, according to the invention, as in the embodiment shown in FIG. 118, in addition to the base line origin detect sensor 57, swing width origin detect sensor 58, and needle swing right and left position detect sensor 59, the needle position sensor 191 can also be provided.

In the above-mentioned respective embodiments, description has been given of the buttonhole darning sewing machine. However, the present invention is not limited to this but the invention can also apply to other needle swing sewing machines.

Also, of course, the concrete detail structures of the illustrated embodiments can also be changed properly.

For example, instead of the needle upper position detection, needle lower position detection or phase detection can also be employed.

Further, in the present embodiments, there has been illustrated the structure in which the respective parameters are operated and set to thereby set the knife drive timing or the respective dimensions of the buttonhole shape However, a similar effect can also be obtained in another structure in which data previously programmed set and stored are read out selectively. Also, parameters operated and set once may be stored and, after then, the parameters may be read out selectively.

Further, it is also possible to employ a structure in which the upper and lower shafts of the sewing machine can be controlled or rotated separately by separately provided motors.

As has been described heretofore, with use of a buttonhole darning sewing machine according to the first aspect of the invention, since a buttonhole having a length corresponding to the length of the side sewing portions is formed through two or more times of the upward-and-downward movement of the cloth cutting knife with the cutting edge thereof having a length set shorter than the length of the side sewing portions of the buttonhole darning seam, a buttonhole having an arbitrary length can be formed using a single kind of cloth cutting knife. Therefore, the present buttonhole darning sewing machine is advantageous in that it not only eliminates the need for replacement of the cloth cutting knife even when the length of the buttonhole is changed but also eliminates the need for preparation of two or more kinds of cloth cutting knives corresponding in number to buttonholes differing in length from each other.

With use of a buttonhole darning sewing machine according to the second aspect of the invention, in addition to the effects obtained in the invention as set forth in the first aspect, since the buttonhole is formed during formation of the stitches of the side sewing portions, the stitches of the side sewing portions can be obtained stably and thus the buttonhole can be formed sharply.

With use of a buttonhole darning sewing machine according to the invention as set forth in the third aspect, similarly to the invention as set forth in the second aspect, in addition to the effects obtained in the invention as set forth in the first aspect, since the buttonhole is formed each time a given number of stitches of the side sewing portions are formed, the stitches of the side sewing portions can be obtained stably; and, because the cloth cutting knife is moved upward and downward once each time a given number of stitches of the side sewing portions are formed, the buttonhole can be formed sharply.

With use of a buttonhole darning sewing machine according to the invention as set forth in the fourth aspect, in addition to the effects obtained in the invention as set forth in the third aspect, there is obtained the advantage that the timing of the upward-and-downward movement of the cloth cutting knife can be set properly in accordance with a given number of stitches corresponding to the length of the cutting edge of the cloth cutting knife and the length of the buttonhole.

With use of a buttonhole darning sewing machine according to the invention as set forth in the fifth aspect, in addition to the effects obtained in the invention as set forth in the first aspect, since the cloth presser is moved by a given length by the electrical moving means in accordance with a feed signal indicating a given amount of feed and also, in synchronization with the feed signal, an operation signal is generated by the knife control means to thereby move the cloth cutting knife upward and downward, there is obtained the advantage that the buttonhole can be formed positively by moving the cloth cutting knife upward and downward two or more times in tune with the cloth feeding operation.

With use of a buttonhole darning sewing machine according to the invention as set forth in the sixth aspect, in addition to the effects obtained in the invention as set forth in the fifth aspect, there is obtained the advantage that the timing of the upward-and-downward movement of the cloth cutting knife can be set properly in accordance with a given amount of cloth feed corresponding to the length of the cutting edge of the cloth cutting knife and the length of the buttonhole.

With use of a buttonhole darning sewing machine according to the invention as set forth in the seventh aspect, in addition to the effects obtained in the invention as set forth in the sixth aspect, there is obtained the following advantage: that is, when no detect signal is generated from the knife upward-and-downward detect means, it can be judged that the cloth cutting knife is out of order, which makes it possible for the sewing machine control means to stop the sewing machine.

With use of a buttonhole darning sewing machine according to the invention as set forth in the eighth aspect, in addition to the effects obtained in the invention as set forth in the first aspect, there is further obtained the advantage that it is possible to carry out not only a pre-sewing cutting processing in which a buttonhole can be previously formed by two or more times of upward-and-downward movement of the cloth cutting knife before formation of the buttonhole darning seam, but also a post-sewing cutting processing in which a buttonhole can be formed by two or more times of upward-and-downward movement of the cloth cutting knife after formation of the buttonhole darning seam.

With use of a buttonhole darning sewing machine according to the invention as set forth in the ninth aspect, in addition to the effects obtained in the invention as set forth in the first aspect since the buttonhole is formed by moving up and down the cloth cutting knife after formation of one of the right and left side sewing portions and during formation of the other, there can be obtained the following advantages: that is, not only the stitches of the right and left side sewing portions can be obtained stably, but also the buttonhole can be formed sharply.

With use of a buttonhole darning sewing machine according to the invention as set forth in the tenth aspect, in addition to the effects obtained in the invention as set forth in the first or ninth aspect, since the speed of the present sewing machine is reduced down to a speed set for the knife drive time, in the upward-and-downward movement of the cloth cutting knife, the amount of movement of the cloth moved by the cloth hold member to be operated in synchronization with the operation of the sewing machine is reduced, which makes it possible to prevent the cloth from being cut excessively.

In a buttonhole darning sewing machine according to the invention as set forth in the eleventh aspect, there is provided the knife control means which can control the cloth cutting knife to thereby carry out the following knife cutting operations selectively: that is, the presewing cutting operation in which the cloth cutting knife is moved up and down before formation of the buttonhole darning seam to thereby form the buttonhole; the inter-sewing cutting operation in which the cloth cutting knife is moved up and down during formation of the buttonhole darning seam to thereby form the buttonhole; and the post-sewing cutting operation in which the cloth cutting knife is moved up and down after formation of the buttonhole darning seam to thereby form the buttonhole. In other words, with use of the present buttonhole darning sewing machine, there can be obtained the advantage that it is possible to carry out selectively any one of the three knife cutting operations: that is, the presewing cutting operation to form the buttonhole before formation of the buttonhole darning seam, the inter-sewing cutting operation to form the buttonhole during formation of the buttonhole darning seam, and the post-sewing cutting operation to form-the buttonhole after formation of the buttonhole darning seam.

With use of a buttonhole darning sewing machine according to the invention as set forth in the twelfth aspect, the downward-movement start timing of said cloth cutting knife is set by the knife downward-movement start timing setting means during formation of said side sewing portions, and the cloth cutting knife is moved up and down by the knife control means, thereby forming a buttonhole. That is, there can be obtained the advantage that a given buttonhole can be formed by moving up and down the cloth cutting knife at the thus set proper knife downward-movement start timing.

With use of a buttonhole darning sewing machine according to the invention as set forth in the thirteenth aspect, in addition to the effect obtained in the invention as set forth in the twelfth aspect, there is obtained the advantage that the proper downward movement timing of the cloth cutting knife can be operated by the operation means in accordance with not only the length of the buttonhole but also the length of the cutting edge of the cloth cutting knife set by the buttonhole/knife cutting edge length setting means.

With use of a buttonhole darning sewing machine according to the invention as set forth in the fourteenth aspect, in addition to the effect obtained in the invention as set forth in the twelfth aspect, there is obtained the advantage that the buttonhole can be formed properly by means of the downward-movement of the knife in synchronization with. the cloth feed operation.

With use of a buttonhole darning sewing machine according to the invention as set forth in the fifteenth aspect, in addition to the effect obtained in the invention as set forth in the twelfth aspect, there is obtained the advantage that the whole knife drop position can be moved in accordance with the knife downward-movement timing.

In a buttonhole darning sewing machine according to the invention as set forth in the sixteenth aspect, in accordance with the setting by the gap setting means for setting the gap between the bar-tack sewing portion and the end portion of the buttonhole, the side sewing length change means changes the length of the side sewing portions without changing the cloth cutting length, and, in accordance with the above change made by the side sewing length change means, the knife downward-movement timing decide means decides the downward-movement of the cloth cutting knife. That is, with use of this invention, there is obtained the advantage that the gap between the lock stitch sewing portion and the knife drop position can be corrected in accordance with the downward movement timing of the cloth cutting knife.

In a buttonhole darning sewing machine according to the invention as set forth in the seventeenth aspect, in accordance with the interval judged by the knife upward-and-downward movement timing interval judge means for judging the interval between the upward-and-downward movement timings decided by the knife upward-and-downward movement timing decide means in correspondence to the length of the buttonhole having a given length formed by the two or more times of upward-and-downward movement of the cloth cutting knife during formation of the buttonhole darning seam, the sewing machine drive speed decide means decides the drive speed of the sewing machine. Therefore, with use of this invention, there can be obtained the following advantage: that is, in the two or more times of upward-and-downward movement of the cloth cutting knife, the sewing machine drive speeds can be respectively controlled in a proper manner, which makes it possible to form the buttonhole in a good condition.

What is claimed is:

1. A buttonhole darning sewing machine comprising a cloth hold plate disposed along an upper surface of a sewing machine bed, and a cloth presser for moving said cloth hold plate at least in the longitudinal direction of said sewing machine bed in synchronization with the upward-and-downward movement of a needle of a sewing machine while holding a cloth between said cloth hold plate and itself, wherein a buttonhole darning seam comprising right and left side sewing portions to be formed on the right and left side portions of a long and narrow buttonhole and a lock stitch sewing portion to be formed at least in one end portion of each of said right and left side sewing portions is formed, and a buttonhole having a length corresponding to said side sewing portions is formed within said buttonhole darning seam along said side sewing portions thereof by means of a cloth cutting knife, characterized by said cloth cutting knife including a cutting edge having a length set shorter than the length of said side sewing portions, and by control means for moving said cloth cutting knife up and down two or more times to thereby form said buttonhole having a length corresponding to the length of said side sewing portions.

2. A buttonhole darning sewing machine as set forth in claim 1, wherein said control means moves said cloth cutting knife up and down at least once while the stitches of at least one of said right and left side sewing portions are being formed.

3. A buttonhole darning sewing machine as set forth in claim 1, wherein said control means moves said cloth cutting knife up and down at least once each time a given number of stitches for at least one of said right and left side sewing portions are formed.

4. A buttonhole darning sewing machine as set forth in claim 3, wherein said given number of stitches are set in accordance with the length of said cutting edge of said cloth cutting knife and the length of said buttonhole.

5. A buttonhole darning sewing machine as set forth in claim 1, wherein said control means includes electrical moving means for moving said cloth presser by a given distance in accordance with a given feed signal, electrical drive means for moving said cloth cutting knife in accordance with an operation signal, and knife control means for generating said operation signal in synchronization with said feed signal indicating a given amount of feed to thereby move said cloth cutting knife up and down.

6. A buttonhole darning sewing machine as set forth in claim 5, wherein said control means sets said given amount of feed in accordance with the length of said cutting edge of said cloth cutting knife and the length of said buttonhole.

7. A buttonhole darning sewing machine as set forth in claim 1, further including knife upper and lower position detect means for detecting the upper or lower position of said cloth cutting knife to thereby generate a detect signal, and sewing machine control means for checking whether said detect signal from said knife upper and lower position detect means is present or not and, if not present, for causing said sewing machine to stop.

8. A buttonhole darning sewing machine as set forth in claim 1, wherein said control means moves said cloth cutting knife prior to or after the formation of said buttonhole darning seam.

9. A buttonhole darning sewing machine as set forth in claim 1, wherein said control means, after formation of one of said right and left side sewing portions, moves said cloth cutting knife while the other of them is being formed.

10. A buttonhole darning sewing machine as set forth in claim 1, wherein said control means, when said cloth cutting knife is moved up and down, reduces the speed of said sewing machine down to a given speed set for a knife driving time.

11. A buttonhole darning sewing machine in which a buttonhole darning seam comprising right and left side sewing portions to be formed on the right and left side portions of a long and narrow buttonhole and a bar-tack sewing portion to be formed at least in one end portion of each of the right and left side sewing portions is formed, and a buttonhole having a length corresponding to said side sewing portions is formed within said buttonhole darning seam along said side sewing portions by means of a cloth cutting knife, characterized by control means for setting said cloth cutting knife selectively into a pre-sewing cutting operation in which said cloth cutting knife is moved up and down before formation of said buttonhole darning seam to thereby form said buttonhole, an inter-sewing cutting operation in which said cloth cutting knife is moved up and down during formation of said buttonhole darning seam to thereby form said buttonhole, and a post-sewing cutting operation in which said cloth cutting knife is moved up and down after formation of said buttonhole darning seam to thereby form said buttonhole.

12. A buttonhole darning sewing machine in which a buttonhole darning seam comprising right and left side sewing portions to be formed on the right and left side portions of a long and narrow buttonhole and a bar-tack sewing portion to be formed at least in one end portion of each of the right and left side sewing portions is formed, and a buttonhole having a length corresponding to said side sewing portions is formed within said buttonhole darning seam along said side sewing portions by means of a cloth cutting knife, characterized by control means which moves said cloth cutting knife up and down during formation of said side sewing portions of said buttonhole darning seam to thereby form said buttonhole, and by start timing setting means for setting the downward-movement start timing of said cloth cutting knife during formation of said side sewing portions.

13. A buttonhole darning sewing machine in which a buttonhole darning seam comprising and left side sewing portions to be formed on the right and left side portions of a long and narrow buttonhole and a bar-tack sewing portion to be formed at least in one end portion of each of the right and left side sewing portions is formed, and a buttonhole having a length corresponding to said side sewing portions is formed within said buttonhole darning seam along said side sewing portions by means of a cloth cutting knife, characterized by control means which moves said cloth cutting knife up and down during formation of said side sewing portions of said buttonhole darning seam to thereby form said buttonhole, and by start timing setting means for setting the domnward-movement start timing of said cloth cutting knife during formation of said side sewing portions, further including buttonhole/knife cutting edge length setting means for setting not only the length of said buttonhole but also the length of the cutting edge of said cloth cutting knife, and operation means for operating the downward-movement timing of said cloth cutting knife in accordance not only with the length of said buttonhole but also with the length of the cutting edge of said cloth cutting knife set by said buttonhole/knife cutting edge length setting means.

14. A buttonhole darning sewing machine as set forth in claim 12, wherein said start timing setting means includes electrical moving means for moving a cloth presser by a given distance along said side sewing portions in response to a given feed signal, and sewing movement position detect means for detecting the sewing movement position of said side sewing portions, characterized in that said cloth cutting knife can be moved down in accordance with a detect signal generated by said sewing movement position detect means.

15. A buttonhole darning sewing machine as set forth in claim 12, wherein said start timing setting means includes buttonhole formation position setting means for setting the formation position of said buttonhole in a direction extending along the cloth feed direction of said buttonhole darning seam, and timing decide means for deciding the downward-movement timing of said cloth cutting knife according to the count of stitches or the count of cloth feed pulses in accordance with a setting made by said buttonhole formation position setting means.

16. A buttonhole darning sewing machine in which a buttonhole darning seam comprising right and left side sewing portions to be formed on the right and left side portions of a long and narrow buttonhole and a bar-tack sewing portion to be formed at least in one end portion of each of the right and left side sewing portions is formed, and a buttonhole having a length corresponding to said side sewing portions is formed within said buttonhole darning seam along said side sewing portions by means of a cloth cutting knife, characterized by gap setting means for setting a gap between said bar-tack sewing portion and an end portion of said buttonhole, side sewing length change means for changing the length of said side sewing portions without changing the cloth cutting length in accordance with said setting made by said gap setting means, and knife downward-movement timing decide means for deciding the downward-movement timing of said cloth cutting knife in accordance with said change made by said side sewing length change means.

17. A buttonhole darning sewing machine for forming a buttonhole of a given length by moving a cloth cutting knife up and down two or more times during formation of a buttonhole darning seam, characterized by knife downward movement timing decide means for deciding the timing of the downward movement of said cloth cutting knife in accordance with the length of said buttonhole, knife downward movement timing interval judge means for judging a gap between the downward movement timings decided by said knife downward movement timing decide means, and sewing machine drive speed decide means for deciding the drive speed of said sewing machine in accordance with the gap judged by said knife upward-and-downward movement timing interval judge means.

18. A buttonhole darning sewing machine as set forth in claim 9, wherein said control means, when said cloth cutting knife is moved up and down, reduces the speed of said sewing machine down to a given speed set for a knife driving time.

* * * * *